US009304428B2

(12) United States Patent
Ayaki et al.

(10) Patent No.: US 9,304,428 B2
(45) Date of Patent: Apr. 5, 2016

(54) FULL-COLOR IMAGE-FORMING METHOD

(71) Applicant: CANON KABUSHIKI KAISHA, Tokyo (JP)

(72) Inventors: Yasukazu Ayaki, Yokohama (JP); Shigeto Tamura, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 22 days.

(21) Appl. No.: 14/226,809

(22) Filed: Mar. 26, 2014

(65) Prior Publication Data

US 2014/0219684 A1 Aug. 7, 2014

Related U.S. Application Data

(60) Division of application No. 12/972,396, filed on Dec. 17, 2010, now Pat. No. 8,728,689, which is a division of application No. 12/133,904, filed on Jun. 5, 2008, now abandoned, which is a continuation of application No. PCT/JP2008/051647, filed on Feb. 1, 2008.

(30) Foreign Application Priority Data

Feb. 2, 2007 (JP) ..... 2007-024380

(51) Int. Cl.
*G03G 13/01* (2006.01)
*G03G 13/08* (2006.01)
(Continued)

(52) U.S. Cl.
CPC ..... *G03G 13/01* (2013.01); *G03G 9/0821* (2013.01); *G03G 9/0823* (2013.01);
(Continued)

(58) Field of Classification Search
CPC . G03G 9/08795; G03G 9/0904; G03G 15/01; G03G 13/01; G03G 13/08
USPC ..... 430/45.5, 45.51
See application file for complete search history.

(56) References Cited

U.S. PATENT DOCUMENTS 4,921,768 A 5/1990 Kunugi et al.
5,707,769 A 1/1998 Hagi et al.
(Continued)

FOREIGN PATENT DOCUMENTS

EP 0 430 553 A1 6/1991
EP 0 441 255 A2 8/1991
(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 164-168.*
(Continued)

*Primary Examiner* — Christopher Rodee
(74) *Attorney, Agent, or Firm* — Fitzpatrick, Cella, Harper and Scinto

(57) ABSTRACT

Provided are a toner containing at least a binder resin and a colorant, the toner having a specific hue angle and an absorbance at a specific wavelength in reflectance spectrophotometry, and a full-color image-forming method involving the use of the toner, the method including the steps of: forming an electrostatic image on a charged electrostatic image bearing member; developing the formed electrostatic image with the toner to form a toner image; transferring the formed toner image onto a transfer material; and fixing the transferred toner image to the transfer material to form a fixed image.

5 Claims, 10 Drawing Sheets

(51) Int. Cl.

| | |
|---|---|
| ***G03G 9/08*** | (2006.01) |
| ***G03G 9/087*** | (2006.01) |
| ***G03G 9/09*** | (2006.01) |
| ***G03G 9/10*** | (2006.01) |

(52) U.S. Cl.

CPC ..... *G03G 9/08795* (2013.01); *G03G 9/08797* (2013.01); *G03G 9/0926* (2013.01); *G03G 9/10* (2013.01); *G03G 13/08* (2013.01)

(56) References Cited

U.S. PATENT DOCUMENTS

| | | | | |
|---|---|---|---|---|
| 6,150,062 | A | 11/2000 | Sugizaki et al. | |
| 6,183,924 | B1 | 2/2001 | Nomura et al. | |
| 6,677,093 | B2 * | 1/2004 | Yoshino et al. | 430/106.2 |
| 6,709,798 | B2 | 3/2004 | Tamaoki et al. | |
| 6,737,211 | B2 | 5/2004 | Hayashi et al. | |
| 6,905,808 | B2 | 6/2005 | Itakura et al. | |
| 6,996,358 | B2 | 2/2006 | Ayaki et al. | |
| 7,014,969 | B2 | 3/2006 | Yachi et al. | |
| 7,199,813 | B2 | 4/2007 | Jacob | |
| 7,229,727 | B2 | 6/2007 | Itakura et al. | |
| 7,241,546 | B2 | 7/2007 | Moriki et al. | |
| 7,288,356 | B2 | 10/2007 | Ayaki et al. | |
| 7,361,441 | B2 | 4/2008 | Itakura et al. | |
| 7,381,509 | B2 | 6/2008 | Ayaki et al. | |
| 7,531,279 | B2 | 5/2009 | Watanabe et al. | |
| 2005/0271961 | A1 | 12/2005 | Jadwin et al. | |
| 2006/0068306 | A1 | 3/2006 | Shu et al. | |
| 2006/0166120 | A1 | 7/2006 | Moriki et al. | |
| 2006/0257774 | A1 | 11/2006 | Daifuku et al. | |
| 2007/0036968 | A1 | 2/2007 | Shimamura et al. | |
| 2008/0113284 | A1 | 5/2008 | Hayashi et al. | |

FOREIGN PATENT DOCUMENTS

| | | | |
|---|---|---|---|
| EP | 1 205 811 | A2 | 5/2002 |
| EP | 1 329 774 | A2 | 7/2003 |
| EP | 1 455 239 | A2 | 9/2004 |
| EP | 1 505 452 | A2 | 2/2005 |
| JP | 3-87841 | A | 4/1991 |
| JP | 10-288856 | A | 10/1998 |
| JP | 11-72960 | | 3/1999 |
| JP | 11-237761 | | 8/1999 |
| JP | 11-249377 | A | 9/1999 |
| JP | 2002-131973 | | 5/2002 |
| JP | 2002-182433 | | 6/2002 |
| JP | 2002-182456 | A | 6/2002 |
| JP | 2003-15361 | | 1/2003 |
| JP | 2003-173048 | A | 6/2003 |
| JP | 2003-280278 | | 10/2003 |
| JP | 2003-280723 | | 10/2003 |
| JP | 2005-99726 | | 4/2005 |
| JP | 2005-128537 | | 5/2005 |
| JP | 2005-165233 | | 6/2005 |
| JP | 2005-283916 | | 10/2005 |
| JP | 2005-308798 | | 11/2005 |
| JP | 2006-78926 | | 3/2006 |
| JP | 2006-91755 | A | 4/2006 |
| JP | 2006-106414 | | 4/2006 |
| JP | 2006-145703 | | 6/2006 |
| JP | 2006-209001 | | 8/2006 |
| JP | 2006-251074 | A | 9/2006 |
| JP | 2006-293290 | | 10/2006 |
| JP | 2006-313255 | | 11/2006 |

OTHER PUBLICATIONS

Indian Office Action dated Dec. 16, 2014 in Indian Application No. 5109/CHENP/2009.

Diamond, Arthur S. & David Weiss (eds.) Handbook of Imaging Materials, 2nd ed., New York, Marcel-Dekker, Inc. Nov. 2001, pp. 178-182.

Chinese Office Action dated Jan. 21, 2013 in Chinese Application No. 201210029019.X.

European Search Report dated Aug. 19, 2013 in European Application No. 13173261.2.

European Search Report dated Aug. 19, 2013 in European Application No. 13173263.8.

European Search Report dated Mar. 30, 2012 in European Application No. 08704356.8.

* cited by examiner

FULL-COLOR IMAGE-FORMING METHOD

BACKGROUND OF THE INVENTION

1. Field of the Invention

The present invention relates to a toner for developing an electrostatic image in an image-forming method such as electrophotography or electrostatic printing, or a toner for forming a toner image in a full-color image-forming method based on a toner-jet system, and particularly, to a toner to be used in a fixing system in which a toner image is fixed to a transfer material such as a print sheet under heat and pressure. The present invention relates also to an image-forming method based on a full-color electrophotographic system to be employed in, for example, a copying machine, a printer, a facsimile, or a digital proof.

2. Description of the Related Art

Various methods have been conventionally known as electrophotographic methods. A general electrophotographic method is as described below. The surface of a latent image bearing member composed of a photoconductive material is uniformly charged by, for example, corona charging or direct charging with a charging roller or the like, and then an electrical latent image is formed on the latent image bearing member by, for example, the application of light energy. Next, the electrical latent image is developed with positively or negatively charged toner so that a toner image is formed. After the toner image has been transferred onto a transfer material such as paper as required, the toner image is fixed onto the transfer material with heat, a pressure, or the like, whereby a copied article is obtained.

In recent years, the formation of an image having an additionally high resolution has been demanded of an image-forming apparatus based on an electrophotographic method such as a printer or a copying machine. In particular, an electrophotographic color image-forming apparatus has been finding use in miscellaneous applications as the apparatus has become widespread, and the demands made upon the apparatus for image quality have become more severe. That is, the color image-forming apparatus has been required to reproduce even a fine portion extremely finely and faithfully in the print of an image such as a general photograph, catalogue, or map. In addition, the apparatus has been required to improve the definition of the color of an image and to extend the color reproduction range of the image.

Further, as for image quality, there are demands for forming an additionally smooth image on a transfer material such as paper even when the transfer material has surface unevenness. In general, an image formed by an electrophotographic method has a step difference between a non-image portion and an image portion in the direction perpendicular to a paper surface of 10 to 30 μm. In a full-color image, in addition to a step difference between a non-image portion and an image portion, a step difference in the image portion between a primary color and a secondary color in the direction perpendicular to a paper surface is 5 to 20 μm, which also causes a reduction in image quality.

In addition, the number of sheets to be printed has also been increasing in association with an increase in speed of an image-forming apparatus, so an additional reduction in running cost has been demanded of the apparatus. Performance requested of toner is as follows: the toner achieves an image with quality and definition each of which is comparable to or higher than a conventional one without narrowing a color reproduction range, a toner consumption is reduced, and fixing energy is reduced.

To satisfy those demands, an increase in content of a colorant in toner has been proposed (see, for example, Patent Documents 1 to 4). Each of those documents aims to form an image with a smaller toner amount than a conventional one and to reduce the surface unevenness of the image by increasing the content of a colorant in toner. However, an increase in colorant content of toner has involved the following problem: the peak of a characteristic absorption wavelength resulting from a colorant in the reflection spectrum of an image becomes broad, with the result that the chroma and lightness of the image reduce.

There is employed a technology involving controlling the dispersed state of a colorant in toner as a method of suppressing reductions in chroma and lightness of a toner image (see, for example, Patent Document 5). The control of the dispersed state of the colorant in the toner exerts a certain effect in some cases, but the control is still insufficient for forming of an image with small image unevenness while reducing the usage of the toner, and, in the case of the control, a reduction in chroma of a secondary color is particularly remarkable.

As described above, no toner having the following characteristics has been found yet: an image having a high resolution and high definition is achieved, good image quality is expressed while none of an image color gamut, chroma, and lightness is reduced even in a secondary color, and a running cost can be reduced.

Patent Document 1: 11-72960 A
Patent Document 2: 11-237761 A
Patent Document 3: 2002-131973 A
Patent Document 4: 2005-128537 A
Patent Document 5: 2003-280723 A

SUMMARY OF THE INVENTION

An object of the present invention is to solve the above problems of the related art.

That is, the object of the present invention is to provide a cyan toner, a magenta toner, a yellow toner, and a black toner each enabling the formation of a good image which: achieves a resolution and definition each of which is higher than a conventional one; shows a good image color gamut, good chroma, and good lightness even in a secondary color; and has small surface unevenness, and a full-color image-forming method involving the use of any one of the toners.

The present invention relates to a cyan toner, including at least: a binder resin; and a colorant, in which the cyan toner has a value ($h^*_C$) for a hue angle h* based on a CIELAB color coordinate system of 210.0 to 270.0, an absorbance ($A_{C470}$) at a wavelength of 470 nm of 0.300 or less, an absorbance ($A_{C620}$) at a wavelength of 620 nm of 1.500 or more, and a ratio ($A_{C620}/A_{C670}$) of $A_{C620}$ to an absorbance ($A_{C670}$) at a wavelength of 670 nm of 1.00 to 1.25 in reflectance spectrophotometry.

Further, the present invention relates to a magenta toner, including at least: a binder resin; and a colorant, in which the magenta toner has a value ($h^*_M$) for a hue angle h* based on a CIELAB color coordinate system of 330.0 to 30.0, an absorbance ($A_{M570}$) at a wavelength of 570 nm of 1.550 or more, an absorbance ($A_{M620}$) at a wavelength of 620 nm of 0.250 or less, and a ratio ($A_{M570}/A_{M450}$) of $A_{M570}$ to an absorbance ($A_{M450}$) at a wavelength of 450 nm of 1.80 to 3.50 in reflectance spectrophotometry.

Further, the present invention relates to a yellow toner, including at least: a binder resin; and a colorant, in which the yellow toner has a value ($h^*_Y$) for a hue angle h* based on a CIELAB color coordinate system of 75.0 to 120.0, an absorbance ($A_{Y450}$) at a wavelength of 450 nm of 1.600 or more, an absorbance ($A_{Y470}$) at a wavelength of 470 nm of 1.460 or more, and an absorbance ($A_{Y510}$) at a wavelength of 510 nm of 0.500 or less in reflectance spectrophotometry.

Further, the present invention relates to a black toner, including at least: a binder resin; and a colorant, in which the black toner has a value ($c^*_K$) for c* based on a CIELAB color coordinate system of 20.0 or less, an absorbance ($A_{K600}$) at a wavelength of 600 nm of 1.610 or more, and a ratio ($A_{K600}/A_{K460}$) of $A_{K600}$ to an absorbance ($A_{K460}$) at a wavelength of 460 nm of 0.970 to 1.035 in reflectance spectrophotometry.

Further, the present invention relates to a full-color image-forming method, including the steps of: forming electrostatic images on a charged electrostatic image bearing member; developing the formed electrostatic images with toners to form toner images; transferring the formed toner images onto a transfer material; and fixing the transferred toner images to the transfer material to form fixed images, in which: the step of forming the toner images includes a step of performing development with a first toner selected from a black toner, a cyan toner, a magenta toner, and a yellow toner to form a first toner image, a step of performing development with a second toner except the first toner selected from the black toner, the cyan toner, the magenta toner, and the yellow toner to form a second toner image, a step of performing development with a third toner except the first toner and the second toner selected from the black toner, the cyan toner, the magenta toner, and the yellow toner to form a third toner image, and a step of performing development with a fourth toner except the first toner, the second toner, and the third toner selected from the black toner, the cyan toner, the magenta toner, and the yellow toner to form a fourth toner image; and the cyan toner contains at least a binder resin and a colorant, and has a value ($h^*_C$) for a hue angle h* based on a CIELAB color coordinate system of 210.0 to 270.0, an absorbance ($A_{C470}$) at a wavelength of 470 nm of 0.300 or less, an absorbance ($A_{C620}$) at a wavelength of 620 nm of 1.500 or more, and a ratio ($A_{C620}/A_{C670}$) of $A_{C620}$ to an absorbance ($A_{C670}$) at a wavelength of 670 nm of 1.00 to 1.25 in reflectance spectrophotometry.

Further, the present invention relates to a full-color image-forming method, including the steps of: forming electrostatic images on a charged electrostatic image bearing member; developing the formed electrostatic images with toners to form toner images; transferring the formed toner images onto a transfer material; and fixing the transferred toner images to the transfer material to form fixed images, in which: the step of forming the toner images includes a step of performing development with a first toner selected from a black toner, a cyan toner, a magenta toner, and a yellow toner to form a first toner image, a step of performing development with a second toner except the first toner selected from the black toner, the cyan toner, the magenta toner, and the yellow toner to form a second toner image, a step of performing development with a third toner except the first toner and the second toner selected from the black toner, the cyan toner, the magenta toner, and the yellow toner to form a third toner image, and a step of performing development with a fourth toner except the first toner, the second toner, and the third toner selected from the black toner, the cyan toner, the magenta toner, and the yellow toner to form a fourth toner image; and the magenta toner is a magenta toner containing at least a binder resin and a colorant, and the magenta toner has a value ($h^*_M$) for a hue angle h* based on a CIELAB color coordinate system of 330.0 to 30.0, an absorbance ($A_{M570}$) at a wavelength of 570 nm of 1.550 or more, an absorbance ($A_{M620}$) at a wavelength of 620 nm of 0.250 or less, and a ratio ($A_{M570}/A_{M450}$) of $A_{M570}$ to an absorbance ($A_{M450}$) at a wavelength of 450 nm of 1.80 to 3.50 in reflectance spectrophotometry.

Further, the present invention relates to a full-color image-forming method, including the steps of: forming electrostatic images on a charged electrostatic image bearing member; developing the formed electrostatic images with toners to form toner images; transferring the formed toner images onto a transfer material; and fixing the transferred toner images to the transfer material to form fixed images, in which: the step of forming the toner images includes a step of performing development with a first toner selected from a black toner, a cyan toner, a magenta toner, and a yellow toner to form a first toner image, a step of performing development with a second toner except the first toner selected from the black toner, the cyan toner, the magenta toner, and the yellow toner to form a second toner image, a step of performing development with a third toner except the first toner and the second toner selected from the black toner, the cyan toner, the magenta toner, and the yellow toner to form a third toner image, and a step of performing development with a fourth toner except the first toner, the second toner, and the third toner selected from the black toner, the cyan toner, the magenta toner, and the yellow toner to form a fourth toner image; and the yellow toner is a yellow toner containing at least a binder resin and a colorant, and the yellow toner has a value ($h^*_Y$) for a hue angle h* based on a CIELAB color coordinate system of 75.0 to 120.0, an absorbance ($A_{Y450}$) at a wavelength of 450 nm of 1.600 or more, an absorbance ($A_{Y470}$) at a wavelength of 470 nm of 1.460 or more, and an absorbance ($A_{Y510}$) at a wavelength of 510 nm of 0.500 or less in reflectance spectrophotometry.

Further, the present invention relates to a full-color image-forming method, including the steps of: forming electrostatic images on a charged electrostatic image bearing member; developing the formed electrostatic images with toners to form toner images; transferring the formed toner images onto a transfer material; and fixing the transferred toner images to the transfer material to form fixed images, in which: the step of forming the toner images includes a step of performing development with a first toner selected from a black toner, a cyan toner, a magenta toner, and a yellow toner to form a first toner image, a step of performing development with a second toner except the first toner selected from the black toner, the cyan toner, the magenta toner, and the yellow toner to form a second toner image, a step of performing development with a third toner except the first toner and the second toner selected from the black toner, the cyan toner, the magenta toner, and the yellow toner to form a third toner image, and a step of performing development with a fourth toner except the first toner, the second toner, and the third toner selected from the black toner, the cyan toner, the magenta toner, and the yellow toner to form a fourth toner image; and the black toner is a black toner containing at least a binder resin and a colorant, and the black toner has a value ($c^*_K$) for c* based on a CIELAB color coordinate system of 20.0 or less, an absorbance ($A_{K600}$) at a wavelength of 600 nm of 1.610 or more, and a ratio ($A_{K600}/A_{K460}$) of $A_{K600}$ to an absorbance ($A_{K460}$) at a wavelength of 460 nm of 0.970 to 1.035 in reflectance spectrophotometry.

According to the present invention, a toner consumption can be reduced, and an image having a color gamut comparable to or better than a conventional one not only in a primary color but also in a secondary color can be formed. In addition, a good-appearance image with reduced surface unevenness can be obtained, and a running cost can be suppressed.

Further features of the present invention will become apparent from the following description of exemplary embodiments (with reference to the attached drawings).

DESCRIPTION OF REFERENCE SYMBOLS

Figure 1:
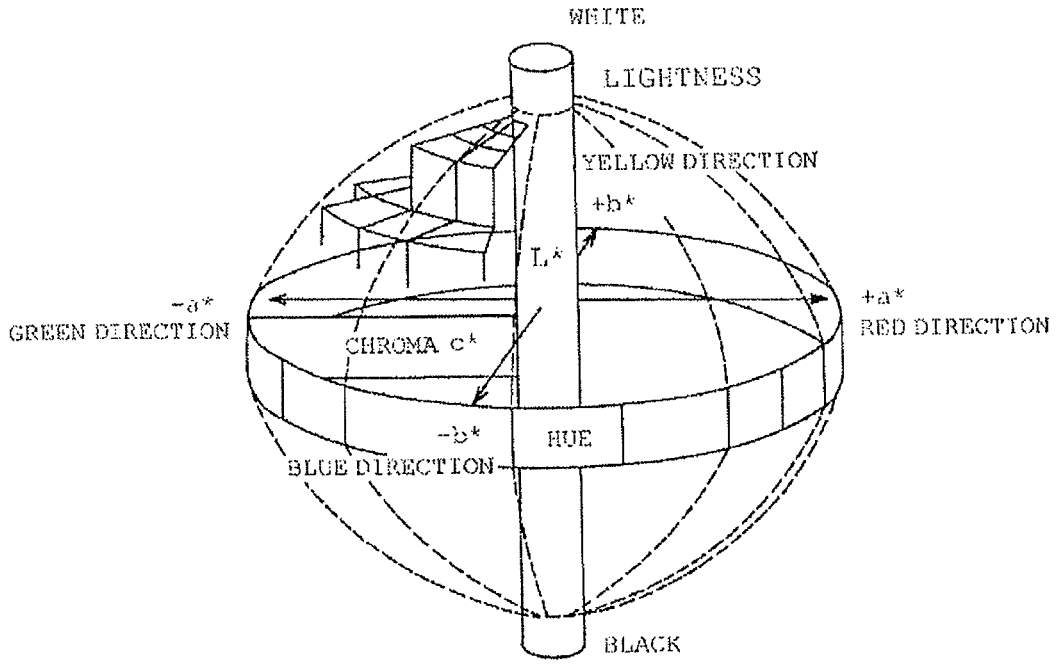
FIG. 1 is a steric conceptual view of a CIELAB color coordinate system.

4 heating device
5 heat-resistant film
6 temperature detecting element
7 ceramic heater
8 rubber roller
9 mandrel
10 pressure roller (pressure member)
11 fixing belt
12 pressure roller (pressure member)
13 excitation coil
14 core
15 holder
16 temperature sensor
17 transport guide
18 separation claw
19 elastic layer
20 metal conductor
21 hollow mandrel
22 surface releasable heat-resistant elastic layer
41 classifying rotor
42 fine powder collection discharge port
43 raw material supply port
44 liner
45 cold air introduction port
46 dispersing rotor
47 powder discharge port
48 discharge valve
49 guide ring
50 square disk
51 first space
52 second space
55 casing
100 heat pressure fixing unit
101 manuscript
102 manuscript board glass
103 exposure lamp
104 lens
105 full-color sensor
106 photosensitive drum
107 pre-exposure lamp
108 corona charging device
109 laser exposure optical system
109*a* polygon mirror
109*b* lens
109*c* mirror
111Y yellow developing device
111C cyan developing device
111M magenta developing device
111K black developing device
112 means for detecting light on drum
113 transferring device
113*a* transferring drum
113*b* transfer charging device
113*c* adsorption charging device
113*d* inner charging device
113*e* outer charging device
113*f* transfer sheet
113*h* separation charging device
113*g* adsorbing roller
114 cleaning device
115Y yellow eccentric cam
115C cyan eccentric cam
115M magenta eccentric cam
115K black eccentric cam
116*a*, 116*b*, 116*c* cassette
117*a* separation claw
117*b* separation pushup roller
118 tray
201 screen
202 measurement container
203 lid
204 sucking machine
205 suction port
206 air flow control valve
207 vacuum gauge
208 potentiometer
209 capacitor
E optical image

DESCRIPTION OF THE EMBODIMENTS

A CIELAB color coordinate system used in the present invention is a specification specified by Commission Internationale de l'Eclairage (CIE). The system is specified also in JIS 28729, and is generally used as means useful in representing a color by digitizing the color. FIG. 1 shows a steric conceptual view of the CIELAB color coordinate system. In FIG. 1, horizontal axes a* and b* both represent hue. The hue measures a tone such as red, yellow, green, blue, and violet. In the present invention, the a* axis represents a red-green direction and the b* axis represents a yellow-blue direction. A vertical axis L* represents lightness, showing a degree of color lightness comparable irrespective of the hue. Further, the c* value represents chroma, showing a degree of vividness of color, and is determined using the following formula.

$$c^* = \sqrt{a^{*2} + b^{*2}} \quad \text{[formula 1]}$$

Figure 2:
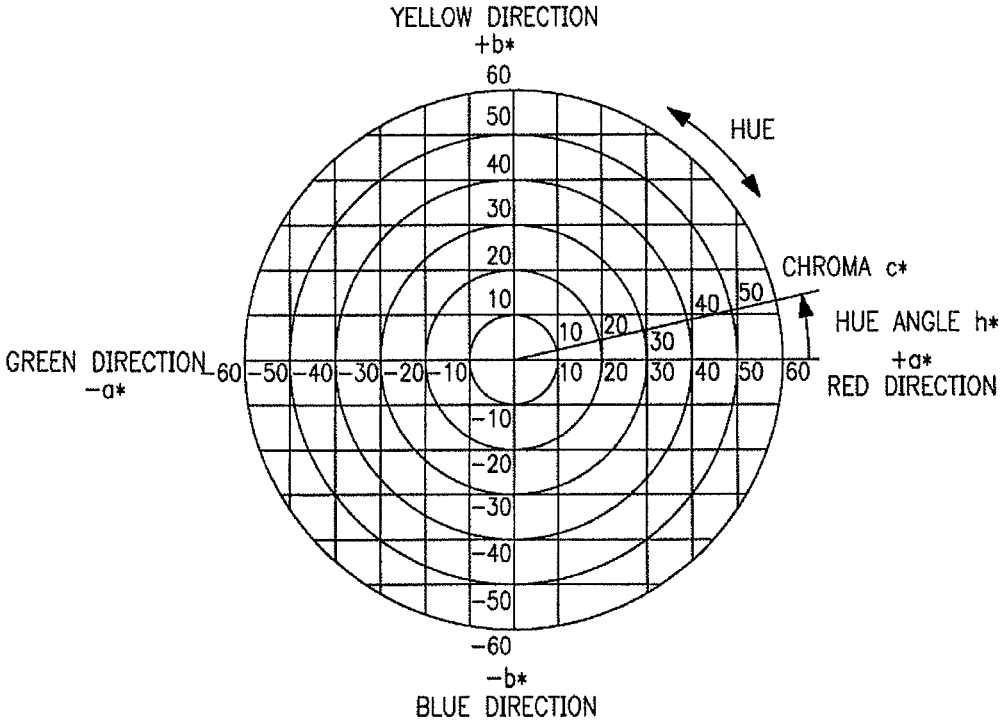
FIG. 2 is a view showing coordinates.

As shown in FIG. 2, a hue angle h* is an angle formed between a straight line connecting a hue (a*, b*) and the origin and a positive a* axis, or is an angle formed between the straight line and the positive a* axis in the counterclockwise direction from the positive a* axis. Accordingly, a hue angle of 0.0 and a hue angle of 360.0 mean the same hue angle. In addition, for example, the expression "hue angle is 330.0 to 30.0" as used in the present invention refers to a region obtained by merging a hue angle region of 330.0 to 360.0 and a hue angle region of 0.0 to 30.0. The hue angle can represent a specific hue irrespective of lightness.

Next, a method for the reflectance spectrophotometry of toner in the present invention will be described. It should be noted that the employment of the measurement method of the present invention allows the kind and content of a colorant in the toner, the dispersed state of the colorant in the toner, and color development property derived from the color of a binder resin and the color of any other additive and intrinsic to the toner to be accurately determined.

A specific measurement method is as described below. The toner is sufficiently dispersed in an aqueous solution of a nonionic surfactant so that the resultant toner dispersion liquid has a certain concentration. A certain amount of the toner dispersion liquid is measured and taken, and the taken liquid is filtrated through a filter having a whiteness of 95 to 120 and a pore diameter of 0.2 to 1.0 μm so that a certain amount of a toner layer is formed on the filter. A transparent, thin glass plate A (cover glass for observation with an optical microscope) is mounted on the upper portion of the toner layer. The resultant is mounted on a glass plate B (slide glass for observation with an optical microscope) having a thickness of 1 to 2 mm, and, furthermore, a metallic weight is mounted from above the thin glass A mounted on the upper portion of the toner layer so that a certain load is applied. The resultant is heated with a hot plate retained at 150° C. for 15 seconds, whereby a sample for measurement is obtained. The absorbance of the above sample for measurement at each wavelength is measured with a reflectance spectrophotometer capable of measuring an absorbance in the wavelength range of 380 nm to 730 nm at an interval of 10 nm by using a sample obtained by mounting the glass A on the filter to which no toner is caused to adhere as a reference.

According to the above method, when the toner melts, the toner adsorbs to the glass plate A to form a uniform toner layer, so the color development property of the toner can be stably measured irrespective of variations in fixing performance, particle diameter, and shape of the toner.

For example, the following method can be employed as an additionally specific measurement method.

An aqueous solution is prepared by dissolving a nonionic surfactant (for example, a Contaminon N manufactured by Wako Pure Chemical Industries, Ltd. can be used) in ion-exchanged water having an electric conductivity of 0.03 to $0.08\times10^{4}$ S/m at a concentration of 3 mass %.

The true density of the toner is measured by a method to be described later, and is represented by $\rho_T$ (g/cm$^3$). $0.02\times\rho_T$ (g) of the toner is measured and taken, and 250 g of the above aqueous solution are gently added to the measured toner, whereby a mixed liquid is prepared. At that time, attention should be paid in order that the aqueous solution may not foam. The mixed liquid is subjected to a dispersion treatment with an ultrasonic cleaning machine (for example, a UT-205S (manufactured by Sharp Corporation) can be used) for 10 minutes, whereby a toner dispersion liquid containing the toner sufficiently dispersed in the mixed liquid is prepared.

A hydrophilic membrane filter having a whiteness of 95 to 120 and a pore diameter of 0.2 to 1.0 μm (for example, a cellulose ester-type membrane filter A080047 (having a pore diameter of 0.80 μm) manufactured by Toyo Roshi Kaisha, Ltd. can be used) is set in a filter holder having a compatible filter diameter of 25 mm (an inner diameter of 18 mm). 8 ml of the toner dispersion liquid are measured and taken, and the taken liquid is gently charged into the filter holder. At that time, attention should be paid in order that the toner dispersion liquid may not foam. Next, the toner dispersion liquid is subjected to suction filtration with a suction apparatus such as an aspirator (for example, an Aspirator SP30 manufactured by Marcos-mepher can be used). After the suction has been continued for 10 minutes, the filter is carefully taken out of the filter holder, and the filter is dried at 40° C. for 3 days, whereby a toner-carrying sample is obtained on the filter.

The above sample is mounted on a glass plate B measuring 1 to 2 mm thick by 76 mm long by 26 mm wide (for example, a slide glass S1112 manufactured by Matsunami Glass Ind., Ltd. can be used). Further, a thin glass plate A measuring 0.12 to 0.17 mm thick by 18 mm long by 18 mm wide (for example, a cover glass CT18189 manufactured by Matsunami Glass Ind., Ltd. can be used) is gently mounted on the upper portion of the toner layer. Further, a weight (for example, brass measuring 22 mm long by 22 mm wide by 42 mm high can be used) is mounted on the upper portion of the thin glass plate A so that a pressure of about 0.54 N/cm$^2$ is applied. In the state, the resultant is left at rest and heated on a hot plate retained at 150° C. for 15 seconds, whereby a sample for measurement is obtained. At that time, after the leaving at rest and heating, the weight and the glass plate B are immediately removed from the sample so that the temperature of the sample returns to normal temperature as quickly as possible. Separately, the thin glass plate A is mounted on the same membrane filter as that described above, and a sample for reference is obtained in the same manner as in the above sample.

A commercially available reflectance spectrophotometer can be used in the reflectance spectrophotometry. To be specific, the absorbance at each wavelength, L*, c*, and h* of the toner can be determined as follows: the above reference sample is subjected to measurement with, for example, a SpectroScan Transmission (manufactured by GretagMacbeth) at the time of the calibration of the apparatus, and then the sample for measurement is subjected to measurement. Specific measurement conditions are shown below.

<Measurement Conditions>
Observation light source: D50
Observation view angle: 2°
Density: DIN NB
White reference: Pap
Filter: No (absent)
Measurement mode: Reflectance Desired data out of values for CIE Lch(ab) (corresponding to L*, c*, and h* described above) and Spectrum D (corresponding to an absorbance at each wavelength in the wavelength range of 380 nm to 730 nm) measured under the above measurement conditions is used.

First, a cyan toner will be described.

The cyan toner of the present invention includes at least: a binder resin; and a colorant, wherein the cyan toner has a value ($h^*_C$) for a hue angle h* based on a CIELAB color coordinate system of 210.0 to 270.0, an absorbance ($A_{C470}$) at a wavelength of 470 nm of 0.300 or less, an absorbance ($A_{C620}$) at a wavelength of 620 nm of 1.500 or more, and a ratio ($A_{C620}/A_{C670}$) of $A_{C620}$ to an absorbance ($A_{C670}$) at a wavelength of 670 nm of 1.00 to 1.25 in reflectance spectrophotometry.

The phrase "cyan toner has $h^*_C$ of 210.0 to 270.0 in the reflectance spectrophotometry" as used in the present invention means that the toner is a toner having a cyan color. When $h^*_C$ is less than 210.0, the toner shows a color close to a green color. When $h^*_C$ exceeds 270.0, the toner shows a color close to a purple color. In addition, $A_{C470}$, $A_{C620}$, and $A_{C620}/A_{C670}$ each show color development property at a specific absorption wavelength of cyan.

In the case of the cyan toner having $h^*_C$ within the above range, the larger $A_{C620}$, the larger opacifying power the cyan toner has; a cyan image having a high image density can be formed with a small toner amount. The smaller $A_{C470}$, the more excellent in color development property the cyan toner is; a cyan image having additionally large lightness can be formed with the same toner amount as that in the case of a conventional toner. In addition, $A_{C620}/A_{C670}$ is involved in the tinge of the toner, and, when the ratio falls within the above range, a full-color image favorably expressing color development property even in a secondary color and having a good color space can be formed.

An increase in addition amount of the colorant in the cyan toner is apt to cause $A_{C470}$ to have a large value. However, when $A_{C470}$ exceeds 0.300, the lightness of an image reduces so that the image becomes obscure even if a sufficient image density is obtained. Accordingly, when a full-color image is formed, a representable color space becomes small. When $A_{C620}$ is less than 1.500, a sufficient image density cannot be obtained, or a toner amount on paper must be increased, so effects of the present invention such as a reduction in unevenness of the surface of an image, an improvement in resolution of the image, and a reduction in toner consumption cannot be obtained. In addition, an increase in addition amount of the colorant in the cyan toner is apt to cause $A_{C620}/A_{C670}$ to have a small value. However, when $A_{C620}/A_{C670}$ exceeds 1.25, the cyan toner shows a strong yellow color, and an ability to represent a secondary color is as follows: a color gamut near a purple color becomes small. When $A_{C620}/A_{C670}$ is less than 1.00, the cyan toner shows a strong red color, and the ability to represent a secondary color is as follows: a color gamut near a green color becomes small.

According to the present invention, the value for $A_{C620}$ described above is preferably large because a toner amount on paper can be reduced, and the effects of the present invention become large. However, the value for $A_{C620}$ described above is preferably 2.300 or less in consideration of a color balance when a full-color image is formed by combining the cyan toner with any other color toner such as a magenta toner, a yellow toner, or a black toner, the color development efficiency of the colorant of the cyan toner, and a material cost. The range of $A_{C620}$ described above is more preferably 1.550 to 2.200, still more preferably 1.650 to 2.200, or particularly preferably 1.800 to 2.100.

The value for $A_{C470}$ described above is preferably small because an image excellent in color development property, and having additionally large lightness and additionally large chroma can be formed. However, the value for $A_{C470}$ described above is preferably 0.050 or more in consideration of a color balance when a full-color image is formed by combining the cyan toner with any other color toner such as a magenta toner or a yellow toner, the color development efficiency of the colorant of the cyan toner, and a material cost. The range of $A_{C470}$ described above is more preferably 0.050 to 0.250, still more preferably 0.080 to 0.250, or particularly preferably 0.100 to 0.200.

The range of the value for $A_{C620}/A_{C670}$ described above is more preferably 1.00 to 1.20, still more preferably 1.03 to 1.18, or particularly preferably 1.05 to 1.10. This is because a color balance becomes good, and a balance between an increase in representable color space of an image and an improvement in resolution or a reduction in surface unevenness of the image becomes particularly suitable.

$A_{C470}$, $A_{C620}$, and $A_{C670}$ described above can each be controlled depending on, for example, the kind and addition amount of the colorant in the toner, the state of presence of the colorant in the toner, the state of presence of any other additive or the like, and the color of an additive.

$A_{C670}$ described above is preferably 1.300 to 2.100. An increase in addition amount of the colorant in the toner is apt to cause $A_{C670}$ to have a large value. When $A_{C670}$ exceeds 2.100, the cyan toner is apt to show a strong red color, and an ability to represent a secondary color is as follows: a color gamut near a green color is apt to be small. When $A_{C670}$ is less than 1.300, the cyan toner is apt to show a strong yellow color, and the ability to represent a secondary color is as follows: a color gamut near a purple color is apt to be small. Accordingly, the range of the value for $A_{C670}$ is more preferably 1.350 to 2.000, or particularly preferably 1.600 to 1.950. This is because a color balance is particularly suitable, and the representable color space of an image becomes particularly large.

By the same reason as that described above, an absorbance ($A_{C420}$) at a wavelength of 420 nm is preferably 0.250 to 0.600. When $A_{C420}$ exceeds 0.600, the cyan toner is apt to show a strong yellow color. When $A_{C420}$ is less than 0.250, the cyan toner is apt to show a strong red color. Accordingly, the range of $A_{C420}$ is more preferably 0.300 to 0.550, or particularly preferably 0.380 to 0.550.

The cyan toner of the present invention has a ratio ($A_{C710}/A_{C670}$) of an absorbance ($A_{C710}$) at a wavelength of 710 nm to $A_{C670}$ of preferably 1.00 to 1.30 in the reflectance spectrophotometry. An increase in addition amount of the colorant in the toner is apt to cause $A_{C710}/A_{C670}$ to have a small value. However, when $A_{C710}/A_{C670}$ falls within the above range, color development efficiency upon formation of a secondary color becomes additionally good. When $A_{C710}/A_{C670}$ is less than 1.00, the lightness of a secondary color image is apt to reduce. When $A_{C710}/A_{C670}$ exceeds 1.30, the chroma of a secondary color may reduce. The range of $A_{C710}/A_{C670}$ described above is more preferably 1.00 to 1.20, or particularly preferably 1.01 to 1.08.

The cyan toner of the present invention has a value ($L^*_C$) for L* of preferably 35.0 to 60.0 in the reflectance spectrophotometry. With such constitution, the chroma of an image is improved, the representable color space of the image expands, and the quality of the image becomes additionally good. When $L^*_C$ is less than 35.0, a representable color space may become small if a full-color image is formed by combining the toner with any other toner. When $L^*_C$ exceeds 60.0, a sufficient image density is hardly obtained. When a toner amount on paper is increased, an image resolution is apt to reduce, and the unevenness of an image becomes large, so the appearance of the image is apt to reduce. Accordingly, the range of $L^*_C$ described above is more preferably 40.0 to 56.0, or particularly preferably 42.0 to 50.0.

The cyan toner of the present invention has a value ($c^*_C$) for c* based on the CIELAB color coordinate system of preferably 55.0 to 75.0 in the reflectance spectrophotometry. With such constitution, the representable color space of an image expands, and a toner amount on paper can be additionally reduced. When $c^*_C$ is less than 55.0, a sufficient image density is hardly obtained. When a toner amount on paper is increased, an image resolution is apt to reduce, and the unevenness of an image becomes large, so the appearance of the image is apt to reduce. When $c^*_C$ exceeds 75.0, if a full-color image is formed by combining the toner with any other toner, a color balance is apt to collapse. Accordingly, $c^*_C$ described above is more preferably 60.0 to 75.0, or particularly preferably 63.0 to 70.0.

A cyan toner of the present invention has a viscosity ($\eta_{C105}$) at 105° C. of 500 to 100,000 Pa·s, a viscosity ($\eta_{C120}$) at 120° C. of 100 to 20,000 Pa·s, and a ratio ($\eta_{C105}/\eta_{C120}$) of $\eta_{C105}$ to $\eta_{C120}$ of preferably 3.0 to 50.0.

In the present invention, $\eta_{C105}$, $\eta_{C120}$, and $\eta_{C105}/\eta_{C120}$ show the melt properties of the toner. The smaller $\eta^{C105}$ or $\eta_{C120}$, the more apt to melt and deform at a low temperature the toner is. As $\eta_{C105}/\eta_{C120}$ becomes closer to 1.0, a change in melt viscosity of the toner with temperature becomes smaller.

Since the cyan toner of the present invention has higher color development property than that of an ordinary toner, even when an image is formed for one kind of image data with a smaller toner amount than that in the case where the ordinary toner is used, an image density and an image color gamut each of which is comparable to a conventional one can be achieved. However, when one attempts to reduce a toner consumption by reducing the thickness of a toner layer of which the image is formed, the toner penetrates into paper, and a fiber of the paper is apt to be remarkable in an image portion unless the toner retains some degree of viscosity in a fixing process. Alternatively, the appearance of the image is apt to reduce owing to a phenomenon such as a reduction in chroma of the image. When the image is formed while a toner amount on the paper is reduced, the amount of a binder resin of which the image is constituted also reduces, so cold offset and hot offset are particularly apt to occur. In view of the foregoing, the toner of the present invention, which is excellent in low-temperature fixability to some extent, preferably retains an appropriate viscosity even at high temperatures.

According to the present invention, when an image is formed while a toner amount on paper is reduced, the image is susceptible to moisture in the paper in the fixing step. Accordingly, in the present invention, a change in melt viscosity of the toner at 105 to 120° C. as temperatures each exceeding the boiling point of water is preferably controlled. In the case where $\eta_{C105}$ described above exceeds 100,000 Pa·s, or $\eta_{C120}$ exceeds 20,000 Pa·s, when the toner is used while the toner amount on the paper is reduced, cold offset is apt to occur. In addition, the color development property of the toner is not sufficiently exerted, and the representable color gamut of the image reduces in some cases. In the case where $\eta_{C105}$ is less than 500 Pa·s, or $\eta_{C120}$ is less than 100 Pa·s, when the toner is used while the toner amount on the paper is reduced, hot offset is apt to occur. In addition, the toner penetrates into the paper, the color gamut of the image reduces, and a fiber of the paper becomes remarkable in an image portion, with the result that the appearance of the image is apt to reduce.

In addition, in the case where $\eta_{C105}/\eta_{C120}$ described above exceeds 50.0, the toner penetrates into the paper, and the chroma of the image reduces, or a fiber of the paper becomes remarkable in the image portion, with the result that the appearance of the image is apt to reduce. In the case of duplex printing, the following problem may arise: an image on a front surface stands on a back surface. Further, hot offset is apt to occur. In the case where $\eta_{C105}/\eta_{C120}$ is less than 3.0, cold offset is apt to occur, or the toner does not undergo sufficient melting and deformation in the fixing step, so the color development property of the toner is not sufficiently exerted, and the representable color gamut of the image reduces in some cases. Further, the front end portion and rear end portion of the paper are apt to differ from each other in image gloss or image color gamut with respect to the travelling direction of the paper in the fixing step, so the appearance of the image is apt to reduce.

Accordingly, the value for $\eta_{C105}$ described above is more preferably 500 to 50,000 Pa·s, or particular preferably 1,000 to 30,000 Pa·s. Similarly, the value for $\eta_{C120}$ described above is more preferably 100 to 10,000 Pa·s, or particularly preferably 400 to 5,000 Pa·s. In addition, $\eta_{C105}/\eta_{C120}$ described above is more preferably 3.0 to 25.0, or particularly preferably 5.0 to 20.0.

The cyan toner of the present invention has the highest endothermic peak with a differential scanning calorimeter (DSC) at preferably 60 to 140° C. The endothermic peak derives from the melting point of a wax in the toner; the melting and deformation of the toner in the fixing step are significantly promoted when the toner present in an image portion is heated to a temperature equal to or higher than the melting point of the wax. Accordingly, when a toner amount on paper is reduced, the endothermic peak is susceptible to the melting behavior of the wax in the fixing step. In addition, in the case where a fixing process in which no oil application mechanism is present or only a trace amount of oil is applied is employed in the fixing step, when an image is formed while a toner amount on paper is reduced, the amount of the toner present on the paper is small, so the amount of the wax in a toner layer of which the image is constituted also reduced. Accordingly, when an image is formed for one kind of image data with a smaller toner amount than that in the case where the ordinary toner is used, cold offset and hot offset are particularly apt to occur. When the temperature of the highest endothermic peak is lower than 60° C., upon melting of the wax in the fixing step, the wax is apt to dissolve in the binder resin in a large amount, and the melt viscosity of the toner is apt to reduce. As a result, the value for $\eta_{C105}$ or $\eta_{C120}$ described above is apt to decrease, and the value for $\eta_{C105}/\eta_{C120}$ described above is apt to increase. In addition, upon melting of the wax in the fixing step, part of the wax dissolves in the binder resin, and the releasing performance of the toner is apt to reduce. Accordingly, when the toner is used while its consumption is reduced, hot offset is remarkably apt to occur. On the other hand, when the temperature of the highest endothermic peak exceeds 140° C., upon melting of the wax in the fixing step, the amount in which the wax dissolves in the binder resin is remarkably small, so the plasticizing effect of the wax is hardly obtained. As a result, the value for $\eta_{C105}$ or $\eta_{C120}$ described above is apt to increase, and the value for $\eta_{C105}/\eta_{C120}$ described above is apt to decrease. In addition, a wax having the highest endothermic peak at a temperature in excess of 140° C. has large crystallinity, so, when a toner amount on paper is reduced, a wax crystal to be mixed in a fixed image has a significant influence on the representable color gamut of an image, and the color gamut is apt to reduce. Accordingly, the highest endothermic peak is placed at more preferably 65° C. to 95° C., or still more preferably 60° C. to 90° C.

By the same reason as that described above, the half width of the highest endothermic peak possessed by the cyan toner of the present invention is preferably 0.5 to 20.0° C. In addition, in the case where a toner amount on paper is reduced, when the half width exceeds 20.0° C., gloss non-uniformity or density non-uniformity is apt to arise in an image at each of the former half portion and latter half portion of the direction in which the paper is passed. When the half width is less than 0.5° C., offset is apt to occur at the latter half portion of the direction in which the paper is passed. Accordingly, the half width is more preferably 1.0 to 15.0° C., or particularly preferably 2.0 to 10.0° C.

The cyan toner of the present invention can use a suitable colorant in a suitable addition amount so as to exert the reflection spectral characteristics. The addition amount of the colorant is preferably 8 to 18 parts by mass with respect to 100 parts by mass of the binder resin. A coloring material is preferably incorporated in as small an amount as possible into the toner in order that a running cost may be reduced. However, when the content of the colorant is less than 8 parts by mass, sufficient color development property may not be obtained. In addition, when the content of the colorant exceeds 18 parts by mass, the representable color space of an image may reduce.

In the cyan toner of the present invention, a relationship between an acid value ($A_C1$) of a first soluble component out of solvent-soluble components extracted from the cyan toner with isopropanol from initiation of the extraction to 20 mass % with reference to a total mass of the soluble components and an acid value ($A_M2$) of a second soluble component out of the solvent-soluble components in excess of 20 mass % to 100 mass % with reference to the total mass preferably satisfies the following expression 1

$$A_C1 > A_C2 \quad \text{(Ex. 1).}$$

In a developing device, the toner is apt to be damaged by a mechanical stress from a toner carrying member, an electrostatic image bearing member, or any other member. Part of the toner chips, or is broken, to produce a fine powder in some cases. The fine powder adheres to any one of the members to change the charging performance of the toner or to contaminate paper directly, and image appearance is reduced in some cases. In particular, in the case of a cyan toner having high coloring power like the toner of the present invention, the charging performance of the toner is susceptible to a colorant even when a trace amount of a fine powder adheres, and the extent to which paper is contaminated when a fine powder adheres to the paper is apt to be large. Accordingly, the charging characteristic of the toner of the present invention is preferably controlled more precisely than in the case of a conventional toner. In the present invention, the following procedure is preferably adopted: the surface layer of a toner particle is provided with a resin layer having a higher acid value than that of the inside of the toner particle, and the exposure of the colorant in the toner particle to a toner surface is suppressed. In addition, when the surface layer of the toner particle is provided with the resin layer having a high acid value, a polar group derived from the acid value is considered to act as a charging auxiliary agent, so a charging failure hardly occurs. When the acid value ($A_C1$) of a first soluble component out of solvent-soluble components extracted from the cyan toner of the present invention with isopropanol from the initiation of the extraction to 20 mass % with reference to the total mass of the soluble components, that is, a component the main component of which is considered to be a resin of which a toner surface layer is formed and the acid value ($A_C2$) of a second soluble component out of the solvent-soluble components in excess of 20 mass % to 100 mass % with reference to the total mass, that is, a component the main component of which is considered to be a resin of which a toner core portion is formed satisfy the expression 1, the first component forms the toner surface layer, whereby the exposure of the colorant to a toner surface is suppressed, and the charging performance of the toner becomes additionally good by virtue of the presence of a large amount of a resin having a large acid value on the toner surface.

$A_C1$ described above is preferably 3.0 to 50.0 mgKOH/g. When $A_C1$ is less than 3.0 mgKOH/g, an improving effect on the charging performance of the toner by virtue of the presence of a component having a high acid value on the surface of the toner is apt to be small. When $A_C1$ exceeds 50.0 mgKOH/g, a polar group derived from the acid value of the component and a polar group in the colorant interact with each other, so the color development property of the toner reduces in some cases. Accordingly, $A_C1$ described above is particularly preferably 5.0 to 30.0 mgKOH/g. In addition, by the same reason as that described above, a difference ($A_C1$-$A_C2$) between $A_C1$ and $A_C2$ is preferably 0.5 to 30.0 mgKOH/g, or more preferably 2.0 to 20.0 mgKOH/g.

$A_C1$ and $A_C2$ described above can be controlled by using two or more kinds of resins having different acid values and controlling the states of presence of the resins in the toner. To be specific, for example, any one of the following methods can be employed: (1) a method involving adding, to the toner, a charge control resin having a large acid value than that of the binder resin out of the charge control resins each having a sulfonic group or a carboxylic group, (2) a method involving forming, near the surface of the toner, a coat layer having a resin having a larger acid value than that of the binder resin out of the resins each having a sulfonic group or a carboxylic group, and (3) a method in which a binder resin having a sulfonic group or a carboxylic group and a high acid value, and a binder resin having a sulfonic group or a carboxylic group and a low acid value are used, and the probability that the binder resin having a high acid value is present is increased by a method such as phase separation from the central portion of the toner toward the surface of the toner.

It is preferable that: the cyan toner of the present invention contain 60.0 to 97.0 mass % of a tetrahydrofuran (THF)-soluble component; and the THF-soluble component contain 0.010 to 1.500 mass % of a sulfur element derived from a sulfonic group. The toner of the present invention is more excellent in color development property than an ordinary toner, and can be used in a reduced amount. The charging characteristic of the toner is preferably set to be larger than that in an ordinary case in order that the amount of the toner to be used in development may be reduced. However, the addition of a large amount of a charge control agent to the toner may reduce the color development property of the toner. When the THF-soluble component of the toner of the present invention contains a predetermined amount of a sulfonic group, the charging characteristic of the toner can be improved without any reduction in color development property of the toner. In addition, the sulfonic group easily undergoes an interaction with the binder resin or any other additive in the toner such as a hydrogen bond or an ionic bond, so the color development property of the toner can be exerted in a particularly favorable manner. Meanwhile, the content of the THF-soluble component in the toner may reduce owing to the polarity of the sulfonic group. Further, when an image is formed while the usage of the toner is reduced as compared to an ordinary case, the offset resistance, gloss uniformity, and penetration resistance of the image are apt to reduce. When the content of the THF-soluble component is less than 60.0 mass %, the color development property of the toner is apt to reduce. When the content of the THF-soluble component exceeds 97.0 mass %, the offset resistance, the gloss uniformity, and the penetration resistance are apt to reduce. In addition, when the content of the sulfur element is less than 0.010 mass %, the extent to which the color development property of the toner is improved may be small. In addition, the amount of the toner to be used in development increases, so dot reproducibility reduces in some cases. When the content of the sulfur element exceeds 1.500 mass %, an interaction between the sulfonic group and the colorant increases, so the color development property of the toner reduces in some cases. In addition, the adsorptivity of the toner to a toner carrying member or an electrostatic image bearing member becomes large, and dot reproducibility reduces in some cases. It should be noted that the content of the above THF-soluble component is more preferably 70.0 to 95.0 mass %, still more preferably 75.0 to 95.0 mass %, or particularly preferably 80.0 to 93.0 mass %. In addition, the content of the above sulfur element derived from the sulfonic group is more preferably 0.010 to 0.500 mass %, still more preferably 0.010 to 0.150 mass %, or particularly preferably 0.020 to 0.100 mass %.

A magenta toner of the present invention will be described.

The magenta toner of the present invention includes at least: a binder resin; and a colorant. The magenta toner has a value ($h^*_M$) for a hue angle h* based on a CIELAB color coordinate system of 330.0 to 30.0, an absorbance ($A_{M570}$) at a wavelength of 570 nm of 1.550 or more, an absorbance ($A_{M620}$) at a wavelength of 620 nm of 0.250 or less, and a ratio ($A_{M570}/A_{M450}$) of $A_{M570}$ to an absorbance ($A_{M450}$) at a wavelength of 450 nm of 1.80 to 3.50 in reflectance spectrophotometry.

The phrase "magenta toner has $h^*_M$ of 330.0 to 30.0 in the reflectance spectrophotometry" as used in the present invention means that the toner is a toner having a magenta color. When $h^*_M$ is less than 330.0, the toner shows a color close to a purple color. When $h^*_M$ exceeds 30.0, the toner shows a color close to an orange color. In addition, $A_{M570}$, $A_{M620}$, and $A_{M570}/A_{M450}$ each show color development property at a specific absorption wavelength of magenta.

In the case of the magenta toner having $h^*_M$ within the above range, the larger $A_{M570}$, the larger opacifying power the magenta toner has; a magenta image having a high image density can be formed with a small toner amount. The smaller $A_{M620}$, the more excellent in color development property the magenta toner is; a magenta image having additionally large lightness can be formed. In addition, $A_{M570}/A_{M450}$ is involved in the tinge of the toner, and, when the values therefor fall within the above range, a full-color image favorably expressing color development property even in a secondary color and having a good color space can be formed.

An increase in addition amount of the colorant in the magenta toner is apt to cause $A_{M620}$ to have a large value. However, when $A_{M620}$ exceeds 0.250, the lightness of an image reduces so that the image becomes obscure even if a sufficient image density is obtained. When $A_{M570}$ is less than 1.550, a sufficient image density cannot be obtained, or a toner amount on paper must be increased, so effects of the present invention such as a reduction in unevenness of the surface of an image, an improvement in resolution of the image, and a reduction in toner consumption cannot be obtained. In addition, an increase in addition amount of the colorant in the magenta toner is apt to cause $A_{M570}/A_{M450}$ to have a small value. However, when $A_{M570}/A_{M450}$ is less than 1.80, the magenta toner shows a strong yellow color, and an ability to represent a secondary color is as follows: a color gamut near a purple color becomes small. When $A_{M570}/A_{M450}$ is more than 3.50, the magenta toner shows a strong blue color, and the ability to represent a secondary color is as follows: a color gamut near a red color becomes small.

According to the present invention, the value for $A_{M570}$ described above is preferably large because a toner amount on paper can be reduced, and the effects of the present invention become large. However, the value for $A_{M570}$ described above is preferably 2.300 or less in consideration of a color balance when a full-color image is formed by combining the magenta toner with any other color toner such as a cyan toner, a yellow toner, or a black toner, the color development efficiency of the colorant of the magenta toner, and a material cost. The range of $A_{M570}$ described above is more preferably 1.600 to 2.200, or particularly preferably 1.800 to 2.200.

The value for $A_{M620}$ described above is preferably small because an image excellent in color development property, and having additionally large lightness and additionally large chroma can be formed. However, the value for $A_{M620}$ described above is preferably 0.050 or more in consideration of a color balance when a full-color image is formed by combining the magenta toner with any other color toner such as a cyan toner, a yellow toner, or a black toner, the color development efficiency of the colorant of the magenta toner, and a material cost. The range of $A_{M620}$ described above is more preferably 0.050 to 0.200, still more preferably 0.100 to 0.174, or particularly preferably 0.150 to 0.170.

The range of the value for $A_{M570}/A_{M450}$ described above is more preferably 2.00 to 3.20, or particularly preferably 2.20 to 2.70. This is because a color balance becomes particularly preferable, and a representable color space of an image becomes particularly large.

$A_{M620}$, $A_{M570}$ and $A_{M570}/A_{M450}$ described above can each be controlled depending on, for example, the kind and addition amount of the colorant in the toner, the state of presence of the colorant in the toner, the state of presence of any other additive or the like, and the color of an additive.

$A_{M450}$ described above is preferably 0.400 to 1.100. An increase in addition amount of the colorant in the toner is apt to cause $A_{M450}$ to have a large value. When $A_{M450}$ exceeds 1.100, the magenta toner is apt to show a strong yellow color, and an ability to represent a secondary color is as follows: a color gamut near a purple color is apt to be small. When $A_{M450}$ is less than 0.400, the magenta toner is apt to show a strong blue color, and the ability to represent a secondary color is as follows: a color gamut near a red color is apt to be small. Accordingly, the range of the value for $A_{M450}$ is more preferably 0.560 to 1.000, or particularly preferably 0.700 to 0.950.

In the present invention, by the same reason as that described above, the toner of the present invention has an absorbance ($A_{M490}$) at a wavelength of 490 nm of preferably 0.600 to 1.500. When $A_{M490}$ is less than 0.600, the magenta toner is apt to show a strong blue color. When $A_{M490}$ exceeds 1.500, the magenta toner is apt to show a strong yellow color. Accordingly, the range of $A_{M490}$ is more preferably 0.800 to 1.400, or particularly preferably 0.900 to 1.360.

The toner of the present invention has a ratio ($A_{M570}/A_{M550}$) of $A_{M570}$ to an absorbance ($A_{M550}$) at a wavelength of 550 nm of preferably 0.98 to 1.20 in the reflectance spectrophotometry. An increase in amount of the colorant in the toner is apt to cause $A_{M570}/A_{M550}$ to take a small value. When $A_{M570}/A_{M550}$ is less than 0.98, an image having small lightness is apt to be obtained. When $A_{M570}/A_{M550}$ exceeds 1.20, an image having small chroma is apt to be obtained. Accordingly, the range of $A_{M570}/A_{M550}$ is more preferably 0.98 to 1.10, or particularly preferably 0.98 to 1.06.

The magenta toner of the present invention has a value ($L^*_M$) for L* of preferably 35.0 to 55.0 in the reflectance spectrophotometry. With such constitution, the representable color space of the image expands, and the quality of the image becomes additionally good. When $L^*_M$ is less than 35.0, a representable color space may become small if a full-color image is formed by combining the toner with any other toner. When $L^*_M$ exceeds 55.0, a sufficient image density is hardly obtained. When a toner amount on paper is increased, an image resolution is apt to reduce, and the unevenness of an image becomes large, so the appearance of the image is apt to reduce. Accordingly, the range of $L^*_M$ described above is more preferably 40.0 to 52.0, or particularly preferably 40.0 to 49.0.

The magenta toner of the present invention has a value ($c^*_M$) for c* based on the CIELAB color coordinate system of preferably 70.0 to 85.0 in the reflectance spectrophotometry. With such constitution, the representable color space of an image expands, and a toner amount on paper can be additionally reduced. When $c^*_M$ is less than 70.0, a sufficient image density is hardly obtained. When a toner amount on paper is increased, an image resolution is apt to reduce, and the unevenness of an image becomes large, so the appearance of the image is apt to reduce. When $c^*_M$ exceeds 85.0, if a full-color image is formed by combining the toner with any other toner, a color balance may be apt to collapse. Accordingly, $c^*_M$ described above is more preferably 75.0 to 85.0, or particularly preferably 77.0 to 82.0.

It is preferable that the magenta toner of the present invention have a viscosity ($\eta_{M\ 105}$) at 105° C. of 500 to 100,000 Pa·s, a viscosity ($\eta_{M120}$) at 120° C. of 100 to 20,000 Pa·s, and a ratio ($\eta_{M105}/\eta_{M120}$) of $\eta_{M105}$ to $\eta_{M120}$ of 3.0 to 50.0.

In the present invention, $\eta_{M105}$, $\eta_{M120}$ and $\eta_{M105}/\eta_{M120}$ show the melt properties of the toner. The smaller $\eta_{M105}$ or $\eta_{M120}$, the more apt to melt and deform at a low temperature the toner is. As $\eta_{M105}/\eta_{M120}$ becomes closer to 1.0, a change in melt viscosity of the toner with temperature becomes smaller.

Since the magenta toner of the present invention has higher color development property than that of an ordinary toner, even when an image is formed for one kind of image data with a smaller toner amount than that in the case where the ordinary toner is used, an image density and an image color gamut each of which is comparable to a conventional one can be achieved. However, when one attempts to reduce a toner consumption by reducing the thickness of a toner layer of which the image is formed, the toner penetrates into paper, and a fiber of the paper is apt to be remarkable in an image portion unless the toner retains some degree of viscosity in a fixing process. Alternatively, the appearance of the image is apt to reduce owing to a phenomenon such as a reduction in chroma of the image. When the image is formed while a toner amount on the paper is reduced, the amount of a binder resin of which the image is constituted also reduces, so cold offset and hot offset are particularly apt to occur. In view of the foregoing, the toner of the present invention, which is excellent in low-temperature fixability to some extent, preferably retains an appropriate viscosity even at high temperatures.

According to the present invention, when an image is formed while a toner amount on paper is reduced, the image is susceptible to moisture in the paper in the fixing step. Accordingly, in the present invention, a change in melt viscosity of the toner at 105 to 120° C. as temperatures each exceeding the boiling point of water is preferably controlled. In the case where $\eta_{M105}$ described above exceeds 100,000 Pa·s, or $\eta_{M120}$ exceeds 20,000 Pa·s, when the toner is used while the toner amount on the paper is reduced, cold offset is apt to occur. In addition, the color development property of the toner is not sufficiently exerted, and the representable color gamut of the image reduces in some cases. In the case where $\eta_{M105}$ is less than 500 Pa·s, or $\eta_{M120}$ is less than 100 Pa·s, when the toner is used while the toner amount on the paper is reduced, hot offset is apt to occur. In addition, the toner penetrates into the paper, the color gamut of the image reduces, and a fiber of the paper becomes remarkable in an image portion, with the result that the appearance of the image is apt to reduce.

In addition, in the case where $\eta_{M105}/\eta_{M120}$ described above exceeds 50.0, the toner penetrates into the paper, and the chroma of the image reduces, or a fiber of the paper becomes remarkable in the image portion, with the result that the appearance of the image is apt to reduce. In the case of duplex printing, the following problem may arise: an image on a front surface stands on a back surface. Further, hot offset is apt to occur. In the case where $\eta_{M105}/\eta_{M120}$ is less than 3.0, cold offset is apt to occur, or the toner does not undergo sufficient melting and deformation in the fixing step, so the color development property of the toner is not sufficiently exerted, and the representable color gamut of the image reduces in some cases. Further, the front end portion and rear end portion of the paper are apt to differ from each other in image gloss or image color gamut with respect to the travelling direction of the paper in the fixing step, so the appearance of the image is apt to reduce.

Accordingly, the value for $\eta_{M105}$ described above is more preferably 500 to 50,000 Pa·s, or particular preferably 1,000 to 30,000 Pas. Similarly, the value for $\eta_{M120}$ described above is more preferably 100 to 10,000 Pa·s, or particularly preferably 400 to 5,000 Pas. In addition, $\eta_{M105}/\eta_{M120}$ described above is more preferably 3.0 to 25.0, or particularly preferably 5.0 to 20.0.

The magenta toner of the present invention has the highest endothermic peak with a differential scanning calorimeter (DSC) at preferably 60 to 140° C. The endothermic peak derives from the melting point of a wax in the toner; the melting and deformation of the toner in the fixing step are significantly promoted when the toner present in an image portion is heated to a temperature equal to or higher than the melting point of the wax. Accordingly, when a toner amount on paper is reduced, the endothermic peak is susceptible to the melting behavior of the wax in the fixing step. In addition, in the case where a fixing process in which no oil application mechanism is present or only a trace amount of oil is applied is employed in the fixing step, when an image is formed while a toner amount on paper is reduced, the amount of the toner present on the paper is small, so the amount of the wax in a toner layer of which the image is constituted also reduced. Accordingly, when an image is formed for one kind of image data with a smaller toner amount than that in the case where the ordinary toner is used, cold offset and hot offset are particularly apt to occur. When the temperature of the highest endothermic peak is lower than 60° C., upon melting of the wax in the fixing step, the wax is apt to dissolve in the binder resin in a large amount, and the melt viscosity of the toner is apt to reduce. As a result, the value for $\eta_{M105}$ or $\eta_{M120}$ described above is apt to decrease, and the value for $\eta_{M105}/\eta_{M120}$ described above is apt to increase. In addition, upon melting of the wax in the fixing step, part of the wax dissolves in the binder resin, and the releasing performance of the toner is apt to reduce. Accordingly, when the toner is used while its consumption is reduced, hot offset is remarkably apt to occur. On the other hand, when the temperature of the highest endothermic peak exceeds 140° C., upon melting of the wax in the fixing step, the amount in which the wax dissolves in the binder resin is remarkably small, so the plasticizing effect of the wax is hardly obtained. As a result, the value for $\eta_{M105}$ or $\eta_{M120}$ described above is apt to increase, and the value for $\eta_{M105}/\eta_{M120}$ described above is apt to decrease. In addition, a wax having the highest endothermic peak at a temperature in excess of 140° C. has large crystallinity, so, when a toner amount on paper is reduced, a wax crystal to be mixed in a fixed image has a significant influence on the representable color gamut of an image, and the color gamut is apt to reduce.

Accordingly, the highest endothermic peak is placed at more preferably 60° C. to 95° C., or still more preferably 65° C. to 90° C.

By the same reason as that described above, the half width of the highest endothermic peak possessed by the magenta toner of the present invention is preferably 0.5 to 20.0° C. In addition, in the case where a toner amount on paper is reduced, when the half width exceeds 20.0° C., gloss non-uniformity or density non-uniformity is apt to arise in an image at each of the former half portion and latter half portion of the direction in which the paper is passed. When the half width is less than 0.5° C., offset is apt to occur at the latter half portion of the direction in which the paper is passed. Accordingly, the half width is more preferably 1.0 to 15.0° C., or particularly preferably 2.0 to 10.0° C.

The magenta toner of the present invention can use a suitable colorant in a suitable addition amount so as to exert the reflection spectral characteristics. The addition amount of the colorant is preferably 8 to 18 parts by mass with respect to 100 parts by mass of the binder resin. A coloring material is preferably incorporated in as small an amount as possible into the toner in order that a running cost may be reduced. However, when the content of the colorant is less than 8 parts by mass, sufficient color development property may not be obtained. In addition, when the content of the colorant exceeds 18 parts by mass, the representable color space of an image may reduce.

In a magenta toner of the present invention, it is preferable that a relationship between an acid value ($A_M1$) of a first soluble component out of solvent-soluble components extracted from the magenta toner with isopropanol from initiation of the extraction to 20 mass % with reference to a total mass of the soluble components and an acid value ($A_M2$) of a second soluble component out of the solvent-soluble components in excess of 20 mass % to 100 mass % with reference to the total mass satisfy the following expression 3

$$A_M1 > A_M2 \quad \text{(Ex. 3).}$$

In a developing device, the toner is apt to be damaged by a mechanical stress from a toner carrying member, an electrostatic image bearing member, or any other member. Part of the toner chips, or is broken, to produce a fine powder in some cases. The fine powder adheres to any one of the members to change the charging performance of the toner or to contaminate paper directly, and image appearance is reduced in some cases. In particular, in the case of a magenta toner having high coloring power like the toner of the present invention, the charging performance of the toner is susceptible to a colorant even when a trace amount of a fine powder adheres, and the extent to which paper is contaminated when a fine powder adheres to the paper is apt to be large. Accordingly, the charging characteristic of the toner of the present invention is preferably controlled more precisely than in the case of a conventional toner. In the present invention, the following procedure is preferably adopted: the surface layer of a toner particle is provided with a resin layer having a higher acid value than that of the inside of the toner particle, and the exposure of the colorant in the toner particle to a toner surface is suppressed. In addition, when the surface layer of the toner particle is provided with the resin layer having a high acid value, a polar group derived from the acid value is considered to act as a charging auxiliary agent, so a charging failure hardly occurs. When the acid value ($A_M1$) of a first soluble component out of solvent-soluble components extracted from the magenta toner of the present invention with isopropanol from the initiation of the extraction to 20 mass % with reference to the total mass of the soluble components, that is, a component the main component of which is considered to be a resin of which a toner surface layer is formed and the acid value ($A_M2$) of a second soluble component out of the solvent-soluble components in excess of 20 mass % to 100 mass % with reference to the total mass, that is, a component the main component of which is considered to be a resin of which a toner core portion is formed satisfy the expression 3, the first component forms the toner surface layer, whereby the exposure of the colorant to a toner surface is suppressed, and the charging performance of the toner becomes additionally good by virtue of the presence of a large amount of a resin having a large acid value on the toner surface.

$A_M1$ described above is preferably 3.0 to 50.0 mgKOH/g. When $A_M1$ is less than 3.0 mgKOH/g, an improving effect on the charging performance of the toner by virtue of the presence of a component having a high acid value on the surface of the toner is apt to be small. When $A_M1$ exceeds 50.0 mgKOH/g, a polar group derived from the acid value of the component and a polar group in the colorant interact with each other, so the color development property of the toner reduces in some cases. Accordingly, $A_M1$ described above is particularly preferably 5.0 to 30.0 mgKOH/g. In addition, by the same reason as that described above, a difference ($A_M1$-$A_M2$) between $A_M1$ and $A_M2$ is preferably 0.5 to 30.0 mgKOH/g, or more preferably 2.0 to 20.0 mgKOH/g.

$A_M1$ and $A_M2$ described above can be controlled by using two or more kinds of resins having different acid values and controlling the states of presence of the resins in the toner. To be specific, for example, any one of the following methods can be employed: (1) a method involving adding, to the toner, a charge control resin having a large acid value than that of the binder resin out of the charge control resins each having a sulfonic group or a carboxylic group, (2) a method involving forming, near the surface of the toner, a coat layer having a resin having a larger acid value than that of the binder resin out of the resins each having a sulfonic group or a carboxylic group, and (3) a method in which a binder resin having a sulfonic group or a carboxylic group and a high acid value, and a binder resin having a sulfonic group or a carboxylic group and a low acid value are used, and the probability that the binder resin having a high acid value is present is increased by a method such as phase separation from the central portion of the toner toward the surface of the toner.

It is preferable that: the magenta toner of the present invention contain 60.0 to 97.0 mass % of a tetrahydrofuran (THF)-soluble component; and the THF-soluble component contain 0.010 to 1.500 mass % of a sulfur element derived from a sulfonic group. The toner of the present invention is more excellent in color development property than an ordinary toner, and can be used in a reduced amount. The charging characteristic of the toner is preferably set to be larger than that in an ordinary case in order that the amount of the toner to be used in development may be reduced. However, the addition of a large amount of a charge control agent to the toner may reduce the color development property of the toner. When the THF-soluble component of the toner of the present invention contains a predetermined amount of a sulfonic group, the charging characteristic of the toner can be improved without any reduction in color development property of the toner. In addition, the sulfonic group easily undergoes an interaction with the binder resin or any other additive in the toner such as a hydrogen bond or an ionic bond, so the color development property of the toner can be exerted in a particularly favorable manner. Meanwhile, the content of the THF-soluble component in the toner may reduce owing to the polarity of the sulfonic group. Further, when an image is formed while the usage of the toner is reduced as compared to an ordinary case, the offset resistance, gloss uniformity, and penetration resistance of the image are apt to reduce. When the content of the THF-soluble component is less than 60.0 mass %, the color development property of the toner is apt to reduce. When the content of the THF-soluble component exceeds 97.0 mass %, the offset resistance, the gloss uniformity, and the penetration resistance are apt to reduce. In addition, when the content of the sulfur element is less than 0.010 mass %, the extent to which the color development property of the toner is improved may be small. In addition, the amount of the toner to be used in development increases, so dot reproducibility reduces in some cases. When the content of the sulfur element exceeds 1.500 mass %, an interaction between the sulfonic group and the colorant increases, so the color development property of the toner reduces in some cases. In addition, the adsorptivity of the toner to a toner carrying member or an electrostatic image bearing member becomes large, and dot reproducibility reduces in some cases. It should be noted that the content of the above THF-soluble component is more preferably 70.0 to 95.0 mass %, still more preferably 75.0 to 95.0 mass %, or particularly preferably 80.0 to 93.0 mass %. In addition, the content of the above sulfur element derived from the sulfonic group is more preferably 0.010 to 0.500 mass %, still more preferably 0.010 to 0.150 mass %, or particularly preferably 0.020 to 0.100 mass %.

A yellow toner of the present invention will be described.

The yellow toner of the present invention includes at least: a binder resin; and a colorant. The yellow toner has a value ($h^*_Y$) for a hue angle h* based on a CIELAB color coordinate system of 75.0 to 120.0, an absorbance ($A_{Y450}$) at a wavelength of 450 nm of 1.600 or less, an absorbance ($A_{Y470}$) at a wavelength of 470 nm of 1.460 or more, and an absorbance ($A_{Y510}$) at a wavelength of 510 nm of 0.500 or less in reflectance spectrophotometry.

The phrase "yellow toner has $h^*_Y$ of 75.0 to 120.0 in the reflectance spectrophotometry" as used in the present invention means that the toner is a toner having a yellow color. When $h^*_Y$ is less than 75.0, the toner shows a color close to an orange color. When $h^*_Y$ exceeds 120.0, the toner shows a color close to a greenish yellow color. In addition, $A_{Y450}$, $A_{Y470}$, and $A_{Y510}$ each show color development property at a specific absorption wavelength of yellow.

In the case of the yellow toner having $h^*_Y$ within the above range, the larger $A_{Y450}$ or $A_{Y470}$, the larger opacifying power the yellow toner has; a yellow image having a high image density can be formed with a small toner amount. In addition, the smaller $A_{Y510}$, the more excellent in color development property the yellow toner is; a full-color image favorably expressing color development property even in a secondary color and having a good color space can be formed.

An increase in addition amount of the colorant in the yellow toner is apt to cause $A_{Y510}$ to have a large value. However, when $A_{Y510}$ exceeds 0.500, the lightness of an image reduces so that the image becomes obscure even if a sufficient image density is obtained. Accordingly, when a full-color image is formed, a representable color space becomes small. On the other hand, $A_{Y450}$ is less than 1.600, or when $A_{Y470}$ is less than 1.460, a sufficient image density cannot be obtained, or a toner amount on paper must be increased, so effects of the present invention such as a reduction in unevenness of the surface of an image, an improvement in resolution of the image, and a reduction in toner consumption cannot be obtained.

According to the present invention, the value for $A_{Y450}$ described above is preferably large because a toner amount on paper can be reduced, and the effects of the present invention become large. However, the value for $A_{Y450}$ described above is preferably 2.300 or less in consideration of a color balance when a full-color image is formed by combining the yellow toner with any other color toner such as a cyan toner, a magenta toner, or a black toner, the color development efficiency of the colorant of the yellow toner, and a material cost. The range of $A_{Y450}$ described above is more preferably 1.650 to 2.200, still more preferably 1.700 to 2.200, or particularly preferably 1.780 to 2.100.

Similarly, the value for $A_{Y470}$ described above is preferably 2.200 or less. The range of $A_{Y470}$ described above is more preferably 1.500 to 2.100, still more preferably 1.650 to 2.000, or particularly preferably 1.700 to 1.980.

The value for $A_{Y510}$ described above is preferably small because an image excellent in color development property, and having additionally large lightness and additionally large chroma can be formed. However, the value for $A_{Y510}$ described above is preferably 0.020 or more in consideration of a color balance when a full-color image is formed by combining the yellow toner with any other color toner such as a cyan toner, a magenta toner, or a black toner, the color development efficiency of the colorant of the yellow toner, and a material cost. The range of $A_{Y510}$ described above is more preferably 0.050 to 0.350, or particularly preferably 0.150 to 0.320.

The yellow toner of the present invention has a ratio ($A_{Y470}/A_{Y490}$) of an absorbance ($A_{Y490}$) at a wavelength of 490 nm to $A_{Y470}$ of preferably 1.20 to 2.10 in the reflectance spectrophotometry. An increase in addition amount of the colorant in the toner is apt to cause $A_{Y470}/A_{Y490}$ to have a small value. When $A_{Y470}/A_{Y490}$ is less than 1.20, the yellow toner is apt to show a strong red color, and an ability to represent a secondary color is as follows: a color gamut near a green color is apt to be small. When $A_{Y470}/A_{Y490}$ exceeds 2.10, the yellow toner is apt to show a strong green color, and the ability to represent a secondary color is as follows: a color gamut near a red color is apt to be small. Accordingly, the range of the value for $A_{Y470}/A_{Y490}$ is more preferably 1.30 to 1.90, still more preferably 1.30 to 1.60, or particularly preferably 1.40 to 1.52.

The yellow toner of the present invention has a value ($L^*_Y$) for L* of preferably 85.0 to 100.0 in the reflectance spectrophotometry. With such constitution, the representable color space of an image expands, and the quality of the image becomes additionally good. When $L^*_Y$ is less than 85.0, the lightness of an image reduces, and a representable color space becomes small in some cases. When $L^*_Y$ exceeds 100.0, if a full-color image is formed by combining the toner with any other toner, a color balance may be apt to collapse. Accordingly, $L^*_Y$ described above is more preferably 90.0 to 100.0, still more preferably 90.0 to 95.0, or particularly preferably 91.0 to 93.0.

The yellow toner of the present invention has a value ($c^*_Y$) for c* based on the CIELAB color coordinate system of preferably 95.0 to 130.0 in the reflectance spectrophotometry. With such constitution, the representable color space of an image expands, and a toner amount on paper can be additionally reduced. When $c^*_Y$ is less than 95.0, the chroma of the image is apt to reduce, and the toner amount on the paper must be increased in some cases. When $c^*_Y$ exceeds 130.0, if a full-color image is formed by combining the toner with any other toner, a color balance may be apt to collapse. Accordingly, $c^*_Y$ described above is more preferably 103.0 to 125.0, still more preferably 103.0 to 118.0, or particularly preferably 108.0 to 118.0.

It is preferable that the cyan toner of the present invention have a viscosity ($\eta_{Y105}$) at 105° C. of 500 to 100,000 Pa·s, a viscosity ($\eta_{Y120}$) at 120° C. of 100 to 20,000 Pa·s, and a ratio ($\eta_{Y105}/\eta_{Y120}$) of $\eta_{Y105}$ to $\eta_{Y120}$ of 3.0 to 50.0.

In the present invention, $\eta_{Y105}$, $\eta_{Y120}$, and $\eta_{Y105}/\eta_{Y120}$ show the melt properties of the toner. The smaller $\eta_{Y105}$ or $\eta_{Y120}$, the more apt to melt and deform at a low temperature the toner is. As $\eta_{Y105}/\eta_{Y120}$ becomes closer to 1.0, a change in melt viscosity of the toner with temperature becomes smaller.

Toner is preferably excellent in low-temperature fixability in order that an image-forming apparatus may operate at a high speed and may consume reduced energy. However, when one attempts to reduce a toner consumption by reducing the thickness of a toner layer of which an image is formed, toner penetrates into paper, and a fiber of the paper is apt to be remarkable in an image portion unless the toner retains some degree of viscosity in a fixing process. Alternatively, the appearance of the image is apt to reduce owing to a phenomenon such as a reduction in chroma of the image. In addition, when the image is formed while a toner amount on the paper is reduced, the amount of a binder resin present on the paper by being incorporated into the toner reduces, so cold offset and hot offset are particularly apt to occur. In view of the foregoing, the toner of the present invention, which is excellent in low-temperature fixability to some extent, preferably retains an appropriate viscosity and has suitable melt properties even at high temperatures.

According to the present invention, when an image is formed while a toner amount on paper is reduced, the image is susceptible to moisture in the paper in the fixing step. Accordingly, in the present invention, a change in melt viscosity of the toner at 105 to 120° C. as temperatures each exceeding the boiling point of water is preferably controlled. In the case where $\eta_{Y105}$ described above exceeds 100,000 Pa·s, or $\eta_{Y120}$ exceeds 20,000 Pa·s, when the toner is used while the toner amount on the paper is reduced, cold offset is apt to occur. In addition, the color development property of the toner is not sufficiently exerted, and the representable color gamut of the image reduces in some cases. In the case where $\eta_{Y105}$ is less than 500 Pa·s, or $\eta_{Y120}$ is less than 100 Pa·s, when the toner is used while the toner amount on the paper is reduced, hot offset is apt to occur. In addition, the toner penetrates into the paper, the color gamut of the image reduces, and a fiber of the paper becomes remarkable in an image portion, with the result that the appearance of the image is apt to reduce.

In addition, in the case where $\eta_{Y105}/\eta_{Y120}$ exceeds 50.0, the toner penetrates into the paper, and the chroma of the image reduces, or a fiber of the paper becomes remarkable in the image portion, with the result that the appearance of the image is apt to reduce. In the case of duplex printing, the following problem may arise: an image on a front surface stands on a back surface. Further, hot offset is apt to occur. In the case where $\eta_{Y105}/\eta_{Y120}$ is less than 3.0, cold offset is apt to occur, or the toner does not undergo sufficient melting and deformation in the fixing step, so the color development property of the toner is not sufficiently exerted, and the representable color gamut of the image reduces in some cases. Further, the front end portion and rear end portion of the paper are apt to differ from each other in image gloss or image color gamut with respect to the travelling direction of the paper in the fixing step, so the appearance of the image is apt to reduce.

Accordingly, the value for $\eta_{Y105}$ described above is more preferably 500 to 50,000 Pa·s, or particular preferably 1,000 to 30,000 Pas. Similarly, the value for $\eta_{Y120}$ described above is more preferably 100 to 10,000 Pa·s, or particularly preferably 100 to 5,000 Pas. In addition, $\eta_{Y105}/\eta_{Y120}$ described above is more preferably 3.0 to 25.0, or particularly preferably 5.0 to 20.0.

Further, the yellow toner of the present invention has the highest endothermic peak with a differential scanning calorimeter (DSC) at preferably 60 to 140° C. The endothermic peak derives from the melting point of a wax in the toner; the melting and deformation of the toner in the fixing step are significantly promoted when the toner present in an image portion is heated to a temperature equal to or higher than the melting point of the wax. Accordingly, when a toner amount on paper is reduced, the endothermic peak is susceptible to the melting behavior of the wax in the fixing step. In addition, in the case where a fixing process in which no oil application mechanism is present or only a trace amount of oil is applied is employed in the fixing step, when an image is formed while a toner amount on paper is reduced, the amount of the toner present on the paper is small, so the amount of the wax in a toner layer of which the image is constituted also reduced because the wax is contained in the toner. Accordingly, when an image is formed for one kind of image data with a smaller toner amount than that in the case where the ordinary toner is used, cold offset and hot offset are particularly apt to occur. When the temperature of the highest endothermic peak is lower than 60° C., upon melting of the wax in the fixing step, the wax is apt to dissolve in the binder resin in a large amount, and the melt viscosity of the toner is apt to reduce. As a result, the value for $\eta_{Y105}$ or $\eta_{Y120}$ described above is apt to decrease, and the value for $\eta_{Y105}/\eta_{Y120}$ described above is apt to increase, so the toner penetrates into the paper, the color gamut of the image reduces, and a fiber of the paper becomes remarkable in an image portion, with the result that the appearance of the image is apt to reduce. Further, upon melting of the wax in the fixing step, part of the wax dissolves in the binder resin, and the releasing performance of the toner is apt to reduce. Accordingly, when the toner is used while its consumption is reduced, hot offset is remarkably apt to occur. On the other hand, when the temperature of the highest endothermic peak exceeds 140° C., upon melting of the wax in the fixing step, the amount in which the wax dissolves in the binder resin is remarkably small, so the plasticizing effect of the wax is hardly obtained. As a result, the color gamut of the image to be expressed is apt to reduce because fixability of toner degrades, and toner does not melt and deform sufficiently in the fixing process, whereby coloring properties of the toner does not express sufficiently. In addition, a wax having the highest endothermic peak at a temperature in excess of 140° C. has large crystallinity, so, when a toner amount on paper is reduced, a wax crystal to be mixed in a fixed image has a significant influence on the representable color gamut of an image, and the color gamut is apt to reduce. Accordingly, the highest endothermic peak is placed at more preferably 60° C. to 95° C., or still more preferably 65° C. to 85° C.

By the same reason as that described above, the half width of the highest endothermic peak possessed by the yellow toner of the present invention is preferably 0.5 to 20.0° C. In addition, in the case where a toner amount on paper is reduced, when the half width exceeds 20.0° C., gloss non-uniformity or density non-uniformity is apt to arise in an image at each of the former half portion and latter half portion of the direction in which the paper is passed. When the half width is less than 0.5° C., offset is apt to occur. Accordingly, the half width is more preferably 1.0 to 15.0° C., or particularly preferably 2.0 to 10.0° C.

The yellow toner of the present invention preferably contains the colorant of 8 to 18 parts by mass with respect to 100 parts by mass of the binder resin. A coloring material is preferably incorporated in as small an amount as possible into the toner in order that a running cost may be reduced. However, when the content of the colorant is less than 8 parts by mass, sufficient color development property may not be obtained. In addition, when the content of the colorant exceeds 18 parts by mass, the representable color space of an image may reduce.

In a yellow toner of the present invention, a relationship between an acid value ($A_Y1$) of a first soluble component out of solvent-soluble components extracted from the isopropanol from initiation of the extraction to 20 mass % with reference to a total mass of the soluble components and an acid value ($A_Y2$) of a second soluble component out of the solvent-soluble components in excess of 20 mass % to 100 mass % with reference to the total mass preferably satisfies the following expression 5

$$A_Y1>A_Y2 \quad \text{(Ex. 5).}$$

In a developing device, the toner is apt to be damaged by a mechanical stress from a toner carrying member, an electrostatic image bearing member, or any other member. Part of the toner chips, or is broken, to produce a fine powder in some cases. The fine powder adheres to any one of the members to change the charging performance of the toner or to contaminate paper directly, and image appearance is reduced in some cases. In particular, in the case of a yellow toner having high coloring power like the toner of the present invention, the charging performance of the toner is susceptible to a colorant even when a trace amount of a fine powder adheres, and the extent to which paper is contaminated when a fine powder adheres to the paper is apt to be large. Accordingly, the charging characteristic of the toner of the present invention is preferably controlled more precisely than in the case of a conventional toner. In the present invention, the following procedure is preferably adopted: the surface layer of a toner particle is provided with a resin layer having a higher acid value than that of the inside of the toner particle, and the exposure of the colorant in the toner particle to a toner surface is suppressed. In addition, when the surface layer of the toner particle is provided with the resin layer having a high acid value, a polar group derived from the acid value is considered to act as a charging auxiliary agent, so a charging failure hardly occurs. When the acid value ($A_Y1$) of a first soluble component out of solvent-soluble components extracted from isopropanol from the initiation of the extraction to 20 mass % with reference to the total mass of the soluble components, that is, a component the main component of which is considered to be a resin of which a toner surface layer is formed and the acid value ($A_Y2$) of a second soluble component out of the solvent-soluble components in excess of 20 mass % to 100 mass % with reference to the total mass, that is, a component the main component of which is considered to be a resin of which a toner core portion is formed satisfy the expression 5, the first component forms the toner surface layer, whereby the exposure of the colorant to a toner surface is suppressed, and the charging performance of the toner becomes additionally good by virtue of the presence of a large amount of a resin having a large acid value on the toner surface.

$A_Y1$ described above is preferably 3.0 to 50.0 mgKOH/g. When $A_Y1$ is less than 3.0 mgKOH/g, an improving effect on the charging performance of the toner by virtue of the presence of a component having a high acid value on the surface of the toner is apt to be small. When $A_Y1$ exceeds 50.0 mgKOH/g, a polar group derived from the acid value of the component and a polar group in the colorant interact with each other, so the color development property of the toner reduces in some cases. Accordingly, $A_Y1$ described above is particularly preferably 5.0 to 30.0 mgKOH/g. In addition, by the same reason as that described above, a difference ($A_Y1$-$A_Y2$) between $A_Y1$ and $A_Y2$ is preferably 0.5 to 30.0 mgKOH/g, or more preferably 2.0 to 20.0 mgKOH/g.

$A_Y1$ and $A_Y2$ described above can be controlled by using two or more kinds of resins having different acid values and controlling the states of presence of the resins in the toner. To be specific, for example, any one of the following methods can be employed: (1) a method involving adding, to the toner, a charge control resin having a large acid value than that of the binder resin out of the charge control resins each having a sulfonic group or a carboxylic group, (2) a method involving forming, near the surface of the toner, a coat layer having a resin having a larger acid value than that of the binder resin out of the resins each having a sulfonic group or a carboxylic group, and (3) a method in which a binder resin having a sulfonic group or a carboxylic group and a high acid value, and a binder resin having a sulfonic group or a carboxylic group and a low acid value are used, and the probability that the binder resin having a high acid value is present is increased by a method such as phase separation from the central portion of the toner toward the surface of the toner.

A yellow toner of the present invention contains 60.0 to 97.0 mass % of a tetrahydrofuran (THF)-soluble component, and the THF-soluble component contains preferably 0.010 to 1.500 mass % of a sulfur element derived from a sulfonic group. The toner of the present invention is more excellent in color development property than an ordinary toner, and can be used in a reduced amount. The charging characteristic of the toner is preferably set to be larger than that in an ordinary case in order that the amount of the toner to be used in development may be reduced. However, the addition of a large amount of a charge control agent to the toner may reduce the color development property of the toner. When the THF-soluble component of the toner of the present invention contains a predetermined amount of a sulfonic group, the charging characteristic of the toner can be improved without any reduction in color development property of the toner. In addition, the sulfonic group easily undergoes an interaction with the binder resin or any other additive in the toner such as a hydrogen bond or an ionic bond, so the color development property of the toner can be exerted in a particularly favorable manner. Meanwhile, the content of the THF-soluble component in the toner may reduce owing to the polarity of the sulfonic group. Further, when an image is formed while the usage of the toner is reduced as compared to an ordinary case, the offset resistance, gloss uniformity, and penetration resistance of the image are apt to reduce. When the content of the THF-soluble component is less than 60.0 mass %, the color development property of the toner is apt to reduce. When the content of the THF-soluble component exceeds 97.0 mass %, the offset resistance, the gloss uniformity, and the penetration resistance are apt to reduce. In addition, when the content of the sulfur element is less than 0.010 mass %, the extent to which the color development property of the toner is improved may be small. In addition, the amount of the toner to be used in development increases, so dot reproducibility reduces in some cases. When the content of the sulfur element exceeds 1.500 mass %, an interaction between the sulfonic group and the colorant increases, so the color development property of the toner reduces in some cases. In addition, the adsorptivity of the toner to a toner carrying member or an electrostatic image bearing member become s large, and dot reproducibility reduces in some cases. It should be noted that the content of the above THF-soluble component is more preferably 70.0 to 95.0 mass %, still more preferably 75.0 to 95.0 mass %, or particularly preferably 80.0 to 93.0 mass %. In addition, the content of the above sulfur element derived from the sulfonic group is more preferably 0.010 to 0.500 mass %, still more preferably 0.010 to 0.150 mass %, or particularly preferably 0.020 to 0.100 mass %.

A black toner of the present invention will be described.

A black toner of the present invention includes at least: a binder resin; and a colorant, wherein the black toner has a value ($C_K$) for a hue angle c* based on a CIELAB color coordinate system of 20.0 or less, an absorbance ($A_{K600}$) at a wavelength of 600 nm of 1.610 or more, and a ratio ($A_{K600}/A_{K460}$) of $A_{K600}$ to an absorbance ($A_{K460}$) at a wavelength of 460 nm of 0.970 to 1.035 in reflectance spectrophotometry.

The phrase "black toner has $c^*_K$ of 20.0 or less in the reflectance spectrophotometry" as used in the present invention means that the toner is a toner having a black color. When $c^*_K$ exceeds 20.0, the toner shows that a red color, a blue color, and other colors have high intensity.

In the case of the black toner having $c^*_K$ within the above range, the larger $A_{K600}$, the larger opacifying power the black toner has; a black image having a high image density can be formed with a small toner amount. In addition, $A_{K600}/A_{K460}$ is involved in the tinge of the toner, and, when the ratio falls within the above range, a full-color image favorably expressing color development property even in a secondary color and a tertiary color and having a good color space can be formed.

An increase in addition amount of the colorant in the black toner is apt to increase $A_{K600}$. Meanwhile, $A_{K600}/A_{K460}$ is apt to take a value largely deviating from 1.000. When $A_{K600}/A_{K460}$ is less than 0.970, the black toner shows a strong red color, and a color space near a navy blue color in a secondary or tertiary color formed of a color toner and the black toner becomes small. In addition, when the toner is used while a toner amount on paper is reduced, a red color becomes particularly remarkable. When $A_{K600}/A_{K460}$ exceeds 1.035, the black toner shows a strong blue color, and a color space near a dark brown color in a secondary or tertiary color formed of a color toner and the black toner becomes small. In addition, when the toner is used while a toner amount on paper is reduced, a blue color becomes particularly remarkable. When $A_{K600}$ is less than 1.610, a sufficient image density cannot be obtained, or a toner amount on paper must be increased, so the effects of the present invention such as a reduction in unevenness of an image surface and an improvement in dot reproducibility cannot be obtained.

According to the present invention, the value for $A_{K600}$ described above is preferably large because a toner amount on paper can be reduced, and the effects of the present invention become large. However, the value for $A_{K600}$ described above is preferably 2.100 or less in consideration of a color balance when a full-color image is formed by combining the black toner with any other color toner such as a cyan toner, a magenta toner, or a yellow toner, the color development efficiency of the colorant of the black toner, and a material cost. The range of $A_{K600}$ described above is more preferably 1.610 to 1.930, still more preferably 1.650 to 1.930, still more preferably 1.700 to 1.920, or particularly preferably 1.700 to 1.920.

The range of the value for $A_{K600}/A_{K460}$ described above is more preferably 0.980 to 1.033, still more preferably 0.990 to 1.030, or particularly preferably 0.998 to 1.025.

$A_{K600}$ and $A_{K600}/A_{K460}$ described above can each be controlled depending on, for example, the kind and addition amount of the colorant in the toner, the state of presence of the colorant in the toner, the state of presence of any other additive or the like, and the color of an additive.

The black toner of the present invention has a ratio ($A_{K460}/A_{K670}$) of $A_{K460}$ to an absorbance ($A_{K670}$) at a wavelength of 670 nm of preferably 0.960 to 1.070 in the reflectance spectrophotometry. An increase in addition amount of the colorant in the toner is apt to cause $A_{K460}/A_{K670}$ to take a value largely deviating from 1.000. When $A_{K460}/A_{K670}$ is less than 0.960, the black toner is apt to show a strong red color, and a color space near a navy blue color in a secondary or tertiary color formed of a color toner and the black toner is apt to be small. In addition, when the toner is used while a toner amount on paper is reduced, a red color may become particularly remarkable. When $A_{K460}/A_{K670}$ exceeds 1.070, the black toner is apt to show a strong blue color, and a color space near a dark brown color in a secondary or tertiary color formed of a color toner and the black toner is apt to be small. In addition, when the toner is used while a toner amount on paper is reduced, a blue color may become particularly remarkable. Accordingly, the range of $A_{K460}/A_{K670}$ described above is more preferably 0.970 to 1.050, or particularly preferably 0.975 to 1.025.

$A_{K460}$ described above is preferably 1.600 to 1.940. Setting $A_{K460}$ within the range allows a relationship between the opacifying power of the black toner and a color balance when a color toner and the black toner are combined to be particularly favorably exerted. In the case where $A_{K460}$ is less than 1.600, when the toner is used while a toner amount on paper is reduced, a color space near a dark brown color may become small. In the case where $A_{K460}$ exceeds 1.940, when the toner is used while a toner amount on paper is reduced, a color space near a navy blue color is apt to be small. Accordingly, the range of $A_{K460}$ is more preferably 1.650 to 1.940, or particularly preferably 1.700 to 1.900.

Similarly, $A_{K670}$ described above is preferably 1.580 to 1.940. Setting $A_{K670}$ within the range allows a relationship between the opacifying power of the black toner and a color balance when a color toner and the black toner are combined to be particularly favorably exerted. In the case where $A_{K670}$ is less than 1.580, when the toner is used while a toner amount on paper is reduced, a color space near a navy blue color may become small. In the case where $A_{K670}$ exceeds 1.940, when the toner is used while a toner amount on paper is reduced, a color space near a dark brown color is apt to be small. Accordingly, the range of $A_{K670}$ is more preferably 1.640 to 1.920, or particularly preferably 1.700 to 1.900.

The black toner of the present invention preferably has a value ($a^*_K$) for a* based on the CIELAB color coordinate system of −2.00 to 0.50, and a value ($b^*_K$) for b* based on the system of −2.00 to 2.00 in the reflectance spectrophotometry. With such constitution, when a toner consumption is reduced, the representable color space of an image additionally expands, and the quality of the image becomes additionally good. In the case where $a^*_K$ is less than −2.00, when a toner consumption is reduced, the color space of a portion having, for example, a dark red color, a dark magenta color, or a dark purple color may become small. In addition, in the case where $a^*_K$ exceeds 0.50, the color space of a portion having, for example, a dark blue color, a dark cyan color, or a dark green color may become small. Accordingly, the range of $a^*_K$ is more preferably −1.65 to 0.10.

Similarly, in the case where $b^*_K$ is less than −2.00, the color space of a portion having, for example, a dark magenta color, a dark blue color, or a dark cyan color may become small. In the case where $b^*_K$ exceeds 2.00, the color space of a portion having, for example, a dark green color, a dark yellow color, or a dark red color may become small. Accordingly, the range of $b^*_K$ is more preferably −1.70 to 1.50, or particularly preferably −1.50 to 1.20.

A black toner of the present invention has a viscosity ($\eta_{K105}$) at 105° C. of 500 to 100,000 Pa·s, a viscosity ($\eta_{K120}$) at 120° C. of 100 to 20,000 Pa·s, and a ratio ($\eta_{K105}/\eta_{K120}$) of $\eta_{K105}$ to $\eta_{K120}$ of preferably 3.0 to 50.0.

In the present invention $\eta_{K105}$, $\eta_{K120}$, and $\eta_{K105}/\eta_{K120}$ show the melt properties of the toner. The smaller $\eta_{K105}$ or $\eta_{K120}$, the more apt to melt and deform at a low temperature the toner is. As $\eta_{K105}/\eta_{K120}$ becomes closer to 1.0, a change in melt viscosity of the toner with temperature becomes smaller.

Since the black toner of the present invention has higher color development property than that of an ordinary toner, even when an image is formed for one kind of image data with a smaller toner amount than that in the case where the ordinary toner is used, an image density and an image color gamut each of which is comparable to a conventional one can be achieved. However, when one attempts to reduce a toner consumption by reducing the thickness of a toner layer of which the image is formed, the toner penetrates into paper, and a fiber of the paper is apt to be remarkable in an image portion unless the toner retains some degree of viscosity in a fixing process. Alternatively, the appearance of the image is apt to reduce owing to a phenomenon such as a reduction in chroma of the image. When the image is formed while a toner amount on the paper is reduced, the amount of a binder resin of which the image is constituted also reduces, so cold offset and hot offset are particularly apt to occur. In view of the foregoing, the toner of the present invention, which is excellent in low-temperature fixability to some extent, preferably retains an appropriate viscosity even at high temperatures.

According to the present invention, when an image is formed while a toner amount on paper is reduced, the image is susceptible to moisture in the paper in the fixing step. Accordingly, in the present invention, a change in melt viscosity of the toner at 105 to 120° C. as temperatures each exceeding the boiling point of water is preferably controlled. In the case where $\eta_{K105}$ described above exceeds 100,000 Pa·s, or $\eta_{K120}$ exceeds 20,000 Pa·s, when the toner is used while the toner amount on the paper is reduced, cold offset is apt to occur. In addition, the color development property of the toner is not sufficiently exerted, and the representable color gamut of the image reduces in some cases. In the case where $\eta_{K105}$ is less than 500 Pa·s, or $\eta_{K120}$ is less than 100 Pa·s, when the toner is used while the toner amount on the paper is reduced, hot offset is apt to occur. In addition, the toner penetrates into the paper, the color gamut of the image reduces, and a fiber of the paper becomes remarkable in an image portion, with the result that the appearance of the image is apt to reduce.

In addition, in the case where $\eta_{K105}/\eta_{K120}$ described above exceeds 50.0, the toner penetrates into the paper, and the chroma of the image reduces, or a fiber of the paper becomes remarkable in the image portion, with the result that the appearance of the image is apt to reduce. In the case of duplex printing, the following problem may arise: an image on a front surface stands on a back surface. Further, hot offset is apt to occur. In the case where $\eta_{K105}/\eta_{K120}$ is less than 3.0, cold offset is apt to occur, or the toner does not undergo sufficient melting and deformation in the fixing step, so the color development property of the toner is not sufficiently exerted, and the representable color gamut of the image reduces in some cases. Further, the front end portion and rear end portion of the paper are apt to differ from each other in image gloss or image color gamut with respect to the travelling direction of the paper in the fixing step, so the appearance of the image is apt to reduce.

Accordingly, the value for $\eta_{K105}$ described above is more preferably 500 to 50,000 Pa·s, or particular preferably 1,000 to 30,000 Pa·s. Similarly, the value for $\eta_{K120}$ described above is more preferably 100 to 10,000 Pa·s, or particularly preferably 400 to 5,000 Pa·s. In addition, $\eta_{K105}/\eta_{K120}$ described above is more preferably 3.0 to 25.0, or particularly preferably 5.0 to 20.0.

The black toner of the present invention has the highest endothermic peak with a differential scanning calorimeter (DSC) at preferably 60 to 140° C. The endothermic peak derives from the melting point of a wax in the toner; the melting and deformation of the toner in the fixing step are significantly promoted when the toner present in an image portion is heated to a temperature equal to or higher than the melting point of the wax. Accordingly, when a toner amount on paper is reduced, the endothermic peak is susceptible to the melting behavior of the wax in the fixing step. In addition, in the case where a fixing process in which no oil application mechanism is present or only a trace amount of oil is applied is employed in the fixing step, when an image is formed while a toner amount on paper is reduced, the amount of the toner present on the paper is small, so the amount of the wax in a toner layer of which the image is constituted also reduces. Accordingly, when an image is formed for one kind of image data with a smaller toner amount than that in the case where the ordinary toner is used, cold offset and hot offset are particularly apt to occur. When the temperature of the highest endothermic peak is lower than 60° C., upon melting of the wax in the fixing step, the wax is apt to dissolve in the binder resin in a large amount, and the melt viscosity of the toner is apt to reduce. As a result, the value for $\eta_{K105}$ or $\eta_{K120}$ described above is apt to decrease, and the value for $\eta_{K105}/\eta_{K120}$ described above is apt to increase. In addition, upon melting of the wax in the fixing step, part of the wax dissolves in the binder resin, and the releasing performance of the toner is apt to reduce. Accordingly, when the toner is used while its consumption is reduced, hot offset is remarkably apt to occur. On the other hand, when the temperature of the highest endothermic peak exceeds 140° C., upon melting of the wax in the fixing step, the amount in which the wax dissolves in the binder resin is remarkably small, so the plasticizing effect of the wax is hardly obtained. As a result, the value for $\eta_{K105}$ or $\eta_{K120}$ described above is apt to increase, and the value for $\eta_{K105}/\eta_{K120}$ described above is apt to decrease. In addition, a wax having the height endothermic peak at a temperature in excess of 140° C. has large crystallinity, so, when a toner amount on paper is reduced, a wax crystal to be mixed in a fixed image has a significant influence on the representable color gamut of an image, and the color gamut is apt to reduce. Accordingly, the highest endothermic peak is placed at more preferably 60° C. to 95° C., or still more preferably 65° C. to 90° C.

By the same reason as that described above, the half width of the highest endothermic peak possessed by the black toner of the present invention is preferably 0.5 to 20.0° C. In addition, in the case where a toner amount on paper is reduced, when the half width exceeds 20.0° C., gloss non-uniformity or density non-uniformity is apt to arise in an image at each of the former half portion and latter half portion of the direction in which the paper is passed. When the half width is less than 0.5° C., offset is apt to occur at the latter half portion of the direction in which the paper is passed. Accordingly, the half width is more preferably 1.0 to 15.0° C., or particularly preferably 2.0 to 10.0° C.

The black toner of the present invention can use a suitable colorant in a suitable addition amount so as to exert the reflection spectral characteristics. The addition amount of the colorant is preferably 8 to 18 parts by mass with respect to 100 parts by mass of the binder resin. A coloring material is preferably incorporated in as small an amount as possible into the toner in order that a running cost may be reduced. However, when the content of the colorant is less than 8 parts by mass, sufficient color development property may not be obtained. In addition, when the content of the colorant exceeds 18 parts by mass, the representable color space of an image may reduce.

In a black toner of the present invention, a relationship between an acid value ($A_K1$) of a first soluble component out of solvent-soluble components extracted from the black toner with isopropanol from initiation of the extraction to 20 mass % with reference to a total mass of the soluble components and an acid value ($A_K2$) of a second soluble component out of the solvent-soluble components in excess of 20 mass % to 100 mass % with reference to the total mass preferably satisfies the following expression 7

$$A_K1 > A_K2 \quad \text{(Ex. 7).}$$

In a developing device, the toner is apt to be damaged by a mechanical stress from a toner carrying member, an electrostatic image bearing member, or any other member. Part of the toner chips, or is broken, to produce a fine powder in some cases. The fine powder adheres to any one of the members to change the charging performance of the toner or to contaminate paper directly, and image appearance is reduced in some cases. In particular, in the case of a black toner having high coloring power like the toner of the present invention, the charging performance of the toner is susceptible to a colorant even when a trace amount of a fine powder adheres, and the extent to which paper is contaminated when a fine powder adheres to the paper is apt to be large. Accordingly, the charging characteristic of the toner of the present invention is preferably controlled more precisely than in the case of a conventional toner. In the present invention, the following procedure is preferably adopted: the surface layer of a toner particle is provided with a resin layer having a higher acid value than that of the inside of the toner particle, and the exposure of the colorant in the toner particle to a toner surface is suppressed. In addition, when the surface layer of the toner particle is provided with the resin layer having a high acid value, a polar group derived from the acid value is considered to act as a charging auxiliary agent, so a charging failure hardly occurs. When the acid value ($A_K1$) of a first soluble component out of solvent-soluble components extracted from the black toner of the present invention with isopropanol from the initiation of the extraction to 20 mass % with reference to the total mass of the soluble components, that is, a component the main component of which is considered to be a resin of which a toner surface layer is formed and the acid value ($A_K2$) of a second soluble component out of the solvent-soluble components in excess of 20 mass % to 100 mass % with reference to the total mass, that is, a component the main component of which is considered to be a resin of which a toner core portion is formed satisfy the expression 7, the first component forms the toner surface layer, whereby the exposure of the colorant to a toner surface is suppressed, and the charging performance of the toner becomes additionally good by virtue of the presence of a large amount of a resin having a large acid value on the toner surface.

$A_K1$ described above is preferably 3.0 to 50.0 mgKOH/g. When $A_K1$ is less than 3.0 mgKOH/g, an improving effect on the charging performance of the toner by virtue of the presence of a component having a high acid value on the surface of the toner is apt to be small. When $A_K1$ exceeds 50.0 mgKOH/g, a polar group derived from the acid value of the component and a polar group in the colorant interact with each other, so the color development property of the toner reduces in some cases. Accordingly, $A_K1$ described above is particularly preferably 5.0 to 30.0 mgKOH/g. In addition, by the same reason as that described above, a difference ($A_K1$-$A_K2$) between $A_K1$ and $A_K2$ is preferably 0.5 to 30.0 mgKOH/g, or more preferably 2.0 to 20.0 mgKOH/g.

$A_K1$ and $A_K2$ described above can be controlled by using two or more kinds of resins having different acid values and controlling the states of presence of the resins in the toner. To be specific, for example, any one of the following methods can be employed: (1) a method involving adding, to the toner, a charge control resin having a large acid value than that of the binder resin out of the charge control resins each having a sulfonic group or a carboxylic group, (2) a method involving forming, near the surface of the toner, a coat layer having a resin having a larger acid value than that of the binder resin out of the resins each having a sulfonic group or a carboxylic group, and (3) a method in which a binder resin having a sulfonic group or a carboxylic group and a high acid value, and a binder resin having a sulfonic group or a carboxylic group and a low acid value are used, and the probability that the binder resin having a high acid value is present is increased by a method such as phase separation from the central portion of the toner toward the surface of the toner.

A black toner of the present invention preferably contains 60.0 to 97.0 mass % of a tetrahydrofuran (THF)-soluble component, and the THF-soluble component contains 0.010 to 1.500 mass % of a sulfur element derived from a sulfonic group. The toner of the present invention is more excellent in color development property than an ordinary toner, and can be used in a reduced amount. The charging characteristic of the toner is preferably set to be larger than that in an ordinary case in order that the amount of the toner to be used in development may be reduced. However, the addition of a large amount of a charge control agent to the toner may reduce the color development property of the toner. When the THF-soluble component of the toner of the present invention contains a predetermined amount of a sulfonic group, the charging characteristic of the toner can be improved without any reduction in color development property of the toner. In addition, the sulfonic group easily undergoes an interaction with the binder resin or any other additive in the toner such as a hydrogen bond or an ionic bond, so the color development property of the toner can be exerted in a particularly favorable manner. Meanwhile, the content of the THF-soluble component in the toner may reduce owing to the polarity of the sulfonic group. Further, when an image is formed while the usage of the toner is reduced as compared to an ordinary case, the offset resistance, gloss uniformity, and penetration resistance of the image are apt to reduce. When the content of the THF-soluble component is less than 60.0 mass %, the color development property of the toner is apt to reduce. When the content of the THF-soluble component exceeds 97.0 mass %, the offset resistance, the gloss uniformity, and the penetration resistance are apt to reduce. In addition, when the content of the sulfur element is less than 0.010 mass %, the extent to which the color development property of the toner is improved may be small. In addition, the amount of the toner to be used in development increases, so dot reproducibility reduces in some cases. When the content of the sulfur element exceeds 1.500 mass %, an interaction between the sulfonic group and the colorant increases, so the color development property of the toner reduces in some cases. In addition, the adsorptivity of the toner to a toner carrying member or an electrostatic image bearing member becomes large, and dot reproducibility reduces in some cases. It should be noted that the content of the above THF-soluble component is more preferably 70.0 to 95.0 mass %, still more preferably 75.0 to 95.0 mass %, or particularly preferably 80.0 to 93.0 mass %. In addition, the content of the above sulfur element derived from the sulfonic group is more preferably 0.010 to 0.500 mass %, still more preferably 0.010 to 0.150 mass %, or particularly preferably 0.020 to 0.100 mass %.

Next, the constitution of a toner preferable for exerting the effects of the present invention to the fullest extent possible will be described. The cyan toner, magenta toner, yellow toner, or black toner of the present invention preferably has a weight-average particle diameter (D4) of 1.5 to 7.5 μm, and a ratio (D4/D1) of D4 described above to a number average particle diameter (D1) of 1.00 to 1.40. When D4 exceeds 7.5 μm, in the case of a toner excellent in color development property like the toner of the present invention, the toner has so large opacifying power that the lightness and chroma of an image will be small in some cases if a sufficient image density is obtained. In addition, the development failure, transfer failure, and fixation failure of one toner particle have so large influences on image appearance that, at the time of continuous printing, an image in which coarseness is remarkable at a halftone portion and a solid image portion fades is apt to be obtained. When the toner is crashed excessively in the fixing step, a dot or a line becomes thick, so faithfulness to image data is apt to reduce. On the other hand, in the case of a toner having D4 of less than 1.5 μm, a transfer failure is apt to be produced, and, when a toner amount on paper is reduced, an image defect is remarkably apt to be produced. In addition, the toner transferred onto the paper is apt to crawl into a fiber of the paper, and, when the toner amount on the paper is reduced, the toner is apt to penetrate into the paper in the fixing step. Accordingly, the toner of the present invention has D4 of more preferably 2.5 to 6.5 μm, still more preferably 2.5 to 6.0 μm, or particularly desirably 3.0 to 5.5 μm. When D4/D1 exceeds 1.40 as well, phenomena similar to those occurring when D4 described above exceeds 7.5 μm and when D4 is less than 1.5 μm are apt to occur. Accordingly, D4/D1 is more preferably 1.00 to 1.25, or still more preferably 1.00 to 1.20.

The toner for each color of the present invention contains toner particles each having a particle diameter more than twice as large as the weight-average particle diameter (D4) at a content of preferably 25 mass % or less. When the toner is used while a toner amount on paper is reduced, an influence of a toner particle having a particle diameter largely deviating from the average particle diameter of the toner is apt to be large. When the content of toner particles each having a particle diameter more than twice as large as D4 exceeds 25.0 mass %, microscopic density non-uniformity is apt to arise in an image portion, and the chroma and lightness of an image are apt to reduce. The transfer failure or scattering of a coarse particle is also apt to show a remarkable image failure, and the reproducibility of a dot or line is apt to reduce. Accordingly, the toner for each color of the present invention contains toner particles each having a particle diameter more than twice as large as D4 of more preferably 15.0 mass % or less, or still more preferably 10.0 mass % or less.

In addition, the toner for each color of the present invention contains toner particles each having a particle diameter less than one half of the number average particle diameter (D1) at a content of preferably 30.0 number % or less. When the content of toner particles each having a particle diameter less than one half of D1 exceeds 30.0 number %, electrostatic offset or the contamination of a member is apt to occur. A fine particle in such toner is apt to cause a transfer failure, and, when a toner amount on paper is reduced, an image defect becomes remarkable. In addition, the toner transferred onto the paper is apt to crawl into a fiber of the paper, so an excessive amount of the toner is needed for the formation of an image having a sufficient image density. Accordingly, the toner of the present invention contains toner particles each having a particle diameter less than one half of D1 at a content of more preferably 20.0 number % or less, or still more preferably 10.0 number % or less.

When the true density of the toner for each color of the present invention is represented by $\rho_T$(g/cm$^3$), the endotherm (Q) of the highest endothermic peak preferably falls within the range of $(1.0\times\rho_T)$ J/cm$^3$ to $(20.0\times\rho_T)$ J/cm$^3$. The endotherm serves as an index showing the content of a wax in the toner. In order that a running cost may be reduced, the content of the wax in the toner is preferably small, so a value for Q described above is preferably as small as possible. However, in order that the toner may be used while a toner amount on paper is reduced, when Q is less than $(1.0\times\rho_T)$ J/cm$^3$, the amount of the wax present on the paper becomes small in the fixing step, so sufficient releasing performance cannot be obtained, and offset is apt to occur. On the other hand, when Q exceeds $(20.0\times\rho_T)$ J/cm$^3$, the endotherm of the toner is large, so, when the toner is used while a toner amount on the paper is reduced, cold offset is apt to occur. Further, the color development of a colorant in a toner layer is obstructed by the crystal of the wax in the toner at an image portion, and the chroma of an image reduces in some cases. Accordingly, the range of Q is more preferably $(4.0\times\rho_T)$ J/cm$^3$ to $(15.0\times\rho_T)$ J/cm$^3$, or particularly preferably $(6.0\times\rho_T)$ J/cm$^3$ to $(10.0\times\rho_T)$ J/cm$^3$.

By the same reason as that described above, the toner for each color of the present invention contains the wax in an amount of preferably 3.0 to 20.0 parts by mass, more preferably 4.0 to 15.0 parts by mass, or still more preferably 5.0 to 13.0 parts by mass with respect to 100 parts by mass of a binder resin.

The toner for each color of the present invention contains a component having a molecular weight of 3,000 to 5,000 at a content of preferably 3.0 to 40.0 area % in a molecular weight distribution by the gel permeation chromatography (GPC) of a tetrahydrofuran (THF)-soluble component. In a developing device, the toner is apt to be damaged by a mechanical stress from a toner carrying member, an electrostatic image bearing member, or any other member. Part of the toner chips, or is broken, to produce a fine powder in some cases. The fine powder adheres to any one of the members to change the charging performance of the toner or to contaminate paper directly, and image appearance is reduced in some cases. In particular, in the case of a toner having high coloring power like the toner of the present invention, the charging performance of the toner is susceptible to a colorant even when a trace amount of a fine powder adheres, and the extent to which paper is contaminated when a fine powder adheres to the paper is apt to be large. On the other hand, when such toner having high coloring power as that described above is used while a toner amount on paper is reduced, cold offset and hot offset are apt to occur. Alternatively, the toner excessively penetrates into the paper in the fixing step, with the result that image gloss and an image color gamut are apt to reduce. Accordingly, the molecular weight of a binder resin of which the toner is mainly composed is preferably controlled more precisely than in an ordinary case. When the content of the component having a molecular weight of 3,000 to 5,000 exceeds 40.0 area %, the crystallinity of the binder resin becomes high, so the toner is apt to crack in a developing device, and the developing performance of the toner is apt to reduce at the time of continuous printing. When the content of the component having a molecular weight of 3,000 to 5,000 is less than 3.0 area %, the fixing performance of the toner reduces, and cold offset is apt to occur. In addition, an affinity between the wax and the binder resin becomes small, with the result that the toner is apt to crack with an interface between the binder resin and the wax in the toner as a base point. Accordingly, the content of the component having a molecular weight of 3,000 to 5,000 is more preferably 5.0 to 40.0 area %, or particularly preferably 8.0 to 35.0 area %.

By the same reason as that described above, the toner for each color of the present invention contains a component having a molecular weight of 300 to 800 at a content of preferably 0.3 to 8.0 area % in the molecular weight distribution by the GPC of the THF-soluble component. When the content of the component having a molecular weight of 300 to 800 exceeds 8.0 area %, the toner is apt to crack in a developing device, and the developing performance of the toner is apt to reduce at the time of continuous printing. In addition, the toner excessively penetrates into paper, with the result that image gloss and an image color gamut are apt to reduce. When the content of the component having a molecular weight of 300 to 800 is less than 0.3 area %, the fixing performance of the toner reduces, and cold offset is apt to occur. In addition, an affinity between the wax and the binder resin becomes small, with the result that the toner is apt to crack with an interface between the binder resin and the wax in the toner as a base point. Accordingly, the content of the component having a molecular weight of 300 to 800 is more preferably 0.3 to 5.0 area %, or particularly preferably 0.5 to 3.5 area %.

The content of the component having a molecular weight of 3,000 to 5,000 and the content of the component having a molecular weight of 300 to 800 described above can each be controlled depending on the content of a component having any such molecular weight as described above in the binder resin or any other additive in the toner. In addition, the contents can each be controlled depending on heating conditions, cooling conditions, or decompression conditions at the time of kneading or a polymerization reaction. The contents can each be adjusted also by controlling, for example, the heating conditions and the cooling conditions with a surface modification apparatus.

It is also preferable to add a solvent capable of dissolving a resin to be used as the binder resin or as any other additive such as toluene or xylene at the time of the production of the resin. The content of the component having a molecular weight of 3,000 to 5,000 can be suitably adjusted by reducing the viscosity of a reaction system to advance the polymerization reaction quickly. In addition, the resin does not solidify in the latter half of the polymerization reaction, so the polymerization reaction can be sufficiently advanced, and the content of the component having a molecular weight of 300 to 800 can be suitably adjusted.

When toner particles are produced by a polymerization method, the content of a component having any such molecular weight as described above can be adjusted by, for example, the addition amount of a polymerization initiator, a heating temperature during the polymerization reaction, and a heating step and a decompression step after the polymerization reaction. It is also preferable that such method and the method of adding the solvent be employed in combination.

When the toner particles are produced by a production method involving the use of a resin as a raw material such as: a wet granulation method such as the so-called solution suspension; a dry granulation method typified by a kneading pulverization method; or a method involving performing granulation by drying a resin dissolved in a solvent such as a spray dry method, it is also preferable that the resin be washed with a solvent having a lower alcohol such as methanol or ethanol after having been produced. When one attempts to increase the content of the component having a molecular weight of 3,000 to 5,000 in the resin, the content of the component having a molecular weight of 300 to 800 is also apt to be large in association with the increase. Washing such resin with the above solvent having a lower alcohol can reduce the content of an unreacted monomer or oligomer, and allows the content of the component having a molecular weight of 300 to 800 to be suitably adjusted.

The toner for each color of the present invention has an average circularity of preferably 0.940 to 0.995. In a developing device, the toner is apt to be damaged by a mechanical stress from a toner carrying member, an electrostatic image bearing member, or any other member. Part of the toner chips, or is broken, to produce a fine powder in some cases. The fine powder adheres to any one of the members to change the charging performance of the toner or to contaminate paper directly, and image appearance is reduced in some cases. In particular, in the case of a toner having high coloring power like the toner of the present invention, the charging performance of the toner is susceptible to a colorant even when a trace amount of a fine powder adheres, and the extent to which paper is contaminated when a fine powder adheres to the paper is apt to be large. When the average circularity is less than 0.940, a protruded portion of the toner is apt to chip, and an image failure is apt to be produced at the time of continuous printing. On the other hand, when the average circularity exceeds 0.995, an image defect is apt to be produced owing to a cleaning failure. Accordingly, the average circularity is more preferably 0.955 to 0.990, or particularly preferably 0.965 to 0.988.

In addition, by the same reason as that described above, the toner for each color of the present invention has a standard deviation of circularities of preferably 0.005 to 0.045. The reason for the foregoing is as described below. Any one of the toner particles of the toner of the present invention has larger color developing power than that of an ordinary toner in order that a toner amount on paper may be reduced. Accordingly, the toner is susceptible to a toner particle having a circularity largely deviating from the value for the average circularity.

Examples of the wax to be used in the present invention include the following. An aliphatic hydrocarbon-based wax such as a low-molecular-weight polyethylene, a low-molecular-weight polypropylene, an olefin copolymer, a microcrystalline wax, a paraffin wax, or a Fischer-Tropsch wax; an oxide of the aliphatic hydrocarbon-based wax such as an oxidized polyethylene wax and block copolymers thereof; a wax mainly composed of an fatty acid ester such as a carnauba wax and a montanate wax; and a wax obtained by deoxidizing part of or whole fatty acid ester, such as a deoxidized carnauba wax.

Further examples include a saturated linear fatty acid such as palmitic acid, stearic acid, or montanic acid; an unsaturated fatty acid such as brassidic acid, eleostearic acid, or parinaric acid; a saturated alcohol such as stearyl alcohol, aralkyl alcohol, behenyl alcohol, carnaubyl alcohol, ceryl alcohol, or mericyl alcohol; a polyalcohol such as sorbitol; a fatty acid amide such as amide linoleate, amide oleate, or amide laurate; a saturated fatty acid bisamide such as methylenebis amide stearate, ethylenebis amide caprate, ethylenebis amide laurate, or hexamethylenebis amide stearate; an unsaturated fatty acid amide such as ethylenebis amide oleate, hexamethylenebis amide oleate, N,N'-dioleyl amide adipate, or N,N'-dioleyl amide sebacate; an aromatic bisamide such as m-xylenebis amide stearate or N,N'-distearyl amide isophthalate; a fatty acid metal salt (which is generally referred to as "metal soap") such as calcium stearate, calcium laurate, zinc stearate, or magnesium stearate; a graft wax obtained by subjecting an aliphatic hydrocarbon wax to graft reaction with a vinyl monomer such as styrene or acrylic acid; a partial esterified product obtained from reaction of a fatty acid and a polyalcohol, such as monoglyceride behenate; and a methylester compound having a hydroxyl group, which is obtained by hydrogenating a vegetable oil.

The particularly preferred wax to be used in the present invention is an aliphatic hydrocarbon-based wax. Preferred examples of the wax include: a low-molecular-weight olefin polymer obtained by radical polymerization of an olefin under a high pressure or by polymerization of an olefin with a Ziegler catalyst or a metallocene catalyst under a low pressure; Fisher-Tropsch wax synthesized from coal or natural gas; an olefin polymer obtained by heat decomposition of a high-molecular-weight olefin polymer; and a synthetic hydrocarbon wax obtained from a distillation residue of a hydrocarbon obtained from a synthetic gas containing carbon monoxide and hydrogen by the Arge method, or a synthetic hydrocarbon wax obtained by hydrogenation thereof. The hydrocarbon wax separated by a press sweating method, a solvent method, a vacuum distillation or a fractional crystallization mode is more preferably used.

A hydrocarbon as a component for a hydrocarbon wax is preferably a hydrocarbon synthesized by a reaction between carbon monoxide and hydrogen using a metal oxide catalyst (multiple system composed of two or more kinds in many cases) [such as a hydrocarbon compound synthesized by a synthol method or a hydrocol method (involving the use of a fluid catalyst bed)], a hydrocarbon having up to several hundreds of carbon atoms obtained by an Arge method (involving the use of an identification catalyst bed) with which a large amount of a wax-like hydrocarbon can be obtained, a hydrocarbon obtained by polymerizing an alkylene such as ethylene with a Ziegler catalyst, or a paraffin wax because any such hydrocarbon is a saturated, long linear hydrocarbon with a small number of small branches. A wax synthesized by a method not involving the polymerization of an alkylene is particularly preferable because of its molecular weight distribution.

The molecular weight of the wax is preferably as follows: a main peak is present in the molecular weight region of 350 to 2,000. The wax preferably has a weight-average molecular weight of 400 to 3,000, and a number average molecular weight of 300 to 1,800. Providing the wax with any such molecular weight can impart preferable heat characteristics to the toner. The molecular weight of the wax can be adjusted depending on the kind of the wax to be used and conditions under which the wax is produced.

In the present invention, preferable production steps for the toner include: a first kneading step (so-called master batch treatment) of kneading raw materials to provide a first kneaded product; and a second kneading step of kneading the first kneaded product and other added materials to provide a finely dispersed colorant composition. The wax in the present invention may be added simultaneously with materials including a binder at the time of the second kneading step, but the wax is preferably added in advance in the state of a wax dispersant to a resin composition in order that a colorant may be dispersed in the toner in an additionally fine fashion and a granular touch in a low-density region may be alleviated.

The wax dispersant contains the wax and a wax dispersion medium, and the wax dispersion medium, which is a product as a result of a reaction between polyolefin and a vinyl polymer, is more preferably obtained by grafting the vinyl polymer to the polyolefin. In addition, a wax dispersant master batch obtained by melting and mixing the resultant wax dispersant and a polyester resin at an appropriate compounding ratio in advance is more preferable because the extent to which the colorant is dispersed in the second kneading step is improved.

Hereinafter, the wax dispersant will be described in detail.

The wax dispersant desirably has a wax dispersion medium having at least: a vinyl polymer synthesized by using one or two or more kinds of vinyl monomers; and polyolefin.

Further, a "wax dispersant master batch" obtained by melting the wax dispersant and mixing the molten dispersant in a polyester resin is desirably added in the second kneading step at the time of toner production.

Examples of the vinyl monomer to be used as the wax dispersion medium include: styrenes such as styrene, o-methylstyrene, m-methylstyrene, p-methylstyrene, p-methoxystyrene, p-phenylstyrene, p-chlorstyrene, 3,4-dichlorstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, and derivatives thereof; α-methylene aliphatic monocarboxylic acids and esters thereof such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylic esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; and acrylate or methacrylate derivatives such as acrylonitrile, methacrylonitrile, and acrylamide.

Further, examples of the vinyl monomer include: unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; unsaturated basic acid half esters such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated basic acid esters such as dimethyl maleate and dimethyl fumarate; acid anhydrides of α,β-unsaturated acids such as acrylic acid, methacrylic acid, crotonic acid, and cinnamic acid; α,β-unsaturated anhydrides such as crotonic and cinnamic anhydride and anhydrides of the above-mentioned α,β-unsaturated acids and lower aliphatic acids; and monomers each having a carboxyl group such as alkenylmalonic acid, alkenylglutaric acid, and alkenyladipic acid, and acid anhydrides thereof and monoesters thereof.

Further, examples of the vinly monomer include: acrylic esters or mathacrylic esters such as 2-hydroxyethyl acrylate, 2-hydroxyethyl methacrylate, and 2-hydroxypropyl methacrylate; and monomers each having a hydroxyl group such as 4-(1-hydroxy-1-methylbutyl) styrene and 4-(1-hydroxy-1-methylhexyl) styrene.

Of those, a copolymer of styrene and a nitrogen-containing acrylate or methacrylate is particularly preferable.

In the molecular weight distribution of a wax dispersion medium having at least a vinyl polymer synthesized by using a vinyl monomer and polyolefin by GPC, a weight-average molecular weight (Mw) is preferably 5,000 to 100,000, a number average molecular weight (Mn) is preferably 1,500 to 15,000, and a ratio (Mw/Mn) of the weight-average molecular weight (Mw) to the number average molecular weight (Mn) is preferably 2 to 40 because of the following reasons.

When the weight-average molecular weight (Mw) of the wax dispersion medium is less than 5,000, the number average molecular weight (Mn) of the wax dispersion medium is less than 1,500, or the ratio (Mw/Mn) of the weight-average molecular weight (Mw) to the number average molecular weight (Mn) is less than 2, the storage stability of the toner may be affected.

When the weight-average molecular weight (Mw) of the wax dispersion medium exceeds 100,000, the number average molecular weight (Mn) of the wax dispersion medium exceeds 15,000, or the ratio (Mw/Mn) of the weight-average molecular weight (Mw) to the number average molecular weight (Mn) exceeds 40, the wax finely dispersed in the wax dispersant cannot rapidly migrate toward the surface of a molten toner at the time of fixation and melting, and an effect of the wax cannot be sufficiently exerted in some cases.

The polyolefin in the wax dispersion medium preferably has a local maximum value for the highest endothermic peak at 80 to 140° C. in an endothermic curve at the time of temperature increase measured with a DSC.

When the local maximum value for the highest endothermic peak of the polyolefin is placed at a temperature lower than 80° C. or at a temperature in excess of 140° C., in any case, a branched structure (graft) formed of the polyolefin and the copolymer synthesized by using a vinyl monomer is lost. Accordingly, the hydrocarbon wax is not finely dispersed, and the segregation of the hydrocarbon wax occurs when a toner is produced, with the result that image failures such as blank dots may be produced. Examples of the polyolefin include polyethylene and an ethylene-propylene copolymer; of those, in particular, low-density polyethylene is most preferably used in terms of the efficiency of a reaction between the copolymer and the polyolefin.

The tetrahydrofuran (THF)-soluble component in the toner for each color of the present invention has an acid value of preferably 0.1 to 50.0 mgKOH/g. Since the toner of the present invention has a large colorant content, the dispersing performance of a colorant in the toner is apt to reduce. However, setting the acid value of a binder resin within the above range improves the dispersing performance of the colorant, and improves the color development property and fixing performance of the toner.

Any one of various resins known as conventional binder resins for electrophotography is used as a binder resin to be used in the cyan toner, magenta toner, yellow toner, or black toner of the present invention. It is preferable that the binder resin be mainly composed of a resin selected from (a) a polyester resin, (b) a hybrid resin having a polyester unit and a vinyl copolymer unit, (c) a mixture of a hybrid resin and a vinyl copolymer, (d) a mixture of a hybrid resin and a polyester resin, (e) a mixture of a polyester resin and a vinyl copolymer, and (f) a mixture of a polyester resin, a hybrid resin having a polyester unit and a vinyl copolymer unit, and a vinyl copolymer out of the various resins.

When a polyester resin is used as the binder resin, a polyhydric alcohol and, for example, a polycarboxylic acid, a polycarboxylic acid anhydride, or a polycarboxylate can be used as raw material monomers.

Examples of the dihydric alcohol component include: alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol; diethylene glycol; triethylene glycol; 1,2-propyleneglycol; 1,3-propyleneglycol; 1,4-butanediol; neopentyl glycol; 1,4-butenediol; 1,5-pentanediol; 1,6-hexanediol; 1,4-cyclohexanedimethanol; dipropylene glycol; polyethylene glycol; polypropylene glycol; polytetramethylene glycol; bisphenol A; and hydrogenated bisphenol A.

Examples of the alcohol component having three or more hydroxyl groups include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of the polycarboxylic acid component include: aromatic dicarboxylic acids such as phtalic acid, isophtalic acid, and terephtalic acid, and anhydrides thereof; alkyldicarboxylic acids such as succinic acid, adipic acid, sebacic acid, and azelaic acid, and anhydrides thereof; succinic acids substituted by an alkyl group having 6 to 12 carbon atoms, and anhydrides thereof; unsaturated dicarboxylic acids such as fumaric acid, maleic acid, and citraconic acid, and anhydrides thereof; and n-dodecenylsuccinic acid and indodecenylsuccinic acid can be given.

Of those, in particular, a polyester resin obtained by condensation polymerization using a bisphenol derivative represented by the following general formula (1) as a diol component and using a carboxylic acid component of divalent carboxylic acid, anhydride thereof, or lower alkyl ester thereof (such as fumaric acid, maleic acid, maleic anhydride, phthalic acid, and terephthalic acid) as an acid component is preferred because the resin or unit serving as a color toner exhibits excellent charging property.

[Chem 1]

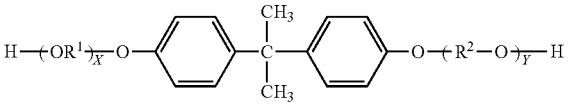

Examples of the polycarboxylic acid component having three or more hydroxyl groups for forming a polyester resin having a crosslinking site include 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, or anhydrides and ester compounds thereof.

The amount of the polycarboxylic acid component having three or more hydroxyl groups to be used is preferably 0.1 to 1.9 mol % based on the amount of total monomers. Moreover, in the case of using a hybrid resin including a polyester unit, which is a polycondensate of a polyhydric alcohol and a polybasic having ester bonds in a main chain, and a vinyl polymer unit, which is a polymer having an unsaturated hydrocarbon base, as the binder resin, further improved wax dispersibility and enhanced low temperature fixability and offset resistance can be expected. The hybrid resin used in the present invention refers to a resin in which a vinyl polymer unit and a polyester unit are chemically bonded to each other. Specifically, a polyester unit and a vinyl polymer unit obtained by polymerizing a monomer having a carboxylate group such as a (meth)acrylate form the resin through an ester exchange reaction. Preferably, the polyester unit and the vinyl polymer form a graft copolymer (or block copolymer) in which the vinyl polymer serves as a backbone polymer and the polyester unit serves as a branch polymer.

Examples of the vinyl monomers for forming the vinyl polymer include: styrene such as styrene, o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, p-nitrostyrene, and derivatives thereof; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylate or methacrylate derivatives such as acrylonitrile, methacrylonitrile, and acrylamide.

Further, examples of the vinyl monomers for forming the vinyl polymer include: unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; unsaturated dibasic acid half esters such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester, and mesaconic acid methyl half ester; unsaturated dibasic acid esters such as dimethyl maleate and dimethyl fumarate; α,β-unsaturated acids such as acrylic acid, methacrylic acid, crotonic acid, and cinnamic acid; α,β-unsaturated anhydrides such as crotonic anhydride and cinnamic anhydride; anhydrides of the above-mentioned α,β-unsaturated acids and lower aliphatic acids; and monomers each having a carboxyl group such as alkenylmalonic acid, alkenylglutaric acid, and alkenyladipic acid, acid anhydrides thereof, and monoesters thereof.

Further, examples of the vinyl monomers for forming the vinyl polymer include: acrylates or methacrylates such as 2-hydroxyethyl acrylate, 2-hydroxyethyl methacrylate, and 2-hydroxypropyl methacrylate; and monomers having hydroxy groups such as 4-(1-hydroxy-1-methylbutyl)styrene and 4-(1-hydroxy-1-methylhexyl)styrene.

In the toner for each color of the present invention, the vinyl polymer units of binder resins may have a crosslinking structure crosslinked with a crosslinking agent having two or more vinyl groups. Examples of the crosslinking agent to be used in this case include: aromatic divinyl compounds such as divinylbenzene and divinylnaphthalene; diacrylate compounds bonded together with an alkyl chain, such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those obtained by changing the "acrylate" of each of the aforementioned compounds to "methacrylate"; diacrylate compounds bonded together with an alkyl chain containing an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by changing the "acrylate" of each of the aforementioned compounds to "methacrylate"; and diacrylate compounds bonded together with a chain containing an aromatic group and an ether bond, such as polyoxyethylene(2)-2,2-bis(4-hydroxyphenyl)propane diacrylate, polyoxyethylene(4)-2,2-bis(4-hydroxyphenyl)propane diacrylate, and those obtained by changing the "acrylate" of each of the aforementioned compounds to "methacrylate".

Examples of the polyfunctional crosslinking agents include: pentaerythritol triacrylate, trimethylolethane triacrylate, trimethylolpropane triacrylate, tetramethylolmethane tetraacrylate, oligoester acrylate, and those obtained by changing the "acrylate" of the aforementioned compounds to "methacrylate"; and triallyl cyanurate and triallyl trimellitate.

When the hybrid resin is used in the present invention, at least one of a vinyl polymer unit and a polyester unit preferably contains a monomer component capable of reacting with both the resin components. Examples of a monomer capable of reacting with the vinyl polymer unit among the monomers each constituting the polyester unit include unsaturated di carboxylic acids such as phthalic acid, maleic acid, citraconic acid, and itaconic acid, and anhydrides of the acids. Examples of a monomer capable of reacting with the polyester unit among the monomers each constituting the vinyl polymer unit include vinyl monomers each having a carboxyl group or a hydroxyl group, and acrylates or methacrylates.

A method of obtaining a product as a result of a reaction between a vinyl polymer unit and a polyester unit is preferably a method involving subjecting one or both resin of the above-mentioned vinyl polymer unit and polyester unit to a polymerization reaction in the presence of a polymer containing a monomer component capable of reacting with each of the units.

Examples of the polymerization initiators to be used in the production of the vinyl polymer of the present invention include 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methylpropane), ketone peroxides such as methyl ethyl ketone peroxide, acetylacetone peroxide, and cyclohexanone peroxide, 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, dicumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxyisopropyl carbonate, di-t-butyl peroxyisophthalate, t-butyl peroxyallylcarbonate, t-amyl peroxy-2-ethylhexanoate, di-t-butyl peroxyhexahydroterephthalate, and di-t-butyl peroxyazelate.

Examples of a method of preparing a hybrid resin to be used in the toner for each color of the present invention include the following methods described in the items (1) to (6).

(1) An ester compound can be used as the hybrid resin component, which is synthesized by separately producing a vinyl polymer and a polyester resin, dissolving and swelling the vinyl polymer and the polyester resin in a small amount of organic solvent, adding an esterification catalyst and alcohol to the solution, and heating the mixture to carry out an ester exchange reaction.

(2) A method in which a polyester unit and a hybrid resin component are produced in the presence of a vinyl polymer after the production of the vinyl polymer. The hybrid resin component is produced by a reaction between the vinyl polymer unit (a vinyl-based monomer may be added as required) and one or both of a polyester monomer (for example, alcohol or a carboxylic acid) and polyester. An organic solvent can be used as appropriate in this case as well.

(3) A method in which a vinyl polymer and a hybrid resin component are produced in the presence of a polyester unit after the production of the polyester unit. The hybrid resin component is produced by a reaction between one or both of the polyester unit (a polyester monomer may be added as required) and a vinyl-based monomer.

(4) A method of producing a hybrid resin component including: producing a vinyl polymer unit and a polyester unit; and adding one or both of a vinyl-based monomer and a polyester monomer (for example, alcohol or a carboxylic acid) in the presence of those polymer units. An organic solvent can be used as appropriate in this case as well.

(5) A method in which, after the production of a hybrid resin component, one or both of a vinyl-based monomer and a polyester monomer (for example, alcohol or a carboxylic acid) is added to carry out one or both of addition polymerization and a condensation polymerization reaction to thereby produce a vinyl polymer unit and a polyester unit. In this case, a hybrid resin component produced by any one of the production methods described in the above items (2) to (4) can also be used, and also one produced by a known production method can be used as required. In addition, an organic solvent can be used as appropriate.

(6) A method in which a vinyl-based monomer and a polyester monomer (for example, alcohol or a carboxylic acid) are mixed to successively carry out addition polymerization and a condensation polymerization reaction to thereby produce a vinyl polymer unit, a polyester unit, and a hybrid resin component. In addition, an organic solvent can be used as appropriate.

In each of the production methods described in the above items (1) to (5), multiple polymer units different from each other in molecular weight and in degree of crosslinking can be used for each of the vinyl polymer unit and the polyester unit.

It should be noted that a mixture of the above polyester resin and a vinyl polymer, a mixture of the above hybrid resin and a vinyl polymer, or a mixture of the above polyester resin, the above hybrid resin, and a vinyl polymer may be used as the binder resin to be incorporated into the toner for each color of the present invention.

The toner for each color of the present invention has tetrahydrofuran (THF)-insoluble matter at a content of preferably 5 to 90 mass %, more preferably 5 to 70 mass %, or still more preferably 5 to 50 mass %. This is because a balance between storage stability or development stability and low-temperature fixability is additionally improved.

In the present invention, an available charge control agent to be incorporated in the toner may be any of those known in the art. In particular, a metallic compound of an aromatic carboxylic acid is preferred because it has no color, has a high toner charge speed, and can maintain a constant charge amount stably.

Examples of a negative charge control agent to be used include a metallic compound of salicylic acid, a metallic compound of naphthoic acid, a metallic compound of dicarboxylic acid, a high-molecular compound having sulfonic acid or carboxylic acid in the side chain, a boron compound, a urea compound, a silicon compound, and a calixarene. Examples of a positive charge control agent to be used include a quaternary ammonium salt, a high-molecular compound having the quaternary ammonium salt in the side chain, a guanidine compound, and an imidazole compound. Of those, aluminium 3,5-di-tert-butylsalicylate is particularly preferred because it exhibits rapid rise in charge amount. The charge control agent may be added to toner particles internally or externally. The amount of the charge control agent to be added is preferably 0.5 to 10 parts by mass with respect to 100 parts by mass of a binder resin.

Of those, a compound having the following characteristics is preferable: the compound has a sulfonic group and an amide bond, has, between the sulfonic group and the amide bond, an alkyl, ether, or aryl group having 1 to 12 carbon atoms, and has an amide sulfonic group. Specific examples of the compound include compounds each having an amide sulfonic group represented by the following general formula (2).

[Chem 2]

$$A1\text{-}B1\text{-}SO_3R1 \quad (2)$$

(In the formula, B1 represents an aromatic ring, alkyl group having 2 to 12 carbon atoms, or ether group having 2 to 12 carbon atoms which may have a substituent, and the substituent is a hydrogen atom, a hydroxyl group, or an alkyl, aryl, or alkoxy group having 1 to 12 carbon atoms, R1 represents a hydrogen atom, an alkali metal ion, a quaternary ammonium ion, or an alkyl or aryl group having 1 to 12 carbon atoms, and A1 represents an amide bond.)

As the compound having a sulfonic amide group, a copolymer of a sulfonic group-containing (meth)acrylamide and another vinyl monomer is preferably exemplified. Specific examples of preferable sulfonic group-containing (meth) acrylamide include 2-acrylamide-2-methylpropane sulfonic acid, its alkali salts, 2-acrylamide-2-methylpropane methyl sulfonate, 2-acrylamide-2-methylpropane ethyl sulfonate, 2-acrylamide-2-methylpropane propyl sulfonate, and a compound represented by the following general formula (3).

[Chem 3]

(3)

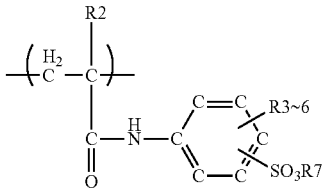

(In the formula, R2 represents a hydrogen atom or a methyl group, R3 to R6 each independently represent a hydrogen atom, a hydroxyl group, or an alkyl or alkoxy group having 1 to 6 carbon atoms, and two adjacent groups of R3 to R6 may form a five- or six-membered aromatic ring, and R7 represents an alkyl group having 1 to 4 carbon atoms.)

When the compound having an amide sulfonic group is a resin having an amide sulfonic group, the content of monomer units each containing an amide sulfonic group in the resin is preferably 1.0 to 30.0 mol %.

In toner particles each containing a resin where the monomer units each containing an amide sulfonic group are present in an appropriate amount, the balance of the charge of the toner and the balance of the dispersion of an internal additive can be appropriately adjusted. When the content of the monomer units each containing an amide sulfonic group in the resin is less than 1 mol %, an effect of a sulfonic group may not be sufficiently exerted. On the other hand, when the content exceeds 30 mol %, the charge of the toner is apt to be non-uniform, and fogging or the like is apt to occur.

The content of an amide sulfonic compound in the toner for each color of the present invention is preferably 0.5 to 15.0 mass % with respect to the entirety of the toner. The presence of an appropriate amount of the amide sulfonic compound in the toner allows the charge of the toner or the balance of the dispersion of an internal additive to be appropriately adjusted. When the content is less than 0.5 mass %, an effect of a sulfonic group may not be sufficiently exerted. On the other hand, when the content exceeds 15.0 mass %, the amount in which sulfonic groups are present in the toner is so large that an effect of any other internal additive may be small.

In the present invention, a known additive can be externally added to each of the toner particles; it is particularly preferable that a fluidity improver be externally added in terms of an improvement in image quality and storage stability under a high-temperature environment. An inorganic fine powder made of, for example, silica, titanium oxide, or aluminum oxide is a preferable fluidity improver. The inorganic fine powder is preferably made hydrophobic with a hydrophobic agent such as a silane compound or silicone oil, or a mixture of them.

Examples of the hydrophobic agent include: coupling agents such as a silane compound, a titanate coupling agent, an aluminium coupling agent, and a zircoaluminate coupling agent.

Specifically, a compound represented by the general formula (4) is preferable as the silane compound. Examples of the silane compound include hexamethyldisilazane, vinyltrimethoxysilane, vinyltriethoxysilane, γ-methacryloxypropyltrimethoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, and n-octadecyltrimethoxysilane. The amount to be made hydrophobic is preferably 1 to 60 parts by mass, more preferably 3 to 50 parts by mass with respect to 100 parts by mass of the inorganic unhydrophobed powder.

[Chem 4]

$$R_mSiY_n \qquad \text{General formula (4)}$$

[In the formula, R represents an alkoxy group, m represents an integer of 1 to 3, Y represents an alkyl group, a vinyl group, a phenyl group, a methacryl group, an amino group, an epoxy group, a mercapto group, or derivatives thereof, and n represents an integer of 1 to 3]

In the present invention, of those fluidity improvers, an alkylalkoxysilane represented by a general formula (5) is particularly suitably used in a hydrophobic treatment for the surface of the inorganic fine powder. The case where n represents less than 4 in the alkylalkoxysilane is not preferable because the treatment can be easily performed, but the extent to which the surface is made hydrophobic is low. When n represents more than 12, the surface shows sufficient hydrophobicity, but the frequency at which titanium oxide fine particles coalesce increases, and the fluidity-improving ability of the improver is apt to reduce. When m represents more than 3, the reactivity of the alkylalkoxysilane reduces, so it becomes difficult to make the surface hydrophobic favorably. It is more preferable that, in the alkylalkoxysilane, n represent 4 to and m represent 1 or 2. The treatment amount of the alkylalkoxysilane is preferably 1 to 60 parts by mass, or more preferably 3 to 50 parts by mass with respect to 100 parts by mass of the inorganic fine powder.

[Chem 5]

$$C_nH_{2n+1}\text{—Si—}(OC_mH_{2m+1})_3 \qquad \text{General formula (5)}$$

[In the formula, n represents an integer of 4 to 12, and m represents an integer of 1 to 3.]

The fluidity improver may be subjected to a hydrophobic treatment with one kind of a hydrophobic agent alone, or may be subjected to a hydrophobic treatment with two or more kinds of hydrophobic agents used in combination. For example, the agent may be subjected to a hydrophobic treatment with one kind of a hydrophobic agent alone. Alternatively, the agent may be subjected to a hydrophobic treatment with two or more kinds of hydrophobic agents simultaneously, or may be subjected to a hydrophobic treatment with one kind of a hydrophobic agent and then subjected to an additional hydrophobic treatment with another hydrophobic agent.

The fluidity improver is added in an amount of preferably 0.01 to 5 parts by mass, or more preferably 0.05 to 3 parts by mass with respect to 100 parts by mass of the toner particles.

A cyan colorant that can be used in the present invention is, for example, a copper phthalocyanine or a derivative of the compound, an anthraquinone compound, or abase dye lake compound. A colorant that can be particularly suitably utilized is, specifically, C.I. Pigment Blue 1, 2, 3, 7, 15, 15:1, 15:2, 15:3, 15:4, 16, 17, 60, 62, or 66, C.I. Vat Blue 6, C.I. Acid Blue 45, a copper phthalocyanine pigment having a structure represented by the following general formula (6), or the like.

[Chem 6]

General Formula (6)

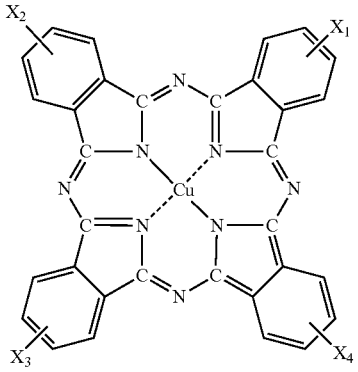

(In the general formula (6), X1 to X4 each represent

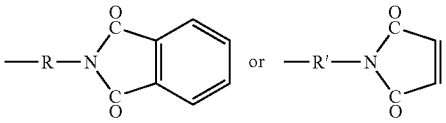

or —H, and R and R' each represent an alkylene group having 1 to 5 carbon atoms provided that the case where all of X1 to X4 each represent —H is excluded.)

To be specific, for example, a compound represented by a formula (7) can be used as a compound represented by the above general formula.

[Chem 7]

Formula (7)

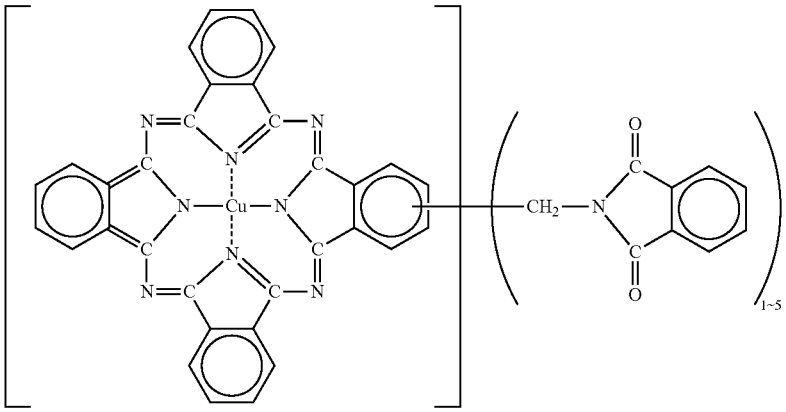

Examples of a magenta colorant include a condensed azo compound, a diketopyrrolopyrrole compound, anthraquinone, a quinacridone compound, a basic dye lake compound, a naphthol compound, a benzimidazolone compound, a thioindigo compound, and a perylene compound. Specifically, particularly preferred examples of the magenta colorant include: C.I. Pigment Red 2, 3, 5, 6, 7, 23, 48:2, 48:3, 48:4, 57:1, 81:1, 122, 144, 146, 150, 166, 169, 177, 184, 185, 202, 206, 220, and 22254; and C.I. Pigment Violet 19.

Examples of a yellow colorant include a condensed azo compound, an isoindolinone compound, an anthraquinone compound, an azo metal complex, a methine compound, and an allylamide compound. Specifically, preferred examples of the yellow colorant include C.I. Pigment Yellow 12, 13, 14, 15, 17, 62, 74, 83, 93, 94, 95, 97, 109, 110, 111, 120, 127, 128, 129, 147, 155, 168, 174, 176, 180, 181, and 191.

Examples of a black colorant include carbon black and any known metallic oxide, or the above-mentioned cyan, magenta, and yellow colorants. Examples of the metallic oxide include a metallic oxide containing an element such as iron, cobalt, nickel, copper, magnesium, manganese, aluminum, or silicon. Of those, a metallic oxide mainly containing an iron oxide such as iron oxide black, γ-iron oxide, iron titanium composite oxide, and iron aluminium composite oxide is preferable. The metallic oxide may contain a metallic element such as a silicon element, an aluminum element, or sodium element from the standpoint of controlling chargeability of the toner. The metallic oxide has a BET specific surface area by nitrogen adsorption of preferably 2 to 30 $m^2/g$, particularly preferably 3 to 28 $m^2/g$, and have a Mohs hardness of preferably 5 to 7.

Examples of the shape of the metallic oxide include an octahedral shape, a hexahedral shape, a spherical shape, an acicular shape, and a scaly shape. The metallic oxide preferably has a shape with a low degree of anisotropy such as the octahedral shape, the hexahedral shape, or the spherical shape in order to increase an image density. The average particle size of the metallic oxide is preferably 0.05 to 1.0 μm, more preferably 0.1 to 0.6 μm, and still more preferably 0.1 to 0.4 μm.

Reflection spectral characteristics suitable for each toner can be adjusted by mixing those colorants.

In the case of a toner having high coloring power like the present invention, two or more kinds of colorants are preferably used as a mixture in order that the charging performance of the toner at the time of continuous printing may be retained at a favorable level.

A fine powder selected from a silica fine powder, an alumina fine powder, a titania fine powder, and a composite oxide is preferably used for improving charging stability, developing performance, fluidity, and storage stability. The silica fine powder is particularly good. Dry silica produced by the vapor-phase oxidation of a silicon halide or alkoxide, and wet silica produced from an alkoxide, water glass, and the like can each be used as silica; the dry silica is more preferable because the number of silanol groups present on its surface or in a silica fine powder is small, and the amount of a production residue such as $Na_2O$ or $SO_3^{2-}$ is small. In the dry silica, a composite fine powder of silica and any other metal oxide can be obtained by using a metal halide compound such as aluminum chloride or titanium chloride and a silicon halide compound in combination in a production step for the dry silica, and the composite fine powder may be used.

The average circularity of the toner for each color of the present invention can be adjusted also by using a surface modification apparatus to be described later.

The toner for each color of the present invention can be produced by a wet production method such as a suspension polymerization method, an agglomeration melt adhesion method, a solution suspension method, or a dispersion polymerization method as well as a dry production method such as a kneading pulverization method.

As the specific production method by kneading pulverization method, a binder resin, a colorant, wax, and such other arbitrary material, cooling and grinding the kneaded product, rounding and classifying the ground products as required, followed by mixing in of the above-described fluidity improver.

First, in a raw material mixing step, predetermined amounts of at least resin and a colorant are weighted, and then compounded and mixed together as agents to be internally added to the toner. Examples of a mixing device include a double con mixer, a V-type mixer, a drum-type mixer, a Super mixer, a Henschel mixer, and a nauta mixer.

Further, the toner raw materials compounded and mixed as described above are melted and kneaded to melt the resin, and the colorant and the like are dispersed in the melted resin. In the melting and kneading step, for example, a batch kneader such as a pressure kneader, a Banbury mixer, etc or a continuous kneader can be used. Recently, due to the advantage of allowing continuous production, a single-screw or twin-screw extruder is becoming mainstream. For example, a KTK series twin-screw extruder from KOBE STEEL, LTD., a TEM series twin-screw extruder from TOSHIBA MACHINE CO., LTD., a twin-screw extruder from KCK Corporation, a co-kneader from Buss Co., Ltd., and the like are generally used. The precolored resin composition obtained by melting and kneading the toner raw materials is rolled out by two rolls or the like after the melting and kneading step, and then cooled through a cooling step of cooling the composition by water cooling or the like.

Subsequently, the resulting cooled product of the precolored resin composition obtained as described above is usually ground into a predetermined particle size by a grinding step. In the grinding step, first, the precolored resin composition is roughly ground with a crusher, a hammer mill, a feather mill, or the like, followed by further grinding with a Criptron system from Kawasaki Heavy Industries, Ltd., a Super Rotor from Nisshin Engineering, or the like. Subsequently, the ground products are classified by using a screen classifier, for example, a classifier such as an Elbow-Jet classifier (from NITTESU MINING CO., LTD.) employing an inertia classification system, a Turboplex classifier (from HOSOKAWA MICRON CORPORATION) employing a centrifugal classification system, etc, to obtain toner particles.

As required, surface modification and rounding may be performed in the surface modification step by using, for example, a hybritization system from NARA MACHINERY CO., LTD., or a mechanofusion system from HOSOKAWA MICRON CORPORATION.

According to the present invention, it is preferable that no mechanical grinding be performed in the grinding step, and that a device that performs classification and surface modification treatment using a mechanical impact force be used after grinding with an air jet type grinding machine to thereby obtain toner particles. The surface modification treatment and the classification may be performed separately, in which case a screen classifier such as HIBOLTA that is a wind screen (from Shin Tokyo Kikai Corporation) may be used. In addition, examples of a method of externally adding external additives include compounding predetermined amounts of the classified toner and known various external additives and then stirring and mixing them by using as an external adding machine a high-speed stirrer that applies a shearing force to powder, such as a Henschel mixer, a Super mixer, or the like.

Figure 7:
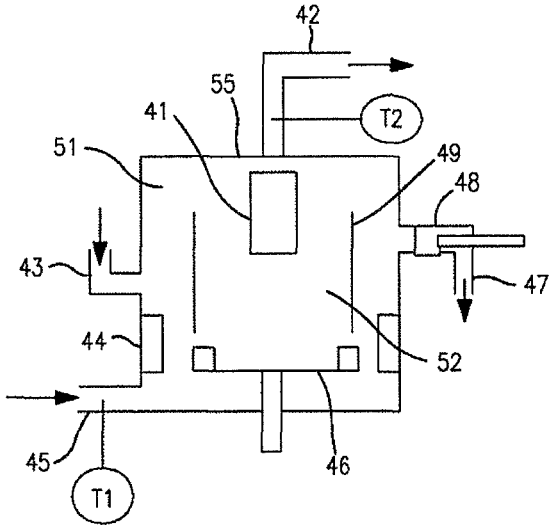
FIG. 7 is a view showing the outline of a constitution of an example of a surface modification apparatus to be suitably used upon production of a toner of the present invention.

FIG. 7 shows an example of a surface modifying device used in the present invention.

The surface modifying device shown in FIG. 7 includes: a casing 55; a jacket (not shown) through which cooling water and an anti-freeze solution can pass; a classifying rotor 41 as classifying means for classifying between particles having sizes larger than a predetermined particle size and fine particles having sizes smaller than the predetermined particle size; a dispersing rotor 46 as surface treatment means for treating the surface of the above-mentioned particles by applying a mechanical impact to the particles; liners 44 arranged circumferentially on an outer periphery of the dispersing rotor 46 at a predetermined interval; a guide ring 49 as guiding means for guiding, from among the particles classified by the classifying rotor 41, the particles having sizes larger than the predetermined size to the dispersing rotor 46; a discharge port for collecting fine powders 42 as discharging means for discharging, from among the particles classified by the classifying rotor 41, the fine particles having sizes smaller than the predetermined particle size to the outside; a cold air introduction port 45 as particle circulation means for sending the particles having their surfaces treated by the dispersing rotor 46 to the classifying rotor 41; a raw material supply port 43 for introducing the treated particles into the casing 55; and a powder discharge port 47 and a discharge valve 48, which are openable and closable, for discharging the surface-treated particles from the casing 55.

The classifying rotor 41 is a cylindrical rotor and is provided on one end surface side inside the casing 55. The fine powder collection discharge port 42 is provided on one end portion of the casing 55 so that particles present inside the classification rotor 41 are discharged therefrom. The raw material supply port 43 is provided in a central portion of a circumferential surface of the casing 55. The cold air introduction port 45 is provided on the other end surface side on the circumferential surface of the casing 55. The powder discharge port 47 is provided on the circumferential surface of the casing 55 at a position opposite to the raw material supply port 43. The discharge valve 48 is a valve capable of freely opening and closing the powder discharge port 47.

Figure 8:
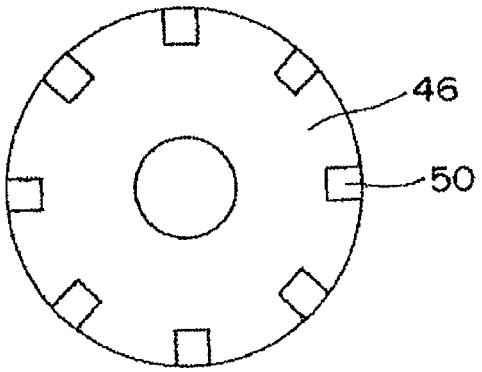
FIG. 8 is a view showing a dispersion rotor of the apparatus shown in FIG. 7 and the arrangement of square disks provided on the rotor.

The dispersing rotor 46 and the liner 44 is provided between the cold air introduction port 45 and the raw material supply port 43 and between the cold air introduction port 45 and the powder discharge port 47, respectively. The liner 44 is arranged circumferentially along an inner peripheral surface of the casing 55. As shown in FIG. 8, the dispersing rotor 46 includes a circular disk and plural square disks 50 arranged normal to the circular disk along the outer edge of the circular disk. The dispersion rotor 46 is provided on the other end surface side of the casing 55 and arranged such that a predetermined gap is formed between the liner 44 and each square disk 50. The guide ring 49 is provided in the central portion of the casing 55. The guide ring 49 is a cylindrical member provided so as to extend from a position where it covers a part of the outer peripheral surface of the classifying rotor 41 to the vicinity of the classifying rotor 41. By means of the guide ring 49, the interior of the casing 55 is divided into a first space 51 sandwiched between the outer peripheral surface of the guide ring 49 and the inner peripheral surface of the casing 55, and a second space 52 defined inside the guide ring 49.

Note that the dispersing rotor 46 may include cylindrical pins instead of the square disks 50. While in this embodiment the liner 44 has a large number of grooves provided on its surface opposing the square disk 50, the liner 44 used may not have such grooves on its surface. Also, the classifying rotor 41 may be installed either vertically as shown in FIG. 7 or horizontally. In addition, one classifying rotor 41 may be provided as shown in FIG. 7, or two or more classifying rotors 41 may be provided.

In the surface modifying device constructed as described above, when an article to be finely ground is introduced from the raw material supply port 43 with the discharged valve 48 being in the "closed" state, first, the introduced article to be finely ground is sucked in by a blower (not shown) and then subjected to classification by the classifying rotor 41. At this time, fine powders classified as having particle sizes equal to a predetermined particle size or smaller pass through the circumferential surface of the classifying rotor 41 to be introduced into the inside of the classifying rotor 41, and then continuously discharged and removed from the device to the exterior. Coarse powders having particle sizes equal to or larger than the predetermined particle size are carried on a circulation flow generated by the dispersion rotor 46 while moving along an inner periphery (second space 52) of the guide ring 49 due to a centrifugal force, to be introduced to the gap (hereinafter also referred to as the "surface modification zone") between the square disk 50 and the liner 44. The powders introduced into the surface modification zone are subjected to surface modification by receiving a mechanical impact force between the dispersing rotor 46 and the liner 44.

The surface-modified powder particles are carried on cold air passing through inside the machine, to be also transported along the outer periphery (first space 51) of the guide ring 49 to reach the classifying rotor 41. By the classifying rotor 41, the fine powers are discharged to the outside of the machine whereas the coarse powders are returned again to the second space 52 where the surface modifying operation is repeated therefor. In this way, with the surface modifying device of FIG. 7, the classification of particles using the classifying rotor 41 and the surface treatment of the particles using the dispersing rotor 46 are repeated. Then, after a given period of time has elapsed, the discharge valve 48 is opened to collect the surface-modified particles from the discharge port 47.

Upon examination, it is preferable to adjust a period of time from the introduction of the article to be finely ground, until the opening of the discharge valve (cycle time) and the rpm of the dispersing rotor in controlling an average roundness of toner particles and an amount of wax present on the toner surface. To increase the average roundness, it is effective to make the cycle time longer or increase a peripheral speed of the dispersing rotor. Further, to restrain the amount of the surface releasing agent used, conversely, it is effective to make the cycle time shorter or to lower the peripheral speed. In particular, unless the circumferential speed of the dispersion rotor is equal to or larger than a certain value, the pulverized products cannot be subjected to efficient sphering, so the pulverized products must be subjected to sphering with the cycle time lengthened. The circumferential speed is preferably $1.2\times10^5$ mm/sec or more, and the cycle time is preferably 5 to 60 seconds from the viewpoint of the appropriate adjustment of the amount in which the wax is present on the surface of the toner and the average circularity of the toner.

When the toner is produced by a wet production method in the present invention, a known surfactant, or known organic or inorganic dispersant can be used as a dispersion stabilizer. Of those, an inorganic dispersant can be preferably used because of the following reason: since the inorganic dispersant shows dispersion stability by virtue of its steric hindrance, the stability hardly collapses even when a reaction temperature is changed, and the inorganic dispersant can be easily washed. Examples of such inorganic dispersant include: polyvalent metal phosphates such as calcium phosphate, magnesium phosphate, aluminum phosphate, and zinc phosphate; carbonates such as calcium carbonate and magnesium carbonate; inorganic salts such as calcium metasilicate, calcium sulfate, and barium sulfate; and inorganic oxides such as calcium hydroxide, magnesium hydroxide, aluminum hydroxide, silica, bentonite, and alumina.

One kind alone, or a combination of two more kinds, of those inorganic dispersants is used in an amount of preferably 0.2 to 20 parts by mass with respect to 100 parts by mass of a polymerizable monomer. 0.001 to 0.1 part by mass of a surfactant may be used in combination when one aims to obtain an additionally fine toner having an average particle diameter of 5 μm or less.

Examples of the surfactant include sodium dodecylbenzenesulfate, sodium tetradecyl sulfate, sodium pentadecyl sulfate, sodium octyl sulfate, sodium oleate, sodium laurate, sodium stearate, and potassium stearate.

Although each of those inorganic dispersants may be used as it is, the particles of each of the inorganic dispersants can be produced in an aqueous medium in order that additionally fine particles may be obtained. For example, in the case of calcium phosphate, water-insoluble calcium phosphate can be produced by mixing an aqueous solution of sodium phosphate and an aqueous solution of calcium chloride under high-speed stirring, and dispersion with additional uniformity and additional fineness can be attained.

In the suspension polymerization method, additives including a release agent composed of a low-softening substance, a colorant, a charge control agent, and a polymerization initiator are added into, for example, a polymerizable monomer, and are uniformly dissolved or dispersed in the monomer with a dispersing machine such as a homogenizer or an ultrasonic dispersing machine, whereby a polymerizable monomer composition is produced. The polymerizable monomer composition is dispersed in an aqueous phase containing a dispersion stabilizer with an ordinary stirring machine, homomixer, or homogenizer so that the droplet particles of the polymerizable monomer composition are produced in the aqueous phase. The particles are polymerized, and are subjected to, for example, filtration, washing, drying, and classification as required. In the suspension polymerization method, in order that the droplet particles of the polymerizable monomer composition may each have a desired toner particle size, granulation is preferably performed while a stirring speed and a stirring time are adjusted. After that, stirring has only to be performed to such an extent that the particle states are maintained and the sedimentation of the particles is prevented by virtue of the action of the dispersion stabilizer. A polymerization temperature is 40° C. or higher, or generally 50 to 90° C.

The toner of the present invention can be used as a one-component developer, or can be used as a two-component developer having the toner of the present invention and a carrier.

When the toner for each color of the present invention is used in a two-component developer, the toner is preferably used in a developer having the toner and a carrier having a 50% particle diameter on a volume basis (D50) of 10.0 to 50.0 μm.

In a developing device, the toner is apt to be damaged by a mechanical stress from the carrier, an electrostatic image bearing member, or any other member. In particular, a stress from the carrier has a significant influence on the toner, and part of the toner chips, or is broken, to produce a fine powder in some cases. The fine powder adheres to anyone of the members to change the charging performance of the toner or to contaminate paper directly, and image appearance is reduced in some cases. In particular, in the case of a toner having high coloring power like the toner of the present invention, the charging performance of the toner is susceptible to a colorant even when a trace amount of a fine powder adheres, and the extent to which paper is contaminated when a fine powder adheres to the paper is apt to be large. When D50 of the carrier exceeds 50.0 μm, a ratio of the toner to be used in development to the toner carried by the carrier reduces, so the toner is apt to crack in a developing device. In addition, when the toner is used while a toner amount on paper is reduced, a dot or line in an image is apt to chip, or a solid image portion in the image is apt to fade. When D50 of the carrier is less than 10.0 μm, the developer is apt to be packed in a developing device, and the toner is apt to crack. When a toner having large coloring power like the toner of the present invention is used, a fine powder generated by the chipping of the toner has so large an influence on the charging performance of the toner that an image failure is apt to be produced in continuous printing. Accordingly, D50 of the carrier is more preferably 10.0 to 45.0 μm, still more preferably 15.0 to 40.0 μm, or particularly desirably 15.0 to 35.0 μm.

By the same reason as that described above, the carrier in the two-component developer has a content of a carrier having a particle diameter more than twice as large as D50 in the volume distribution of preferably 25.0% or less. When the content of the carrier exceeds 25.0%, a ratio of the toner to be used in development to the toner carried by the carrier reduces, so the toner is apt to crack in a developing device. In addition, when the toner is used while a toner amount on paper is reduced, a dot or line in an image is apt to chip, or a solid image portion in the image is apt to fade. Accordingly, the content is more preferably 15.0% or less, or still more preferably 10.0% or less.

In addition, the carrier in the two-component developer has a content of a carrier having a particle diameter less than one half of D50 in the volume distribution of preferably 30.0% or less. When the content of the carrier exceeds 30.0%, the developer is apt to be packed in a developing device, and the toner is apt to crack. When a toner having large coloring power like the toner of the present invention is used, a fine powder generated by the chipping of the toner has so large an influence on the charging performance of the toner that an image failure is apt to be produced in continuous printing. Accordingly, the content is more preferably 20.0% or less, or still more preferably 15.0% or less.

The 50% particle diameter on a volume distribution basis (D50) of the carrier, the content of the carrier having a particle diameter more than twice as large as D50, and the content of the carrier having a particle diameter less than one half of D50 described above can each be measured with a dry or wet laser diffraction type particle size distribution meter as long as the meter has a measuring range from submicrons to several hundreds of microns. To be specific, for example, a laser diffraction type particle size distribution measuring device SALD-3000 (manufactured by Shimadzu Corporation) can be used in the measurement.

An element selected from, for example, iron, copper, zinc, nickel, cobalt, manganese, and chromium elements can be used alone as the carrier that can be used in the invention. Alternatively, a carrier constituted in a composite ferrite state can be used. The shape of the carrier is a spherical shape, a flat shape, or an amorphous shape, and a carrier of any one of the shapes can be used. Further, even a fine structure characterizing the surface of the carrier (such as surface unevenness) is preferably controlled. In general, the following method has been employed: the above inorganic oxide is calcined and granulated so that carrier core particles are produced, and then the particles are each coated with a resin. In order that the burden of the carrier on the toner may be alleviated, a low-density dispersed carrier obtained by kneading an inorganic oxide and a resin, pulverizing the kneaded product, and classifying the pulverized products, or a carrier having a true spherical shape formed by directly polymerizing a kneaded product of an inorganic oxide and a monomer in an aqueous medium is also preferably used.

A coated carrier obtained by coating the surface of the above carrier with a resin is particularly preferable. A method involving dissolving or suspending the resin in a solvent and applying the solution or the suspension to the carrier to cause the solution or the suspension to adhere to the carrier, or a method involving merely mixing a resin powder and the carrier to cause the powder and the carrier to adhere to each other is applicable to the production of the coated carrier.

A coat material for the surface of the carrier varies depending on a material for the toner; examples of the coat material include polytetrafluoroethylene, a monochlorotrifluoroethylene polymer, polyvinylidene fluoride, a silicone resin, a polyester resin, a styrene resin, an acrylic resin, polyamide, polyvinyl butyral, and an amino acrylate resin, and one kind of them may be used alone, or multiple kinds of them may be used. The treatment amount of the above coating material for the carrier core particles is preferably 0.01 to 30 mass % (more preferably 0.05 to 20 mass %).

The carrier has an intensity of magnetization measured in a magnetic field of 10,000/4π (kA/m) (10,000 Oe) ($\sigma_{10000}$) of preferably 25 to 100 $Am^2/kg$. In a developing device, the toner is apt to be damaged by a mechanical stress from the carrier, an electrostatic image bearing member, or any other member. In particular, a stress from the carrier has a significant influence on the toner, and part of the toner chips, or is broken, to produce a fine powder in some cases. The fine powder adheres to any one of the members to change the charging performance of the toner or to contaminate paper directly, and image appearance is reduced in some cases. In particular, in the case of a toner having high coloring power like the toner of the present invention, the charging performance of the toner is susceptible to a colorant even when a trace amount of a fine powder adheres, and the extent to which paper is contaminated when a fine powder adheres to the paper is apt to be large. When $\sigma_{10000}$ of the carrier exceeds 100 $Am^2/kg$, the toner receives a large stress in a developer magnetic brush, so the toner is apt to crack in a developing device. When $\sigma_{10000}$ of the carrier is less than 25 $Am^2/kg$, the charging performance of the toner is apt to be reduced even by a trace amount of a fine powder adhering to the carrier owing to the cracking of the toner, so the stability of an image density at the time of continuous printing is apt to reduce. Accordingly, $\sigma_{10000}$ described above is more preferably 40 to 90 $Am^2/kg$, or particularly preferably 50 to 70 $Am^2/kg$.

The intensity of magnetization ($\sigma_{10000}$) of the carrier can be adjusted by appropriately selecting the kind and amount of a magnetic substance to be incorporated.

The intensity of magnetization ($\sigma_{10000}$) of the carrier can be measured with, for example, a vibration magnetic field-type magnetic property automatic recorder BHV-30 (manufactured by Riken Denshi. Co., Ltd.). A specific measurement method is as described below. A cylindrical plastic container is densely filled with the carrier to a sufficient extent. Meanwhile, an external magnetic field of 10,000/4π (kA/m) (10,000 Oe) is generated. In the state, the magnetizing moment of the carrier with which the container is filled is measured. Further, the actual mass of the carrier with which the container is filled is measured, and the intensity of magnetization of the carrier ($Am^2/kg$) is determined.

The carrier has an average circularity ($C_C$) of preferably 0.750 to 0.990. The average circularity ($C_C$) is a coefficient showing the extent to which the shape of the carrier is close to a round shape, and the average circularity is determined from the largest diameter and measured particle projected area of a particle. When the average circularity is 1.000, all carrier particles are each of a true spherical shape, and, as the value decreases, the particles are each of an additionally elongated or amorphous shape. In a developing device, the toner is apt to be damaged by a mechanical stress from the carrier, an electrostatic image bearing member, or any other member. In particular, a stress from the carrier has a significant influence on the toner, and part of the toner chips, or is broken, to produce a fine powder in some cases. The fine powder adheres to any one of the members to change the charging performance of the toner or to contaminate paper directly, and image appearance is reduced in some cases. In particular, in the case of a toner having high coloring power like the toner of the present invention, the charging performance of the toner is susceptible to a colorant even when a trace amount of a fine powder adheres, and the extent to which paper is contaminated when a fine powder adheres to the paper is apt to be large. When $C_C$ described above is less than 0.750, a stress is apt to converge on the toner present at a protruded portion of the carrier, so the toner is apt to crack. When $C_C$ described above exceeds 0.990, the developer is apt to be packed in a developing device, and the toner is apt to crack. Accordingly, $C_C$ described above is more preferably 0.800 to 0.990, still more preferably 0.850 to 0.980, or particularly desirably 0.870 to 0.950.

In addition, by the same reason as that described above, the coefficient of variation ($C_{CV}$) of the circularity distribution of the carrier on a volume basis is preferably 0.5 to 20.0%. The larger the coefficient of variation, the larger the extent to which the shape of the carrier changes. When $C_{CV}$ exceeds 20.0%, a stress is apt to converge on the toner present at a protruded portion of the carrier, so the toner is apt to crack. When $C_{CV}$ described above is less than 0.5%, the developer is apt to be packed in a developing device, and the toner is apt to crack. Accordingly, $C_{CV}$ described above is more preferably 0.5 to 15.0%, still more preferably 0.5 to 12.0%, or particularly preferably 1.0 to 10.0%. It should be noted that the coefficient of variation $C_{CV}$ can be determined from the following expression.

$$\text{Coefficient of variation } C_{CV}(\%) = (\text{standard deviation of circularites}/D50) \times 100$$

The average circularity $C_C$ and the coefficient of variation $C_{CV}$ of the circularity distribution can each be measured with, for example, a Multi-Image Analyzer (manufactured by Beckman Coulter, Inc).

A specific measurement method is as described below. A solution prepared by mixing an aqueous solution of NaCl having a concentration of about 1% and glycerin at 50 vol %: 50 vol % is used as an electrolyte solution. Here, the aqueous solution of NaCl has only to be prepared by using first grade sodium chloride, or, for example, an ISOTON (registered trademark)-II (manufactured by Coulter Scientific Japan, Co.) can be used as the aqueous solution. Glycerin has only to be a reagent grade or first grade reagent.

0.1 to 1.0 ml of a surfactant (preferably an alkylbenzene sulfonate) as a dispersant is added to the electrolyte solution (about 30 ml). Further, 2 to 20 mg of a measurement sample are added to the mixture. The electrolyte solution in which the sample has been suspended is subjected to a dispersion treatment with an ultrasonic dispersing unit for about 1 minute, whereby a dispersion liquid is obtained.

By using a 200-μm aperture as an aperture and a lens having a magnification of 20, the circle-equivalent diameter and the circularity are calculated under the following condition.

Average brightness in measurement frame: 220 to 230, measurement frame setting: 300, threshold (SH): 50, binarization level: 180

The electrolyte solution and the dispersion liquid are charged into a glass measurement container, and the concentration of the carrier in the measurement container is set to 5 to 10 vol %. The contents in the glass measurement container are stirred at the maximum stirring speed. A suction pressure for the sample is set to 10 kPa. When the carrier has so large a specific gravity as to be apt to sediment, a time period for the measurement is set to 15 to 30 minutes. In addition, the measurement is suspended every 5 to 10 minutes, and the container is replenished with the sample liquid and the mixed solution of the electrolyte solution and glycerin.

Number of particles to be measured is 2,000. After the completion of the measurement, blurred images, agglomerated particles (multiple particles are simultaneously subjected to measurement), and the like are removed from a particle image screen with software in the main body of the apparatus.

The circularity and the circle-equivalent diameter of the carrier are calculated from the following equation.

$$\text{Circularity} = (4 \times \text{Area}/(\text{MaxLength}^2 \times \pi)$$

$$\text{Circle-equivalent diameter} = (4 \cdot \text{Area}/\pi)^{1/2} \qquad \text{[Formula 2]}$$

The term "Area" as used herein is defined as the projected area of a binarized particle image, while the term "MaxLength" as used herein is defined as the maximum diameter of the particle image of the carrier. A circle-equivalent diameter is represented as the diameter of a true circle when the "Area" is regarded as the area of the true circle. The resultant individual circle-equivalent diameters are classified into 256 divisions ranging from 4 to 100 μm, and are plotted on a logarithmic graph on a volume basis.

The carrier has a true specific gravity of preferably 2.0 to 6.0 g/cm$^3$. In a developing device, the toner is apt to be damaged by a mechanical stress from the carrier, and part of the toner chips, or is broken, to produce a fine powder in some cases. The fine powder adheres to the carrier to change the charging performance of the toner or to contaminate paper directly, and image appearance is reduced in some cases. In particular, in the case of a toner having high coloring power like the toner of the present invention, the charging performance of the toner is susceptible to a colorant even when a trace amount of a fine powder adheres, and the extent to which paper is contaminated when a fine powder adheres to the paper is apt to be large. When the true specific gravity of the carrier exceeds 6.0 g/cm$^3$, the toner receives a large stress in a developer magnetic brush, so the toner is apt to crack in a developing device. When the true specific gravity of the carrier is less than 2.0 g/cm$^3$, the charging performance of the toner is apt to be reduced even by a trace amount of a fine powder adhering to the carrier owing to the cracking of the toner, so the stability of an image density at the time of continuous printing is apt to reduce. Accordingly, the true specific gravity is more preferably 2.0 to 5.5 g/cm$^3$, still more preferably 2.0 to 5.0 g/cm$^3$, or particularly preferably 2.5 to 4.3 g/cm$^3$.

As described later, the true specific gravity of the carrier can be measured with, for example, a dry automatic densimeter Autopycnometer (manufactured by Yuasa Ionics Inc.).

The carrier is preferably a magnetic fine particle-dispersed resin carrier having a binder resin and a magnetic substance. The above binder resin is preferably a thermosetting resin. The above-mentioned physical properties can be suitably achieved, and, when a toner having large coloring power is used like the present invention, an influence of the colorant in the toner can be reduced.

Examples of the heat-curable resin composition include a phenol resin, an epoxy resin, a polyimide-based resin, a melamine resin, an urea resin, an unsaturated polyester resin, an alkyd resin, a xylene resin, an acetoguanamine resin, a furan resin, a silicone-based resin, a polyimide resin, and a urethane resin. Each of the above-described resins may be used alone or two or more of them may be used in combination, but preferably contains at least a phenol resin.

A ratio "binder resin:magnetic fine particles" between a binder resin of which composite particles in the present invention are each constituted and magnetic fine particles is preferably 1:99 to 1:50 on a mass basis.

The carrier possessed by the two-component developer of the present invention may be coated with a coupling agent or a resin as required.

Any known resin can be used as the coat resin. Examples of the resin include an epoxy resin, a silicone resin, a polyester resin, a fluorine resin, a styrene resin, an acrylic resin, and a phenol resin. A polymer obtained by polymerizing a monomer is also permitted. In consideration of durability and anti-contamination, a silicone resin is preferable. The treatment amount of the coat resin is preferably 0.01 to 3.0 parts by mass, or more preferably 0.1 to 2.0 parts by mass with respect to 100 parts by mass of carrier cores in order that the above characteristics may be obtained.

In particular, a phenol resin is used as a binder resin for each of the composite particles, an epoxy group-containing silane coupling agent is used as a lipophilic treatment agent for each of the magnetic fine particles, and a silicone resin is used as a coat resin for each of the composite particles (carrier cores). In addition, an amino group-containing silane coupling agent is preferably incorporated into the silicone resin, or an amino group-containing silane coupling agent is preferably used as a pre-treatment agent before the composite particles are each coated with the resin. With such constitution, the amino group-containing silane coupling agent hydrolyzes by virtue of moisture moderately adsorbing to the inside of the phenol resin to undergo self-condensation while forming a hydrogen bond with a hydroxyl group of the phenol resin, or to condense with a remaining silanol group in the silicone resin to form a strong coating. At the same time, an amino group and an epoxy group of the lipophilic treatment agent for each of the magnetic fine particles react with each other, whereby the adhesiveness of the silicone resin is improved, and the flaking or the like of the coat resin is suppressed.

Next, a method of producing the magnetic fine particle-dispersed resin carrier will be described.

The composite particles can be produced by, for example, the so-called polymerization method involving: dispersing the magnetic fine particles (non-magnetic inorganic compound fine particles as required) in a monomer of which the binder resin is constituted; adding an initiator or a catalyst to the dispersed product; and dispersing the mixture in, for example, an aqueous medium to polymerize the mixture, or the so-called kneading pulverization method involving pulverizing the binder resin containing the magnetic fine particles. The polymerization method is preferable in order that the particle diameter of the carrier may be easily controlled and a sharp particle size distribution may be obtained.

Composite particles each using a phenol resin as a binder resin can be produced by, for example, a method involving: dispersing, in an aqueous medium, phenols, aldehydes, and magnetic fine particles each subjected to a lipophilic treatment; and adding a basic catalyst to the mixture to cause them to react with one another. A method of forming the so-called denatured phenol resin involving mixing phenols with a natural resin such as rosin, or a drying oil such as a wood oil or a linseed oil to cause them to react with each other is also permitted.

The binder resin is particularly preferably a phenol resin because of the following reason: the resin retains adsorbed water to a moderate extent, so the hydrolysis of a coupling agent is promoted, and a strong coating can be formed.

Composite particles each using an epoxy resin as a binder resin can be produced by, for example, a method involving: dispersing, in an aqueous medium, bisphenols, epihalohydrin, and magnetic fine particles each subjected to a lipophilic treatment; and causing them to react with one another in an alkali aqueous medium.

Composite particles each using a melamine resin as a binder resin can be produced by, for example, a method involving: dispersing, in an aqueous medium, melamines, aldehydes, and magnetic fine particles each subjected to a lipophilic treatment; and causing them to react with one another in the presence of a weak acid catalyst.

A method of producing composite particles each using any other thermosetting resin is, for example, a method involving: kneading magnetic fine particles each subjected to a lipophilic treatment with various resins; pulverizing the kneaded product; and subjecting the kneaded products to a sphering treatment.

Composite particles composed of magnetic fine particles each subjected to a lipophilic treatment and a binder resin are treated with heat as required in some cases in order that the resin may be additionally cured. The heat treatment is particularly preferably performed under reduced pressure or an inert atmosphere in order that the magnetic fine particles may be prevented from oxidizing.

When the composite particles are each coated with a coupling agent, a method involving: dissolving the coupling agent in water or a solvent according to an ordinary method; immersing the composite particles in the solution; and filtrating and drying the resultant, or a method involving: spraying the composite particles with an aqueous solution of the coupling agent or a solution of the coupling agent in a solvent while stirring the composite particles; and drying the composite particles is employed. The method involving treating the composite particles while stirring the composite particles is particularly preferable in order that the composite particles may be prevented from coalescing and a uniform coat layer may be formed.

The surface of each of the composite particles has only to be coated with a resin by a known method, and, for example, any one of a method involving mixing the composite particles and the resin with a stirring machine such as a Henschel mixer or a high-speed mixer, a method involving impregnating the composite particles with a solvent containing the resin, and a method involving spraying the composite particles with the resin by using a spray dryer is available.

Next, a full-color image-forming method of the present invention will be described.

The present invention relates to a full-color image-forming method including the steps of: forming electrostatic images on a charged electrostatic image bearing member; developing the formed electrostatic images with toners to form toner images; transferring the formed toner images onto a transfer material; and fixing the transferred toner images to the transfer material to form fixed images, in which: the step of forming the toner images includes a step of performing development with a first toner selected from a black toner, a cyan toner, a magenta toner, and a yellow toner to form a first toner image, a step of performing development with a second toner except the first toner selected from the black toner, the cyan toner, the magenta toner, and the yellow toner to form a second toner image, a step of performing development with a third toner except the first toner and the second toner selected from the black toner, the cyan toner, the magenta toner, and the yellow toner to form a third toner image, and a step of performing development with a fourth toner except the first toner, the second toner, and the third toner selected from the black toner, the cyan toner, the magenta toner, and the yellow toner to form a fourth toner image; and the cyan toner is a cyan toner containing at least a binder resin and a colorant, and the cyan toner has a value ($h^*_C$) for a hue angle h* based on a CIELAB color coordinate system of 210.0 to 270.0, an absorbance ($A_{C470}$) at a wavelength of 470 nm of 0.300 or less, an absorbance ($A_{C620}$) at a wavelength of 620 nm of 1.500 or more, and a ratio ($A_{C620}/A_{C670}$) of $A_{C620}$ to an absorbance ($A_{C670}$) at a wavelength of 670 nm of 1.00 to 1.25 in reflectance spectrophotometry.

According to such full-color image-forming method, an image color gamut comparable to or better than a conventional one can be represented, a good-appearance image with reduced surface unevenness can be obtained, and a running cost can be suppressed as a result of a reduction in consumption of the cyan toner. Further, a toner amount to be used in the development of the toner images on the electrostatic image bearing member can be reduced, so toner scattering in the transferring step can be suppressed, and toner images faithful to the electrostatic images can be formed on the transfer material. The deformation of each of the toner images on the transfer material is suppressed in the transferring step, so fixed images faithful to the electrostatic images can be formed. In addition, a toner amount on a transfer material can be reduced, so, even when paper much thinner than a conventional one such as paper for an advertisement folded in a newspaper is used as a transfer material, a fixation failure or the winding of the paper around a fixing unit is suppressed, and an image with small surface unevenness can be formed.

The reason for the foregoing is as described below. Since a cyan toner having specific reflection spectral characteristics and more excellent in color development property than a conventional toner is used, a toner amount per unit area needed for representing an image color gamut and a color space each of which is comparable to or better than a conventional one for certain image data can be reduced as compared to a conventional cyan toner. As a result, the amount of the cyan toner to be used in the development of certain image data on a unit area of the electrostatic image bearing member can be reduced. The toner amount per unit area is small, but the area of an electrostatic image to be formed on the electrostatic image bearing member is constant, so the height of a toner image developed on the electrostatic image bearing member with the toner can be reduced. According to the investigation conducted by the inventors of the present invention, the height of a toner image on the electrostatic image bearing member and the ease with which a toner scatters in the transferring step establish a proportional relationship. Accordingly, reducing the above height of the toner image suppresses the scattering of the toner, and allows the toner image on the electrostatic image bearing member to be transferred onto the transfer material with additional faithfulness. The effect is more significant in the case of an image-forming method involving the use of an intermediate transfer body, and is particularly significant when the intermediate transfer body is used twice or more.

In general, a toner image transferred onto a transfer material undergoes a fixing step so that a fixed image is formed. According to the investigation conducted by the inventors of the present invention, the height of an unfixed toner image on the transfer material and the ease with which the toner image spreads in a transferring step establish a proportional relationship. That is, even if a high-definition, high-resolution toner image is formed on the transfer material, when the toner image has a high height, the resolution of a fixed image reduces owing to the melt spread or rolling of toner in the fixing step. In the full-color image-forming method of the present invention, the height of a cyan toner image on the transfer material can be reduced, so a phenomenon such as the melt spread or rolling of toner in the fixing step is suppressed, and hence a fixed toner image faithful to the unfixed toner image on the transfer material can be formed.

Those effects are exerted irrespective of whether the fixing step is of a contact type or a non-contact type. When the fixing step is based on a heat fixing system, those effects are particularly significant; in the case of a fixing step based on a heat pressure system, a suppressing effect on the rolling of toner is significant.

When the fixing step is of a contact type, in particular, a heat pressure system, an elastic force possessed by paper used as a transfer material itself is utilized to some extent in order that a phenomenon in which the paper winds around a fixing unit in the fixing step may be prevented. That is, when toner used in development on the paper contacts with the fixing member of the fixing unit so as to melt, a force acting between the toner and the paper is larger than a force acting between the fixing member and the toner, so the toner is peeled from the fixing member by the elastic modulus of the paper, and a fixed image is obtained. Accordingly, when paper much thinner than a conventional one and having a smaller elastic modulus than that of the conventional one such as paper for an advertisement folded in a newspaper is used as a transfer material, the elastic modulus of the paper is not sufficient, so a force acting between a fixing member and toner becomes larger than a force acting between the toner and the paper, and a phenomenon in which the toner and the paper wind around the fixing member is apt to occur.

In the image-forming method of the present invention, when the true density of the cyan toner is represented by $\beta_{TC}$ and a toner amount upon development of image data based on the CIELAB color coordinate system with (L*=53.9, a*=−37.0, b*=−50.1) (cyan solid image specified as a Japan color) onto the transfer material is represented by $M1_C$ (mg/cm$^2$), a coloring coefficient $A_C$ represented by the following expression 9 is preferably 3.0 to 12.0.

$$A_C = A_{C620}/(M1_C \times \rho_{TC}) \quad \text{(Ex. 9)}$$

The above coloring coefficient $A_C$ is considered to show such coloring properties for the image-forming method as described below: the extent of color development property possessed by toner to be used and the amount in which the toner is used in the formation of an image. According to the investigation conducted by the inventors of the present invention, as $A_{C620}$ showing the color development property of the toner increases, the amount of the toner to be used in the formation of the image is preferably reduced, so the larger $A_C$, the better coloring efficiency the image-forming method shows. When $A_C$ is less than 3.0, the color development property possessed by the toner is so small as compared to the amount of the toner to be used in the development of the image that the image density of the image may be insufficient. In addition, even when the image density is sufficient, the amount of the toner to be used in the development is so large that the resolution of the image may reduce. On the other hand, when $A_C$ exceeds 12.0, the color development property possessed by the toner is excessively large, so, even when the resolution of the image is sufficient, the color development efficiency of the colorant of the toner reduces, and a representable color space narrows in some cases. In addition, even when the color space is sufficient, the amount of the toner to be used in the formation of the image is so small that the coarseness of a highlight portion, the disturbance of an edge portion of a line image, or the like is apt to be remarkable. Accordingly, the range of $A_C$ is more preferably 3.0 to 11.0, still more preferably 4.0 to 11.0, or particularly preferably 6.0 to 11.0.

The cyan toner of the present invention has $A_{C620}$ in a specific range, and has color development property higher than that of an ordinary toner. As a result, even when an image is formed in a state where a toner usage is small, specifically, $A_C$ is 3.0 to 12.0, an image density and an image color gamut each of which is comparable to a conventional one can be achieved. However, when one attempts to reduce a toner consumption by reducing the thickness of a toner layer of which the image is formed, the toner penetrates into paper, so a fiber of the paper is apt to be remarkable in an image portion. Alternatively, the appearance of the image is apt to reduce owing to a phenomenon such as a reduction in image chroma. When an image is formed while a toner amount on paper is reduced, the amount of a binder resin of which the image is constituted also reduces, so cold offset and hot offset are particularly apt to occur. In view of the foregoing, the toner of the present invention, which is excellent in low-temperature fixability to some extent, preferably retains an appropriate viscosity even at high temperatures.

It is preferable that: the step of forming the toner images include a step of transporting the toners to a developing portion with a toner carrying member and a step of developing the electrostatic images with the toners in the developing portion; and a ratio ($Q_C/A_{C620}$) of the absolute value for the charge quantity ($Q_C$) (mC/kg) of the toner on the toner carrying member in the transporting step to $A_{C620}$ is 22.0 to 50.0. In the present invention, a cyan toner having specific reflection spectral characteristics and more excellent in color development property than a conventional toner is used, but a toner amount with which an electrostatic latent image is developed is preferably controlled in consideration of a relationship between the color development property and the charge quantity possessed by the toner. That is, the following procedure is preferably adopted: as long as $Q_C/A_{C620}$ falls within the above range, as $A_{C620}$ of the toner to be used increases, the value for $Q_C$ is increased so that a toner amount used in the development of image data is reduced. With such procedure, the color development efficiency of the toner can be additionally improved, and the resolution of an image is improved. In addition, a toner excellent in color development property is apt to show a remarkable image failure even when the toner scatters to a slight extent, so the following procedure is preferably adopted: as the color development property of the toner becomes more excellent, the charge quantity of the toner is increased so that an image failure such as toner scattering is suppressed. Further, as the color development property of the toner becomes more excellent, the disturbance of an edge portion of, for example, a dot image or line image is more liable to be remarkable. However, when the charge quantity of the toner is retained in a certain range in association with the color development property of the toner, the disturbance of the edge portion is suppressed, and a reduction in resolution of the image is easily suppressed. When $Q_C/A_{C620}$ described above is less than 22.0, the charge quantity of the toner is so small as compared to the color development property of the toner that a toner amount to be used in the development of an image increases, and, even when the image density of the image is sufficient, the resolution of the image may reduce. Alternatively, the color development property of the toner is so large as compared to the charge quantity of the toner that, even when the image resolution is sufficient, the color development efficiency of the colorant of the toner reduces, and a representable color space narrows in some cases. When $Q_C/A_{C620}$ described above exceeds 50.0, the charge quantity of the toner is so large as compared to the color development property of the toner that a toner amount to be used in the development of an image is excessively small, and, even when the image density of the image is sufficient, the coarseness of a highlight portion, the disturbance of an edge portion of a line image, or the like is apt to be remarkable. Alternatively, the color development property of the toner is so small as compared to the charge quantity of the toner that, even when the image resolution is sufficient, the image density or image color gamut of the image may be insufficient. Accordingly, $Q_C/A_{C620}$ described above is more preferably 24.0 to 45.0, still more preferably 27.0 to 44.6, or still more preferably 30.0 to 44.6.

In the image-forming method of the present invention, $M1_C$ (mg/cm$^2$) described above is preferably $(0.10\times\rho_{TC})$ to $(0.40\times\rho_{TC})$ mg/cm$^2$ because a toner consumption is reduced, and the effects of the present invention is favorably exerted. When $M1_C$ is less than $(0.10\times\rho_{TC})$ mg/cm$^2$, the toner penetrates into paper, and the representable color space of an image narrows in some cases. Alternatively, the number of toner particles of which the image is formed reduces, and the uniformity of the image reduces in some cases. When $M1_C$ exceeds $(0.40\times\rho_{TC})$ mg/cm$^2$, the resolution of the image is apt to reduce. In addition, when a transfer material having a small elastic modulus is used, the winding of paper as the transfer material in the fixing step is apt to occur. Accordingly, the above range of $M1_C$ is more preferably $(0.12\times\rho_{TC})$ to $(0.35\times\rho_{TC})$ mg/cm$^2$, or particularly preferably $(0.15\times\rho_{TC})$ to $(0.30\times\rho_{TC})$ mg/cm$^2$.

In the step of forming the toner images, a ratio ($H_{C80}/H_{C20}$) of the average height ($H_{C80}$) of the toner layer of a toner image formed on the electrostatic image bearing member for image data having a cyan monochromatic density of 80% to the average height ($H_{C20}$) of the toner layer of a toner image formed on the electrostatic image bearing member for image data having a cyan monochromatic density of 20% is preferably 0.90 to 1.30. According to the present invention, an additional improving effect on an image resolution is obtained, gloss non-uniformity is suppressed, an image with suppressed surface unevenness is obtained irrespective of the thickness of the transfer material, and a toner consumption can be reduced. When a toner excellent in color development property is used like the present invention, the tinge of an image at a certain point of the image is largely changed by the number of toner particles present in the direction perpendicular to an image surface at the point. Accordingly, in the present invention, such image-forming method as described below is preferably employed: the numbers of toner particles present in the directions perpendicular to the surfaces of the respective gradation images are uniformized to the extent possible irrespective of the image densities of the images. When $H_{C80}/H_{C20}$ described above is less than 0.90 or exceeds 1.30, a range from the highlight portion to halftone portion of an image becomes susceptible to image non-uniformity caused by changing in tinges owing to the non-uniformity of the number of toner particles present in the direction perpendicular to the surface of the image. In particular, when $H_{C80}/$ $H_{C20}$ exceeds 1.30, the resolution of a high-density gradation portion is apt to reduce, and the reproducibility of an image for image data is apt to reduce. Accordingly, $H_{C80}/H_{C20}$ described above is preferably 0.95 to 1.20, or particularly preferably 1.00 to 1.15. Such image formation is effective in an image-forming method in which image formation based on an area coverage modulation method where gradation is represented on the basis of the area of an image region is adopted over a range from a low-density region to a high-density solid image region.

The present invention relates to a full-color image-forming method including the steps of: forming electrostatic images on a charged electrostatic image bearing member; developing the formed electrostatic images with toners to form toner images; transferring the formed toner images onto a transfer material; and fixing the transferred toner images to the transfer material to form fixed images, in which: the step of forming the toner images includes a step of performing development with a first toner selected from a black toner, a cyan toner, a magenta toner, and a yellow toner to form a first toner image, a step of performing development with a second toner except the first toner selected from the black toner, the cyan toner, the magenta toner, and the yellow toner to form a second toner image, a step of performing development with a third toner except the first toner and the second toner selected from the black toner, the cyan toner, the magenta toner, and the yellow toner to form a third toner image, and a step of performing development with a fourth toner except the first toner, the second toner, and the third toner selected from the black toner, the cyan toner, the magenta toner, and the yellow toner to form a fourth toner image; and the magenta toner is a magenta toner containing at least a binder resin and a colorant, and the magenta toner has a value ($h^*_M$) for a hue angle h* based on a CIELAB color coordinate system of 330.0 to 30.0, an absorbance ($A_{M570}$) at a wavelength of 570 nm of 1.550 or more, an absorbance ($A_{M620}$) at a wavelength of 620 nm of 0.250 or less, and a ratio ($A_{M570}/A_{M450}$) of $A_{M570}$ to an absorbance ($A_{M450}$) at a wavelength of 450 nm of 1.80 to 3.50 in reflectance spectrophotometry.

According to such full-color image-forming method, an image color gamut comparable to or better than a conventional one can be represented, a good-appearance image with reduced surface unevenness can be obtained, and a running cost can be suppressed as a result of a reduction in consumption of the magenta toner. Further, a toner amount to be used in the development of the toner images on the electrostatic image bearing member can be reduced, so toner scattering in the transferring step can be suppressed, and toner images faithful to the electrostatic images can be formed on the transfer material. The deformation of each of the toner images on the transfer material is suppressed in the transferring step, so fixed images faithful to the electrostatic images can be formed. In addition, a toner amount on a transfer material can be reduced, so, even when paper much thinner than a conventional one such as paper for an advertisement folded in a newspaper is used as a transfer material, a fixation failure or the winding of the paper around a fixing unit is suppressed, and an image with small surface unevenness can be formed.

The reason for the foregoing is as described below. Since a magenta toner having specific reflection spectral characteristics and more excellent in color development property than a conventional toner is used, a toner amount per unit area needed for representing an image color gamut and a color space each of which is comparable to or better than a conventional one for certain image data can be reduced as compared to a conventional magenta toner. As a result, the amount of the magenta toner to be used in the development of certain image data on a unit area of the electrostatic image bearing member can be reduced. The toner amount per unit area is small, but the area of an electrostatic image to be formed on the electrostatic image bearing member is constant, so the height of a toner image developed on the electrostatic image bearing member with the toner can be reduced. According to the investigation conducted by the inventors of the present invention, the height of a toner image on the electrostatic image bearing member and the ease with which a toner scatters in the transferring step establish a proportional relationship. Accordingly, reducing the above height of the toner image suppresses the scattering of the toner, and allows the toner image on the electrostatic image bearing member to be transferred onto the transfer material with additional faithfulness. The effect is more significant in the case of an image-forming method involving the use of an intermediate transfer body, and is particularly significant when the intermediate transfer body is used twice or more.

In general, a toner image transferred onto a transfer material undergoes a fixing step so that a fixed image is formed. According to the investigation conducted by the inventors of the present invention, the height of an unfixed toner image on the transfer material and the ease with which the toner image spreads in a transferring step establish a proportional relationship. That is, even if a high-definition, high-resolution toner image is formed on the transfer material, when the toner image has a high height, the resolution of a fixed image reduces owing to the melt spread or rolling of toner in the fixing step. In the full-color image-forming method of the present invention, the height of a magenta toner image on the transfer material can be reduced, so a phenomenon such as the melt spread or rolling of toner in the fixing step is suppressed, and hence a fixed toner image faithful to the unfixed toner image on the transfer material can be formed.

Those effects are exerted irrespective of whether the fixing step is of a contact type or a non-contact type. When the fixing step is based on a heat fixing system, those effects are particularly significant; in the case of a fixing step based on a heat pressure system, a suppressing effect on the rolling of toner is significant.

When the fixing step is of a contact type, in particular, a heat pressure system, an elastic force possessed by paper used as a transfer material itself is utilized to some extent in order that a phenomenon in which the paper winds around a fixing unit in the fixing step may be prevented. That is, when toner used in development on the paper contacts with the fixing member of the fixing unit so as to melt, a force acting between the toner and the paper is larger than a force acting between the fixing member and the toner, so the toner is peeled from the fixing member by the elastic modulus of the paper, and a fixed image is obtained. Accordingly, when paper much thinner than a conventional one and having a smaller elastic modulus than that of the conventional one such as paper for an advertisement folded in a newspaper is used as a transfer material, the elastic modulus of the paper is not sufficient, so a force acting between a fixing member and toner becomes larger than a force acting between the toner and the paper, and a phenomenon in which the toner and the paper wind around the fixing member is apt to occur.

In the image-forming method of the present invention, when the true density of the magenta toner is represented by $\rho_{TM}$ and a toner amount upon development of image data based on the CIELAB color coordinate system with (L*=47.0, a*=75.0, b*=−6.0) (magenta solid image specified as a Japan color) onto the transfer material is represented by $M1_M$ (mg/cm$^2$), a coloring coefficient $A_M$ represented by the following expression 10 is preferably 3.0 to 12.0.

$$A_M = A_{M570}/(M1_M \times \rho_{TM}) \quad \text{(Ex. 10)}$$

The above coloring coefficient $A_M$ is considered to show such coloring properties for the image-forming method as described below: the extent of color development property possessed by toner to be used and the amount in which the toner is used in the formation of an image. According to the investigation conducted by the inventors of the present invention, as $A_{M570}$ showing the color development property of the toner increases, the amount of the toner to be used in the formation of the image is preferably reduced, so the larger $A_M$, the better coloring efficiency the image-forming method shows. When $A_M$ is less than 3.0, the color development property possessed by the toner is so small that the image density of the image may be insufficient. In addition, even when the image density is sufficient, the amount of the toner to be used in the development is so large that the resolution of the image may reduce. On the other hand, when $A_M$ exceeds 12.0, the color development property possessed by the toner is excessively large, so, even when the resolution of the image is sufficient, the color development efficiency of the colorant of the toner reduces, and a representable color space narrows in some cases. In addition, even when the color space is sufficient, the amount of the toner to be used in the formation of the image is so small that the coarseness of a highlight portion, the disturbance of an edge portion of a line image, or the like is apt to be remarkable. Accordingly, the range of $A_M$ is more preferably 3.0 to 11.0, still more preferably 4.0 to 11.0, or particularly preferably 6.0 to 11.0.

The magenta toner of the present invention has $A_{M570}$ in a specific range, and has color development property higher than that of an ordinary toner. As a result, even when an image is formed in a state where a toner usage is small, specifically, $A_M$ is 3.0 to 12.0, an image density and an image color gamut each of which is comparable to a conventional one can be achieved. However, when one attempts to reduce a toner consumption by reducing the thickness of a toner layer of which the image is formed, the toner penetrates into paper, so a fiber of the paper is apt to be remarkable in an image portion. Alternatively, the appearance of the image is apt to reduce owing to a phenomenon such as a reduction in image chroma. When an image is formed while a toner amount on paper is reduced, the amount of a binder resin of which the image is constituted also reduces, so cold offset and hot offset are particularly apt to occur. In view of the foregoing, the toner of the present invention, which is excellent in low-temperature fixability to some extent, preferably retains an appropriate viscosity even at high temperatures.

It is preferable that: the step of forming the toner images include a step of transporting the toners to a developing portion with a toner carrying member and a step of developing the electrostatic images with the toners in the developing portion; and a ratio ($Q_M/A_{M570}$) of the absolute value for the charge quantity ($Q_M$) (mC/kg) of the toner on the toner carrying member in the transporting step to $A_{M570}$ is 22.0 to 50.0. In the present invention, a magenta toner having specific reflection spectral characteristics and more excellent in color development property than a conventional toner is used, but a toner amount with which an electrostatic latent image is developed is preferably controlled in consideration of a relationship between the color development property and the charge quantity possessed by the toner. That is, the following procedure is preferably adopted: as long as $Q_M/A_{M570}$ falls within the above range, as $A_{M570}$ of the toner to be used increases, the value for $Q_M$ is increased so that a toner amount used in the development of image data is reduced. With such procedure, the color development efficiency of the toner can be additionally improved, and the resolution of an image is improved. In addition, a toner excellent in color development property is apt to show a remarkable image failure even when the toner scatters to a slight extent, so the following procedure is preferably adopted: as the color development property of the toner becomes more excellent, the charge quantity of the toner is increased so that an image failure such as toner scattering is suppressed. Further, as the color development property of the toner becomes more excellent, the disturbance of an edge portion of, for example, a dot image or line image is more liable to be remarkable. However, when the charge quantity of the toner is retained in a certain range in association with the color development property of the toner, the disturbance of the edge portion is suppressed, and a reduction in resolution of the image is easily suppressed. When $Q_M/A_{M570}$ described above is less than 22.0, the charge quantity of the toner is so small as compared to the color development property of the toner that a toner amount to be used in the development of an image increases, and, even when the image density of the image is sufficient, the resolution of the image may reduce. Alternatively, the color development property of the toner is so large as compared to the charge quantity of the toner that, even when the image resolution is sufficient, the color development efficiency of the colorant of the toner reduces, and a representable color space narrows in some cases. When $Q_M/A_{M570}$ described above exceeds 50.0, the charge quantity of the toner is so large as compared to the color development property of the toner that a toner amount to be used in the development of an image is excessively small, and, even when the image density of the image is sufficient, the coarseness of a highlight portion, the disturbance of an edge portion of a line image, or the like is apt to be remarkable. Alternatively, the color development property of the toner is so small as compared to the charge quantity of the toner that, even when the image resolution is sufficient, the image density or image color gamut of the image may be insufficient. Accordingly, $Q_M/A_{M570}$ described above is more preferably 23.0 to 45.0, still more preferably 26.0 to 44.0, or still more preferably 30.0 to 44.6.

In the image-forming method of the present invention, $M1_M$ (mg/cm$^2$) described above is preferably $(0.10\times\rho_{TM})$ to $(0.40\times\rho_{TM})$ mg/cm$^2$ because a toner consumption is reduced, and the effects of the present invention is favorably exerted. When $M1_M$ is less than $(0.10\times\rho_{TM})$ mg/cm$^2$, the toner penetrates into paper, and the representable color space of an image narrows in some cases. Alternatively, the number of toner particles of which the image is formed reduces, and the uniformity of the image reduces in some cases. When $M1_M$ exceeds $(0.40\times\rho_{TM})$ mg/cm$^2$, the resolution of the image is apt to reduce. In addition, when a transfer material having a small elastic modulus is used, the winding of paper as the transfer material in the fixing step is apt to occur. Accordingly, the above range of $M1_M$ is more preferably $(0.12\times\rho_{TM})$ to $(0.35\times\rho_{TM})$ mg/cm$^2$, or particularly preferably $(0.15\times\rho_{TM})$ to $(0.30\times\rho_{TM})$ mg/cm$^2$.

In the step of forming the toner images, a ratio ($H_{M80}/H_{M20}$) of the average height ($H_{M80}$) of the toner layer of a toner image formed on the electrostatic image bearing member for image data having a magenta monochromatic density of 80% to the average height ($H_{M20}$) of the toner layer of a toner image formed on the electrostatic image bearing member for image data having a magenta monochromatic density of 20% is preferably 0.90 to 1.30. According to the present invention, an additional improving effect on an image resolution is obtained, gloss non-uniformity is suppressed, an image with suppressed surface unevenness is obtained irrespective of the thickness of the transfer material, and a toner consumption can be reduced. When a toner excellent in color development property is used like the present invention, the tinge of an image at a certain point of the image is largely changed by the number of toner particles present in the direction perpendicular to an image surface at the point. Accordingly, in the present invention, such image-forming method as described below is preferably employed: the numbers of toner particles present in the directions perpendicular to the surfaces of the respective gradation images are uniformized to the extent possible irrespective of the image densities of the images. When $H_{M80}/H_{M20}$ described above is less than 0.90 or exceeds 1.30, a range from the highlight portion to halftone portion of an image becomes susceptible to image non-uniformity caused by changing in tinges owing to the non-uniformity of the number of toner particles present in the direction perpendicular to the surface of the image. In particular, when $H_{M80}/H_{M20}$ exceeds 1.30, the resolution of a high-density gradation portion is apt to reduce, and the reproducibility of an image for image data is apt to reduce. Accordingly, $H_{M80}/H_{M20}$ described above is preferably 0.95 to 1.20, or particularly preferably 1.00 to 1.15. Such image formation is effective in an image-forming method in which image formation based on an area coverage modulation method where gradation is represented on the basis of the area of an image region is adopted over a range from a low-density region to a high-density solid image region.

The present invention relates to a full-color image-forming method including the steps of: forming electrostatic images on a charged electrostatic image bearing member; developing the formed electrostatic images with toners to form toner images; transferring the formed toner images onto a transfer material; and fixing the transferred toner images to the transfer material to form fixed images, in which: the step of forming the toner images includes a step of performing development with a first toner selected from a black toner, a cyan toner, a magenta toner, and a yellow toner to form a first toner image, a step of performing development with a second toner except the first toner selected from the black toner, the cyan toner, the magenta toner, and the yellow toner to form a second toner image, a step of performing development with a third toner except the first toner and the second toner selected from the black toner, the cyan toner, the magenta toner, and the yellow toner to form a third toner image, and a step of performing development with a fourth toner except the first toner, the second toner, and the third toner selected from the black toner, the cyan toner, the magenta toner, and the yellow toner to form a fourth toner image; and the yellow toner is a yellow toner containing at least a binder resin and a colorant, and the yellow toner has a value ($h^*_Y$) for a hue angle h* based on a CIELAB color coordinate system of 75.0 to 120.0, an absorbance ($A_{Y450}$) at a wavelength of 450 nm of 1.600 or more, an absorbance ($A_{Y470}$) at a wavelength of 470 nm of 1.460 or more, and a an absorbance ($A_{Y510}$) at a wavelength of 510 nm of 0.500 or less in reflectance spectrophotometry.

According to such full-color image-forming method, an image color gamut comparable to or better than a conventional one can be represented, a good-appearance image with reduced surface unevenness can be obtained, and a running cost can be suppressed as a result of a reduction in consumption of the yellow toner. Further, a toner amount to be used in the development of the toner images on the electrostatic image bearing member can be reduced, so toner scattering in the transferring step can be suppressed, and toner images faithful to the electrostatic images can be formed on the transfer material. The deformation of each of the toner images on the transfer material is suppressed in the transferring step, so fixed images faithful to the electrostatic images can be formed. In addition, a toner amount on a transfer material can be reduced, so, even when paper much thinner than a conventional one such as paper for an advertisement folded in a newspaper is used as a transfer material, a fixation failure or the winding of the paper around a fixing unit is suppressed, and an image with small surface unevenness can be formed.

The reason for the foregoing is as described below. Since a yellow toner having specific reflection spectral characteristics and more excellent in color development property than a conventional toner is used, a toner amount per unit area needed for representing an image color gamut and a color space each of which is comparable to or better than a conventional one for certain image data can be reduced as compared to a conventional yellow toner. As a result, the amount of the yellow toner to be used in the development of certain image data on a unit area of the electrostatic image bearing member can be reduced. The toner amount per unit area is small, but the area of an electrostatic image to be formed on the electrostatic image bearing member is constant, so the height of a toner image developed on the electrostatic image bearing member with the toner can be reduced. According to the investigation conducted by the inventors of the present invention, the height of a toner image on the electrostatic image bearing member and the ease with which a toner scatters in the transferring step establish a proportional relationship. Accordingly, reducing the above height of the toner image suppresses the scattering of the toner, and allows the toner image on the electrostatic image bearing member to be transferred onto the transfer material with additional faithfulness. The effect is more significant in the case of an image-forming method involving the use of an intermediate transfer body, and is particularly significant when the intermediate transfer body is used twice or more.

In general, a toner image transferred onto a transfer material undergoes a fixing step so that a fixed image is formed. According to the investigation conducted by the inventors of the present invention, the height of an unfixed toner image on the transfer material and the ease with which the toner image spreads in a transferring step establish a proportional relationship. That is, even if a high-definition, high-resolution toner image is formed on the transfer material, when the toner image has a high height, the resolution of a fixed image reduces owing to the melt spread or rolling of toner in the fixing step. In the full-color image-forming method of the present invention, the height of a yellow toner image on the transfer material can be reduced, so a phenomenon such as the melt spread or rolling of toner in the fixing step is suppressed, and hence a fixed toner image faithful to the unfixed toner image on the transfer material can be formed.

Those effects are exerted irrespective of whether the fixing step is of a contact type or a non-contact type. When the fixing step is based on a heat fixing system, those effects are particularly significant; in the case of a fixing step based on a heat pressure system, a suppressing effect on the rolling of toner is significant.

When the fixing step is of a contact type, in particular, a heat pressure system, an elastic force possessed by paper used as a transfer material itself is utilized to some extent in order that a phenomenon in which the paper winds around a fixing unit in the fixing step may be prevented. That is, when toner used in development on the paper contacts with the fixing member of the fixing unit so as to melt, a force acting between the toner and the paper is larger than a force acting between the fixing member and the toner, so the toner is peeled from the fixing member by the elastic modulus of the paper, and a fixed image is obtained. Accordingly, when paper much thinner than a conventional one and having a smaller elastic modulus than that of the conventional one such as paper for an advertisement folded in a newspaper is used as a transfer material, the elastic modulus of the paper is not sufficient, so a force acting between a fixing member and toner becomes larger than a force acting between the toner and the paper, and a phenomenon in which the toner and the paper wind around the fixing member is apt to occur.

In the image-forming method of the present invention, when the true density of the yellow toner is represented by $\rho_{TY}$ and a toner amount upon development of image data based on the CIELAB color coordinate system with (L*=88.0, a*=−6.0, b*=95.0) (yellow solid image specified as a Japan color) onto the transfer material is represented by $M1_Y$ (mg/cm$^2$), a coloring coefficient $A_Y$ represented by the following expression 11 is preferably 3.0 to 12.0.

$$A_Y = A_{Y450}/(M1_Y \times \rho_{TY}) \quad \text{(Ex. 11)}$$

The above coloring coefficient $A_Y$ is considered to show such coloring properties for the image-forming method as described below: the extent of color development property possessed by toner to be used and the amount in which the toner is used in the formation of an image. According to the investigation conducted by the inventors of the present invention, as $A_{Y450}$ showing the color development property of the toner increases, the amount of the toner to be used in the formation of the image is preferably reduced, so the larger $A_Y$, the better coloring efficiency the image-forming method shows. When $A_Y$ is less than 3.0, the color development property possessed by the toner is so small as compared to the amount of the toner to be used in the development of the image that the image density of the image may be insufficient. In addition, even when the image density is sufficient, the amount of the toner to be used in the development is so large that the resolution of the image may reduce. On the other hand, when $A_Y$ exceeds 12.0, the color development property possessed by the toner is excessively large, so, even when the resolution of the image is sufficient, the color development efficiency of the colorant of the toner reduces, and a representable color space narrows in some cases. In addition, even when the color space is sufficient, the amount of the toner to be used in the formation of the image is so small that the coarseness of a highlight portion, the disturbance of an edge portion of a line image, or the like is apt to be remarkable. Accordingly, the range of $A_Y$ is more preferably 3.0 to 11.0, still more preferably 4.0 to 11.0, or particularly preferably 6.0 to 11.0.

The yellow toner of the present invention has $A_{Y450}$ in a specific range, and has color development property higher than that of an ordinary toner. As a result, even when an image is formed in a state where a toner usage is small, specifically, $A_Y$ is 3.0 to 12.0, an image density and an image color gamut each of which is comparable to a conventional one can be achieved. However, when one attempts to reduce a toner consumption by reducing the thickness of a toner layer of which the image is formed, the toner penetrates into paper, so a fiber of the paper is apt to be remarkable in an image portion. Alternatively, the appearance of the image is apt to reduce owing to a phenomenon such as a reduction in image chroma. When an image is formed while a toner amount on paper is reduced, the amount of a binder resin of which the image is constituted also reduces, so cold offset and hot offset are particularly apt to occur. In view of the foregoing, the toner of the present invention, which is excellent in low-temperature fixability to some extent, preferably retains an appropriate viscosity even at high temperatures.

It is preferable that: the step of forming the toner images include a step of transporting the toners to a developing portion with a toner carrying member and a step of developing the electrostatic images with the toners in the developing portion; and a ratio ($Q_Y/A_{Y450}$) of the absolute value for the charge quantity ($Q_Y$) (mC/kg) of the toner on the toner carrying member in the transporting step to $A_{Y450}$ is 22.0 to 50.0. In the present invention, a yellow toner having specific reflection spectral characteristics and more excellent in color development property than a conventional toner is used, but a toner amount with which an electrostatic latent image is developed is preferably controlled in consideration of a relationship between the color development property and the charge quantity possessed by the toner. That is, the following procedure is preferably adopted: as long as $Q_Y/A_{Y450}$ falls within the above range, as $A_{Y450}$ of the toner to be used increases, the value for $Q_Y$ is increased so that a toner amount used in the development of image data is reduced. With such procedure, the color development efficiency of the toner can be additionally improved, and the resolution of an image is improved. In addition, a toner excellent in color development property is apt to show a remarkable image failure even when the toner scatters to a slight extent, so the following procedure is preferably adopted: as the color development property of the toner becomes more excellent, the charge quantity of the toner is increased so that an image failure such as toner scattering is suppressed. Further, as the color development property of the toner becomes more excellent, the disturbance of an edge portion of, for example, a dot image or line image is more liable to be remarkable. However, when the charge quantity of the toner is retained in a certain range in association with the color development property of the toner, the disturbance of the edge portion is suppressed, and a reduction in resolution of the image is easily suppressed. When $Q_Y/A_{Y450}$ described above is less than 22.0, the charge quantity of the toner is so small as compared to the color development property of the toner that a toner amount to be used in the development of an image increases, and, even when the image density of the image is sufficient, the resolution of the image may reduce. Alternatively, the color development property of the toner is so large as compared to the charge quantity of the toner that, even when the image resolution is sufficient, the color development efficiency of the colorant of the toner reduces, and a representable color space narrows in some cases. When $Q_Y/A_{Y450}$ described above exceeds 50.0, the charge quantity of the toner is so large as compared to the color development property of the toner that a toner amount to be used in the development of an image is excessively small, and, even when the image density of the image is sufficient, the coarseness of a highlight portion, the disturbance of an edge portion of a line image, or the like is apt to be remarkable. Alternatively, the color development property of the toner is so small as compared to the charge quantity of the toner that, even when the image resolution is sufficient, the image density or image color gamut of the image may be insufficient. Accordingly, $Q_Y/A_{Y450}$ described above is more preferably 23.0 to 45.0, still more preferably 27.0 to 45.0, or still more preferably 30.0 to 45.0.

In the image-forming method of the present invention, $M1_Y$ (mg/cm$^2$) described above is preferably ($0.10\times\rho_{TY}$) to ($0.40\times\rho_{TY}$) mg/cm$^2$ because a toner consumption is reduced, and the effects of the present invention is favorably exerted. When $M1_Y$ is less than ($0.10\times\rho_{TY}$) mg/cm$^2$, the toner penetrates into paper, and the representable color space of an image narrows in some cases. Alternatively, the number of toner particles of which the image is formed reduces, and the uniformity of the image reduces in some cases. When $M1_Y$ exceeds ($0.40\times\rho_{TY}$)

mg/cm$^2$, the resolution of the image is apt to reduce. In addition, when a transfer material having a small elastic modulus is used, the winding of paper as the transfer material in the fixing step is apt to occur. Accordingly, the above range of $M1_Y$ is more preferably $(0.12\times\rho_{TY})$ to $(0.35\times\rho_{TY})$ mg/cm$^2$, or particularly preferably $(0.15\times\rho_{TY})$ to $(0.30\times\rho_{TY})$ mg/cm$^2$.

In the step of forming the toner images, a ratio $(H_{Y80}/H_{Y20})$ of the average height $(H_{Y80})$ of the toner layer of a toner image formed on the electrostatic image bearing member for image data having a yellow monochromatic density of 80% to the average height $(H_{Y20})$ of the toner layer of a toner image formed on the electrostatic image bearing member for image data having a yellow monochromatic density of 20% is preferably 0.90 to 1.30. According to the present invention, an additional improving effect on an image resolution is obtained, gloss non-uniformity is suppressed, an image with suppressed surface unevenness is obtained irrespective of the thickness of the transfer material, and a toner consumption can be reduced. When a toner excellent in color development property is used like the present invention, the tinge of an image at a certain point of the image is largely changed by the number of toner particles present in the direction perpendicular to an image surface at the point. Accordingly, in the present invention, such image-forming method as described below is preferably employed: the numbers of toner particles present in the directions perpendicular to the surfaces of the respective gradation images are uniformized to the extent possible irrespective of the image densities of the images. When $H_{Y80}/H_{Y20}$ described above is less than 0.90 or exceeds 1.30, a range from the highlight portion to halftone portion of an image becomes susceptible to image non-uniformity caused by changing in tinges owing to the non-uniformity of the number of toner particles present in the direction perpendicular to the surface of the image. In particular, when $H_{Y80}/H_{Y20}$ exceeds 1.30, the resolution of a high-density gradation portion is apt to reduce, and the reproducibility of an image for image data is apt to reduce. Accordingly, $H_{Y80}/H_{Y20}$ described above is preferably 0.95 to 1.20, or particularly preferably 1.00 to 1.15. Such image formation is effective in an image-forming method in which image formation based on an area coverage modulation method where gradation is represented on the basis of the area of an image region is adopted over a range from a low-density region to a high-density solid image region.

The present invention relates to a full-color image-forming method including the steps of: forming electrostatic images on a charged electrostatic image bearing member; developing the formed electrostatic images with toners to form toner images; transferring the formed toner images onto a transfer material; and fixing the transferred toner images to the transfer material to form fixed images, in which: the step of forming the toner images includes a step of performing development with a first toner selected from a black toner, a cyan toner, a magenta toner, and a yellow toner to form a first toner image, a step of performing development with a second toner except the first toner selected from the black toner, the cyan toner, the magenta toner, and the yellow toner to form a second toner image, a step of performing development with a third toner except the first toner and the second toner selected from the black toner, the cyan toner, the magenta toner, and the yellow toner to form a third toner image, and a step of performing development with a fourth toner except the first toner, the second toner, and the third toner selected from the black toner, the cyan toner, the magenta toner, and the yellow toner to form a fourth toner image; and the black toner is a black toner containing at least a binder resin and a colorant, and the black toner has a value $(c^*_K)$ for c* based on a CIELAB color coordinate system of 20.0 or less, an absorbance $(A_{K600})$ at a wavelength of 600 nm of 1.610 or more, and a ratio $(A_{K600}/A_{K460})$ of $A_{K600}$ to an absorbance $(A_{K460})$ at a wavelength of 460 nm of 0.970 to 1.035 in reflectance spectrophotometry.

According to such full-color image-forming method, an image color gamut comparable to or better than a conventional one can be represented, a good-appearance image with reduced surface unevenness can be obtained, and a running cost can be suppressed as a result of a reduction in consumption of the black toner. Further, a toner amount to be used in the development of the toner images on the electrostatic image bearing member can be reduced, so toner scattering in the transferring step can be suppressed, and toner images faithful to the electrostatic images can be formed on the transfer material. The deformation of each of the toner images on the transfer material is suppressed in the transferring step, so fixed images faithful to the electrostatic images can be formed. In addition, a toner amount on a transfer material can be reduced, so, even when paper much thinner than a conventional one such as paper for an advertisement folded in a newspaper is used as a transfer material, a fixation failure or the winding of the paper around a fixing unit is suppressed, and an image with small surface unevenness can be formed.

The reason for the foregoing is as described below. Since a black toner having specific reflection spectral characteristics and more excellent in color development property than a conventional toner is used, a toner amount per unit area needed for representing an image color gamut and a color space each of which is comparable to or better than a conventional one for certain image data can be reduced as compared to a conventional black toner. As a result, the amount of the black toner to be used in the development of certain image data on a unit area of the electrostatic image bearing member can be reduced. The toner amount per unit area is small, but the area of an electrostatic image to be formed on the electrostatic image bearing member is constant, so the height of a toner image developed on the electrostatic image bearing member with the toner can be reduced. According to the investigation conducted by the inventors of the present invention, the height of a toner image on the electrostatic image bearing member and the ease with which a toner scatters in the transferring step establish a proportional relationship. Accordingly, reducing the above height of the toner image suppresses the scattering of the toner, and allows the toner image on the electrostatic image bearing member to be transferred onto the transfer material with additional faithfulness. The effect is more significant in the case of an image-forming method involving the use of an intermediate transfer body, and is particularly significant when the intermediate transfer body is used twice or more.

In general, a toner image transferred onto a transfer material undergoes a fixing step so that a fixed image is formed. According to the investigation conducted by the inventors of the present invention, the height of an unfixed toner image on the transfer material and the ease with which the toner image spreads in a transferring step establish a proportional relationship. That is, even if a high-definition, high-resolution toner image is formed on the transfer material, when the toner image has a high height, the resolution of a fixed image reduces owing to the melt spread or rolling of toner in the fixing step. In the full-color image-forming method of the present invention, the height of a black toner image on the transfer material can be reduced, so a phenomenon such as the melt spread or rolling of toner in the fixing step is suppressed, and hence a fixed toner image faithful to the unfixed toner image on the transfer material can be formed.

Those effects are exerted irrespective of whether the fixing step is of a contact type or a non-contact type. When the fixing step is based on a heat fixing system, those effects are particularly significant; in the case of a fixing step based on a heat pressure system, a suppressing effect on the rolling of toner is significant.

When the fixing step is of a contact type, in particular, a heat pressure system, an elastic force possessed by paper used as a transfer material itself is utilized to some extent in order that a phenomenon in which the paper winds around a fixing unit in the fixing step may be prevented. That is, when toner used in development on the paper contacts with the fixing member of the fixing unit so as to melt, a force acting between the toner and the paper is larger than a force acting between the fixing member and the toner, so the toner is peeled from the fixing member by the elastic modulus of the paper, and a fixed image is obtained. Accordingly, when paper much thinner than a conventional one and having a smaller elastic modulus than that of the conventional one such as paper for an advertisement folded in a newspaper is used as a transfer material, the elastic modulus of the paper is not sufficient, so a force acting between a fixing member and toner becomes larger than a force acting between the toner and the paper, and a phenomenon in which the toner and the paper wind around the fixing member is apt to occur.

In the image-forming method of the present invention, when the true density of the black toner is represented by $\rho_{TK}$ and a toner amount upon development of image data based on the CIELAB color coordinate system with (L*=13.2, a*=1.3, b*=1.9) (black solid image specified as a Japan color) onto the transfer material is represented by $M1_K$ (mg/cm$^2$), a coloring coefficient $A_K$ represented by the following expression 12 is preferably 3.0 to 12.0.

$$A_K = A_{K600}/(M1_K \times \rho_{TK}) \quad \text{(Ex. 12)}$$

The above coloring coefficient $A_K$ is considered to show such coloring properties for the image-forming method as described below: the extent of color development property possessed by toner to be used and the amount in which the toner is used in the formation of an image. According to the investigation conducted by the inventors of the present invention, as $A_{K600}$ showing the color development property of the toner increases, the amount of the toner to be used in the formation of the image is preferably reduced, so the larger $A_K$, the better coloring efficiency the image-forming method shows. When $A_K$ is less than 3.0, the color development property possessed by the toner is so small as compared to the amount of the toner to be used in the development of the image that the image density of the image may be insufficient. In addition, even when the image density is sufficient, the amount of the toner to be used in the development is so large that the resolution of the image may reduce. On the other hand, when $A_K$ exceeds 12.0, the color development property possessed by the toner is excessively large, so, even when the resolution of the image is sufficient, the color development efficiency of the colorant of the toner reduces, and a representable color space narrows in some cases. In addition, even when the color space is sufficient, the amount of the toner to be used in the formation of the image is so small that the coarseness of a highlight portion, the disturbance of an edge portion of a line image, or the like is apt to be remarkable. Accordingly, the range of $A_K$ is more preferably 3.0 to 11.0, still more preferably 4.0 to 11.0, or particularly preferably 6.0 to 11.0.

The black toner of the present invention has $A_{K600}$ in a specific range, and has color development property higher than that of an ordinary toner. As a result, even when an image is formed in a state where a toner usage is small, specifically, $A_K$ is 3.0 to 12.0, an image density and an image color gamut each of which is comparable to a conventional one can be achieved. However, when one attempts to reduce a toner consumption by reducing the thickness of a toner layer of which the image is formed, the toner penetrates into paper, so a fiber of the paper is apt to be remarkable in an image portion. Alternatively, the appearance of the image is apt to reduce owing to a phenomenon such as a reduction in image chroma. When an image is formed while a toner amount on paper is reduced, the amount of a binder resin of which the image is constituted also reduces, so cold offset and hot offset are particularly apt to occur. In view of the foregoing, the toner of the present invention, which is excellent in low-temperature fixability to some extent, preferably retains an appropriate viscosity even at high temperatures.

It is preferable that: the step of forming the toner images include a step of transporting the toners to a developing portion with a toner carrying member and a step of developing the electrostatic images with the toners in the developing portion; and a ratio ($Q_K/A_{K600}$) of the absolute value for the charge quantity ($Q_K$) (mC/kg) of the toner on the toner carrying member in the transporting step to $A_{K600}$ is 22.0 to 50.0. In the present invention, a black toner having specific reflection spectral characteristics and more excellent in color development property than a conventional toner is used, but a toner amount with which an electrostatic latent image is developed is preferably controlled in consideration of a relationship between the color development property and the charge quantity possessed by the toner. That is, the following procedure is preferably adopted: as long as $Q_K/A_{K600}$ falls within the above range, as $A_{K600}$ of the toner to be used increases, the value for $Q_K$ is increased so that a toner amount used in the development of image data is reduced. With such procedure, the color development efficiency of the toner can be additionally improved, and the resolution of an image is improved. In addition, a toner excellent in color development property is apt to show a remarkable image failure even when the toner scatters to a slight extent, so the following procedure is preferably adopted: as the color development property of the toner becomes more excellent, the charge quantity of the toner is increased so that an image failure such as toner scattering owing to charge defect is suppressed. Further, as the color development property of the toner becomes more excellent, the disturbance of an edge portion of, for example, a dot image or line image is more liable to be remarkable. However, when the charge quantity of the toner is retained in a certain range in association with the color development property of the toner, the disturbance of the edge portion is suppressed, and a reduction in resolution of the image is easily suppressed. When $Q_K/A_{K600}$ described above is less than 22.0, the charge quantity of the toner is so small as compared to the color development property of the toner that a toner amount to be used in the development of an image increases, and, even when the image density of the image is sufficient, the resolution of the image may reduce. Alternatively, the color development property of the toner is so large as compared to the charge quantity of the toner that, even when the image resolution is sufficient, the color development efficiency of the colorant of the toner reduces, and a representable color space narrows in some cases. When $Q_K/A_{K600}$ described above exceeds 50.0, the charge quantity of the toner is so large as compared to the color development property of the toner that a toner amount to be used in the development of an image is excessively small, and, even when the image density of the image is sufficient, the coarseness of a highlight portion, the disturbance of an edge portion of a line image, or the like is apt to be remarkable. Alternatively, the color development property of the toner is so small as compared to the charge quantity of the toner that, even when the image resolution is sufficient, the image density or image color gamut of the image may be insufficient. Accordingly, $Q_K/A_{K600}$ described above is more preferably 23.0 to 50.0, still more preferably 30.0 to 50.0, or still more preferably 36.0 to 50.0.

In the image-forming method of the present invention, $M1_x$ (mg/cm$^2$) described above is preferably $(0.10\times\rho_{TK})$ to $(0.40\times\rho_{TK})$ mg/cm$^2$ because a toner consumption is reduced, and the effects of the present invention is favorably exerted. When $M1_K$ is less than $(0.10\times\rho_{TC})$ mg/cm$^2$, the toner penetrates into paper, and the representable color space of an image narrows in some cases. Alternatively, the number of toner particles of which the image is formed reduces, and the uniformity of the image reduces in some cases. When $M1_K$ exceeds $(0.40\times\rho_{TK})$ mg/cm$^2$, the resolution of the image is apt to reduce. In addition, when a transfer material having a small elastic modulus is used, the winding of paper as the transfer material in the fixing step is apt to occur. Accordingly, the above range of $M1_K$ is more preferably $(0.12\times\rho_{TK})$ to $(0.35\times\rho_{TK})$ mg/cm$^2$, or particularly preferably $(0.15\times\rho_{TK})$ to $(0.30\times\rho_{TK})$ mg/cm$^2$.

In the step of forming the toner images, a ratio $(H_{K80}/H_{K20})$ of the average height $(H_{K80})$ of the toner layer of a toner image formed on the electrostatic image bearing member for image data having a black monochromatic density of 80% to the average height $(H_{K20})$ of the toner layer of a toner image formed on the electrostatic image bearing member for image data having a black monochromatic density of 20% is preferably 0.90 to 1.30. According to the present invention, an additional improving effect on an image resolution is obtained, gloss non-uniformity is suppressed, an image with suppressed surface unevenness is obtained irrespective of the thickness of the transfer material, and a toner consumption can be reduced. When a toner excellent in color development property is used like the present invention, the tinge of an image at a certain point of the image is largely changed by the number of toner particles present in the direction perpendicular to an image surface at the point. Accordingly, in the present invention, such image-forming method as described below is preferably employed: the numbers of toner particles present in the directions perpendicular to the surfaces of the respective gradation images are uniformized to the extent possible irrespective of the image densities of the images. When $H_{K80}/H_{K20}$ described above is less than 0.90 or exceeds 1.30, a range from the highlight portion to halftone portion of an image becomes susceptible to image non-uniformity caused by changing in tinges owing to the non-uniformity of the number of toner particles present in the direction perpendicular to the surface of the image. In particular, when $H_{K80}/H_{K20}$ exceeds 1.30, the resolution of a high-density gradation portion is apt to reduce, and the reproducibility of an image for image data is apt to reduce. Accordingly, $H_{K80}/H_{K20}$ described above is preferably 0.95 to 1.20, or particularly preferably 1.00 to 1.15. Such image formation is effective in an image-forming method in which image formation based on an area coverage modulation method where gradation is represented on the basis of the area of an image region is adopted over a range from a low-density region to a high-density solid image region.

Next, an image-forming apparatus preferable for the present invention will be shown.

(1) Example of Image-Forming Apparatus

Figure 3:
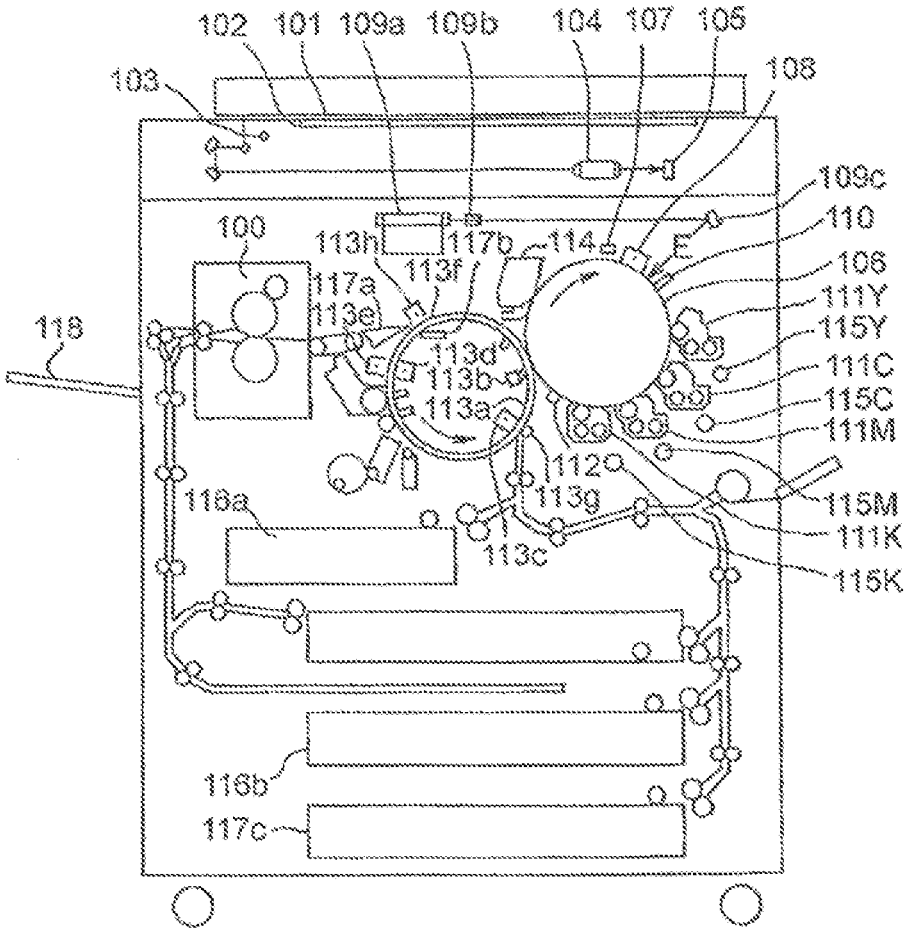
FIG. 3 is a view showing the outline of a structure of an example of an image-forming apparatus to be used in the present invention.

FIG. 3 is an outline constitution view showing an example of an image-forming apparatus for forming a full-color image by an electrophotographic method. The image-forming apparatus of FIG. 3 is used as a full-color copying machine or full-color printer. In the case of a full-color copying machine, as shown in FIG. 3, the apparatus has a digital color image reader portion at its upper portion and a digital color image printer portion at its lower portion.

In the image reader portion, a manuscript 101 is mounted on a manuscript board glass 102, and is exposed to and scanned with an exposure lamp 103, whereby a reflected light image from the manuscript 101 is converged on a full-color sensor 105 by a lens 104, and a color separation image signal is obtained. The color separation image signal passes through an amplifier circuit (not shown), is processed in a video processing unit (not shown), and is sent to the digital image printer portion.

In the image printer portion, a photosensitive drum 106 as an image bearing member has, for example, a photosensitive layer having an organic photoconductor, and is rotatably supported in the direction indicated by an arrow. Arranged around the photosensitive drum 106 are a pre-exposure lamp 107, a corona charging device 108, a laser exposure optical system 109, a potential sensor 110, four developing devices 111Y, 111C, 111M, and 111K containing toners different from one another in color, means 112 for detecting a light quantity on the drum, a transferring device 113, and a cleaning device 114.

In the laser exposure optical system, an image signal from the reader portion is converted into an optical signal for image scan exposure in a laser output portion (not shown), and the converted laser light is reflected on a polygon mirror 109*a*, and is projected onto the surface of the photosensitive drum 106 through a lens 109*b* and a mirror 109*c*.

The printer portion rotates the photosensitive drum 106 in the direction indicated by the arrow at the time of image formation, negatively charges the photosensitive drum 106 in a uniform manner with the charging device 108 after the antistatic treatment of the drum with the pre-exposure lamp 107, and irradiates each separated color with an optical image E to form an electrostatic image on the photosensitive drum 106.

Next, a predetermined developing device is actuated to develop the electrostatic image on the photosensitive drum 106, whereby a toner image is formed with a toner on the photosensitive drum 106. The developing devices 111Y, 111C, 111M, and 111K alternatively approach the photosensitive drum 106 in accordance with the respective separated colors by virtue of the operations of their eccentric cams 115Y, 115C, 115M, and 115K so as to perform development.

The transferring device has a transferring drum 113*a*, a transfer charging device 113*b*, an adsorption charging device 113*c* for electrostatically adsorbing a recording material and an adsorbing roller 113*g* opposed to the device 113*c*, an inner charging device 113*d*, an outer charging device 113*e*, and a separation charging device 113*h*. The transferring drum 113*a* is rotatably pivoted, and a transfer sheet 113*f* as a transfer material bearing member for bearing a transfer material is tensioned at the opening portion of the peripheral surface of the drum so as to be integral with the upper portion of the cylinder of the drum. A resin film such as a polycarbonate film is used as the transfer sheet 113*f*.

The transfer material is transported from a cassette 116*a*, 116*b*, or 116*c* to the transferring drum 113*a* through a transfer sheet transporting system, and is mounted on the transferring drum 113*a*. The transfer material mounted on the transferring drum 113*a* is repeatedly transported to a transferring position opposed to the photosensitive drum 106 in association with the rotation of the transferring drum 113*a*, and the toner image on the photosensitive drum 106 is transferred onto the transfer material by virtue of the action of the transfer charging device 113*b* during the passage of the transfer material thorough the transferring position.

The toner image may be directly transferred from the photosensitive member onto the transfer material. Alternatively, the following procedure may be adopted: the toner image on the photosensitive member is transferred onto an intermediate transfer body, and the toner image is transferred from the intermediate transfer body onto the transfer material.

The above image-forming step is repeated for yellow (Y), magenta (M), cyan (C), and black (K) toners, and a color image obtained by superimposing four toner images on the transfer material on the transferring drum 113*a* is obtained.

The transfer material onto which the four toner images have been transferred as described above is separated from the transferring drum 113*a* by virtue of the action of each of a separation claw 117*a*, a separation pushup roller 117*b*, and the separation charging device 113*h* so as to be sent to a heat pressure fixing unit 100 where the images are fixed under heat and pressure so that the color mixture, color development, and fixing to the transfer material of the toners are performed, and a full-color fixed image is obtained. After that, the transfer material is discharged to a tray 118, whereby the formation of the full-color image is completed.

A binarizing approach in the present invention will be described.

Various methods have been proposed as binarizing approaches for gradation reproduction. Methods to be most frequently employed in ordinary cases are a dither method and a dot pattern method. The dither method involves causing one pixel of a read input signal to correspond to one pixel of binary recording as shown in FIG. 9(*a*).

Figure 9:
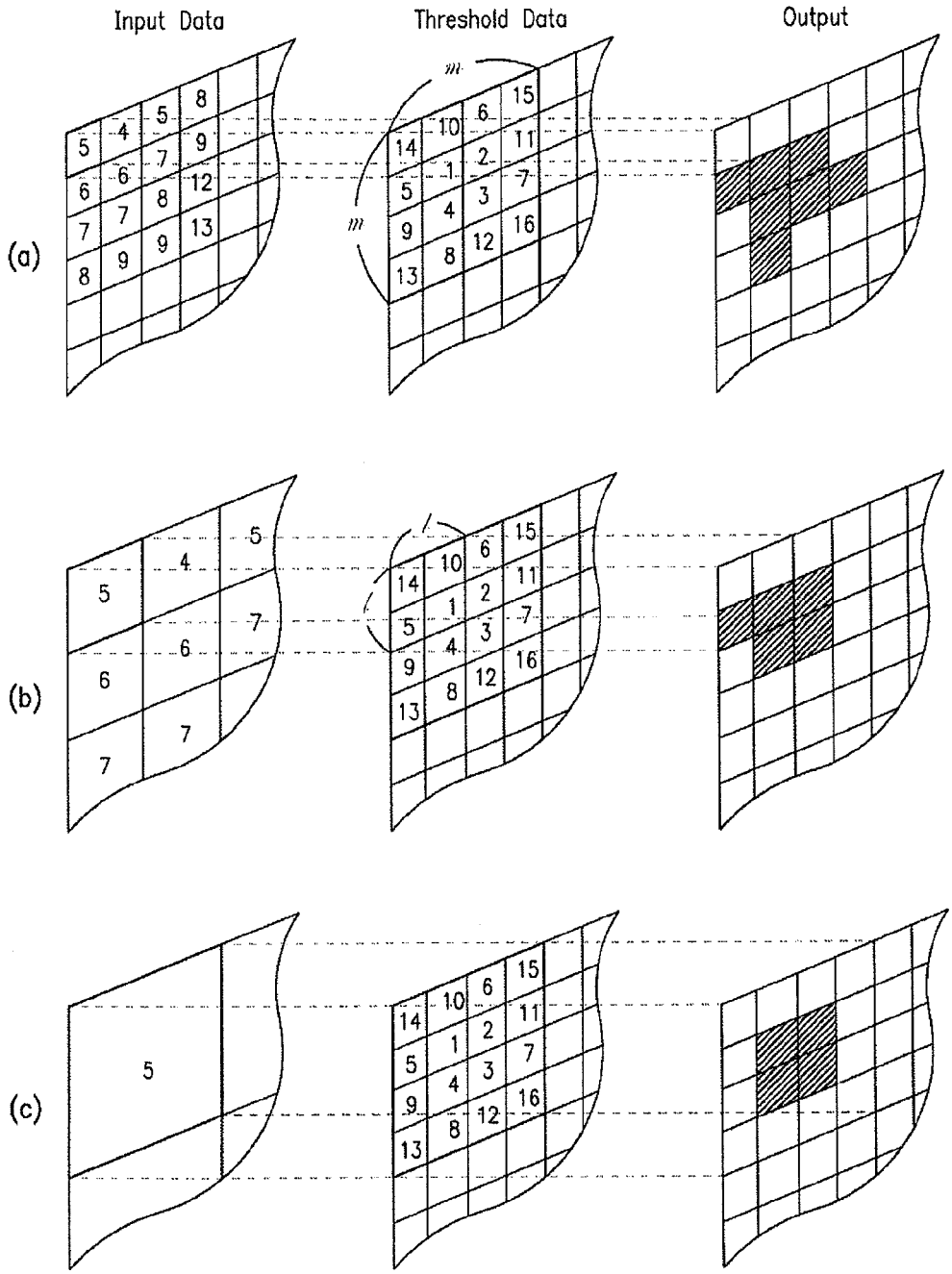
FIG. 9 are each a view showing an example of a binarizing approach for gradation reproduction employed in the present invention.

The dot pattern method involves causing one pixel of a read input signal to correspond to multiple recorded pixels as shown in FIG. 9(*c*).

An approach intermediate between both the methods is a method involving causing one pixel of a read input signal to correspond to a partial matrix (L×L) in an m×m matrix as shown in FIG. 9(*b*). In the correspondence to the partial pixel, L=1 corresponds to the dither method, L=m corresponds to the dot pattern method, and an output image size can be changed by taking an arbitrary value for L.

Figure 10:
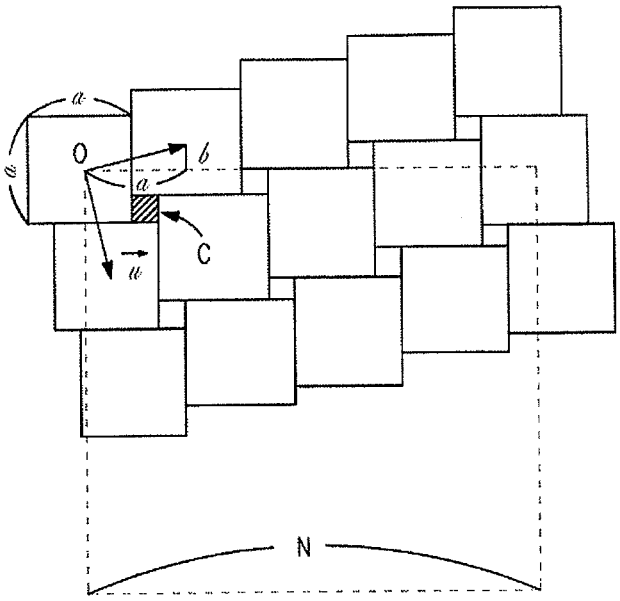
FIG. 10 is a view showing an example of a dither pattern of each color employing the binarizing approach employed in the present invention.

A dither pattern for each color is formed by employing such binarizing approach. A halftone dot having a screen angle can be produced in a dither pattern for each color by placing basic halftone dots (basic cells) each composed of a×a pixels while appropriately displacing the halftone as shown in FIG. 10. When a displacement value (displacement vector) is represented by u=(a, b), a screen angle θ to be obtained can be determined from the following expression.

$$\theta=\tan^{-1}(b/a)$$

A square threshold matrix size (N) corresponding to one cycle of the dots can be determined from the following expression using the values a and b for such displacement vector u.

$$N=LCM(a,b)\times(b/a+a/b)$$

It should be noted that LCM(a, b) represents the least common multiple of a and b. As small a matrix size as possible is preferably used in order that a dither pattern having a desired angle may be realized, and a burden on hardware may be alleviated.

In the present invention, providing different screen angles for the respective colors has, for example, the following effects: the uniformity of the respective colors can be maintained even when the positions of the colors are shifted, and the generation of moire fringes can be suppressed. In particular, the generation of moire fringes is largely affected by a combination of the screen angles of the respective colors. A preferable combination of screen angles in the present invention is as follows: when yellow is 0°, cyan (or magenta) is 14 to 22°, black is 41 to 49°, and magenta (or cyan) is 68 to 76°. The following combination is particularly preferable: when yellow is 0°, cyan (or magenta) is 16 to 20°, black is 43 to 47°, and magenta (or cyan) is 69 to 73°.

Figure 12:
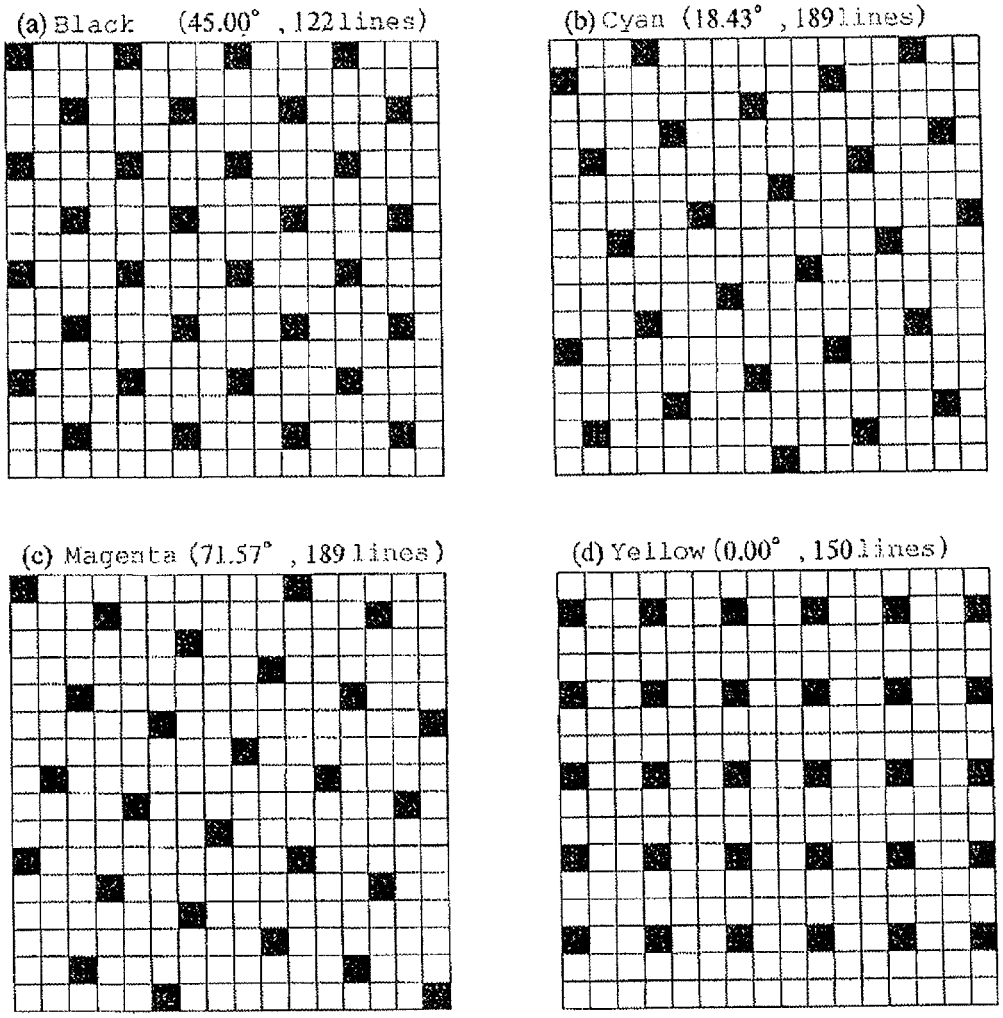
FIG. 12 are each view showing an example of an arrangement of the lattice points of the dither pattern used in the present invention.

FIG. 12 shows an example of the arrangement of dither pattern lattice points which can be preferably used in the present invention. In the arrangement, the following setting is established: yellow (0°, 150 lines), cyan (18.43°, 189 lines), black (45.00°, 122 lines), and magenta (71.57°, 189 lines).

In addition, a screen angle is preferably provided by providing a phase difference for the above-mentioned pulse width modulation system (PWM system).

In addition, the dither pattern forming approach employed in the present invention allows multiple levels to be output. The following procedure has only to be adopted: multiple dither matrix patterns are prepared, an input pixel value and the threshold of each dither matrix pattern are compared with each other, and the gradation of a matrix pattern exceeding the threshold is output. The lighting width of a laser pulse at that time is controlled by gradation; the lighting position of the pulse at that time can be set in consideration of a "center, left, or right" in a pixel, and the position of a pixel in the matrix pattern and an influence of a peripheral pixel around the pattern.

The perimeter of a rasterized image in the present invention is determined on the assumption that the halftone pixel of a multi-level image is also one pixel. Although the position of a dot may shift to the "center, left, or right" in one pixel owing to the above change in lighting position, even a halftone image is converted into one pixel with an output resolution (such as 600 dpi or 1,200 dpi) as a basic unit.

In the present invention, a halftone dot dither system in which the size of a halftone dot is changed, or a diffusion dither system in which the number of halftones dots is changed while the size of each halftone dot is not changed can be used.

In the present invention, the diffusion dither system is more preferably used. An image density in a dot system is determined by the area ratio of dots. That is, as the area of the dots increases, the image density increases, but the use of the diffusion dither system enables a representable color space to be enlarged upon formation of a full-color image. In the present invention, a toner having high color development property is used. When the respective color toners are each a toner having high color development property, the color development efficiency of a toner present in a lower layer on a transfer material is apt to reduce owing to an influence of a toner present in an upper layer on the material. Accordingly, the use of the diffusion dither system allows a portion where the respective color toner layers are superimposed to be additionally reduced, and enables the toners to exert their color development properties to the fullest extent possible. In addition, when a fine-line image is formed with a toner having high color development property, the nick or edge portion of each halftone dot of which a fine line is formed is apt to be remarkable, but the use of the diffusion dither system improves fine-line reproducibility, and can increase a resolution. In addition, the use can reduce a toner usage.

A film fixing system is preferably used as a heat fixing method in the image-forming method of the present invention. Specific examples of the film fixing system include an SURF fixing system and an IHF fixing system. That is, the following fixing method is preferable: heat pressure means having at least a rotatable heating body surrounded by a heat-resistant film and a pressure roller as a pressure member is used, the pressure roller and the heat-resistant film are brought into contact with each other to form a nip portion, and a recording material is transported while being sandwiched between the film and the pressure roller at the nip portion so that a fixed image is formed. When a toner having high color development property is used while its usage is reduced like the present invention, the toner penetrates into a transfer material such as paper in the fixing step, and image appearance reduces in some cases. A film fixing system which: reduces the pressure to be applied to the toner at the nip portion; and can enlarge a nip width is preferable.

Figure 4:
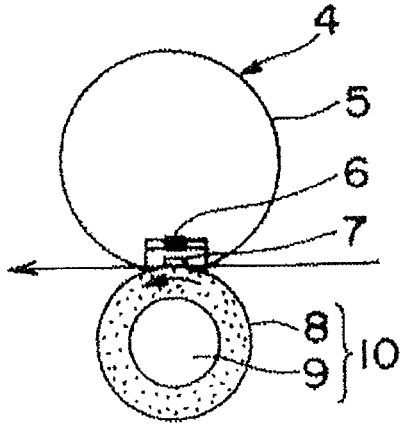
FIG. 4 is an outline view showing an example of a fixing apparatus to be used in the present invention.

FIG. 4 shows an example of a fixing apparatus that realizes the SURF fixing system. The fixing apparatus has a heating device 4 and a pressure roller 10 provided so as to be opposed to the device. The heating device 4 has: a cylindrical heat-resistant film 5 made of polyimide coated with a fluorine resin or the like and having a thickness around 50 μm; and a ceramic heater 7 as a heating body and a temperature detecting element 6 such as a thermistor placed in contact with the heater to adjust the temperature at which toner is heated. The pressure roller (pressure member) 10 has a mandrel 9 made of an aluminum alloy and a rubber roller 8 which: is placed on the outside of the peripheral surface of the mandrel; and is coated with a resin composition excellent in releasing performance and heat resistance such as a silicone resin or a fluorine resin.

The pressure roller 10 is provided while being biased by biasing means (not shown) such as a spring toward the heating surface of the ceramic heater (heating means) 7. The heat-resistant film 5 is provided so as to be movable along an endless orbital (circular orbital in the shown form) passing through the upper portion of the heating surface of the ceramic heater. The heat-resistant film 5 is sandwiched between the ceramic heater 7 and the pressure roller 10 to form a nip portion between the film and the pressure roller 10. A recording material having an unfixed toner image is introduced into the nip portion, whereby toner on the recording material melts, and a fixed toner image is formed on the recording material.

Figure 5:
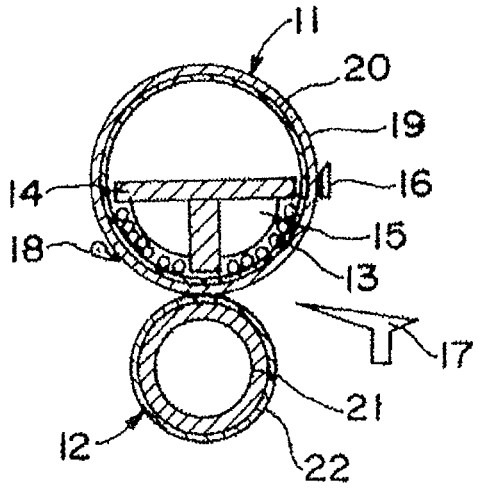
FIG. 5 is an outline view showing another example of the fixing apparatus to be used in the present invention.

FIG. 5 shows an example of a fixing apparatus that realizes the IHF fixing system. The fixing apparatus has a fixing belt 11 and a pressure roller (pressure member) 12 provided so as to be opposed to the belt. The fixing belt 11 has a metal conductor 20 and an elastic layer 19 made of a fluorine resin or the like with which the surface of the conductor is coated. An excitation coil 13 is placed in the fixing belt 11 so as to be concentric with the belt. In addition, a core 14 formed of a magnetic substance and serving as a magnetic field-shielding member for shielding a magnetic field is placed in the fixing belt 11. The pressure roller 12 has a hollow mandrel 21 made of an aluminum alloy and a surface releasable heat-resistant elastic layer 22 with which the outside of the peripheral surface of the mandrel is coated.

The core 14 is supported by a pair of holders 15 each having a fan sectional shape. The holders 15 are each formed of a heat-resistant resin such as polyphenylene sulfide (PPS), polyether ether ketone (PEEK), or a phenol resin. The excitation coil 13 is formed by winding a wire along the surface of each of the holders 15 so that the coil is of such a structure that the wire travels along the inner peripheral surface of the fixing roller from the central protruded portion of the core 14 having a "T"-shaped section.

A temperature sensor 16 is placed in contact with the surface of the fixing belt 11. In addition, a transport guide 17 is placed at a position for guiding a recording material having an unfixed toner image to a pressure contact portion (nip portion) between the fixing belt 11 and the pressure roller 12. In addition, a separation claw 18 is provided in the rear of the fixing apparatus. The separation claw 18 is placed in contact with, or close to, the surface of the fixing belt 11 to prevent the recording material such as paper from winding around the fixing belt 11.

The pressure roller 12 is provided while being biased by biasing means (not shown) such as a spring toward the fixing belt 11 (core 14). The fixing belt 11 is provided so as to be movable along an endless orbital (circular orbital in the shown form) passing while facing the excitation coil 13. The fixing belt 11 is sandwiched between the core 14 and the pressure roller 12 at its portion opposed to the pressure roller 12 to form a nip portion between the belt and the pressure roller 12. A recording material having an unfixed toner image is introduced into the nip portion, whereby toner on the recording material melts, and a fixed toner image is formed on the recording material.

The excitation coil 13 generates a high-frequency magnetic field by flowing a high-frequency current in the coil. The magnetic field generates an induced eddy current in the fixing belt 11 to cause the fixing belt 11 to undergo Joule heating by virtue of the skin resistance of the fixing belt itself. In the apparatus, the excitation coil and a series of devices that flows a high-frequency current in the excitation coil are said to be heating means. The temperature of the fixing belt 11 is automatically controlled to a constant temperature by increasing or decreasing power supply to the excitation coil 13 on the basis of a signal detected by the temperature sensor 16.

In addition, the high-frequency magnetic field can be efficiently generated by combining the excitation coil 13 with the core 14 composed of a magnetic substance. In particular, when a core having a "T"-shaped section is used like the form shown in FIG. 5, a heat quantity needed for the fixing apparatus can be generated with low power by virtue of the effective concentration of the high-frequency magnetic field or a shielding effect on a magnetic field to a portion except a heat-generating portion.

A material for the elastic layer 19 is, for example, a fluorine resin or a silicone resin. Specific examples of the material include a tetrafluoroethylene/perfluoroalkylvinylether copolymer (PFA), polytetrafluoroethylene (PTFE), polyvinyl fluoride (PVF), a vinylidene fluoride fluorocarbon rubber, a propylene/tetrafluoroethylene fluorocarbon rubber, a fluorosilicone rubber, and a silicone rubber.

The thickness of the elastic layer 19 is preferably 10 to 500 μm in order that gloss non-uniformity due to the fact that the heating surface of heating means cannot follow the unevenness of the recording material or the unevenness of a toner layer upon printing of an image may be prevented.

When the thickness of the elastic layer 19 is less than 10 μm, the layer cannot exert its function as an elastic member, and a pressure distribution at the time of fixation becomes non-uniform, so an unfixed toner having a secondary color cannot be sufficiently fixed under heat particularly at the time of the fixation of a full-color image, and the gloss non-uniformity of a fixed image arises. Moreover, the color mixing property of toners deteriorates owing to the insufficient melting of the toners, with the result that a high-definition full-color image cannot be obtained. Accordingly, a thickness of less than 10 μm is not preferable. In addition, when the thickness of the elastic layer 19 exceeds 500 μm, thermal conductivity at the time of fixation is inhibited, and heat followability at a fixing surface reduces, with the result that quick start property reduces, and fixation non-uniformity is apt to arise. Accordingly, a thickness in excess of 500 μm is not preferable either.

Next, methods of measuring the respective physical properties concerning the toner of the present invention will be described below.

(Measurement of True Density of Toner)

The true density of the toner can be measured by a method involving the use of a gasreplacement type pycnometer. The measurement principle is as described below. A shut-off valve is provided between a sample chamber (having a volume $V_1$) and a comparison chamber (having a volume $V_2$) each having a constant volume, and the mass ($M_0$ (g)) of a sample is measured in advance before the sample is loaded into the sample chamber. The inside of each of the sample chamber and the comparison chamber is filled with an inert gas such as helium, and a pressure at that time is represented by $P_1$. The shut-off valve is closed, an inert gas is added only to the sample chamber, and a pressure at that time is represented by $P_2$. A pressure in a system when the shut-off valve is opened so that the sample chamber and the comparison chamber are connected to each other is represented by $P_3$. The volume ($V_0$ ($cm^3$) of the sample can be determined from the following expression A. The true density $\rho_T$ ($g/cm^3$) of the toner can be determined from the following expression B.

$$V_0=V_1-[V_2/\{(P_2-P_1)/(P_3-P_1)-1\}] \quad \text{(Ex. A)}$$

$$\rho_T=M_0/V_0 \quad \text{(Ex. B)}$$

The true density can be measured with, for example, a dry automatic densimeter Accupyc 1330 (manufactured by Shimadzu Corporation). At that time, a 10-$cm^3$ sample container is used, a helium gas purge as a sample pretreatment is performed at a maximum pressure of 19.5 psig (134.4 kPa) ten times. After that, a fluctuation in pressure in the sample chamber of 0.0050 psig/min is used as an index for judging whether the pressure in the container reaches equilibrium. If the fluctuation is equal to or lower than the value, the pressure is regarded as being in an equilibrium state, so measurement is initiated, and the true density is automatically measured. The measurement is performed five times, and the average of the five measured values is determined and defined as the true density ($g/cm^3$).

(Measurement of Viscosity ($\eta_{105}$) of Toner at 105° C. and Viscosity ($\eta_{120}$ of Toner at 120° C.)

The viscosities of the toner at 105° C. and 120° C. can be measured with a constant-load capillary extrusion rheometer. The method involves measuring an extrusion resistance when a molten substance passes through a capillary to measure the viscosity of the molten substance.

The measurement principle is as described below. A sample loaded into a cylinder is heated, and a constant pressure P is applied from above the sample by a piston. When the sample is heated to a certain temperature or higher, the sample is extruded through a capillary provided for the bottom portion of the cylinder. The viscosity η (Pa·s) of the toner at each temperature can be determined from the following expression by using an outflow Q ($cm^3/s$) and a pressure at that time:

$$\text{Outflow } Q=A\times(S_2-S_1)/((t_2-t_1)\times 10)$$

where $S_1$ represents the position (mm) of the piston at a time $t_1$ (s), $S_2$ represents the position (mm) of the piston at a time $t_2$ (s), and A represents the sectional area ($cm^2$) of the piston;

$$\text{Viscosity } \eta=\pi\times D^4\times P/(128{,}000\times L\times Q)$$

where P represents a pressure (Pa), D represents the diameter (mm) of the capillary, and L represents the length (mm) of the capillary.

To be specific, the measurement is performed with, for example, a Flow Tester CFT-500D (manufactured by Shimadzu Corporation) under the following conditions.

Sample: When the true density of the toner is represented by ρ, (1.5×ρ) g of the toner are weighed, and the toner is subjected to pressure molding with a pressure molder under a normal-temperature, normal-pressure environment at a load of 200 kgf (1,960N) for 2 minutes into a cylinder having a diameter of about 10 mm and a height of about 15 mm to be used as a sample.

Cylinder pressure: $4.90\times10^5$ (Pa)

Measurement mode: temperature increase method

Rate of temperature increase: 4.0° C./min

The viscosity can be measured with a mirror-abraded die having a length of 1.0 mm and a diameter of 0.3 mm, 0.5 mm, 1.0 mm, or 1.5 mm. When each die is used, the viscosities of the toner at 40° C. to 200° C. are measured, and a value determined by one measurement is used for each of the viscosity at 105° C. and the viscosity at 120° C.

(Measurement of Molecular Weight in Toner, Binder Resin, Wax, and the Like by Gel Permeation Chromatography (GPC))

As described below, a molecular weight distribution of binder resin in the toner, and resin part of wax dispersion medium by GPC can be determined through measurement by GPC using THF soluble matter obtained by dissolving a sample as a measuring object in a tetrahydrofuran (THF) solvent.

When a true density of a sample to be measured is defined as ρ, (25×ρ)mg of the sample is put in 5 ml of THF, and the sample is left for 24 hours. Then, the mixture is passed through a sample treatment filter (having a pore size of 0.45 to 0.5 μm, for example, Mishoridisk H-25-5 manufactured by Tosoh Corporation or Ekicrodisk 25 CR manufactured by Gelman Science Japan) to prepare a sample for GPC measurement. GPC measurement of the sample prepared by the above method is as follows. A column is stabilized in a heat chamber at 40° C., and THF to serve as a solvent is flown to the column stabilized at the temperature at a flow velocity of 1 ml/min. Then, about 100 μl of the sample solution is injected for measurement.

A combination of multiple commercially available polystyrene gel columns is preferably used as a column for accurately measuring a molecular weight region of $10^3$ to $2\times10^6$. Preferable examples of the combination of commercially available polystyrene gel columns include: a combination of shodex GPS KF-801, 802, 803, 804, 805, 806, and 807 manufactured by Showa Denko K.K.; and a combination of μ-styragel 500, $10^3$, $10^4$, and $10^5$ manufactured by Waters Corporation. RI (A refractive index) detector is used as a detector.

In measuring the molecular weight of the sample, the molecular weight distribution possessed by the sample is calculated from a relationship between a logarithmic value for a calibration curve prepared by several kinds of monodisperse polystyrene standard samples and the number of counts (Retention time). Examples of the standard polystyrene samples for preparing a calibration curve to be used include samples manufactured by TOSOH CORPORATION or by Pressure Chemical Co. each having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, or $4.48\times10^6$. At least about ten standard polystyrene samples are suitably used.

(Measurement of Molecular Weight of Wax by GPC)

Device: GPC-150C (manufactured by Waters Corporation)

Column: GMH-MT 30 cm×2 (manufactured by Tosoh Corporation)

Temperature: 135° C.

Solvent: o-dichlorobenzene (added with 0.1% of IONOL)

Flow rate: 1.0 ml/min

Sample: 0.4 ml of a 0.15 wt % wax is injected.

The measurement is performed under the above-described conditions. Upon calculation of the molecular weight of the wax, a molecular weight calibration curve created from a monodisperse polystyrene standard sample is used. Furthermore, the molecular weight of the wax is calculated through polyethylene conversion by using a conversion equation deduced from a Mark-Houwink viscosity equation.

(Measurement of Glass Transition Point (Tg), and Temperature, Endotherm, and Half Width of Highest Endothermic Peak)

Figure 6:
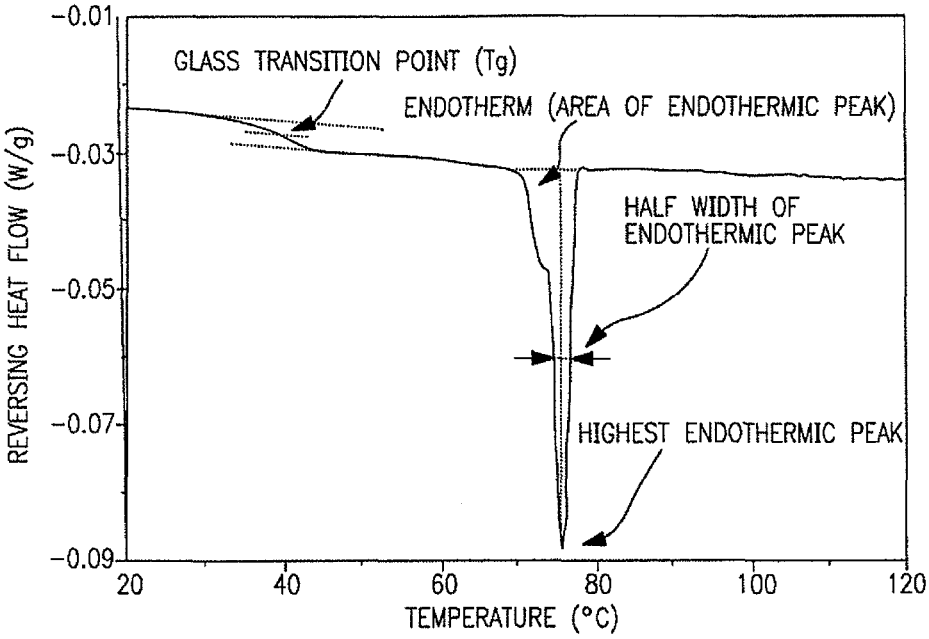
FIG. 6 is a view showing an example in which the measurement of a glass transition point (Tg), a temperature of a highest endothermic peak, endotherm, and half width of the highest endothermic peak of the toner, to be used in the present invention, is performed for Toner 1.

In the present invention, a glass transition point (Tg), and the temperature, endotherm, and half width of the highest endothermic peak are measured with a differential scanning calorimeter (DSC). To be specific, for example, a Q1000 (manufactured by TA Instruments) can be utilized as a DSC. A measurement method is as described below. 4 mg of a sample are precisely weighed in an aluminum pan, and measurement is performed by using an empty aluminum pan as a reference pan under a nitrogen atmosphere at a modulation amplitude of 1.0° C. and a frequency of 1/min. A reversing heat flow curve obtained by scanning at a measurement temperature retained at 10° C. for 10 minutes and then increased at a rate of temperature increase of 1° C./min from 10° C. to 180° C. is defined as a DSC curve, and Tg is determined from the curve by a middle point method. It should be noted that a glass transition temperature determined by the middle point method is defined as a point of intersection of a middle line, which is placed between a base line before an endothermic peak and a base line after the endothermic peak, and a rise-up curve in a DSC curve at the time of temperature increase (see FIG. 6).

The temperature, endotherm, and half width of the highest endothermic peak of the toner are measured as described below. In a reversing heat flow curve obtained as a result of the same measurement as described above, a straight line is drawn to connect the point at which an endothermic peak leaves the extrapolated line of a base line before the endothermic peak and the point at which the extrapolated line of the base line after the completion of the endothermic peak and the endothermic peak contact with each other. The temperature at which the endothermic peak shows a local maximum value in the region surrounded by the straight line and the endothermic peak is defined as the temperature of the highest endothermic peak. When the peak shows two or more local maximum values, the temperature at the local maximum value that is most distant from the connecting straight line in the surrounded region is defined as the temperature of the highest endothermic peak. When two or more independent surrounded regions are present, the temperature at the local maximum value that is most distant from a straight line connecting points in the same manner as that described above is similarly defined as the temperature of the highest endothermic peak. In addition, the half width of the highest endothermic peak is defined as the temperature width of a line connecting a point, which corresponds to one half of the length between a straight line connecting points in the same manner as that described above and a local maximum value in the highest endothermic peak specified by the above method, and a DSC curve at a lower temperature than that of the local maximum value.

The endotherm is determined as described below. In the reversing heat flow curve obtained by the above measurement, a straight line is drawn to connect the point at which an endothermic peak leaves the extrapolated line of a base line before the endothermic peak and the point at which the extrapolated line of the base line after the completion of the endothermic peak and the endothermic peak contact with each other. The area of the region surrounded by the straight line and the endothermic peak (integration value of a melt peak) is determined to be the endotherm (J/g). When two or more independent surrounded regions are present, the sum of the areas of the regions is defined as the endotherm.

<Measurement of Average Circularity of Toner>

The average circularity of toner is measured with a flow-type particle image analyzer "FPIA-2100 type" (manufactured by SYSMEX CORPORATION) and is calculated from the following equation.

Circle-equivalent diameter=(particle projected area/$\pi$)$^{1/2}$×2

Circularity=(perimeter of circle having same area as particle projected area)/(circumferential length of the projected image of a particle) [Formula 3]

where the "particle projected area" is defined as an area of a binarized toner particle image, and the "circumferential length of the projected image of a particle" is defined as a borderline drawn by connecting edge points of the toner particle image. When image processing, the periphery length of the particle image in 512×512 image processing resolution (having pixels of 0.3 μm×0.3 μm) is used.

The roundness in the present invention is an indication for the degree of irregularities of a toner particle. If the toner particle is of a complete spherical shape, the roundness is equal to 1.000. The more complicated the surface shape, the lower the value for the roundness.

In addition, an average circularity C which means an average value of a circularity frequency distribution is calculated from the following equation where ci denotes a circularity (center value) at a division point i in the particle size distribution and m denotes a number of measured particles.

$$\text{average circularity } C = \sum_{i=1}^{m} ci/m \quad \text{[Formula 4]}$$

It should be noted that the "FPIA-2100" as a measuring apparatus used in the present invention calculates the circularities of the respective particles, classifies the particles into classes obtained by equally dividing a circularity range of 0.4 to 1.0 in an increment of 0.01 depending on the resultant circularities upon calculation of an average circularity and a circularity standard deviation, and calculates the average circularity and the circularity standard deviation by using the central value of each division and the number of measured particles.

A specific measurement method is as follows. 10 ml of ion-exchanged water from which an impurity solid or the like has been removed in advance is charged in a vessel, and a surfactant, preferably an alkyl benzene sulfonate, is added as a dispersant to the water. After that, 0.02 g of a measurement sample is added to the mixture, and is uniformly dispersed. An ultrasonic dispersing unit "Tetoral 150" (manufactured by NIKKAKI BIOSCO., LTD.) is used as dispersing means, and the dispersion treatment is performed for 2 minutes to prepare a dispersion for measurement. At that time, the dispersion is appropriately cooled so as not to have a temperature of 40° C. or higher. In addition, in order that a fluctuation in circularity may be suppressed, the temperature of the environment where the flow-type particle image analyzer FPIA-2100 is placed is controlled to 23° C.±0.5° C. so that the temperature in the apparatus becomes 26 to 27° C., and automatic focusing is performed by using 2-μm latex particles at a certain time interval, or preferably every 2 hours.

The flow type particle image measuring device is used for circularity measurement of the toner particles. The concentration of the dispersion is readjusted in such a manner that a concentration of color toner particles upon the measurement may be in the range of 3,000 to 10,000 particles/μl. Then, 1,000 or more toner particles are measured. After the measurement, an average circularity of the toner particles is determined by using the obtained data while cutting off data for particles each having a circle-equivalent diameter of less than 2 μm.

(Weight-Average Particle Diameter (D4) of Toner, Particle Diameter Distribution (D4/D1), Content of Toner Particles Each Having Particle Diameter More than Twice as Large as D4, and Content of Toner Particles Each Having Particle Diameter Less than One Half of D1)

A Coulter Multisizer IIE (manufactured by Beckman Coulter, Inc) is used as a measuring apparatus. Measurement is performed by using an ISOTON (R)-II (1% aqueous solution of sodium chloride, manufactured by Coulter Scientific Japan, Co.) as an electrolyte solution. A measurement method is as described below. 0.1 to 5 ml of a surfactant (preferably an alkylbenzene sulfonate) as a dispersant are added to 100 to 150 ml of the aqueous electrolyte solution. Further, 2 to 20 mg of a measurement sample are added to the mixture. The electrolyte solution in which the sample has been suspended is subjected to a dispersion treatment with an ultrasonic dispersing unit for about 1 to 3 minutes, and the volumes and number of the particles of the toner are measured with the measuring apparatus so that the weight-average particle diameter of the toner is calculated.

When the weight-average particle diameter is larger than 6.0 μm, the volumes and number of particles each having a particle diameter of 2 to 60 μm are measured with a 100-μm aperture. When the weight-average particle diameter is 3.0 to 6.0 μm, the volumes and number of particles each having a particle diameter of 1 to 30 μm are measured with a 50-μm aperture. When the weight-average particle diameter is smaller than 3.0 μm, the volumes and number of particles each having a particle diameter of 0.6 to 18 μm are measured with a 30-μm aperture.

(Method of Collecting Tetrahydrofuran (THF)-Soluble Component and Method of Measuring Content of the Component)

The THF-soluble component of the toner means the mass ratio of an ultrahigh molecular weight polymer component (substantially a crosslinked polymer) which has become insoluble in a THF solvent. A value measured as described below is defined as the content of the THF-soluble component of the toner.

About 1 g of the toner is weighed ($W_1$ g). The weighed toner is placed in extraction thimble (such as No. 86R manufactured by Toyo Roshi), and is set in a Soxhlet extractor. The toner is extracted by using 200 ml of THF as a solvent in an oil bath at 80° C. for 12 hours, whereby an extracted solution is obtained. After THF in the extracted solution has been removed by distillation, the remainder is dried in a vacuum at 40° C. for 3 days, and the THF-soluble component is weighed ($W_2$ g). The content of the THF-soluble component of the toner is calculated from the following expression.

$$\text{Content of THF-soluble component of toner (mass \%)} = W_2 \times 100 / W_1 \quad \text{[Formula 5]}$$

In addition, the THF-soluble component obtained by the above method is used in the measurement of the molecular weight of the toner and in the measurement of a sulfur element derived from a sulfonic group.

(Method of Collecting Isopropanol-Soluble Component)

About 2 g of the toner are weighed ($W_1$ g). The weighed toner is placed in extraction thimble (such as No. 86R manufactured by Toyo Roshi), and is subjected to a Soxhlet extractor. The toner is extracted by using 200 ml of isopropanol as a solvent for 12 hours. After isopropanol in a soluble component has been removed by distillation, the remainder is dried, whereby a sample is collected. The sample is defined as 100 mass % of a solvent-soluble component extracted with isopropanol. The time period for extraction is changed, and a calibration curve showing a relationship between the time period for extraction and an extracted amount is created. Heating is stopped at a time corresponding to an extracted amount of 20 mass % on the basis of the calibration curve, and a flask containing the extract (Extract 1) is shifted to a flask containing 200 ml of new isopropanol, and extraction is restarted. Heating is stopped when the total time period for extraction reaches 12 hours, and an extract (Extract 2) is collected. The solvent in each of Extract and Extract 2 is removed by distillation, and a first solvent-soluble component and a second-solvent soluble component are collected from Extract 1 and Extract 2, respectively.

(Measurement of Sulfur Element Derived from Sulfonic Group)

The content of a sulfur element is measured with a wavelength dispersive fluorescent X-ray "Axios advanced" (manufactured by PANalytical). About 3 g of the toner are loaded into a ring made of vinyl chloride for 27-mm measurement, and is pressed at 200 kN so as to be molded into a sample. The toner usage and the thickness of the sample after the molding are measured, and the content of a sulfur element derived from a sulfonic group in the toner is determined as an input value for content calculation. Analysis conditions and analysis are shown below.

Analysis Conditions

Determination method: fundamental-parameters method Elements to be analyzed: Each of the elements ranging from boron to uranium in the periodic table is subjected to measurement.

Measurement atmosphere: vacuum

Measurement sample: solid

Collimator mask diameter: 27 mm

Measurement condition: An automatic program set in advance to an excitation condition optimal for each element was used.

Measuring time: about 20 minutes

General values recommended by the apparatus were used for the other conditions.

Analysis

Analysis program: UniQuant5

Analysis condition: oxide form

Balance component: $CH_2$

General values recommended by the apparatus were used for the other conditions.

(Method of Measuring Acid Value)

An acid value is determined as described below. A basic operation is in conformance with JIS-K0070. To be specific, a test is performed by the following method.

(1) Reagent (a) Solvent

A mixed liquid of ethyl ether and ethyl alcohol (1+1 or 2+1) or a mixed liquid of benzene and ethyl alcohol (1+1 or 2+1) is used as a solvent, and any such solution is neutralized with a 0.1-mol/L solution of potassium hydroxide in ethyl alcohol immediately before the use of the solution by using phenolphthalein as an indicator.

(b) Phenolphthalein Solution 1 g of phenolphthalein is dissolved in 100 ml of ethyl alcohol (95 v/v %).

(c) 0.1-mol/L Solution of Potassium Hydroxide in Ethyl Alcohol 7.0 g of potassium hydroxide are dissolved in as small an amount as possible of water. Ethyl alcohol (95 v/v %) is added to the solution so that the mixture has a volume of 1 l. The mixture is left to stand for 2 to 3 days, and is then filtrated. Standardization is performed in conformance with JIS K 8006 (basic item concerning titration during content test for reagent).

(2) Operation 1 to 2 g of a sample are precisely weighed, and 100 ml of the solvent and several drops of a phenolphthalein solution as an indicator are added to the sample. The mixture is sufficiently shaken until the sample completely dissolves. In the case of a solid sample, the sample is dissolved by heating the mixture on a water bath. After having been cooled, the resultant is titrated with a 0.1-mol/L solution of potassium hydroxide in ethyl alcohol, and the amount of the solution in which the faint red color of the indicator continues for 30 seconds is defined as the end point of the titration.

(3) Calculation Expression

The acid value of the sample is calculated from the following expression.

$$A=(B\times f\times 5.611)/S \quad \text{[Formula 6]}$$

In the expression, A represents the acid value, B represents the usage (ml) of the 0.1-mol/L solution of potassium hydroxide in ethyl alcohol, f represents the factor of the 0.1-mol/L solution of potassium hydroxide in ethyl alcohol, and S represents the sample (g).

(Charge Quantity of Toner)

A method of measuring the charge quantity of the toner is as described below. In the case of development with a two-component developer having the toner and a carrier, the developer recovered from a toner carrying member such as a developing sleeve is subjected to a blow-off measurement method for the determination of the charge quantity of the toner. In the case of a one-component developer, the developer is directly subjected from a toner carrying member such as a developing sleeve to the blow-off measurement method for the determination of the charge quantity of the toner. The blow-off measurement method can be performed by a known method.

Figure 11:
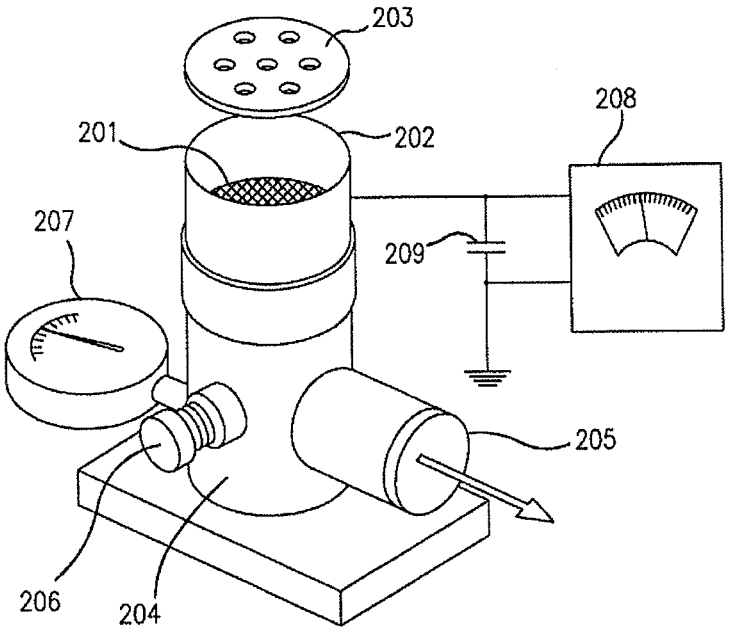
FIG. 11 is a view showing the outline of a charge quantity measuring apparatus for a two-component developer used in the present invention.

In the case of a two-component developer, in the present invention, the charge quantity is preferably measured with a charge quantity measuring apparatus shown in FIG. 11.

FIG. 11 is an explanatory view of an apparatus for measuring the triboelectric charge quantity of a two-component developer. First, a metallic measurement container 202 having, at its bottom, a screen 201 having an aperture of 30 μm is filled with 0.5 to 1.5 g of a two-component developer recovered from the upper portion of a sleeve, and is covered with a metallic lid 203. The mass of the entirety of the measurement container 202 at that time is measured and represented by W1 (g). Next, by using a sucking machine 204 (at least part of which in contact with the measurement container 202 is an insulator) suction is performed from a suction port 205, and the pressure indicated by a vacuum gauge 207 is set to 4 kPa by adjusting an air flow control valve 206. Suction is performed in the state sufficiently, or preferably for about 2 minutes so that the toner is sucked and removed. The potential indicated by a potentiometer 208 at that time is represented by V (volt). Here, reference numeral 209 represents a capacitor which has a capacity of C (μF). In addition, the mass of the entirety of the measurement container after the suction is measured and represented by W2 (g). The triboelectric charge quantity (mC/kg) of the toner is calculated from the following expression.

$$\text{Triboelectric charge quantity (mC/kg) of two-component developer}=C\times V/(W1-W2).$$

In the case of a one-component developer, toner on a toner carrying member such as a developing sleeve is directly sucked and subjected to measurement with a suction type charge quantity measuring apparatus (210HS-2A manufactured by TREK JAPAN). The mass W3 (kg) of a Faraday cage mounted with a filter is measured, the entire toner present in an area of about 5 $cm^2$ on the toner carrying member is sucked, and the mass W4 (kg) of the Faraday cage after the suction is measured. The charge quantity (mC/kg) of the toner is calculated from the following expression on the basis of a value q (mC) measured as a result of the suction of the toner.

$$\text{Charge quantity (mC/kg) of toner}=q/(W4-W3)$$

(Toner Amount on Electrostatic Image Bearing Member and Toner Amount on Transfer Material)

As in the above case of a one-component developer in the measurement of the charge quantity of toner, toner on an electrostatic image bearing member and toner on a transfer material before fixation are each directly sucked and subjected to measurement. After the entire toner present in an area of about 5 $cm^2$ on a toner carrying member has been sucked, an area A ($cm^2$) of the sucked portion is measured. A toner amount ($mg/cm^2$ i) is calculated from the following expression.

$$\text{Toner amount (mg/cm}^2)=(W4-W3)/A$$

(Measurement of Gloss of Image)

The gloss of an image can be measured with a commercially available device. To be specific, the gloss can be measured with, for example, a PG-3D manufactured by NIPPON DENSHOKU INDUSTRIES CO., LTD. (incident angle θ=75°). Black glass having a gloss value of 96.9 can be used in calibration with a standard sample.

(Measurement Chroma c* and Lightness L* of Image)

The chroma c* and lightness L* of an image can be measured with a commercially available device in accordance with the specifications of the CIELAB color coordinate system. To be specific, L*, a*, b*, c*, and h* can be determined as follows: a non-image portion is subjected to measurement with, for example, a SpectroScan Transmission (manufactured by GretagMacbeth) as a reference, and then an image portion is subjected to measurement. Specific measurement conditions are shown below.

Measurement Conditions

Observation light source: D50

Observation view angle: 2°

Density: DIN NB

White reference: Pap

Filter: No (absent)

It should be noted that, when the measuring apparatus does not display the chroma c*, the chroma can be calculated from the following expression.

$$c^* = \sqrt{a^{*2} + b^{*2}} \quad \text{[Formula 7]}$$

(Measurement of Height of Toner Layer Developed on Electrostatic Image Bearing Member and Height of Toner Layer on Fixing Paper)

The height of a toner layer developed on an electrostatic image bearing member and the height of a toner layer on fixing paper can each be determined by direct measurement with a commercially available optical observer. To be specific, each height can be measured with, for example, a color laser microscope (VK-9500, manufactured by KEYENCE CORPORATION). A distance between the point at which the height of a toner layer in the direction perpendicular to a measuring surface (the electrostatic image bearing member or the non-image portion of the fixing paper) shows a local maximum value and the measuring surface is measured. The same operation is performed for 10 randomly sampled points, and the average of the heights is defined as the height of the toner layer.

EXAMPLES

Hereinafter, the present invention will be described more specifically by way of production examples and examples. However, the present invention is by no means limited to those examples.

(Sulfonic Acid Compound Production Example 1)

A mixture composed of the following materials was loaded into a reaction vessel equipped with a reflux pipe, a stirring machine, a temperature gauge, a nitrogen introducing pipe, a dropping device, and a decompression device, and was polymerized at 70° C. for 10 hours while being stirred. The solvent was removed by distillation, whereby a resin A was obtained.

Toluene: 200 parts by mass
Styrene: 90 parts by mass
Acrylic acid: 10 parts by mass
t-butylperoxy-2-ethylhexanoate: 3 parts by mass The following materials were added to a reaction vessel equipped with a reflux pipe, a stirring machine, a temperature gauge, a nitrogen introducing pipe, a dropping device, and a decompression device, and were heated at 120° C. for 6 hours while being stirred. After the completion of the reaction, the resultant was loaded into 600 parts by mass of ethanol, and the precipitate was collected. The resultant precipitate was washed with hydrochloric acid and water, and was then dried, whereby a resin B was obtained.

Above resin A: 15 parts by mass
p-toluidine-2-sulfonic acid: 12 parts by mass
Pyridine: 320 parts by mass
Triphenyl phosphite: 36 parts by mass The following materials were added to a reaction vessel equipped with a reflux pipe, a stirring machine, a temperature gauge, a nitrogen introducing pipe, a dropping device, and a decompression device, and were cooled to 0° C. while being stirred. 44 parts by mass of a 2-mol/L solution of trimethylsilyl diazomethane in hexane (manufactured by SIGMA-ALDRICH) were added to the resultant, and the mixture was stirred for 5 hours. After the solvent had been removed by distillation, the remainder was loaded into 3,000 parts by mass of methanol, and the precipitate was collected and dried, whereby a sulfonic acid compound 1 represented by the following chemical formula was obtained. The resultant sulfonic acid compound 1 had a number average molecular weight of 11,200, a weight-average molecular weight of 13,700, a glass transition temperature of 86.7° C., and an acid value of 6.8 mgKOH/g.

Above resin B: 100 parts by mass
Chloroform: 400 parts by mass
Methanol: 100 parts by mass

[Chem 8]

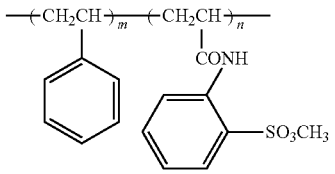

(Sulfonic Acid Compound Production Example 2)

The following materials were added to a reaction vessel equipped with a reflux pipe, a stirring machine, a temperature gauge, a nitrogen introducing pipe, a dropping device, and a decompression device, and were heated to 80° C. while being stirred.

Methanol: 300 parts by mass
2-butanone: 150 parts by mass
2-propanol: 150 parts by mass
Styrene: 76 parts by mass
2-ethylhexyl acrylate: 12 parts by mass
2-acrylamide-2-methylpropanesulfonic acid: 12 parts by mass A solution composed of the following materials was dropped to the resultant over 30 minutes, and the mixture was continuously stirred for an additional 10 hours. After that, 600 parts by mass of deionized water were added to the mixture while the temperature was maintained, and the whole was stirred for 2 hours while attention was paid in order that an interface between an organic layer and a water layer might not be disturbed. After the water layer had been wasted, the solvent was removed by distillation under reduced pressure. The remainder was dried under reduced pressure, whereby a sulfonic acid compound 2 was obtained. The resultant sulfonic acid compound 2 had a number average molecular weight of 15,300, a weight-average molecular weight of 24,300, a glass transition temperature of 61.2° C., and an acid value of 18.4 mgKOH/g.

t-butylperoxy-2-ethylhexanoate: 1 part by mass
2-butanone: 20 parts by mass (Cyan Toner Production Example 1)

| | |
|---|---|
| Styrene | 70 parts by mass |
| n-butyl acrylate | 30 parts by mass |
| Pigment Blue 15:3 | 12 parts by mass |
| Aluminum salicylate compound (BONTRON E-88: manufactured by Orient Chemical Industries, LTD.) | 1 part by mass |
| Sulfonic acid compound 1 | 1.8 parts by mass |
| Divinylbenzene | 0.01 part by mass |
| Resin 1 obtained in Resin Production Example 1 to be described later | 25 parts by mass |
| Wax 1 shown in Table 1 | 8 parts by mass |
| Toluene | 10 parts by mass |

A mixture composed of the above components was prepared. 100 parts by mass of glass beads each having a diameter of 1 mm were added to the mixture, and the whole was dispersed with a paint shaker for 12 hours while the extent to which the whole was heated was suppressed with cold air. The glass beads were removed, whereby a monomer dispersion liquid was obtained.

900 parts by mass of ion-exchanged water and 3.5 parts by mass of tricalcium phosphate were added to a container equipped with a high-speed stirring device TK-homomixer (manufactured by Tokushu Kika Kogyo). The number of revolutions of the device was adjusted to 10,000 revolutions/min, and the mixture was heated to 70° C., whereby a dispersion medium system was obtained.

parts by mass of t-butylperoxy-2-ethylhexanoate (TBEH) as a polymerization initiator and 1 part by mass of disuccinic acid peroxide (DSAP) as a polymerization initiator and an acid value-imparting agent were added to the above monomer dispersion liquid, and the mixture was loaded into the above dispersion medium system. The resultant was subjected to a granulating step with the high-speed stirring device for 5 minutes while the number of revolutions was maintained at 15,000 revolutions/min. After that, the resultant was polymerized for 12 hours with a propeller stirring blade used as a stirring machine instead of the high-speed stirring device at 150 revolutions/min. The resultant was heated to 90° C., and was stirred for 2 hours while the pressure in the container was reduced to 50 kPa. Then, toluene was removed by distillation. After that, the remainder was cooled to 30° C. at a cooling rate of 1.5° C./min. The resultant was filtrated, washed, dried, and classified, whereby toner particles were obtained.

Above toner particles 100 parts by mass Hydrophobic titanium oxide treated with n-$C_4H_9Si(OCH_3)_3$ (BET specific surface area: 120 $m^2/g$)

1 part by mass

Hydrophobic silica treated with hexamethyldisilazane and then with silicone oil (BET specific surface area: 160 $m^2/g$) 1 part by mass A mixture composed of the above components was mixed with a Henschel mixer, whereby Cyan Toner 1 was obtained. Tables 5, 6, and 7 show the physical properties of the toner.

(Cyan Toner Production Examples 2 to 4)

Cyan Toners 2 to 4 were each obtained in the same manner as in Cyan Toner Production Example 1 except that conditions in Cyan Toner Production Example 1 were changed as shown in Table 3. Tables 5, 6, and 7 show the physical properties of the toners.

(Cyan Toner Production Example 5)

| | |
|---|---|
| Styrene | 70 parts by mass |
| n-butyl acrylate | 30 parts by mass |
| Colorant used in Cyan toner 1 | 12 parts by mass |
| Aluminum salicylate compound (BONTRON E-88: manufactured by Orient Chemical Industries, LTD.) | 1 part by mass |
| Sulfonic acid compound | 1.6 parts by mass |
| Divinylbenzene | 0.02 part by mass |
| Resin 1 obtained in Resin Production Example 1 to be described later | 3 parts by mass |
| Wax 1 shown in Table 1 | 8 parts by mass |

A mixture composed of the above components was prepared. The whole was dispersed for 12 hours with a propeller stirring blade used as a stirring machine at 150 revolutions/min while the extent to which the whole was heated was suppressed with cold air, whereby a monomer dispersion liquid was obtained.

900 parts by mass of ion-exchanged water and 3.5 parts by mass of tricalcium phosphate were added to a container equipped with a high-speed stirring device TK-homomixer (manufactured by Tokushu Kika Kogyo). The number of revolutions of the device was adjusted to 10,000 revolutions/min, and the mixture was heated to 80° C., whereby a dispersion medium system was obtained.

4 parts by mass of t-butylperoxy-2-ethylhexanoate (TBEH) as a polymerization initiator and 1 part by mass of disuccinic acid peroxide (DSAP) as a polymerization initiator and an acid value-imparting agent were added to the above monomer dispersion liquid, and the mixture was loaded into the above dispersion medium system. The resultant was subjected to a granulating step with the high-speed stirring device for 5 minutes while the number of revolutions was maintained at 15,000 revolutions/min. After that, the resultant was polymerized for 12 hours with a propeller stirring blade used as a stirring machine instead of the high-speed stirring device at 150 revolutions/min. The resultant was heated to 70° C., and was stirred for 5 hours while the pressure in the container was reduced to 50 kPa. Then, toluene was removed by distillation. After that, the remainder was cooled to 30° C. at a cooling rate of 4.5° C./min. The resultant was filtrated, washed, dried, and classified, whereby toner particles were obtained.

Above toner particles 100 parts by mass Hydrophobic titanium oxide treated with n-$C_4H_9Si(OCH_3)_3$ (BET specific surface area: 120 $m^2/g$)

1 part by mass

Hydrophobic silica treated with hexamethyldisilazane and then with silicone oil (BET specific surface area: 160 $m^2/g$) 1 part by mass A mixture composed of the above components was mixed with a Henschel mixer, whereby Cyan Toner 5 was obtained. Tables 5, 6, and 7 show the physical properties of the toner.

(Resin Production Example 1)

90 parts by mass of a monomer mixture for polyester composed of carboxylic acid monomers (terephthalic acid: 29 mol %, isophthalic acid: 16 mol %, dodecenylsuccinic anhydride: 3 mol %), alcohol monomers (a bisphenol A derivative 1 represented by the following general formula (9) (R: an ethylene group, x+y=2.4): 30 mol %, and a bisphenol A derivative 2 represented by the general formula (9) (R: a propylene group, x+y=2.4): 22 mol %), and an esterification catalyst (tetrastearyl titanate) were loaded into a reaction vessel equipped with a reflux pipe, a stirring machine, a temperature gauge, a nitrogen introducing pipe, a dropping device, and a decompression device. Under a nitrogen atmosphere, the resultant mixture was heated to 150° C.

[Chem 9]

General formula (9)

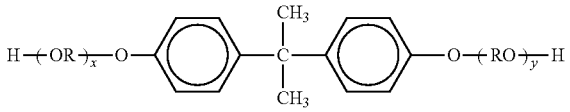

一般式 (9)

A vinyl monomer mixture composed of 8.0 parts by mass of styrene, 1.9 parts by mass of 2-ethylhexyl acrylate, 0.1 part by mass of acrylic acid, and 0.1 part by mass of di-t-butyl peroxide was dropped over 2 hours while the resultant in the reaction vessel was stirred. The resultant mixture was heated to 220° C. under reduced pressure so as to be subjected to a dehydration condensation reaction for 8 hours. The resultant reaction liquid was charged into 400 parts by mass of methanol, and the solid content was collected and dried, whereby a resin 1 was obtained. The resultant resin 1 had a number average molecular weight of 5,300, a weight-average molecular weight of 21,600, a glass transition temperature of 53.8° C., and an acid value of 8.7 mgKOH/g.

(Resin Production Example 2)

100 parts by mass of a monomer mixture for polyester composed of carboxylic acid monomers (terephthalic acid: 23 mol %, isophthalic acid: 22 mol %, dodecenylsuccinic anhydride: 3 mol %), alcohol monomers (a bisphenol A derivative 1 represented by the above general formula (9) (R: an ethylene group, x+y=2.4): 15 mol %, and a bisphenol A derivative 2 represented by the general formula (9) (R: a propylene group, x+y=2.4): 35 mol %), and an esterification catalyst (tetrastearyl titanate) were loaded into a reaction vessel equipped with a reflux pipe, a stirring machine, a temperature gauge, a nitrogen introducing pipe, a dropping device, and a decompression device. Under a nitrogen atmosphere, the pressure in the vessel was reduced, and the resultant mixture was heated to 190° C. so as to be subjected to a dehydration condensation reaction for 8 hours. The resultant reaction liquid was charged into 400 parts by mass of methanol, and the solid content was collected and dried, whereby a resin 2 was obtained. The resultant resin 2 had a number average molecular weight of 2,600, a weight-average molecular weight of 39,400, a glass transition temperature of 51.3° C., and an acid value of 17.6 mgKOH/g.

(Resin Production Example 3)

100 parts by mass of a monomer mixture for polyester composed of carboxylic acid monomers (terephthalic acid: 22 mol %, trimellitic acid: 7 mol %, dodecenylsuccinic anhydride: mol %), alcohol monomers (a bisphenol A derivative 1 represented by the above general formula (9) (R: an ethylene group, x+y=2.4): 14 mol %, and a bisphenol A derivative 2 represented by the general formula (9) (R: a propylene group, x+y=2.4): 37 mol %), and an esterification catalyst (dibutyltin oxide) were loaded into a reaction vessel equipped with a reflux pipe, a stirring machine, a temperature gauge, a nitrogen introducing pipe, a dropping device, and a decompression device. Under a nitrogen atmosphere, the pressure in the vessel was reduced, and the resultant mixture was heated to 220° C. so as to be subjected to a dehydration condensation reaction for 8 hours, whereby a resin 3 was obtained. The resultant resin 3 had a number average molecular weight of 43,700, a weight-average molecular weight of 103,600, a glass transition temperature of 54.1° C., and an acid value of 0.9 mgKOH/g.

(Wax Dispersant Master Batch Production Example 1)

600 parts by mass of xylene and 120 parts by mass of polyethylene (weight-average molecular weight: 11,000, number average molecular weight: 4,200, highest endothermic peak: 92° C.) were loaded into an autoclave reaction tank mounted with a temperature gauge and a stirring machine. Under a nitrogen atmosphere, the temperature of the mixture was increased to 150° C., and a mixed solution of 1,000 parts by mass of styrene, 84 parts by mass of acrylonitrile, 120 parts by mass of monobutyl maleate, 40 parts by mass of di-t-butylperoxyhexahydrophthalate, and 400 parts by mass of xylene was dropped to the mixture over 3 hours. Further, the resultant mixture was polymerized while its temperature was retained at the temperature for 60 minutes. Next, xylene was removed by distillation, whereby a wax dispersion medium as a graft reaction product was obtained.

A mixture composed of 25 parts by mass of the resin 1, 25 parts by mass of the above wax dispersion medium, and 50 parts by mass of the wax 1 shown in Table 1 was sufficiently mixed with a Henschel mixer, and the mixture was melted and kneaded with a biaxial extruder. After having been cooled, the kneaded product was coarsely pulverized with a hammer mill, whereby a wax dispersant master batch 1 containing a wax dispersant was obtained.

(Wax Dispersant Master Batch Production Examples 2 and 3)

Wax dispersant master batches 2 and 3 were each obtained in the same manner as in Wax Dispersant Master Batch Production Example 1 except that the wax 1 shown in Table 1 was changed to a wax 2 or 3.

(Colorant-dispersed Body Production Example 1)

40 parts by mass of the resin 1, 100 parts by mass of Pigment Blue 15:3, and 200 parts by mass of xylene were loaded into an Attritor (manufactured by MITSUI MINING & SMELTING CO., LTD.) containing zirconia beads each having a diameter of 20 mm, and the mixture was rotated at a number of revolutions of 300 revolutions/min for 8 hours. The zirconia beads were separated, and xylene was removed by distillation. After having been cooled, the resultant was coarsely pulverized with a hammer mill, and was then finely pulverized with an air-jet pulverizer, whereby a pre-dispersed body 1 was obtained.

Next, 100 parts by mass of the resin 1 and 140 parts by mass of the pre-dispersed body 1 were preliminarily mixed with a Henschel mixer to a sufficient extent, and then the mixture was melted and kneaded under heat with a kneader type mixer at 130° C. for 1 hour. After having been cooled, the resultant was coarsely pulverized with a hammer mill, and was then finely pulverized with an air-jet pulverizer, whereby a colorant-dispersed body 1 was obtained.

(Colorant-dispersed Body Production Examples 2 to 4)

Colorant-dispersed bodies 2 to 4 were each obtained in the same manner as in Colorant-dispersed Body Production Example 1 except that the colorant in Colorant-dispersed Body Production Example 1 was changed to a colorant shown in Table 2.

(Cyan Toner Production Example 6)

| | |
|---|---|
| Resin 1 | 74.8 parts by mass |
| Colorant-dispersed body 1 (colorant content: 12 parts by mass) | 31.2 parts by mass |
| Wax dispersant master batch 2 (the content of the wax 2: 6.0 parts by mass) | 12.0 parts by mass |
| Sulfonic acid compound 2 | 1.6 parts by mass |
| Aluminum salicylate compound (BONTRON E-88: manufactured by Orient Chemical Industries, LTD.) | 1.0 part by mass |

The above materials were preliminarily mixed with a Henschel mixer to a sufficient extent, and then the mixture was melted and kneaded with a biaxial extruder. After having been cooled, the resultant was coarsely pulverized with a cutter mill, and was then pulverized with an air-jet pulverizer, whereby pulverized products were obtained.

The above pulverized products were subjected to surface modification with the apparatus shown in FIG. 7, whereby toner particles were obtained. A cycle time in this case was set to 30 seconds.

Above toner particles 100 parts by mass Hydrophobic titanium oxide treated with n-$C_4H_9Si(OCH_3)_3$ (BET specific surface area: 120 $m^2/g$)

1 part by mass

Hydrophobic silica treated with hexamethyldisilazane and then with silicone oil (BET specific surface area: 160 $m^2/g$) 1 part by mass The above components were mixed with a Henschel mixer, whereby Cyan Toner 6 was obtained. Tables 5, 6, and 7 show the physical properties of the toner.

(Cyan Toner Production Examples 7 and 10)

Cyan Toners 7 and 10 were each obtained in the same manner as in Cyan Toner Production Example 6 except that conditions in Cyan Toner Production Example 6 were changed as shown in Table 4. Tables 5, 6, and 7 show the physical properties of the toners.

(Cyan Toner Production Example 8)

| | |
|---|---|
| Resin 1 | 81.0 parts by mass |
| Colorant used in Colorant-dispersed body | 113.0 parts by mass |
| Wax dispersant master batch 2 (the content of the wax 2: 6.0 parts by mass) | 12.0 parts by mass |
| Aluminum salicylate compound (BONTRON E-88: manufactured by Orient Chemical Industries, LTD.) | 1.0 part by mass |
| Sulfonic acid compound 2 | 1.6 parts by mass |

The above materials were preliminarily mixed with a Henschel mixer to a sufficient extent, and then the mixture was melted and kneaded with a biaxial extruder. After having been cooled, the resultant was coarsely pulverized with a cutter mill, and was then pulverized with an air-jet pulverizer, whereby pulverized products were obtained.

The subsequent operation was the same as that in Cyan Toner Production Example 6 except that the cycle time was changed to 45 seconds, whereby Cyan Toner 8 was obtained. Tables 5, 6, and 7 show the physical properties of the toner.

(Cyan Toner Production Example 9)

Cyan Toner 9 was obtained in the same manner as in Cyan Toner Production Example 8 except that conditions in Cyan Toner Production Example 8 were changed as shown in Table 4. Tables 5, 6, and 7 show the physical properties of the toners.

(Magenta Toner Production Examples 1 to 4, Yellow Toner Production Examples 1 to 4, and Black Toner Production Examples 1 to 4)

Magenta Toners 1 to 4 were each obtained in the same manner as in Cyan Toner Production Example 1 except that conditions in Cyan Toner Production Example 1 were changed as shown in Tables 2 and 3. Tables 8, 9, and 10 show the physical properties of the toners.

Yellow Toners 1 to 4 were each obtained in the same manner as in Cyan Toner Production Example 1 except that conditions in Cyan Toner Production Example 1 were changed as shown in Tables 2 and 3. Tables 11, 12, and 13 show the physical properties of the toners.

Black Toners 1 to 4 were each obtained in the same manner as in Cyan Toner Production Example 1 except that conditions in Cyan Toner Production Example 1 were changed as shown in Tables 2 and 3. Tables 14, 15, and 16 show the physical properties of the toners.

(Magenta Toner Production Example 5, Yellow Toner Production Example 5, and Black Toner Production Examples 5 and 6)

Magenta Toner 5 was obtained in the same manner as in Cyan Toner Production Example 5 except that conditions in Cyan Toner Production Example 5 were changed as shown in Tables 2 and 3. Tables 8, 9, and 10 show the physical properties of the toners.

Yellow Toner 5 was obtained in the same manner as in Cyan Toner Production Example 5 except that conditions in Cyan Toner Production Example 5 were changed as shown in Tables 2 and 3. Tables 11, 12, and 13 show the physical properties of the toners.

Black Toners 5 and 6 was obtained in the same manner as in Cyan Toner Production Example 5 except that conditions in Cyan Toner Production Example 5 were changed as shown in Tables 2 and 3. Tables 14, 15, and 16 show the physical properties of the toners.

(Magenta Toner Production Examples 6, 7, and 10, Yellow Toner Production Examples 6, 7, and 10, and Black Toner Production Examples 7, 8, and 11)

Magenta Toners 6, 7, and 10 were each obtained in the same manner as in Cyan Toner Production Example 6 except that conditions in Cyan Toner Production Example 6 were changed as shown in Table 4. Tables 8, 9, and 10 show the physical properties of the toners.

Yellow Toners 6, 7, and 10 were each obtained in the same manner as in Cyan Toner Production Example 6 except that conditions in Cyan Toner Production Example 6 were changed as shown in Table 4. Tables 11, 12, and 13 show the physical properties of the toners.

Black Toners 7, 8, and 11 were each obtained in the same manner as in Cyan Toner Production Example 6 except that conditions in Cyan Toner Production Example 6 were changed as shown in Table 4. Tables 14, 15, and 16 show the physical properties of the toners.

(Magenta Toner Production Examples 8 and 9, Yellow Toner Production Examples 8 and 9, and Black Toner Production Examples 9 and 10)

Magenta Toners 8 and 9 were each obtained in the same manner as in Cyan Toner Production Example 8 except that conditions in Cyan Toner Production Example 8 were changed as shown in Tables 4. Tables 8, 9, and 10 show the physical properties of the toners.

Yellow Toners 8 and 9 were each obtained in the same manner as in Cyan Toner Production Example 8 except that conditions in Cyan Toner Production Example 8 were changed as shown in Table 4. Tables 11, 12, and 13 show the physical properties of the toners.

Black Toners 9 and 10 were each obtained in the same manner as in Cyan Toner Production Example 8 except that conditions in Cyan Toner Production Example 8 were changed as shown in Table 4. Tables 14, 15, and 16 show the physical properties of the toners.

TABLE 1

| | Kind of wax | Highest endothermic peak | Half width of highest endothermic peak | Mp | Mw | Mn |
|---|---|---|---|---|---|---|
| Wax 1 | Refined normal paraffin | 78.1°C. | 3.2°C. | 510 | 510 | 410 |
| Wax 2 | Refined Fischer-Tropsch | 91.6°C. | 6.4°C. | 800 | 890 | 610 |
| Wax 3 | Polyethylene | 116.4°C. | 21.4 v | 2730 | 8930 | 1040 |

TABLE 2

| | Colorant used | |
|---|---|---|
| Cyan toner Production Examples 1 to 5 | Pigment Blue 15:3 | |
| Cyan toner Production Examples 6 to 10 | Pigment Blue 15:3 | Used in colorant-dispersed body 1 |
| Magenta toner Production Examples 1 to 5 | Mixture containing Pigment Red 122 and Pigment Red 57:1 in equal amounts | |
| Magenta toner Production Examples 6 to 10 | Mixture containing Pigment Red 122 and Pigment Red 57:1 in equal amounts | Used in colorant-dispersed body 2 |
| Yellow toner Production Examples 1 to 5 | Pigment yellow 140 | |

TABLE 2-continued

| | Colorant used | |
|---|---|---|
| Yellow toner Production Examples 6 to 10 | Pigment yellow 74 | Used in colorant-dispersed body 3 |
| Black toner Production Examples 1 to 5 | Carbon black | |

TABLE 2-continued

| | Colorant used | |
|---|---|---|
| Black toner Production Examples 6 to 10 | Mixture containing carbon black, Pigment Blue 15:3, Pigment Red 122, and Pigment Yellow 74 in equal amounts | Used in colorant-dispersed body 4 |

TABLE 3

| Production Example | Toner | Addition amount of colorant (part(s) by mass) | Addition amount of tricalcium phosphate (part(s) by mass) | Addition amount of saturated polyester (part(s) by mass) | Addition amount of sulfonic acid compound (part(s) by mass) |
|---|---|---|---|---|---|
| Cyan toner Production Example 1 | Cyan toner 1 | 12 | 3.5 | 25.0 | 1.8 |
| Cyan toner Production Example 2 | Cyan toner 2 | 16 | 4.0 | 3.0 | 2.4 |
| Cyan toner Production Example 3 | Cyan toner 3 | 9 | 3.0 | 25.0 | 1.2 |
| Cyan toner Production Example 4 | Cyan toner 4 | 6 | 3.5 | 3.0 | — |
| Cyan toner Production Example 5 | Cyan toner 5 | 12 | 3.5 | 3.0 | 1.6 |
| Magenta toner Production Example 1 | Magenta toner 1 | 12 | 3.5 | 25.0 | 1.8 |
| Magenta toner Production Example 2 | Magenta toner 2 | 16 | 4.0 | 3.0 | 2.4 |
| Magenta toner Production Example 3 | Magenta toner 3 | 9 | 3.0 | 25.0 | 1.2 |
| Magenta toner Production Example 4 | Magenta toner 4 | 6 | 3.5 | 3.0 | — |
| Magenta toner Production Example 5 | Magenta toner 5 | 12 | 3.5 | 3.0 | 1.6 |
| Yellow toner Production Example 1 | Yellow toner 1 | 12 | 3.5 | 25.0 | 1.8 |
| Yellow toner Production Example 2 | Yellow toner 2 | 16 | 4.0 | 3.0 | 2.4 |
| Yellow toner Production Example 3 | Yellow toner 3 | 9 | 3.0 | 25.0 | 1.2 |
| Yellow toner Production Example 4 | Yellow toner 4 | 6 | 3.5 | 3.0 | — |
| Yellow toner Production Example 5 | Yellow toner 5 | 12 | 3.5 | 3.0 | 1.6 |
| Black toner Production Example 1 | Black toner 1 | 12 | 3.5 | 25.0 | 2.5 |
| Black toner Production Example 2 | Black toner 2 | 16 | 4.0 | 3.0 | 3.4 |
| Black toner Production Example 3 | Black toner 3 | 9 | 3.0 | 25.0 | 1.7 |
| Black toner Production Example 4 | Black toner 4 | 6 | 3.5 | 3.0 | — |
| Black toner Production Example 5 | Black toner 5 | 12 | 3.5 | 3.0 | 2.24 |
| Black toner Production Example 6 | Black toner 6 | 16 | 4.0 | 3.0 | 3.36 |

| Production Example | Toner | Polymerization temperature (° C.) | Addition amount of TBEH (part(s) by mass) | Addition amount of DSAP (part(s) by mass) | Temperature to which resultant is heated and time in decompression step |
|---|---|---|---|---|---|
| Cyan toner Production Example 1 | Cyan toner 1 | 70 | 2 | 1 | 90° C. for 2 hours |
| Cyan toner Production Example 2 | Cyan toner 2 | 70 | 2 | 1 | 80° C. for 3 hours |
| Cyan toner Production Example 3 | Cyan toner 3 | 80 | 2 | 1 | 80° C. for 3 hours |
| Cyan toner Production Example 4 | Cyan toner 4 | 70 | 2 | 1 | 80° C. for 3 hours |
| Cyan toner Production Example 5 | Cyan toner 5 | 80 | 4 | 1 | 70° C. for 5 hours |
| Magenta toner Production Example 1 | Magenta toner 1 | 70 | 2 | 1 | 90° C. for 2 hours |

TABLE 3-continued

| | | | | | |
|---|---|---|---|---|---|
| Magenta toner Production Example 2 | Magenta toner 2 | 70 | 2 | 1 | 80° C. for 3 hours |
| Magenta toner Production Example 3 | Magenta toner 3 | 80 | 2 | 1 | 80° C. for 3 hours |
| Magenta toner Production Example 4 | Magenta toner 4 | 70 | 2 | 1 | 80° C. for 3 hours |
| Magenta toner Production Example 5 | Magenta toner 5 | 80 | 4 | 1 | 70° C. for 5 hours |
| Yellow toner Production Example 1 | Yellow toner 1 | 70 | 2 | 1 | 90° C. for 2 hours |
| Yellow toner Production Example 2 | Yellow toner 2 | 70 | 2 | 1 | 80° C. for 3 hours |
| Yellow toner Production Example 3 | Yellow toner 3 | 80 | 2 | 1 | 80° C. for 3 hours |
| Yellow toner Production Example 4 | Yellow toner 4 | 70 | 2 | 1 | 80° C. for 3 hours |
| Yellow toner Production Example 5 | Yellow toner 5 | 80 | 4 | 1 | 70° C. for 5 hours |
| Black toner Production Example 1 | Black toner 1 | 70 | 2 | 1 | 90° C. for 2 hours |
| Black toner Production Example 2 | Black toner 2 | 70 | 2 | 1 | 80° C. for 3 hours |
| Black toner Production Example 3 | Black toner 3 | 80 | 2 | 1 | 80° C. for 3 hours |
| Black toner Production Example 4 | Black toner 4 | 70 | 2 | 1 | 80° C. for 3 hours |
| Black toner Production Example 5 | Black toner 5 | 80 | 4 | 1 | 70° C. for 5 hours |
| Black toner Production Example 6 | Black toner 6 | 70 | 2 | 1 | 80° C. for 3 hours |

TABLE 4

| | | Binder resin | | Colorant | | | |
|---|---|---|---|---|---|---|---|
| Production Example | Toner | Kind | Addition amount (part(s) by mass) | Kind | Addition amount (part(s) by mass | Addition amount of colorant with respect to 100 parts by mass of binder resin (part(s) by mass) | Addition amount of sulfonic acid compound (part(s) by mass) |
| Cyan toner Production Example 6 | Cyan toner 6 | Resin 1 | 74.8 | Colorant-dispersed body 1 | 31.2 | 12 | 1.6 |
| Cyan toner Production Example 7 | Cyan toner 7 | Resin 1 | 82.8 | Colorant-dispersed body 1 | 19.2 | 8 | 1.0 |
| Cyan toner Production Example 8 | Cyan toner 8 | Resin 1 | 81.0 | Colorant used in colorant-dispersed body 1 | 13.0 | 12 | 1.6 |
| Cyan toner Production Example 9 | Cyan toner 9 | Resin 2 | 85.0 | Colorant used in colorant-dispersed body 1 | 9.0 | 8 | 1.0 |
| Cyan toner Production Example 10 | Cyan toner 10 | Resin 3 | 63.2 | Colorant-dispersed body 1 | 52.8 | 22 | 4.5 |
| Magenta toner Production Example 6 | Magenta toner 6 | Resin 1 | 74.8 | Colorant-dispersed body 2 | 31.2 | 12 | 1.6 |
| Magenta toner Production Example 7 | Magenta toner 7 | Resin 1 | 82.8 | Colorant-dispersed body 2 | 19.2 | 8 | 1.0 |
| Magenta toner Production Example 8 | Magenta toner 8 | Resin 1 | 81.0 | Colorant used in colorant-dispersed body 2 | 13.0 | 12 | 1.6 |
| Magenta toner Production Example 9 | Magenta toner 9 | Resin 2 | 85.0 | Colorant used in colorant-dispersed body 2 | 9.0 | 8 | 1.0 |
| Magenta toner Production Example 10 | Magenta toner 10 | Resin 3 | 63.2 | Colorant-dispersed body 2 | 52.8 | 22 | 4.5 |
| Yellow toner Production Example 6 | Yellow toner 6 | Resin 1 | 74.8 | Colorant-dispersed body 3 | 31.2 | 12 | 1.6 |
| Yellow toner Production Example 7 | Yellow toner 7 | Resin 1 | 82.8 | Colorant-dispersed body 3 | 19.2 | 8 | 1.0 |
| Yellow toner Production Example 8 | Yellow toner 8 | Resin 1 | 81.0 | Colorant used in colorant-dispersed body 3 | 13.0 | 12 | 1.6 |
| Yellow toner Production Example 9 | Yellow toner 9 | Resin 2 | 85.0 | Colorant used in colorant-dispersed body 3 | 9.0 | 8 | 1.0 |
| Yellow toner Production Example 10 | Yellow toner 10 | Resin 3 | 63.2 | Colorant-dispersed body 3 | 52.8 | 22 | 4.5 |
| Black toner Production Example 7 | Black toner 7 | Resin 1 | 74.8 | Colorant-dispersed body 4 | 31.2 | 12 | 1.6 |
| Black toner Production Example 8 | Black toner 8 | Resin 1 | 82.8 | Colorant-dispersed body 4 | 19.2 | 8 | 1.0 |
| Black toner Production Example 9 | Black toner 9 | Resin 1 | 81.0 | Colorant used in colorant-dispersed body 4 | 13.0 | 12 | 1.6 |

TABLE 4-continued

| | | | | | | | |
|---|---|---|---|---|---|---|---|
| Black toner Production Example 10 | Black toner 10 | Resin 2 | 85.0 | Colorant used in colorant-dispersed body 4 | 9.0 | 8 | 1.0 |
| Black toner Production Example 11 | Black toner 11 | Resin 3 | 63.2 | Colorant-dispersed body 4 | 52.8 | 22 | 4.5 |

| | | Wax | | | |
|---|---|---|---|---|---|
| Production Example | Toner | Kind | Addition amount (part(s) by mass) | Addition amount of colorant with respect to 100 parts by mass of binder resin (part(s) by mass) | Cycle time (sec) |
| Cyan toner Production Example 6 | Cyan toner 6 | Wax dispersant master batch 2 | 12 | 6 | 30 |
| Cyan toner Production Example 7 | Cyan toner 7 | Wax dispersant master batch 2 | 12 | 6 | 45 |
| Cyan toner Production Example 8 | Cyan toner 8 | Wax dispersant master batch 2 | 12 | 6 | 45 |
| Cyan toner Production Example 9 | Cyan toner 9 | Wax dispersant master batch 2 | 12 | 6 | 15 |
| Cyan toner Production Example 10 | Cyan toner 10 | Wax dispersant master batch 3 | 12 | 6 | 15 |
| Magenta toner Production Example 6 | Magenta toner 6 | Wax dispersant master batch 2 | 12 | 6 | 30 |
| Magenta toner Production Example 7 | Magenta toner 7 | Wax dispersant master batch 2 | 12 | 6 | 45 |
| Magenta toner Production Example 8 | Magenta toner 8 | Wax dispersant master batch 2 | 12 | 6 | 45 |
| Magenta toner Production Example 9 | Magenta toner 9 | Wax dispersant master batch 2 | 12 | 6 | 15 |
| Magenta toner Production Example 10 | Magenta toner 10 | Wax dispersant master batch 3 | 12 | 6 | 15 |
| Yellow toner Production Example 6 | Yellow toner 6 | Wax dispersant master batch 2 | 12 | 6 | 30 |
| Yellow toner Production Example 7 | Yellow toner 7 | Wax dispersant master batch 2 | 12 | 6 | 45 |
| Yellow toner Production Example 8 | Yellow toner 8 | Wax dispersant master batch 2 | 12 | 6 | 45 |
| Yellow toner Production Example 9 | Yellow toner 9 | Wax dispersant master batch 2 | 12 | 6 | 15 |
| Yellow toner Production Example 10 | Yellow toner 10 | Wax dispersant master batch 3 | 12 | 6 | 15 |
| Black toner Production Example 7 | Black toner 7 | Wax dispersant master batch 2 | 12 | 6 | 30 |
| Black toner Production Example 8 | Black toner 8 | Wax dispersant master batch 2 | 12 | 6 | 45 |
| Black toner Production Example 9 | Black toner 9 | Wax dispersant master batch 2 | 12 | 6 | 45 |
| Black toner Production Example 10 | Black toner 10 | Wax dispersant master batch 2 | 12 | 6 | 15 |
| Black toner Production Example 11 | Black toner 11 | Wax dispersant master batch 3 | 12 | 6 | 15 |

TABLE 5

| | | | Shape | | | | | | Thermal properties | | | |
|---|---|---|---|---|---|---|---|---|---|---|---|---|
| Production Example | Toner | True density ρ | D4 (μm) | D4/D1 | Content of particles each having a particle diameter twice or more as large as D4 (wt %) | Content of particles each having a particle diameter one half or less as large D1 (numbers) | Average circularity | Standard deviation of circularities | Tg (° C.) | Highest endo-thermic peak (° C.) | Half width of highest endo-thermic peak (° C.) | Endo-therm (J/cm$^3$) |
| Cyan toner Production Example 1 | Cyan toner 1 | 1.10 | 4.2 | 1.12 | 2.3 | 3.4 | 0.983 | 0.012 | 51.6 | 77.8 | 3.2 | 9.3 |
| Cyan toner Production Example 2 | Cyan toner 2 | 1.10 | 3.6 | 1.16 | 5.4 | 11.2 | 0.973 | 0.017 | 50.8 | 77.8 | 3.2 | 9.3 |
| Cyan toner Production Example 3 | Cyan toner 3 | 1.10 | 4.8 | 1.18 | 4.8 | 6.3 | 0.974 | 0.018 | 51.4 | 77.8 | 3.2 | 9.3 |
| Cyan toner Production Example 4 | Cyan toner 4 | 1.10 | 4.2 | 1.18 | 6.1 | 7.4 | 0.957 | 0.031 | 50.9 | 77.8 | 3.2 | 9.3 |

TABLE 5-continued

| | | | | | | | | | | | | |
|---|---|---|---|---|---|---|---|---|---|---|---|---|
| Cyan toner Production Example 5 | Cyan toner 5 | 1.10 | 4.2 | 1.19 | 6.8 | 13.7 | 0.954 | 0.033 | 50.2 | 77.8 | 3.2 | 9.3 |
| Cyan toner Production Example 6 | Cyan toner 6 | 1.24 | 5.3 | 1.18 | 3.5 | 4.9 | 0.967 | 0.026 | 54.2 | 91.5 | 6.3 | 7.2 |
| Cyan toner Production Example 7 | Cyan toner 7 | 1.24 | 5.3 | 1.23 | 4.2 | 5.1 | 0.956 | 0.032 | 54.1 | 91.5 | 6.3 | 7.2 |
| Cyan toner Production Example 8 | Cyan toner 8 | 1.24 | 5.3 | 1.23 | 4.6 | 5.2 | 0.957 | 0.031 | 54.3 | 91.5 | 6.3 | 7.2 |
| Cyan toner Production Example 9 | Cyan toner 9 | 1.24 | 5.3 | 1.33 | 5.7 | 7.8 | 0.934 | 0.047 | 53.9 | 91.5 | 6.3 | 7.2 |
| Cyan toner Production Example 10 | Cyan toner 10 | 1.24 | 7.6 | 1.33 | 15.3 | 21.6 | 0.933 | 0.051 | 55.4 | 116.2 | 21.2 | 3.9 |

| | | Molecular weight | | | | | |
|---|---|---|---|---|---|---|---|
| Production Example | Toner | Mw | Mn | Mw/Mn | Content of component having molecular weight of 3,000 to 5,000 (mass %) | Content of component having molecular weight of 300 to 800 (mass %) | Content of THF-soluble component (mass %) |
| Cyan toner Production Example 1 | Cyan toner 1 | 97100 | 7800 | 12.4 | 15.7 | 4.2 | 91.3 |
| Cyan toner Production Example 2 | Cyan toner 2 | 97200 | 7700 | 12.6 | 15.8 | 4.3 | 91.2 |
| Cyan toner Production Example 3 | Cyan toner 3 | 25300 | 6300 | 4.0 | 15.9 | 4.2 | 91.4 |
| Cyan toner Production Example 4 | Cyan toner 4 | 97100 | 7700 | 12.6 | 15.7 | 4.2 | 91.3 |
| Cyan toner Production Example 5 | Cyan toner 5 | 14800 | 3200 | 4.6 | 43.2 | 7.1 | 97.2 |
| Cyan toner Production Example 6 | Cyan toner 6 | 29300 | 6200 | 4.7 | 15.8 | 3.7 | 86.6 |
| Cyan toner Production Example 7 | Cyan toner 7 | 29400 | 6100 | 4.8 | 15.9 | 3.8 | 86.7 |
| Cyan toner Production Example 8 | Cyan toner 8 | 29200 | 6200 | 4.7 | 15.7 | 3.9 | 86.8 |
| Cyan toner Production Example 9 | Cyan toner 9 | 47600 | 2900 | 16.4 | 43.2 | 10.4 | 91.3 |
| Cyan toner Production Example 10 | Cyan toner 10 | 135400 | 67100 | 2.0 | 4.6 | 0.3 | 97.9 |

TABLE 6

| | Melt properties | | | | Reflection spectral characteristics | | | | | | | | |
|---|---|---|---|---|---|---|---|---|---|---|---|---|---|
| Toner | Softening point (° C.) | $\eta_{C105}$ | $\eta_{C120}$ | $\eta_{C105}/\eta_{C20}$ | $A_{C620}$ | $A_{C470}$ | $A_{C620}/A_{C670}$ | $A_{C670}$ | $A_{C420}$ | $A_{C710}/A_{C670}$ | $h^*_C$ | $L^*_C$ | $C^*_C$ |
| Cyan toner 1 | 96 | 11800 | 1300 | 9.1 | 1.91 | 0.165 | 1.08 | 1.761 | 0.451 | 1.05 | 245.5 | 46.2 | 66.4 |
| Cyan toner 2 | 88 | 6280 | 540 | 12.6 | 2.05 | 0.179 | 1.06 | 1.927 | 0.491 | 1.04 | 247.5 | 44.1 | 66.9 |
| Cyan toner 3 | 94 | 10400 | 600 | 17.3 | 1.74 | 0.158 | 1.09 | 1.604 | 0.429 | 1.05 | 244.8 | 47.8 | 65.3 |
| Cyan toner 4 | 92 | 6810 | 530 | 12.8 | 1.34 | 0.124 | 1.09 | 1.226 | 0.325 | 1.11 | 237.0 | 56.2 | 61.3 |
| Cyan toner 5 | 73 | 4200 | 90 | 46.7 | 1.77 | 0.290 | 0.97 | 1.816 | 0.674 | 0.96 | 429.9 | 38.7 | 58.7 |
| Cyan toner 6 | 109 | 24800 | 2700 | 9.2 | 1.88 | 0.166 | 1.08 | 1.743 | 0.453 | 1.05 | 245.7 | 46.2 | 66.2 |
| Cyan toner 7 | 109 | 24700 | 2600 | 9.5 | 1.59 | 0.112 | 1.15 | 1.388 | 0.309 | 1.13 | 235.1 | 55.7 | 65.5 |
| Cyan toner 8 | 108 | 24700 | 2700 | 9.1 | 1.78 | 0.257 | 0.98 | 1.812 | 0.601 | 0.97 | 246.3 | 41.3 | 60.3 |
| Cyan toner 9 | 86 | 6830 | 320 | 21.3 | 1.29 | 0.141 | 1.07 | 1.205 | 0.343 | 1.09 | 236.5 | 55.6 | 58.7 |
| Cyan toner 10 | 122 | 68300 | 15800 | 4.3 | 1.76 | 0.362 | 0.97 | 1.806 | 0.840 | 0.97 | 257.1 | 33.6 | 55.4 |

TABLE 7

| Toner | Acid value $A_C1$ (mg KOH/g) | $A_C1$-$A_C2$ | Sulfonic acid compound | Content of sulfur element (mass %) |
|---|---|---|---|---|
| Cyan toner 1 | 12.4 | 8.5 | Sulfonic acid compound 1 | 0.072 |
| Cyan toner 2 | 6.3 | 2.5 | Sulfonic acid compound 1 | 0.096 |
| Cyan toner 3 | 11.9 | 8.1 | Sulfonic acid compound 1 | 0.048 |
| Cyan toner 4 | 1.3 | 0.2 | — | 0.000 |
| Cyan toner 5 | 4.6 | 0.8 | Sulfonic acid compound 1 | 0.064 |
| Cyan toner 6 | 7.2 | 1.6 | Sulfonic acid compound 2 | 0.057 |

TABLE 7-continued

| Toner | Acid value $A_C1$ (mg KOH/g) | $A_C1$-$A_C2$ | Sulfonic acid compound | Content of sulfur element (mass %) |
|---|---|---|---|---|
| Cyan toner 7 | 6.4 | 0.9 | Sulfonic acid compound 2 | 0.039 |
| Cyan toner 8 | 7.1 | 1.5 | Sulfonic acid compound 2 | 0.063 |
| Cyan toner 9 | 2.1 | 0.4 | Sulfonic acid compound 2 | 0.038 |
| Cyan toner 10 | 32.1 | 15.6 | Sulfonic acid compound 2 | 0.176 |

TABLE 8

| | | | Shape | | | | | | Thermal properties | | | |
|---|---|---|---|---|---|---|---|---|---|---|---|---|
| Production Example | Toner | True density ρ | D4 (μm) | D4/D1 | Content of particles each having a particle diameter twice or more as large as D4 (wt %) | Content of particles each having a particle diameter one half or less as large D1 (numbers) | Average circularity | Standard deviation of circularities | Tg (° C.) | Highest endo-thermic peak (° C.) | Half width of highest endo-thermic peak (° C.) | Endo-therm (J/cm$^3$) |
| Magenta toner Production Example 1 | Magenta toner 1 | 1.10 | 4.2 | 1.11 | 2.2 | 3.3 | 0.984 | 0.011 | 51.5 | 77.8 | 3.2 | 9.3 |
| Magenta toner Production Example 2 | Magenta toner 2 | 1.10 | 3.6 | 1.15 | 5.3 | 11.1 | 0.975 | 0.016 | 50.8 | 77.8 | 3.2 | 9.3 |
| Magenta toner Production Example 3 | Magenta toner 3 | 1.10 | 4.8 | 1.18 | 4.7 | 6.2 | 0.974 | 0.017 | 51.3 | 77.8 | 3.2 | 9.3 |
| Magenta toner Production Example 4 | Magenta toner 4 | 1.10 | 4.2 | 1.18 | 6.0 | 7.4 | 0.958 | 0.030 | 50.9 | 77.8 | 3.2 | 9.3 |
| Magenta toner Production Example 5 | Magenta toner 5 | 1.10 | 4.2 | 1.18 | 6.8 | 13.6 | 0.954 | 0.032 | 50.2 | 77.8 | 3.2 | 9.3 |
| Magenta toner Production Example 6 | Magenta toner 6 | 1.24 | 5.3 | 1.19 | 3.5 | 4.8 | 0.968 | 0.025 | 54.1 | 91.5 | 6.3 | 7.2 |
| Magenta toner Production Example 7 | Magenta toner 7 | 1.24 | 5.3 | 1.22 | 4.1 | 5.0 | 0.957 | 0.031 | 54.1 | 91.5 | 6.3 | 7.2 |
| Magenta toner Production Example 8 | Magenta toner 8 | 1.24 | 5.3 | 1.22 | 4.6 | 5.2 | 0.958 | 0.030 | 54.2 | 91.5 | 6.3 | 7.2 |
| Magenta toner Production Example 9 | Magenta toner 9 | 1.24 | 5.3 | 1.32 | 5.6 | 7.7 | 0.933 | 0.046 | 53.9 | 91.5 | 6.3 | 7.2 |
| Magenta toner Production Example 10 | Magenta toner 10 | 1.24 | 7.6 | 1.32 | 15.2 | 21.5 | 0.934 | 0.051 | 55.3 | 116.2 | 21.2 | 3.9 |

| | | Molecular weight | | | | | |
|---|---|---|---|---|---|---|---|
| Production Example | Toner | Mw | Mn | Mw/Mn | Content of component having molecular weight of 3,000 to 5,000 (mass %) | Content of component having molecular weight of 300 to 800 (mass %) | Content of THF-soluble component (mass %) |
| Magenta toner Production Example 1 | Magenta toner 1 | 97200 | 7800 | 12.5 | 15.7 | 4.2 | 91.2 |

TABLE 8-continued

| | | | | | | | |
|---|---|---|---|---|---|---|---|
| Magenta toner Production Example 2 | Magenta toner 2 | 97100 | 7700 | 12.6 | 15.8 | 4.1 | 91.3 |
| Magenta toner Production Example 3 | Magenta toner 3 | 25100 | 6200 | 4.0 | 16.0 | 4.2 | 91.5 |
| Magenta toner Production Example 4 | Magenta toner 4 | 97100 | 7700 | 12.6 | 15.7 | 4.2 | 91.3 |
| Magenta toner Production Example 5 | Magenta toner 5 | 14700 | 3200 | 4.6 | 43.1 | 7.2 | 97.3 |
| Magenta toner Production Example 6 | Magenta toner 6 | 29400 | 6200 | 4.7 | 15.7 | 3.6 | 86.7 |
| Magenta toner Production Example 7 | Magenta toner 7 | 29300 | 6200 | 4.7 | 15.8 | 3.7 | 86.6 |
| Magenta toner Production Example 8 | Magenta toner 8 | 29300 | 6100 | 4.8 | 15.8 | 3.8 | 86.8 |
| Magenta toner Production Example 9 | Magenta toner 9 | 47500 | 2860 | 16.6 | 43.4 | 10.7 | 86.8 |
| Magenta toner Production Example 10 | Magenta toner 10 | 135100 | 66900 | 2.0 | 4.7 | 0.2 | 98.1 |

TABLE 9

| | Melt properties | | | | Reflection spectral characteristics | | | | | | | | |
|---|---|---|---|---|---|---|---|---|---|---|---|---|---|
| Toner | Softening point (° C.) | $\eta_{M105}$ | $\eta_{M120}$ | $\eta_{M105}/\eta_{M120}$ | $A_M570$ | $A_M620$ | $A_M570/A_M450$ | $A_M450$ | $A_M490$ | $AM570/AM550$ | $h^*_M$ | $L^*_M$ | $C^*_M$ |
| Magenta toner 1 | 96 | 11700 | 1280 | 9.1 | 1.972 | 0.158 | 2.51 | 0.785 | 1.242 | 10.3 | 0.13 | 43.61 | 79.1 |
| Magenta toner 2 | 88 | 6800 | 530 | 12.8 | 2.113 | 0.167 | 2.52 | 0.838 | 1.346 | 1.00 | 1.95 | 42.46 | 80.09 |
| Magenta toner 3 | 94 | 10300 | 590 | 17.5 | 1.904 | 0.152 | 2.54 | 0.749 | 1.181 | 1.04 | 358.75 | 44.34 | 78.64 |
| Magenta toner 4 | 92 | 6800 | 530 | 12.8 | 1.521 | 0.100 | 2.78 | 0.548 | 0.863 | 1.08 | 351.57 | 50.07 | 76.26 |
| Magenta toner 5 | 72 | 4180 | 90 | 46.4 | 1.714 | 0.176 | 1.57 | 1.091 | 1.633 | 0.94 | 15.52 | 43.56 | 79.74 |
| Magenta toner 6 | 109 | 24700 | 2690 | 9.2 | 2.038 | 0.159 | 2.61 | 0.780 | 1.246 | 1.02 | 359.58 | 43.41 | 79.59 |
| Magenta toner 7 | 108 | 24600 | 2620 | 9.4 | 1.670 | 0.103 | 2.87 | 0.581 | 0.924 | 1.08 | 352.66 | 48.65 | 78.43 |
| Magenta toner 8 | 108 | 24700 | 2640 | 9.4 | 1.749 | 0.145 | 1.70 | 1.031 | 1.631 | 0.94 | 14.09 | 44.67 | 81.36 |
| Magenta toner 9 | 86 | 6810 | 300 | 22.7 | 1.526 | 0.220 | 1.25 | 1.222 | 1.549 | 0.95 | 20.39 | 42.79 | 75.75 |
| Magenta toner 10 | 121 | 68100 | 15600 | 4.4 | 1.762 | 0.294 | 1.10 | 1.606 | 1.870 | 0.93 | 27.48 | 38.29 | 80.01 |

TABLE 10

| Toner | Acid value $A_M1$ (mg KOH/g) | $A_M1$-$A_M2$ | Sulfonic acid compound | Content of sulfur element (mass %) |
|---|---|---|---|---|
| Magenta toner 1 | 12.3 | 8.4 | Sulfonic acid compound 1 | 0.071 |
| Magenta toner 2 | 6.3 | 2.5 | Sulfonic acid compound 1 | 0.095 |
| Magenta toner 3 | 11.8 | 8 | Sulfonic acid compound 1 | 0.048 |
| Magenta toner 4 | 1.3 | 0.2 | — | 0.000 |
| Magenta toner 5 | 4.6 | 0.8 | Sulfonic acid compound 1 | 0.063 |

TABLE 10-continued

| Toner | Acid value $A_M1$ (mg KOH/g) | $A_M1$-$A_M2$ | Sulfonic acid compound | Content of sulfur element (mass %) |
|---|---|---|---|---|
| Magenta toner 6 | 7.1 | 1.5 | Sulfonic acid compound 2 | 0.057 |
| Magenta toner 7 | 6.4 | 0.9 | Sulfonic acid compound 2 | 0.039 |
| Magenta toner 8 | 7 | 1.4 | Sulfonic acid compound 2 | 0.062 |
| Magenta toner 9 | 2.1 | 0.4 | Sulfonic acid compound 2 | 0.038 |
| Magenta toner 10 | 31.9 | 15.4 | Sulfonic acid compound 2 | 0.174 |

TABLE 11

| Production Example | Toner | True density ρ | Shape: D4 (μm) | D4/D1 | Content of particles each having a particle diameter twice or more as large as D4 (wt %) | Content of particles each having a particle diameter one half or less as large D1 (numbers) | Average circularity | Standard deviation of circularities | Thermal properties: Tg (° C.) | Highest endo-thermic peak- (° C.) | Half width of highest endo-thermic peak (° C.) | Endo-therm (J/cm$^3$) |
|---|---|---|---|---|---|---|---|---|---|---|---|---|
| Yellow toner Production Example 1 | Yellow toner 1 | 1.10 | 4.3 | 1.13 | 2.4 | 3.5 | 0.982 | 0.013 | 51.7 | 77.8 | 3.2 | 9.3 |
| Yellow toner Production Example 2 | Yellow toner 2 | 1.10 | 3.7 | 1.16 | 5.5 | 11.3 | 0.972 | 0.017 | 50.8 | 77.8 | 3.2 | 9.3 |
| Yellow toner Production Example 3 | Yellow toner 3 | 1.10 | 4.9 | 1.19 | 4.9 | 6.4 | 0.973 | 0.019 | 51.5 | 77.8 | 3.2 | 9.3 |
| Yellow toner Production Example 4 | Yellow toner 4 | 1.10 | 4.3 | 1.19 | 6.2 | 7.5 | 0.956 | 0.032 | 51.0 | 77.8 | 3.2 | 9.3 |
| Yellow toner Production Example 5 | Yellow toner 5 | 1.10 | 4.3 | 1.20 | 6.9 | 13.8 | 0.953 | 0.034 | 50.3 | 77.8 | 3.2 | 9.3 |
| Yellow toner Production Example 6 | Yellow toner 6 | 1.24 | 5.4 | 1.19 | 3.6 | 4.9 | 0.966 | 0.025 | 54.3 | 91.5 | 6.3 | 7.2 |
| Yellow toner Production Example 7 | Yellow toner 7 | 1.24 | 5.4 | 1.23 | 4.3 | 5.2 | 0.955 | 0.032 | 54.2 | 91.5 | 6.3 | 7.2 |
| Yellow toner Production Example 8 | Yellow toner 8 | 1.24 | 5.4 | 1.23 | 4.7 | 5.3 | 0.958 | 0.032 | 54.3 | 91.5 | 6.3 | 7.2 |
| Yellow toner Production Example 9 | Yellow toner 9 | 1.24 | 5.4 | 1.34 | 5.8 | 7.9 | 0.932 | 0.048 | 54.0 | 91.5 | 6.3 | 7.2 |
| Yellow toner Production Example 10 | Yellow toner 10 | 1.24 | 7.6 | 1.34 | 15.4 | 21.8 | 0.932 | 0.052 | 55.4 | 116.2 | 21.2 | 3.9 |

| Production Example | Toner | Molecular weight: Mw | Mn | Mw/Mn | Content of component having molecular weight of 3,000 to 5,000 (mass %) | Content of component having molecular weight of 300 to 800 (mass %) | Content of THF-soluble component (mass %) |
|---|---|---|---|---|---|---|---|
| Yellow toner Production Example 1 | Yellow toner 1 | 97300 | 7900 | 12.3 | 15.6 | 4.1 | 91.2 |
| Yellowa toner Production Example 2 | Yellow toner 2 | 97400 | 7800 | 12.5 | 15.7 | 4.2 | 91.2 |
| Yellow toner Production Example 3 | Yellow toner 3 | 25400 | 6400 | 4.0 | 16.0 | 4.1 | 91.3 |
| Yellowa toner Production Example 4 | Yellow toner 4 | 97300 | 7800 | 12.5 | 15.5 | 4.0 | 91.2 |
| Yellow toner Production Example 5 | Yellow toner 5 | 14900 | 3300 | 4.5 | 43.1 | 6.9 | 97.1 |
| Yellow toner Production Example 6 | Yellow toner 6 | 29400 | 6300 | 4.7 | 15.7 | 3.7 | 86.6 |
| Yellow toner Production Example 7 | Yellow toner 7 | 29500 | 6100 | 4.8 | 15.8 | 3.8 | 86.6 |
| Yellow toner Production Example 8 | Yellow toner 8 | 29300 | 6200 | 4.7 | 15.7 | 3.8 | 86.7 |
| Yellow toner Production Example 9 | Yellow toner 9 | 47700 | 2890 | 16.5 | 43.1 | 10.3 | 86.6 |

TABLE 11-continued

| | | | | | | | |
|---|---|---|---|---|---|---|---|
| Yellow toner Production Example 10 | Yellow toner 10 | 135800 | 67300 | 2.0 | 4.5 | 0.1 | 97.7 |

TABLE 12

| | Melt properties | | | | Reflection spectral characteristics | | | | | | |
|---|---|---|---|---|---|---|---|---|---|---|---|
| Toner | Softening point (° C.) | $\eta_{Y105}$ | $\eta_{Y120}$ | $\eta_{Y105}/\eta_{Y120}$ | $A_Y450$ | $A_Y470$ | $A_Y510$ | $A_{Y470}/A_{Y490}$ | $h^*_Y$ | $L^*_Y$ | $C^*_Y$ |
| Yellow toner 1 | 97 | 11900 | 1320 | 9.0 | 1.852 | 1.767 | 0.241 | 1.49 | 93.20 | 92.48 | 113.45 |
| Yellow toner 2 | 89 | 6850 | 560 | 12.2 | 2.046 | 1.935 | 0.272 | 1.46 | 92.68 | 92.13 | 116.73 |
| Yellow toner 3 | 94 | 10600 | 620 | 17.1 | 1.745 | 1.669 | 0.232 | 1.48 | 93.38 | 92.35 | 110.99 |
| Yellow toner 4 | 92 | 6820 | 540 | 12.6 | 1.560 | 1.433 | 0.126 | 1.97 | 95.89 | 93.63 | 103.70 |
| Yellow toner 5 | 73 | 4220 | 90 | 46.9 | 1.718 | 1.652 | 0.535 | 1.16 | 87.89 | 93.37 | 119.13 |
| Yellow toner 6 | 109 | 24900 | 2720 | 9.2 | 1.835 | 1.741 | 0.245 | 1.46 | 93.17 | 92.28 | 112.89 |
| Yellow toner 7 | 109 | 24800 | 2670 | 9.3 | 1.663 | 1.525 | 0.134 | 1.96 | 95.60 | 93.53 | 105.28 |
| Yellow toner 8 | 108 | 24800 | 2710 | 9.2 | 1.690 | 1.639 | 0.619 | 1.13 | 86.62 | 92.57 | 118.74 |
| Yellow toner 9 | 87 | 6850 | 360 | 19.0 | 1.627 | 1.313 | 0.176 | 1.97 | 94.08 | 96.11 | 106.15 |
| Yellow toner 10 | 124 | 68900 | 16300 | 4.2 | 1.748 | 1.683 | 0.847 | 1.13 | 83.73 | 90.40 | 119.91 |

TABLE 13

| Toner | Acid value $A_Y1$ (mg KOH/g) | $A_Y1$-$A_Y2$ | Sulfonic acid compound | Content of sulfur element (mass %) |
|---|---|---|---|---|
| Yellow toner 1 | 12.6 | 8.6 | Sulfonic acid compound 1 | 0.073 |
| Yellow toner 2 | 6.4 | 2.6 | Sulfonic acid compound 1 | 0.097 |
| Yellow toner 3 | 12 | 8.2 | Sulfonic acid compound 1 | 0.048 |
| Yellow toner 4 | 1.4 | 0.3 | — | 0.000 |
| Yellow toner 5 | 4.7 | 0.8 | Sulfonic acid compound 1 | 0.065 |

TABLE 13-continued

| Toner | Acid value $A_Y1$ (mg KOH/g) | $A_Y1$-$A_Y2$ | Sulfonic acid compound | Content of sulfur element (mass %) |
|---|---|---|---|---|
| Yellow toner 6 | 7.3 | 1.7 | Sulfonic acid compound 2 | 0.057 |
| Yellow toner 7 | 6.4 | 0.9 | Sulfonic acid compound 2 | 0.039 |
| Yellow toner 8 | 7.2 | 1.6 | Sulfonic acid compound 2 | 0.064 |
| Yellow toner 9 | 2.2 | 0.5 | Sulfonic acid compound 2 | 0.038 |
| Yellow toner 10 | 32.3 | 15.7 | Sulfonic acid compound 2 | 0.177 |

TABLE 14

| | | | Shape | | | | | | Thermal properties | | | |
|---|---|---|---|---|---|---|---|---|---|---|---|---|
| Production Example | Toner | True density ρ | D4 (μm) | D4/D1 | Content of particles each having a particle diameter twice or more as large as D4 (wt %) | Content of particles each having a particle diameter one half or less as large D1 (numbers) | Average circularity | Standard deviation of circularities | Tg (° C.) | Highest endothermic peak (° C.) | Half width of highest endo-thermic peak (° C.) | Endo-therm (J/cm$^3$) |
| Black toner Production Example 1 | Black toner 1 | 1.10 | 4.2 | 1.11 | 2.3 | 3.3 | 0.984 | 0.012 | 51.6 | 77.8 | 3.2 | 9.3 |
| Black toner Production Example 2 | Black toner 2 | 1.10 | 3.6 | 1.12 | 4.8 | 9.8 | 0.974 | 0.016 | 50.9 | 77.8 | 3.2 | 9.3 |
| Black toner Production Example 3 | Black toner 3 | 1.10 | 4.7 | 1.17 | 4.7 | 6.2 | 0.975 | 0.017 | 51.5 | 77.8 | 3.2 | 9.3 |
| Black toner Production Example 4 | Black toner 4 | 1.10 | 4.2 | 1.18 | 6.1 | 7.5 | 0.958 | 0.032 | 50.9 | 77.8 | 3.2 | 9.3 |
| Black toner Production Example 5 | Black toner 5 | 1.10 | 4.2 | 1.19 | 6.9 | 13.8 | 0.955 | 0.034 | 50.3 | 77.8 | 3.2 | 9.3 |
| Black toner Production Example 6 | Black toner 6 | 1.24 | 4.3 | 1.22 | 7.1 | 15.1 | 0.953 | 0.038 | 50.2 | 77.8 | 3.2 | 9.3 |

TABLE 14-continued

| | | | | | | | | | | | | |
|---|---|---|---|---|---|---|---|---|---|---|---|---|
| Black toner Production Example 7 | Black toner 7 | 1.24 | 5.3 | 1.17 | 3.4 | 4.8 | 0.968 | 0.025 | 54.2 | 91.5 | 6.3 | 7.2 |
| Black toner Production Example 8 | Black toner 8 | 1.24 | 5.3 | 1.22 | 4.1 | 4.9 | 0.957 | 0.031 | 54.2 | 91.5 | 6.3 | 7.2 |
| Black toner Production Example 9 | Black toner 9 | 1.24 | 5.3 | 1.23 | 4.7 | 5.1 | 0.956 | 0.032 | 54.3 | 91.5 | 6.3 | 7.2 |
| Black toner Production Example 10 | Black toner 10 | 1.24 | 5.3 | 1.34 | 5.8 | 7.9 | 0.932 | 0.049 | 53.9 | 91.5 | 6.3 | 7.2 |
| Black toner Production Example 11 | Black toner 11 | 1.24 | 7.5 | 1.33 | 15.4 | 21.7 | 0.932 | 0.052 | 55.3 | 116.2 | 21.2 | 3.9 |

| | | Molecular weight | | | | | |
|---|---|---|---|---|---|---|---|
| Production Example | Toner | Mw | Mn | Mw/Mn | Content of component having molecular weight of 3,000 to 5,000 (mass %) | Content of component having molecular weight of 300 to 800 (mass %) | Content of THF-soluble component (mass %) |
| Black toner Production Example 1 | Black toner 1 | 96900 | 7600 | 12.8 | 16.1 | 3.9 | 91.4 |
| Black toner Production Example 2 | Black toner 2 | 97100 | 7700 | 12.6 | 15.9 | 4.1 | 91.1 |
| Black toner Production Example 3 | Black toner 3 | 25100 | 6280 | 4.0 | 16.1 | 4.0 | 91.5 |
| Black toner Production Example 4 | Black toner 4 | 96800 | 7500 | 12.9 | 15.8 | 4.1 | 91.4 |
| Black toner Production Example 5 | Black toner 5 | 14600 | 3100 | 4.7 | 43.1 | 7.2 | 97.2 |
| Black toner Production Example 6 | Black toner 6 | 96700 | 7400 | 13.1 | 15.9 | 4.0 | 91.5 |
| Black toner Production Example 7 | Black toner 7 | 29400 | 6300 | 4.7 | 15.7 | 3.6 | 86.6 |
| Black toner Production Example 8 | Black toner 8 | 29500 | 6300 | 4.7 | 15.8 | 3.7 | 86.7 |
| Black toner Production Example 9 | Black toner 9 | 29400 | 6200 | 4.7 | 15.7 | 3.9 | 86.7 |
| Black toner Production Example 10 | Black toner 10 | 47700 | 2910 | 16.4 | 43.0 | 10.5 | 86.8 |
| Black toner Production Example 11 | Black toner 11 | 136000 | 66500 | 2.0 | 4.4 | 0.4 | 97.9 |

TABLE 15

| | Melt properties | | | | Reflection spectral characteristics | | | | | | | | |
|---|---|---|---|---|---|---|---|---|---|---|---|---|---|
| Toner | Softening point (° C.) | $\eta_{K105}$ | $\eta_{K120}$ | $\eta_{K105}/\eta_{K120}$ | $A_K600$ | $A_K600/A_K460$ | $A_K460$ | $A_K670$ | $A_K460/A_K670$ | $L^*_K$ | $a^*_K$ | $b^*_K$ | $c^*_K$ |
| Black toner 1 | 95 | 11600 | 1260 | 9.2 | 1.763 | 1.007 | 1.751 | 1.732 | 1.011 | 14.22 | −0.45 | −0.09 | 0.46 |
| Black toner 2 | 88 | 6760 | 520 | 13.0 | 1.883 | 1.012 | 1.861 | 1.843 | 1.010 | 11.64 | −0.38 | −0.18 | 0.42 |
| Black toner 3 | 94 | 10300 | 580 | 17.8 | 1.714 | 0.994 | 1.725 | 1.663 | 1.037 | 15.52 | −1.04 | 1.12 | 1.53 |
| Black toner 4 | 91 | 6790 | 510 | 13.3 | 1.577 | 0.995 | 1.585 | 1.529 | 1.037 | 19.01 | −1.09 | 1.33 | 1.72 |
| Black toner 5 | 72 | 4180 | 80 | 52.3 | 1.639 | 0.946 | 1.732 | 1.593 | 1.087 | 16.34 | 1.13 | 2.89 | 3.11 |
| Black toner 6 | 94 | 11500 | 1250 | 9.2 | 1.883 | 0.957 | 1.968 | 1.832 | 1.074 | 10.89 | 0.95 | 2.36 | 2.55 |
| Black toner 7 | 109 | 24900 | 2680 | 9.3 | 1.788 | 1.022 | 1.749 | 1.782 | 0.981 | 13.62 | 0.04 | −1.45 | 1.45 |
| Black toner 8 | 109 | 24800 | 2640 | 9.4 | 1.675 | 1.031 | 1.624 | 1.689 | 0.962 | 16.47 | −0.41 | −1.91 | 1.96 |

TABLE 15-continued

| Toner | Melt properties | | | | Reflection spectral characteristics | | | | | | | | |
|---|---|---|---|---|---|---|---|---|---|---|---|---|---|
| | Softening point (° C.) | $\eta_{K105}$ | $\eta_{K120}$ | $\eta_{K105}/\eta_{K120}$ | $A_K600$ | $A_K600/A_K460$ | $A_K460$ | $A_K670$ | $A_K460/A_K670$ | $L^*_K$ | $a^*_K$ | $b^*_K$ | $c^*_K$ |
| Black toner 9 | 108 | 24800 | 2560 | 9.7 | 1.766 | 1.040 | 1.698 | 1.779 | 0.954 | 14.30 | −0.33 | −2.27 | 2.30 |
| Black toner 10 | 86 | 6840 | 290 | 23.6 | 1.643 | 1.046 | 1.570 | 1.663 | 0.944 | 17.49 | −0.72 | −2.42 | 2.52 |
| Black toner 11 | 124 | 69200 | 16100 | 4.3 | 1.951 | 1.037 | 1.882 | 1.950 | 0.965 | 10.39 | −0.24 | −1.82 | 1.84 |

TABLE 16

| Toner | Acid value $A_K1$ (mg KOH/g) | $A_K1$-$A_K2$ | Sulfonic acid compound | Content of sulfur element (mass %) |
|---|---|---|---|---|
| Black toner 1 | 12.6 | 8.6 | Sulfonic acid compound 1 | 0.072 |
| Black toner 2 | 6.4 | 2.5 | Sulfonic acid compound 1 | 0.096 |
| Black toner 3 | 12.1 | 8.2 | Sulfonic acid compound 1 | 0.048 |
| Black toner 4 | 1.4 | 0.3 | — | 0.000 |
| Black toner 5 | 4.7 | 0.8 | Sulfonic acid compound 1 | 0.064 |
| Black toner 6 | 7.8 | 3.9 | Sulfonic acid compound 1 | 0.152 |
| Black toner 7 | 7.4 | 1.7 | Sulfonic acid compound 2 | 0.057 |
| Black toner 8 | 6.5 | 0.9 | Sulfonic acid compound 2 | 0.040 |
| Black toner 9 | 7.3 | 1.6 | Sulfonic acid compound 2 | 0.065 |
| Black toner 10 | 2.2 | 0.4 | Sulfonic acid compound 2 | 0.039 |
| Black toner 11 | 32.4 | 15.8 | Sulfonic acid compound 2 | 0.181 |

(Carrier Production Example 1)

A magnetite powder ($Fe_3O_4$) having a number average particle diameter of 180 nm, an intensity of magnetization of 72 $Am^2/kg$, and a specific resistance of $5.1\times10^5$ Ω·cm was calcined in the air at 700° C. for 3 hours. 4.2 mass % of a silane coupling agent (3-(2-aminoethylaminopropyl)trimethoxysilane) were added to the magnetite powder. The materials were mixed and stirred in a container at 120° C. so that the surface of the above magnetite powder was treated. Thus, a treated magnetite powder was obtained.

| | |
|---|---|
| Phenol | 10 parts by mass |
| Formaldehyde solution (37-mass % aqueous solution of formaldehyde) | 14 parts by mass |
| Magnetite powder subjected to hydrophobic treatment | 90 parts by mass |

The above materials were sufficiently mixed in a flask. Under a nitrogen atmosphere, 4 parts by mass of 28-mass % ammonia water and 12 parts by mass of water were added to the flask. The mixture was heated while being stirred so that its temperature was retained at 85° C. Then, the mixture was subjected to a polymerization reaction for 4 hours so as to be cured.

After having been cooled to 30° C., the cured product was washed with water and dried, whereby spherical carrier particles 1 were obtained.

A mixture composed of the following materials was loaded into a reaction vessel equipped with a reflux pipe, a stirring machine, a temperature gauge, a nitrogen introducing pipe, a dropping device, and a decompression device. The mixture was heated to 70° C. under a nitrogen atmosphere while being stirred, and the temperature was retained for 10 hours.

| | |
|---|---|
| Methyl methacrylate macromonomer (AA-6 manufactured by TOAGOSEI CO., LTD.) | 10 parts by mass |
| Methyl methacrylate | 90 parts by mass |
| Toluene | 100 parts by mass |
| Methyl ethyl ketone | 110 parts by mass |
| 2,2'-azobis(2,4-dimethylvaleronitrile) | 2.4 parts by mass |

2 parts by mass of carbon black (manufactured by Tokai Carbon Co., Ltd.: TOKABLACK #5500) and 200 parts by mass of toluene were added to the mixture, and the whole was sufficiently mixed with a homogenizer, whereby a coat liquid was obtained. Subsequently, 100 parts by mass of the carrier particles 1 were stirred while a shearing stress was continuously applied, and, during the stirring, 25 parts by mass of the above coat liquid were gradually added. The temperature of the resultant mixture was retained at 70° C., and the mixture was stirred. Further, the temperature was increased to 100° C., and then the mixture was stirred for 2 hours. After having been cooled, the mixture was shredded. Further, the shredded products were classified, whereby Carrier 1 was obtained.

Carrier 1 had a 50% particle diameter on a volume basis (D50) of 24.6 μm, a true specific gravity of 3.55 $g/cm^3$, an intensity of magnetization of 64 $Am^2/kg$, and a specific resistance of $2.1\times10^{12}$ Ω·cm.

(Carrier Production Example 2)

12.578 mol % of LiO, 6.500 mol % of MgO, 80.600 mol % of $Fe_2O_3$, 0.020 mol % of MnO, and 0.002 mol % of CuO were mixed with a wet ball mill for 5 hours, and the mixture was dried. The temperature of the mixture was retained at 850° C. for 1 hour, and then the mixture was temporarily calcined. The resultant was pulverized with a wet ball mill for 6 hours into particles having a number average particle diameter of 2 μm. 2.4 mass % of polyvinyl alcohol were added to the particles. Subsequently, the mixture was granulated and dried with a spray dryer. In an electric furnace, the temperature of each of the granulated products was retained at 1,200° C. for 4 hours, and then the granulated products were calcined. After that, the calcined products were shredded and screened with a sieve having an aperture of 250 μm so that coarse particles were removed. Thus, carrier particles 2 were obtained.

The subsequent operation was the same as that in Carrier Production Example 1 except that the usage of the coat liquid was changed to 18 parts by mass, whereby Carrier 2 was obtained.

Carrier 2 had a 50% particle diameter on a volume basis (D50) of 33.6 μm, a true specific gravity of 3.69 $g/cm^3$, an intensity of magnetization of 59 $Am^2/kg$, and a specific resistance of $2.9\times10^{12}$ Ω·cm.

Example 1

8 parts by mass of Cyan Toner 1 and 92 parts by mass of Carrier 1 were mixed, whereby a two-component cyan developer 1 was obtained. 8 parts by mass of Magenta Toner 4, Yellow Toner 4, or Black Toner 4 and 92 parts by mass of Carrier 1 were similarly mixed, whereby a two-component magenta developer 4, a two-component yellow developer 4, or a two-component black developer 4 was obtained, respectively.

The two-component cyan developer 1 was set in the cyan developing device of a commercially available full-color copying machine (iRC3220, manufactured by Canon Inc.), and the magenta developer 4, yellow developer 4, and black developer 4 described above were set in the other developing devices of the machine corresponding to the respective colors. The two-component cyan developer 1 was designed so that a toner amount to be used in the development of an electrostatic latent image identical to a conventional one was small and the charge quantity of the toner was large. Image data based on a CIELAB color coordinate system with ($L^*=53.9$, $a^*=-37.0$, $b^*=-50.1$) (cyan solid image specified as a Japan color) was printed on plain paper (A4-size CLC paper (81.4 g/m$^2$); manufactured by Canon Inc.), and a toner amount $M1_C$ (mg/cm$^2$) used in the development of the image data on the paper was measured.

In addition, the fixing unit of the full-color copying machine (iRC3220; manufactured by Canon Inc.) was removed and reconstructed so that the temperature of a fixing member could be adjusted, and then a fixability test was performed. The above toner image was fixed under a normal-temperature, normal-humidity environment in the range of 110° C. to 220° C. while the preset temperature of the fixing unit was changed in an increment of 10° C. The temperature at which cold offset was no longer observed was defined as a low non-offset temperature. A temperature lower than the lower one of the temperature at which hot offset was observed and the temperature at which the winding of receiver paper around the fixing unit occurred by 10° C. was defined as a high non-offset temperature.

The preset temperature of the fixing unit of the commercially available full-color copying machine (iRC3220; manufactured by Canon Inc.) was changed so as to be lower than the temperature at which average gloss was largest in the above fixability test by 10° C., and the two-component cyan developer 1 was set in the cyan developing device of the machine. In addition, the two-component magenta developer 4, the two-component yellow developer 4, and the two-component black developer 4 corresponding to the respective colors were set in the other developing devices of the machine. A full-color image was formed under a normal-temperature, normal-humidity environment, and a color space was measured. Further, belt-like solid images each measuring 3 cm long by 15 cm wide and each created from image data based on a CIELAB color coordinate system with ($L^*=53.9$, $a^*=-37.0$, $b^*=-50.1$) (cyan solid image specified as a Japan color) and images on each of which 30 circular dots each having a diameter of 42 μm were formed at an interval of one space for one dot were continuously printed. A cyan image on a first sheet, a 3,000-th sheet, or a 6,000-th sheet was evaluated for the spread state of each dot, the chipped state of each dot, and the gloss uniformity of a solid portion. At that time, part of the cyan developer present on a developing sleeve was collected, and the charge quantity of the toner was measured. Further, the height of a toner image developed on an electrostatic image bearing member was measured. Table 18 shows the results.

Evaluation criteria for the respective items in examples will be shown below.

(Color Space)

A full-color image with a 256-step gradation was formed, and its color space volume was evaluated as a relative value when the color space volume of Comparative Example 1 to be described later was defined as 100%.

A: The color space volume is 97% or more of the area of Comparative Example 1 (color space performance: most excellent).

B: The color space volume is 94% or more and less than 97% of the area of Comparative Example 1 (color space performance: excellent).

C: The color space volume is 90% or more and less than 94% of the area of Comparative Example 1 (color space performance: good).

D: The color space volume is less than 90% of the area of Comparative Example 1 (color space performance: poor).

(Gloss Uniformity)

A difference in gloss between a solid image portion at a front end portion and a solid image portion at a rear end portion was measured for the direction in which paper was passed.

A: The difference in gloss is less than 5 (gloss uniformity: most excellent).

B: The difference in gloss is 5 or more and less than 10 (gloss uniformity: excellent).

C: The difference in gloss is 10 or more and less than 15 (gloss uniformity: good).

D: The difference in gloss is 15 or more (gloss uniformity: poor).

(Dot Spread)

Figure 13:
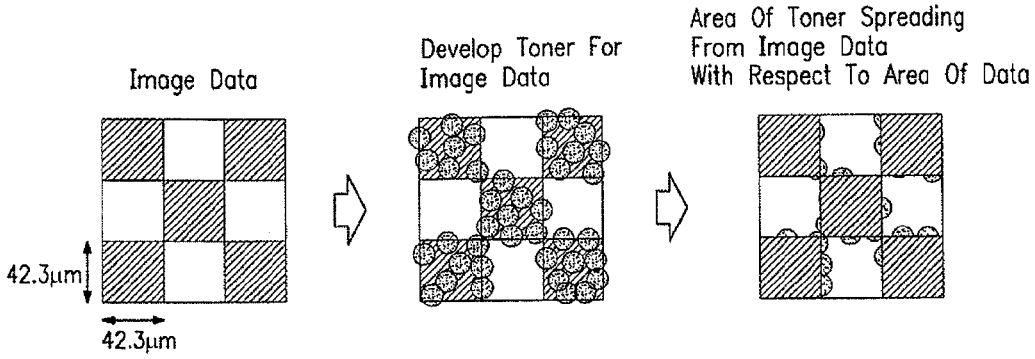
FIG. 13 is a view showing the concept of dot spread.

Dot spread can be measured with a commercially available optical microscope. To be specific, the dot spread can be measured with, for example, a color laser microscope (VK-9500, manufactured by KEYENCE CORPORATION). In a fixed image on which image data on a square solid image (600 dpi, one dot) measuring 42.3 μm long by 42.3 μm wide is output, the area of the square is defined as 100%, and the area of toner spreading from the square is determined in a percentage unit. The same operation was performed for 30 randomly sampled images, and evaluation for dot spread was performed by determining the average of the areas. Evaluation criteria are shown below. FIG. 13 shows a conceptual view of dot spread. It should be noted that, for each of a cyan image, a magenta image, and a yellow image, data on an observed image was divided into red (R), green (G), and blue (B), and the cyan image, the magenta image, and the yellow image were evaluated by using the R data, the G data, and the B data, respectively.

A: The average of the area percentages of the toner that spreads is less than 5.0% (dot spread performance: most excellent).

B: The average of the area percentages of the toner that spreads is 5.0% or more and less than 10.0% (dot spread performance: excellent).

C: The average of the area percentages of the toner that spreads is 10.0% or more and less than 15.0% (dot spread performance: good).

D: The average of the area percentages of the toner that spreads is 15.0% or more (dot spread performance: poor).

(Dot Chipping)

Figure 14:
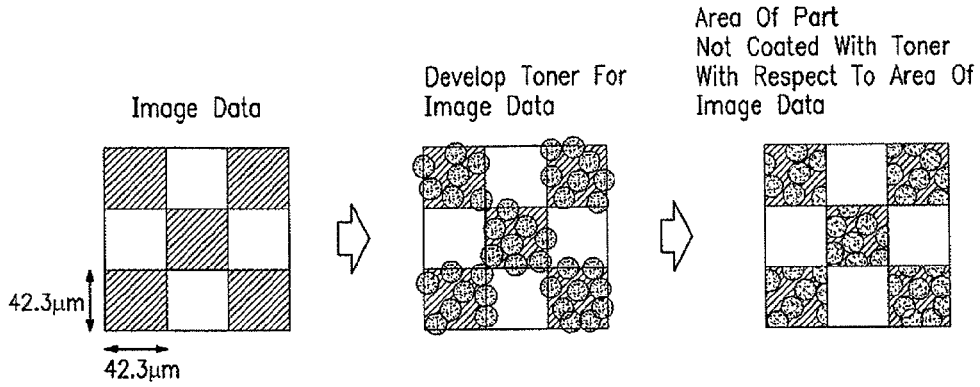
FIG. 14 is a view showing the concept of dot chipping.

A toner height on a drum or on unfixed paper is measured by the same procedure as that described above, the area of the square is defined as 100%, and the area of a portion where no toner is present in the square is measured in a percentage unit. The same operation was performed for 30 randomly sampled images, and evaluation for dot chipping was performed by determining the average of the areas. Evaluation criteria are shown below. FIG. 14 shows a conceptual view of dot chipping. It should be noted that, for each of a cyan image, a magenta image, and a yellow image, data on an observed image was divided into red (R), green (G), and blue (B), and the cyan image, the magenta image, and the yellow image were evaluated by using the R data, the G data, and the B data, respectively.

A: The average of the area percentages of portions where no toner is present is less than 5.0% (dot chipping performance: most excellent).

B: The average of the area percentages of portions where no toner is present is 5.0% or more and less than 10.0% (dot chipping performance: excellent).

C: The average of the area percentages of portions where no toner is present is 10.0% or more and less than 15.0% (dot chipping performance: good).

D: The average of the area percentages of portions where no toner is present is 15.0% or more (dot chipping performance: poor).

Examples 2 to 20 and Comparative Examples 1 to 21

Evaluation was performed in the same manner as in Example 1 except that any toner shown in Table 17 was used. It should be noted that image data based on a CIELAB color coordinate system with (L*=47.0, a*=75.0, b*=−6.0) (magenta solid image specified as a Japan color) was used as data on an image to be evaluated in each of Examples 6 to 10 and Comparative Examples 6 to 10, image data based on the CIELAB color coordinate system with (L*=88.0, a*=−6.0, b*=95.0) (yellow solid image specified as a Japan color) was used as data on an image to be evaluated in each of Examples 11 to 15 and Comparative Examples 11 to 15, and image data based on the CIELAB color coordinate system with (L*=13.2, a*=1.3, b*=1.9) (black solid image specified as a Japan color) was used as data on an image to be evaluated in each of Examples 16 to 20 and Comparative Examples 16 to 21. In addition, Tables 18 to 21 show the results.

TABLE 17

| Example | Cyan developer | Magenta developer | Yellow developer | Black developer |
|---|---|---|---|---|
| Example 1 | Cyan toner 1 | Magenta toner 4 | Yellow toner 4 | Black toner 4 |
| Example 2 | Cyan toner 2 | Magenta toner 4 | Yellow toner 4 | Black toner 4 |
| Example 3 | Cyan toner 3 | Magenta toner 4 | Yellow toner 4 | Black toner 4 |
| Comparative Example 1 | Cyan toner 4 | Magenta toner 4 | Yellow toner 4 | Black toner 4 |
| Comparative Example 2 | Cyan toner 5 | Magenta toner 4 | Yellow toner 4 | Black toner 4 |
| Example 4 | Cyan toner 6 | Magenta toner 4 | Yellow toner 4 | Black toner 4 |
| Example 5 | Cyan toner 7 | Magenta toner 4 | Yellow toner 4 | Black toner 4 |
| Comparative Example 3 | Cyan toner 8 | Magenta toner 4 | Yellow toner 4 | Black toner 4 |
| Comparative Example 4 | Cyan toner 9 | Magenta toner 4 | Yellow toner 4 | Black toner 4 |
| Comparative Example 5 | Cyan toner 10 | Magenta toner 4 | Yellow toner 4 | Black toner 4 |
| Example 6 | Cyan toner 4 | Magenta toner 1 | Yellow toner 4 | Black toner 4 |
| Example 7 | Cyan toner 4 | Magenta toner 2 | Yellow toner 4 | Black toner 4 |
| Example 8 | Cyan toner 4 | Magenta toner 3 | Yellow toner 4 | Black toner 4 |
| Comparative Example 6 | Cyan toner 4 | Magenta toner 4 | Yellow toner 4 | Black toner 4 |
| Comparative Example 7 | Cyan toner 4 | Magenta toner 5 | Yellow toner 4 | Black toner 4 |
| Example 9 | Cyan toner 4 | Magenta toner 6 | Yellow toner 4 | Black toner 4 |
| Example 10 | Cyan toner 4 | Magenta toner 7 | Yellow toner 4 | Black toner 4 |
| Comparative Example 8 | Cyan toner 4 | Magenta toner 8 | Yellow toner 4 | Black toner 4 |
| Comparative Example 9 | Cyan toner 4 | Magenta toner 9 | Yellow toner 4 | Black toner 4 |
| Comparative Example 10 | Cyan toner 4 | Magenta toner 10 | Yellow toner 4 | Black toner 4 |
| Example 11 | Cyan toner 4 | Magenta toner 4 | Yellow toner 1 | Black toner 4 |
| Example 12 | Cyan toner 4 | Magenta toner 4 | Yellow toner 2 | Black toner 4 |
| Example 13 | Cyan toner 4 | Magenta toner 4 | Yellow toner 3 | Black toner 4 |
| Comparative Example 11 | Cyan toner 4 | Magenta toner 4 | Yellow toner 4 | Black toner 4 |
| Comparative Example 12 | Cyan toner 4 | Magenta toner 4 | Yellow toner 5 | Black toner 4 |
| Example 14 | Cyan toner 4 | Magenta toner 4 | Yellow toner 6 | Black toner 4 |
| Example 15 | Cyan toner 4 | Magenta toner 4 | Yellow toner 7 | Black toner 4 |
| Comparative Example 13 | Cyan toner 4 | Magenta toner 4 | Yellow toner 8 | Black toner 4 |
| Comparative Example 14 | Cyan toner 4 | Magenta toner 4 | Yellow toner 9 | Black toner 4 |
| Comparative Example 15 | Cyan toner 4 | Magenta toner 4 | Yellow toner 10 | Black toner 4 |
| Example 16 | Cyan toner 4 | Magenta toner 4 | Yellow toner 4 | Black toner 1 |
| Example 17 | Cyan toner 4 | Magenta toner 4 | Yellow toner 4 | Black toner 2 |
| Example 18 | Cyan toner 4 | Magenta toner 4 | Yellow toner 4 | Black toner 3 |
| Comparative Example 16 | Cyan toner 4 | Magenta toner 4 | Yellow toner 4 | Black toner 4 |
| Comparative Example 17 | Cyan toner 4 | Magenta toner 4 | Yellow toner 4 | Black toner 5 |
| Comparative Example 18 | Cyan toner 4 | Magenta toner 4 | Yellow toner 4 | Black toner 6 |
| Example 19 | Cyan toner 4 | Magenta toner 4 | Yellow toner 4 | Black toner 7 |
| Example 20 | Cyan toner 4 | Magenta toner 4 | Yellow toner 4 | Black toner 8 |
| Comparative Example 19 | Cyan toner 4 | Magenta toner 4 | Yellow toner 4 | Black toner 9 |
| Comparative Example 20 | Cyan toner 4 | Magenta toner 4 | Yellow toner 4 | Black toner 10 |
| Comparative Example 21 | Cyan toner 4 | Magenta toner 4 | Yellow toner 4 | Black toner 11 |

TABLE 18

| Example | Toner amount $Ml_C$ on transfer material ($mg/cm^2$) | $A_C620$ | $A_C$ | $Q_C/A_{C620}$ First sheet | $Q_C/A_{C620}$ 3,000-th sheet | $Q_C/A_{C620}$ 6,000-th sheet | 80% toner height (μm) | $H_{C80}/H_{C20}$ | Low non-off set temperature (° C.) | High non-off set temperature (° C.) |
|---|---|---|---|---|---|---|---|---|---|---|
| Example 1 | 0.24 | 1.907 | 7.2 | 40.9 | 40.9 | 39.9 | 12 | 1.09 | 120 | 200 |
| Example 2 | 0.18 | 2.051 | 10.4 | 44.4 | 42.9 | 41.9 | 10 | 1.11 | 120 | 190 |
| Example 3 | 0.35 | 1.741 | 4.5 | 32.2 | 31.6 | 30.4 | 14 | 1.17 | 120 | 200 |
| Comparative Example 1 | 0.52 | 1.340 | 2.3 | 21.6 | 21.6 | 20.9 | 22 | 1.59 | 120 | 160 |
| Comparative Example 2 | 0.25 | 1.765 | 6.4 | 44.8 | 40.2 | 32.3 | 15 | 1.26 | 110 | 140 |
| Example 4 | 0.26 | 1.882 | 5.8 | 38.3 | 37.2 | 35.1 | 13 | 1.10 | 130 | 220 |
| Example 5 | 0.38 | 1.593 | 3.4 | 30.1 | 28.2 | 24.5 | 16 | 1.18 | 130 | 220 |
| Comparative Example 3 | 0.26 | 1.779 | 5.5 | 39.3 | 36.5 | 29.2 | 16 | 1.32 | 130 | 220 |
| Comparative Example 4 | 0.37 | 1.286 | 2.8 | 38.1 | 28.7 | 20.2 | 18 | 1.44 | 120 | 150 |
| Comparative Example 5 | 0.14 | 1.760 | 10.1 | 52.3 | 47.7 | 32.4 | 9 | 1.13 | 150 | 220 |

| Example | Color space | Charge quantity (mC/kg) First sheet | Charge quantity (mC/kg) 3,000-th sheet | Charge quantity (mC/kg) 6,000-th sheet | Dot spread First sheet | Dot spread 3,000-th sheet | Dot spread 6,000-th sheet | Dot chipping First sheet | Dot chipping 3,000-th sheet | Dot chipping 6,000-th sheet | Gloss uniformity First sheet | Gloss uniformity 3,000-th sheet | Gloss uniformity 6,000-th sheet |
|---|---|---|---|---|---|---|---|---|---|---|---|---|---|
| Example 1 | A | 78 | 78 | 76 | A | A | A | A | A | A | A | A | A |
| Example 2 | B | 91 | 88 | 86 | A | A | A | A | B | B | A | A | B |
| Example 3 | A | 56 | 55 | 53 | B | B | B | A | A | B | A | A | A |
| Comparative Example 1 | — | 29 | 29 | 28 | C | C | C | A | A | A | A | A | A |
| Comparative Example 2 | D | 79 | 71 | 57 | A | A | B | A | B | C | C | C | C |
| Example 4 | A | 72 | 70 | 66 | A | B | B | B | B | C | A | B | C |
| Example 5 | A | 48 | 45 | 39 | B | B | C | A | B | B | A | B | B |
| Comparative Example 3 | D | 70 | 65 | 52 | A | B | B | B | C | C | A | C | C |
| Comparative Example 4 | C | 49 | 33 | 26 | B | B | C | A | B | C | C | C | C |
| Comparative Example 5 | D | 92 | 84 | 57 | A | B | C | C | C | D | B | B | C |

TABLE 19

| Example | Toner amount $Ml_M$ on transfer material ($mg/cm^2$) | $A_M570$ | $A_M$ | $Q_M/A_{M570}$ First sheet | $Q_M/A_{M570}$ 3,000-th sheet | $Q_M/A_{M570}$ 6,000-th sheet | 80% toner height (μm) | $H_{C80}/H_{C20}$ | Low non-off set temperature (° C.) | High non-off set temperature (° C.) |
|---|---|---|---|---|---|---|---|---|---|---|
| Example 6 | 0.23 | 1.972 | 7.8 | 40.6 | 40.6 | 39.6 | 12 | 1.09 | 120 | 200 |
| Example 7 | 0.18 | 2.113 | 10.7 | 44.0 | 42.1 | 41.2 | 10 | 1.11 | 120 | 190 |
| Example 8 | 0.34 | 1.904 | 5.1 | 30.5 | 29.9 | 28.9 | 14 | 1.16 | 120 | 200 |
| Comparative Example 6 | 0.53 | 1.521 | 2.6 | 20.4 | 20.4 | 19.7 | 22 | 1.57 | 120 | 160 |
| Comparative Example 7 | 0.25 | 1.714 | 6.2 | 47.3 | 42.0 | 35.0 | 15 | 1.25 | 110 | 140 |
| Example 9 | 0.26 | 2.038 | 6.3 | 36.3 | 35.8 | 33.4 | 13 | 1.10 | 130 | 220 |
| Example 10 | 0.37 | 1.670 | 3.6 | 29.9 | 28.1 | 24.6 | 16 | 1.17 | 130 | 220 |
| Comparative Example 8 | 0.26 | 1.749 | 5.4 | 41.7 | 38.3 | 31.4 | 16 | 1.31 | 130 | 220 |
| Comparative Example 9 | 0.38 | 1.526 | 3.2 | 33.4 | 22.9 | 18.3 | 18 | 1.42 | 120 | 150 |
| Comparative Example 10 | 0.14 | 1.762 | 10.1 | 53.3 | 48.8 | 33.5 | 9 | 1.12 | 150 | 220 |

TABLE 19-continued

| Example | Color space | Charge quantity (mC/kg) | | | Dot spread | | | Dot chipping | | | Gloss uniformity | | |
|---|---|---|---|---|---|---|---|---|---|---|---|---|---|
| | | First sheet | 3,000-th sheet | 6,000-th sheet | First sheet | 3,000-th sheet | 6,000-th sheet | First sheet | 3,000-th sheet | 6,000-th sheet | First sheet | 3,000-th sheet | 6,000-th sheet |
| Example 6 | A | 80 | 80 | 78 | A | A | A | A | A | A | A | A | A |
| Example 7 | B | 93 | 89 | 67 | A | A | A | A | B | B | A | A | B |
| Example 8 | A | 58 | 57 | 55 | B | B | B | A | A | B | A | A | A |
| Comparative Example 6 | — | 31 | 31 | 30 | C | C | C | A | A | A | A | A | A |
| Comparative Example 7 | D | 81 | 72 | 60 | A | A | B | A | B | C | C | C | C |
| Example 9 | A | 74 | 73 | 68 | A | B | B | B | B | C | A | B | C |
| Example 10 | A | 50 | 47 | 41 | B | B | C | A | B | B | A | B | B |
| Comparative Example 8 | D | 73 | 67 | 55 | A | B | B | B | C | C | A | C | C |
| Comparative Example 9 | C | 51 | 35 | 28 | B | B | C | A | B | C | C | C | C |
| Comparative Example 10 | D | 94 | 86 | 59 | A | B | C | C | C | D | B | B | C |

TABLE 20

| Example | Toner amount $Ml_Y$ on transfer material ($mg/cm^2$) | $A_Y450$ | $A_Y$ | $Q_Y/A_{Y450}$ First sheet | $Q_Y/A_{Y450}$ 3,000-th sheet | $Q_Y/A_{Y450}$ 6,000-th sheet | 80% toner height (μm) | $H_{C80}/H_{C20}$ | Low non-offset temperature (° C.) | High non-offset temperature (° C.) |
|---|---|---|---|---|---|---|---|---|---|---|
| Example 11 | 0.25 | 1.852 | 6.7 | 43.7 | 43.7 | 42.7 | 12 | 1.08 | 120 | 200 |
| Example 12 | 0.19 | 2.046 | 9.8 | 45.9 | 44.0 | 43.0 | 10 | 1.10 | 120 | 190 |
| Example 13 | 0.34 | 1.745 | 4.7 | 33.8 | 33.2 | 32.7 | 14 | 1.15 | 120 | 200 |
| Comparative Example 11 | 0.52 | 1.560 | 2.7 | 21.2 | 21.2 | 20.5 | 22 | 1.54 | 120 | 160 |
| Comparative Example 12 | 0.26 | 1.718 | 6.0 | 47.7 | 43.1 | 36.1 | 15 | 1.24 | 110 | 140 |
| Example 14 | 0.25 | 1.835 | 5.9 | 40.9 | 40.3 | 37.6 | 13 | 1.09 | 130 | 220 |
| Example 15 | 0.39 | 1.663 | 3.4 | 31.3 | 29.5 | 25.3 | 16 | 1.17 | 130 | 220 |
| Comparative Example 13 | 0.27 | 1.690 | 5.0 | 43.8 | 40.2 | 33.7 | 16 | 1.30 | 130 | 220 |
| Comparative Example 14 | 0.37 | 1.627 | 3.5 | 32.0 | 22.1 | 17.8 | 18 | 1.39 | 120 | 150 |
| Comparative Example 15 | 0.13 | 1.748 | 10.8 | 54.9 | 50.3 | 34.3 | 9 | 1.11 | 150 | 220 |

| Example | Color space | Charge quantity (mC/kg) | | | Dot spread | | | Dot chipping | | | Gloss uniformity | | |
|---|---|---|---|---|---|---|---|---|---|---|---|---|---|
| | | First sheet | 3,000-th sheet | 6,000-th sheet | First sheet | 3,000-th sheet | 6,000-th sheet | First sheet | 3,000-th sheet | 6,000-th sheet | First sheet | 3,000-th sheet | 6,000-th sheet |
| Example 11 | A | 81 | 81 | 79 | A | A | A | A | A | A | A | A | A |
| Example 12 | A | 94 | 90 | 88 | A | A | A | A | B | B | A | A | B |
| Example 13 | A | 59 | 58 | 57 | B | B | B | A | A | B | A | A | A |
| Comparative Example 11 | — | 33 | 33 | 32 | C | C | C | A | A | A | A | A | A |
| Comparative Example 12 | D | 82 | 74 | 62 | A | A | B | A | B | C | C | C | C |
| Example 14 | A | 75 | 74 | 69 | A | B | B | B | B | C | A | B | C |
| Example 15 | A | 52 | 49 | 42 | B | B | C | A | B | B | A | B | B |
| Comparative Example 13 | D | 74 | 68 | 57 | A | B | B | B | C | C | A | C | C |
| Comparative Example 14 | D | 52 | 36 | 29 | B | B | C | A | B | C | C | C | C |
| Comparative Example 15 | C | 96 | 88 | 60 | A | B | C | C | C | D | B | B | C |

TABLE 21

| Example | Toner amount $Ml_K$ on transfer material ($mg/cm^2$) | $A_K600$ | $A_K$ | $Q_K/A_{K600}$ First sheet | $Q_K/A_{K600}$ 3,000-th sheet | $Q_K/A_{K600}$ 6,000-th sheet | 80% toner height (μm) | $H_{C80}/H_{C20}$ | Low non-offset temperature (° C.) | High non-offset temperature (° C.) |
|---|---|---|---|---|---|---|---|---|---|---|
| Example 16 | 0.23 | 1.763 | 7.0 | 43.7 | 43.1 | 42.5 | 12 | 1.10 | 120 | 200 |
| Example 17 | 0.17 | 1.883 | 10.1 | 48.3 | 46.7 | 45.7 | 10 | 1.12 | 120 | 190 |
| Example 18 | 0.34 | 1.714 | 4.6 | 32.7 | 32.1 | 31.5 | 14 | 1.18 | 120 | 200 |
| Comparative Example 16 | 0.51 | 1.577 | 2.8 | 19.0 | 18.4 | 17.8 | 22 | 1.58 | 120 | 160 |
| Comparative Example 17 | 0.24 | 1.639 | 6.2 | 48.2 | 42.7 | 35.4 | 15 | 1.26 | 110 | 150 |
| Comparative Example 18 | 0.17 | 1.883 | 8.9 | 47.3 | 42.0 | 28.1 | 13 | 1.29 | 110 | 140 |
| Example 19 | 0.25 | 1.788 | 5.7 | 40.3 | 39.7 | 36.9 | 13 | 1.11 | 130 | 220 |
| Example 20 | 0.37 | 1.675 | 3.6 | 28.7 | 27.5 | 23.3 | 16 | 1.19 | 130 | 220 |
| Comparative Example 19 | 0.25 | 1.766 | 5.7 | 40.2 | 36.8 | 30.6 | 16 | 1.32 | 130 | 220 |
| Comparative Example 20 | 0.36 | 1.643 | 3.7 | 29.8 | 20.1 | 15.2 | 18 | 1.43 | 120 | 150 |
| Comparative Example 21 | 0.12 | 1.951 | 13.0 | 46.6 | 41.5 | 27.2 | 9 | 1.14 | 150 | 220 |

| Example | Color space | Charge quantity (mC/kg) First sheet | Charge quantity (mC/kg) 3,000-th sheet | Charge quantity (mC/kg) 6,000-th sheet | Dot spread First sheet | Dot spread 3,000-th sheet | Dot spread 6,000-th sheet | Dot chipping First sheet | Dot chipping 3,000-th sheet | Dot chipping 6,000-th sheet | Gloss uniformity First sheet | Gloss uniformity 3,000-th sheet | Gloss uniformity 6,000-th sheet |
|---|---|---|---|---|---|---|---|---|---|---|---|---|---|
| Example 16 | A | 77 | 76 | 75 | A | A | A | A | A | A | A | A | A |
| Example 17 | A | 91 | 88 | 86 | A | A | A | A | B | B | A | A | B |
| Example 18 | A | 56 | 55 | 54 | B | B | B | A | A | B | A | A | A |
| Comparative Example 16 | — | 30 | 29 | 28 | C | C | C | A | A | A | A | A | A |
| Comparative Example 17 | B | 79 | 70 | 58 | A | A | B | A | B | C | C | C | C |
| Comparative Example 18 | C | 89 | 79 | 53 | A | B | C | B | C | C | C | C | C |
| Example 19 | A | 72 | 71 | 66 | A | B | B | B | B | C | A | B | C |
| Example 20 | A | 48 | 46 | 39 | B | B | C | A | B | B | A | B | B |
| Comparative Example 19 | C | 71 | 65 | 54 | A | B | B | B | C | C | A | C | C |
| Comparative Example 20 | B | 49 | 33 | 25 | B | B | C | A | B | C | C | C | C |
| Comparative Example 21 | C | 91 | 81 | 53 | A | B | C | C | C | D | B | B | C |

Examples 21 to 24

In each of Examples 21 to 24, evaluation was performed in the same manner as in each of Examples 1, 6, 11, and 16, respectively except that: the carrier to be used in each of Examples 1, 6, 11, and 16 was changed to Carrier 2; and a mixing ratio between a toner and the carrier was 4 parts by mass: 96 parts by mass. Table 22 shows the results.

Example 25

Cyan Toner 1, Magenta Toner 1, Yellow Toner 1, and Black Toner 1 were each independently mixed with Carrier 1, and the produced two-component developers were set in the developing devices of the full-color copying machine used in Example 1 corresponding to the respective colors. A mixing

TABLE 22

| Example | Toner used: Cyan developer | Toner used: Magenta developer | Toner used: Yellow developer | Toner used: Black developer | Dot spread First sheet | Dot spread 3,000-th sheet | Dot spread 6,000-th sheet | Dot chipping First sheet | Dot chipping 3,000-th sheet | Dot chipping 6,000-th sheet | Solid uniformity First sheet | Solid uniformity 3,000-th sheet | Solid uniformity 6,000-th sheet |
|---|---|---|---|---|---|---|---|---|---|---|---|---|---|
| Example 21 | Cyan toner 1 | Magenta toner 4 | Yellow toner 4 | Black toner 4 | B | B | C | A | A | B | A | A | B |
| Example 22 | Cyan toner 4 | Magenta toner 1 | Yellow toner 4 | Black toner 4 | B | B | C | A | A | B | A | A | B |
| Example 23 | Cyan toner 4 | Magenta toner 4 | Yellow toner 1 | Black toner 4 | B | B | C | A | A | B | A | A | B |
| Example 24 | Cyan toner 4 | Magenta toner 4 | Yellow toner 4 | Black toner 1 | B | B | C | A | A | B | A | A | B |

ratio between each toner and the carrier was 8 parts by mass: 92 parts by mass.

The temperature of the fixing unit of the machine was set to 140° C., and full-color images were output on 5,000 sheets of coat paper (52 g/m$^2$, whiteness 83 to 84%, A4 size). A toner consumption after printing on the 5,000 sheets was determined in a percentage unit when the toner consumption of Comparative Example 25 was defined as 100. Evaluation criteria are shown below. Table 24 shows the results of the evaluation.

(Color Space)

A full-color image with a 256-step gradation was formed, and its color space volume was evaluated as a relative value when the color space volume of Comparative Example 25 to be described later was defined as 100%.

A: The color space volume is 96% or more of the area of Comparative Example 25 (color space performance: most excellent).

B: The color space volume is 90% or more and less than 96% of the area of Comparative Example 25 (color space performance: excellent).

C: The color space volume is 80% or more and less than 90% of the area of Comparative Example 25 (color space performance: good).

D: The color space volume is less than 80% of the area of Comparative Example 25 (color space performance: poor).

(Image Appearance of Five-Point Letter)

A five-point letter was observed with a digital microscope (VH-7000C manufactured by KEYENCE CORPORATION) and a lens having a magnification of 150. It should be noted that, for each of a cyan image, a magenta image, and a yellow image, data on an observed image was divided into red (R), green (G), and blue (B), and the cyan image, the magenta image, and the yellow image were evaluated by using the R data, the G data, and the B data, respectively.

A: The reproducibility of each of an edge portion and a fine portion is particularly good.

B: The reproducibility of each of an edge portion and a fine portion is good.

C: The reproducibility is at an ordinary level.

D: The reproducibility of each of an edge portion and a fine portion is poor.

(Gloss Uniformity)

A difference in gloss between an image portion and a non-image portion was evaluated.

A: The maximum of the difference in gloss is less than 20 (gloss uniformity: most excellent).

B: The maximum of the difference in gloss is 20 or more and less than 30 (gloss uniformity: excellent).

C: The maximum of the difference in gloss is 30 or more and less than 45 (gloss uniformity: good).

D: The maximum of the difference in gloss is 45 or more (gloss uniformity: poor).

Examples 26 to 29 and Comparative Examples 25 to 29

Evaluation was performed in the same manner as in Example 25 except that any toner shown in Table 23 was used. Table 24 shows the results.

TABLE 23

| Example | Cyan toner | Magenta toner | Yellow toner | Black toner |
|---|---|---|---|---|
| Example 25 | Cyan toner 1 | Magenta toner 1 | Yellow toner 1 | Black toner 1 |
| Example 26 | Cyan toner 2 | Magenta toner 2 | Yellow toner 2 | Black toner 2 |
| Example 27 | Cyan toner 3 | Magenta toner 3 | Yellow toner 3 | Black toner 3 |
| Comparative Example 25 | Cyan toner 4 | Magenta toner 4 | Yellow toner 4 | Black toner 4 |
| Comparative Example 26 | Cyan toner 5 | Magenta toner 5 | Yellow toner 5 | Black toner 5 |
| Example 28 | Cyan toner 6 | Magenta toner 6 | Yellow toner 6 | Black toner 7 |
| Example 29 | Cyan toner 7 | Magenta toner 7 | Yellow toner 7 | Black toner 8 |
| Comparative Example 27 | Cyan toner 8 | Magenta toner 8 | Yellow toner 8 | Black toner 9 |
| Comparative Example 28 | Cyan toner 9 | Magenta toner 9 | Yellow toner 9 | Black toner 10 |
| Comparative Example 29 | Cyan toner 10 | Magenta toner 10 | Yellow toner 10 | Black toner 11 |

TABLE 24

| | Cyan developer | | | Magenta developer | | | Yellow developer | | | Black developer | | |
|---|---|---|---|---|---|---|---|---|---|---|---|---|
| Example | $A_C$ | $Q_C/A_{C620}$ | $H_{C80}/H_{C20}$ | $A_M$ | $Q_M/A_{M570}$ | $H_{M80}/H_{M20}$ | $A_Y$ | $Q_Y/A_{Y450}$ | $H_{Y80}/H_{Y20}$ | $A_K$ | $Q_K/A_{K600}$ | $H_{K80}/H_{K20}$ |
| Example 25 | 7.3 | 41.0 | 1.09 | 7.9 | 40.7 | 1.09 | 6.8 | 43.8 | 1.08 | 7.1 | 43.8 | 1.10 |
| Example 26 | 10.5 | 44.5 | 1.11 | 10.8 | 44.1 | 1.11 | 9.9 | 46.0 | 1.10 | 10.2 | 48.4 | 1.12 |
| Example 27 | 4.6 | 32.3 | 1.17 | 5.2 | 30.6 | 1.16 | 4.8 | 33.9 | 1.15 | 4.7 | 32.8 | 1.18 |
| Comparative Example 25 | 2.4 | 21.7 | 1.59 | 2.7 | 20.5 | 1.57 | 2.8 | 21.3 | 1.54 | 2.9 | 19.1 | 1.58 |
| Comparative Example 26 | 6.5 | 44.9 | 1.26 | 6.3 | 47.4 | 1.25 | 6.1 | 47.8 | 1.24 | 6.3 | 48.3 | 1.26 |
| Example 28 | 5.9 | 38.4 | 1.10 | 6.4 | 36.4 | 1.10 | 6.0 | 41.0 | 1.09 | 5.8 | 40.4 | 1.11 |
| Example 29 | 3.5 | 30.2 | 1.18 | 3.7 | 30.0 | 1.17 | 3.5 | 31.4 | 1.17 | 3.7 | 28.8 | 1.19 |
| Comparative Example 27 | 5.6 | 39.4 | 1.32 | 5.5 | 41.8 | 1.31 | 5.1 | 43.9 | 1.30 | 5.8 | 40.3 | 1.32 |
| Comparative Example 28 | 2.9 | 38.2 | 1.44 | 3.3 | 33.5 | 1.42 | 3.6 | 32.1 | 1.39 | 3.8 | 29.9 | 1.43 |
| Comparative Example 29 | 10.2 | 52.4 | 1.13 | 10.2 | 53.4 | 1.12 | 10.9 | 55.0 | 1.11 | 13.1 | 46.7 | 1.14 |

TABLE 24-continued

| Example | Color space | Gloss uniformity | Image appearance of letter First sheet | Image appearance of letter 5,000-th sheet | Toner consumption represented in percentage unit (%) |
|---|---|---|---|---|---|
| Example 25 | A | B | A | A | 38 |
| Example 26 | B | A | A | A | 30 |
| Example 27 | A | C | B | B | 51 |
| Comparative Example 25 | — | D | C | C | 100 |
| Comparative Example 26 | C | A | B | C | 39 |
| Example 28 | A | B | A | B | 41 |
| Example 29 | A | C | B | C | 59 |
| Comparative Example 27 | D | B | B | D | 42 |
| Comparative Example 28 | C | A | C | D | 60 |
| Comparative Example 29 | C | A | B | D | 20 |

Example 30

Cyan Toner 1, Magenta Toner 1, Yellow Toner 1, and Black Toner 1 were set in the cyan cartridge, magenta cartridge, yellow cartridge, and black cartridge of a commercially available color laser beam printer (LBP-5500; manufactured by Canon Inc.) corresponding to the respective colors. The temperature of the fixing unit of the printer was set to 150° C., and a full-color image was output on recycled paper (A4-size recycle paper (66 g/m$^2$), manufactured by Canon Inc.). Table 26 shows the results of the evaluation.

(Color Gamut)

Color gamut area was evaluated with fixed images of a primary color and secondary color when the color gamut area of Comparative Example 30 to be described later was defined as 100%.

A: The color gamut area is 95% or more of the area of Comparative Example 30 (color gamut performance: most excellent).

B: The color gamut area is 90% or more and less than 95% of the area of Comparative Example 30 (color gamut performance: excellent).

C: The color gamut area is 85% or more and less than 90% of the area of Comparative Example 30 (color gamut performance: good).

D: The gamut area is less than 85% of the area of Comparative Example 30 (color gamut performance: poor).

(Gloss Uniformity)

A difference in gloss between a solid image portion at a front end portion and a solid image portion at a rear end portion was measured for the direction in which paper was passed.

A: The difference in gloss is less than 5 (gloss uniformity: most excellent).

B: The difference in gloss is 5 or more and less than 10 (gloss uniformity: excellent).

C: The difference in gloss is 10 or more and less than 15 (gloss uniformity: good).

D: The difference in gloss is 15 or more (gloss uniformity: poor).

(Penetrating Performance)

A black solid image was formed on paper, and the paper was placed on a white plate having an L* of 100 with the back surface of the paper facing upward. The reflection density of a portion corresponding to an image portion was measured from the back surface of the paper.

A: The image density is less than 0.2 (penetrating performance: most excellent).

B: The image density is 0.2 or more and less than 0.3 (penetrating performance: excellent).

C: The image density is 0.3 or more and less than 0.4 (penetrating performance: good).

D: The image density is 0.4 or more (penetrating performance: poor).

(Image Appearance of Six-Point Letter)

A six-point letter was observed with a digital microscope (VH-7000C manufactured by KEYENCE CORPORATION) and a lens having a magnification of 150. It should be noted that, for each of a cyan image, a magenta image, and a yellow image, data on an observed image was divided into red (R), green (G), and blue (B), and the cyan image, the magenta image, and the yellow image were evaluated by using the R data, the G data, and the B data, respectively.

A: The reproducibility of each of an edge portion and a fine portion is particularly good.

B: The reproducibility of each of an edge portion and a fine portion is good.

C: The reproducibility is at an ordinary level.

D: The reproducibility of each of an edge portion and a fine portion is poor.

Examples 31 and 32, and Comparative Examples 30 and 31

Evaluation was performed in the same manner as in Example 30 except that any toner shown in Table 25 was used. Table 26 shows the results of the evaluation.

TABLE 25

| Example | Cyan cartridge | Magenta cartridge | Yellow cartridge | Black cartridge |
|---|---|---|---|---|
| Example 30 | Cyan toner 1 | Magenta toner 1 | Yellow toner 1 | Black toner 1 |
| Example 31 | Cyan toner 2 | Magenta toner 2 | Yellow toner 2 | Black toner 2 |
| Example 32 | Cyan toner 3 | Magenta toner 3 | Yellow toner 3 | Black toner 3 |
| Comparative Example 30 | Cyan toner 4 | Magenta toner 4 | Yellow toner 4 | Black toner 4 |
| Comparative Example 31 | Cyan toner 5 | Magenta toner 5 | Yellow toner 5 | Black toner 5 |

TABLE 26

| Example | Cyan cartridge | | | Magenta cartridge | | | Yellow cartridge | | | Black cartridge | | |
|---|---|---|---|---|---|---|---|---|---|---|---|---|
| | $A_C$ | $Q_C/A_{C620}$ | $H_{C80}/H_{C20}$ | $A_M$ | $Q_M/A_{M570}$ | $H_{M80}/H_{M20}$ | $A_Y$ | $Q_Y/A_{Y450}$ | $H_{Y80}/H_{Y20}$ | $A_K$ | $Q_K/A_{K600}$ | $H_{K80}/H_{K20}$ |
| Example 30 | 7.9 | 42.0 | 1.08 | 8.5 | 41.6 | 1.08 | 7.3 | 44.8 | 1.07 | 7.6 | 43.3 | 1.09 |
| Example 31 | 11.7 | 45.3 | 1.10 | 12.0 | 45.0 | 1.10 | 10.9 | 46.9 | 1.09 | 11.4 | 49.4 | 1.11 |
| Example 32 | 4.8 | 33.3 | 1.16 | 5.4 | 31.5 | 1.15 | 5.0 | 35.0 | 1.14 | 4.9 | 33.8 | 1.17 |
| Comparative Example 30 | 2.4 | 23.1 | 1.55 | 2.7 | 21.7 | 1.53 | 2.8 | 22.4 | 1.51 | 2.9 | 20.3 | 1.54 |
| Comparative Example 31 | 7.0 | 45.9 | 1.25 | 6.8 | 48.4 | 1.24 | 6.5 | 48.9 | 1.23 | 6.8 | 49.4 | 1.25 |

| Example | Color gamut (%) | Gloss uniformity | Penetrating performance | Image appearance of letter | |
|---|---|---|---|---|---|
| | | | | First sheet | 3,000-th sheet |
| Example 30 | A | A | A | A | A |
| Example 31 | B | A | A | A | A |
| Example 32 | A | B | A | B | B |
| Comparative Example 30 | — | C | B | C | C |
| Comparative Example 31 | C | D | C | B | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-024380, filed on 2 Feb., 2007, which is hereby incorporated by reference herein in its entirety.

What is claimed is:

1. An image-forming method, comprising:

forming a black image by forming an electrostatic latent image on an electrostatic image bearing member, and developing the electrostatic latent image with a black toner; and transferring the black image onto a transfer material, wherein:

the black toner contains a binder resin and a colorant, the colorant is contained in the black toner in an amount of from 8 parts by mass to 18 parts by mass based on 100 parts by mass of the binder resin, and the colorant is dispersed in the binder resin so that the black toner has a value ($c^*_K$) for c* based on a CIELAB color coordinate system of 20.0 or less, an absorbance ($A_{K600}$) at a wavelength of 600 nm of 1.610 or more, and a ratio ($A_{K600}/A_{K460}$) of $A_{K600}$ to an absorbance ($A_{K460}$) at a wavelength of 460 nm of 0.970 to 1.035 in reflectance spectrophotometry, and wherein, when a true density of the black toner is represented by $\rho_{TK}$ and a toner amount upon development of image data represented by the CIELAB color coordinate system with L*=13.2, a*=1.3, and b*=1.9 onto the transfer material is represented by $M1_K$ (mg/cm$^2$), a coloring coefficient $A_K$ represented by the following expression is 3.0 to 12.0

$$A_K=A_{K600}/(M1_K\times\rho_{TK}).$$

2. A full-color image-forming method, comprising the steps of:

forming each of a plurality of electrostatic images on a charged electrostatic image bearing member;

developing the formed electrostatic images with toners to form toner images;

transferring the formed toner images onto a transfer material; and fixing the transferred toner images to the transfer material to form fixed images, wherein:

the step of forming the toner images includes a step of performing development with a first toner selected from a black toner, a cyan toner, a magenta toner, and a yellow toner to form a first toner image, a step of performing development with a second toner except the first toner selected from the black toner, the cyan toner, the magenta toner, and the yellow toner to form a second toner image, a step of performing development with a third toner except the first toner and the second toner selected from the black toner, the cyan toner, the magenta toner, and the yellow toner to form a third toner image, and a step of performing development with a fourth toner except the first toner, the second toner, and the third toner selected from the black toner, the cyan toner, the magenta toner, and the yellow toner to form a fourth toner image;

the black toner contains at least a binder resin and a colorant, and the black toner has a value ($c^*_K$) for c* based on a CIELAB color coordinate system of 20.0 or less, an absorbance ($A_{K600}$) at a wavelength of 600 nm of 1.610 or more, and a ratio ($A_{K600}/A_{K460}$) of $A_{K600}$ to an absorbance ($A_{K460}$) at a wavelength of 460 nm of 0.970 to 1.035 in reflectance spectrophotometry; and the black toner contains the colorant of 8 to 18 parts by mass with respect to 100 parts by mass of the binder resin, and wherein, when a true density of the black toner is represented by $\rho_{TK}$ and a toner amount upon development of image data represented by the CIELAB color coordinate system with L*=13.2, a*=1.3, and b*=1.9 onto the transfer material is represented by $M1_K$ (mg/cm$^2$) a coefficient $A_K$ resented by the following expression is 3.0 to 12.0

$$A_K=A_{K600}/(M1_K\times\rho_{TK}).$$

3. A full-color image-forming method according to claim 2, wherein the step of forming the toner images includes a step of transporting the toners to a developing portion with a toner carrying member and a step of developing the electrostatic images with the toners in the developing portion, and a ratio ($Q_K/A_{K600}$) of a charge quantity ($Q_K$) (mC/kg) of the black toner on the toner carrying member in the transporting step to $A_{K600}$ is 22.0 to 50.0.

4. A full-color image-forming method according to claim 2, wherein, in the step of forming the toner images, a ratio ($H_{K80}/H_{K20}$) of an average height ($H_{K80}$) of a toner layer of a toner image formed on the electrostatic image bearing member for image data having a black monochromatic density of 80% to an average height ($H_{K20}$) of a toner layer of a toner image formed on the electrostatic image bearing member for image data having a black monochromatic density of 20% is 0.90 to 1.30.

5. An image-forming method, comprising:

forming a black image by forming an electrostatic latent image on an electrostatic image bearing member, and developing the electrostatic latent image with a black toner; and transferring the black image onto a transfer material, wherein:

the black toner contains a binder resin and a colorant, the colorant is contained in the black toner in an amount of from 8 parts by mass to 18 parts by mass based on 100 parts by mass of the binder resin, and the colorant is dispersed in the binder resin so that the black toner has a value ($c^*_K$) for c* based on a CIELAB color coordinate system of 20.0 or less, an absorbance ($A_{K600}$) at a wavelength of 600 nm of 1.610 or more, and a ratio ($A_{K600}/A_{K460}$) of $A_{K600}$ to an absorbance ($A_{K460}$) at a wavelength of 460 nm of 0.970 to 1.035 in reflectance spectrophotometry, wherein:

when an average height of a first toner layer is defined as $H_{K20}$, where the first toner layer is formed by developing image data having black monochromatic density of 20% on the electrostatic image bearing member with the black toner, and an average height of a second toner layer is defined as $H_{K80}$, where the second toner layer is formed by developing image date having black monochromatic density of 80% on the electrostatic image bearing member with the black toner, said step is performed so that $H_{K20}$ and $H_{K80}$ satisfies the following relationship:

$$0.90 \leq H_{K80}/H_{K20} \leq 1.30, \text{ and}$$

wherein, when a true density of the black toner is represented by $\rho_{TK}$ and a toner amount upon development of image data represented by the CIELAB color coordinate system with L*=13.2, a*=1.3, and b*=1.9 onto the transfer material is represented by $M1_K$ (mg/cm$^2$), a coefficient $A_K$ represented by the following expression is 3.0 to 12.0

$$A_K = A_{K600}/(M1_K \times \rho_{TK}).$$

* * * * *